US009284635B2

(12) United States Patent
Branagan et al.

(10) Patent No.: US 9,284,635 B2
(45) **Date of Patent: *Mar. 15, 2016**

(54) RECRYSTALLIZATION, REFINEMENT, AND STRENGTHENING MECHANISMS FOR PRODUCTION OF ADVANCED HIGH STRENGTH METAL ALLOYS

(71) Applicant: The NanoSteel Company, Inc., Providence, RI (US)

(72) Inventors: Daniel James Branagan, Idaho Falls, ID (US); Grant G. Justice, Idaho Falls, ID (US); Andrew T. Ball, Idaho Falls, ID (US); Jason K. Walleser, Idaho Falls, ID (US); Brian E. Meacham, Idaho Falls, ID (US); Kurtis Clark, Idaho Falls, ID (US); Longzhou Ma, Idaho Falls, ID (US); Igor Yakubtsov, Idaho Falls, ID (US); Scott Larish, Idaho Falls, ID (US); Sheng Cheng, Idaho Falls, ID (US); Taylor L. Giddens, Idaho Falls, ID (US); Andrew E. Frerichs, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/575,301

(22) Filed: Dec. 18, 2014

(65) Prior Publication Data

US 2015/0101714 A1 Apr. 16, 2015

Related U.S. Application Data

(63) Continuation of application No. 14/505,175, filed on Oct. 2, 2014.

(60) Provisional application No. 61/885,842, filed on Oct. 2, 2013.

(51) Int. Cl.
*C22C 38/58* (2006.01)
*C21D 8/02* (2006.01)
(Continued)

(52) U.S. Cl.
CPC ..... *C22C 38/58* (2013.01); *C21D 6/004* (2013.01); *C21D 6/005* (2013.01); *C21D 6/008* (2013.01);
(Continued)

(58) Field of Classification Search
CPC ..... C22C 38/54; C22C 38/34; C21D 6/00; C21D 7/00; C21D 9/00
USPC ..... 148/327, 328, 330, 579, 648
See application file for complete search history.

(56) References Cited

U.S. PATENT DOCUMENTS 2,553,330 A 5/1951 Post et al.
3,900,316 A 8/1975 Jones
(Continued)

OTHER PUBLICATIONS

International Search Report and Written Opinion dated Dec. 12, 2014 issued in related International Patent Application No. PCT/US14/58883.

*Primary Examiner* — Jie Yang
(74) *Attorney, Agent, or Firm* — Grossman, Tucker, Perreault & Pfleger, PLLC

(57) ABSTRACT

This disclosure deals with a class of metal alloys with advanced property combinations applicable to metallic sheet production. More specifically, the present application identifies the formation of metal alloys of relatively high strength and ductility and the use of one or more cycles of elevated temperature treatment and cold deformation to produce metallic sheet at reduced thickness with relatively high strength and ductility.

19 Claims, 22 Drawing Sheets

(51) Int. Cl.

| | |
|---|---|
| ***C21D 6/00*** | (2006.01) |
| ***C22C 38/54*** | (2006.01) |
| ***C22C 38/42*** | (2006.01) |
| ***C22C 38/50*** | (2006.01) |
| ***C22C 38/02*** | (2006.01) |
| ***C21D 9/22*** | (2006.01) |
| ***C21D 9/44*** | (2006.01) |
| ***C21D 9/00*** | (2006.01) |
| ***C21D 6/02*** | (2006.01) |
| ***C22C 38/00*** | (2006.01) |
| ***C22C 38/04*** | (2006.01) |
| ***C22C 38/08*** | (2006.01) |
| ***C22C 38/16*** | (2006.01) |
| ***C22C 38/20*** | (2006.01) |
| ***C22C 38/32*** | (2006.01) |
| ***C22C 38/34*** | (2006.01) |
| ***C22C 38/38*** | (2006.01) |
| ***C22C 38/56*** | (2006.01) |

(52) U.S. Cl.

CPC ..... *C21D 6/02* (2013.01); *C21D 8/0205* (2013.01); *C21D 8/0215* (2013.01); *C21D 8/0221* (2013.01); *C21D 8/0236* (2013.01); *C21D 8/0247* (2013.01); *C21D 8/0268* (2013.01); *C21D 9/0068* (2013.01); *C21D 9/22* (2013.01); *C21D 9/44* (2013.01); *C22C 38/002* (2013.01); *C22C 38/02* (2013.01); *C22C 38/04* (2013.01); *C22C 38/08* (2013.01); *C22C 38/16* (2013.01); *C22C 38/20* (2013.01); *C22C 38/32* (2013.01); *C22C 38/34* (2013.01); *C22C 38/38* (2013.01); *C22C 38/42* (2013.01); *C22C 38/50* (2013.01); *C22C 38/54* (2013.01); *C22C 38/56* (2013.01); *C21D 2211/001* (2013.01); *C21D 2211/004* (2013.01); *C21D 2211/005* (2013.01)

(56) References Cited

U.S. PATENT DOCUMENTS

| | | | | |
|---|---|---|---|---|
| 4,365,994 | A | 12/1982 | Ray | |
| 4,576,653 | A * | 3/1986 | Ray | 419/61 |
| 5,002,731 | A | 3/1991 | Crook et al. | |
| 8,257,512 | B1 * | 9/2012 | Branagan et al. | 148/326 |
| 8,419,869 | B1 * | 4/2013 | Branagan et al. | 148/579 |
| 8,641,840 | B2 * | 2/2014 | Branagan et al. | 148/561 |
| 2004/0258554 | A1 | 12/2004 | Radon | |
| 2014/0238556 | A1 * | 8/2014 | Branagan et al. | 148/547 |

* cited by examiner

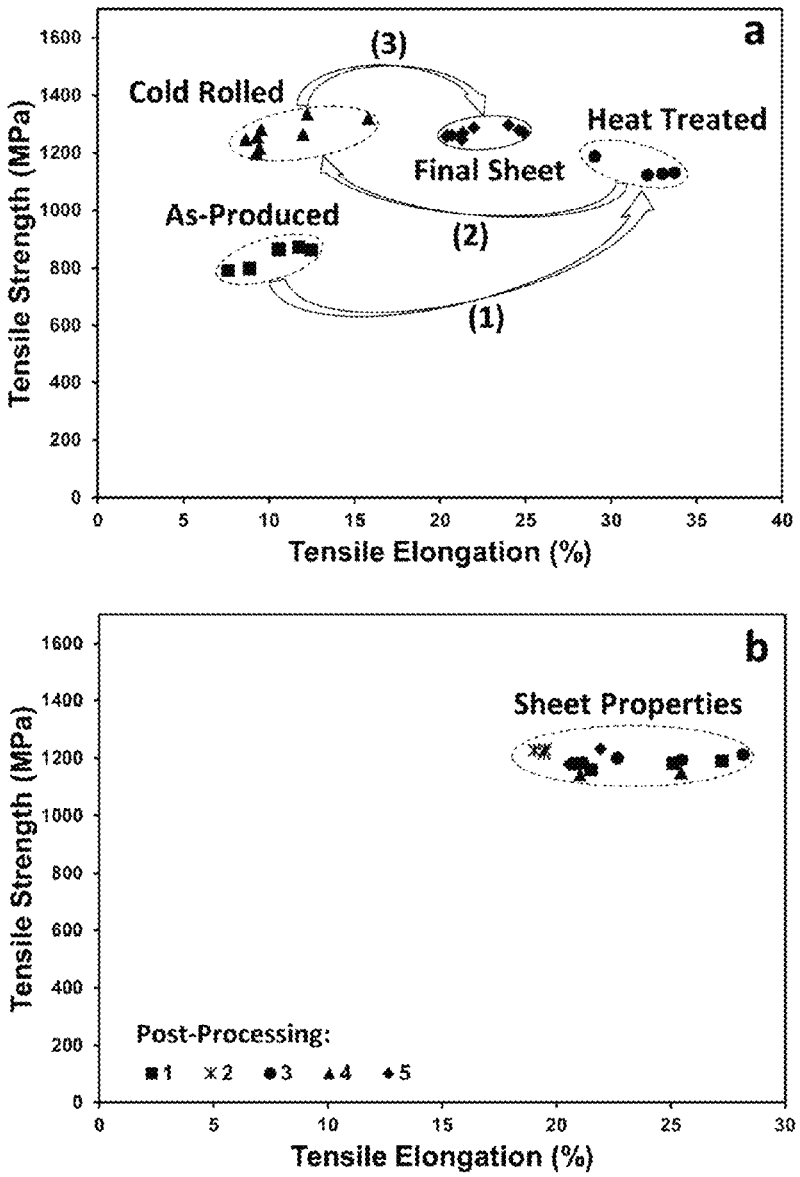

FIG. 8 Tensile properties of industrial sheet from a) Alloy 260 at different process steps utilized in post-processing sheet production: (1) homogenization heat treatment; (2) cold rolling; (3) final treatment and b) Alloy 284 after different post-processing: (1) homogenization heat treatment only; (2) to (5) homogenization heat treatment + cold rolling + annealing with different parameters.

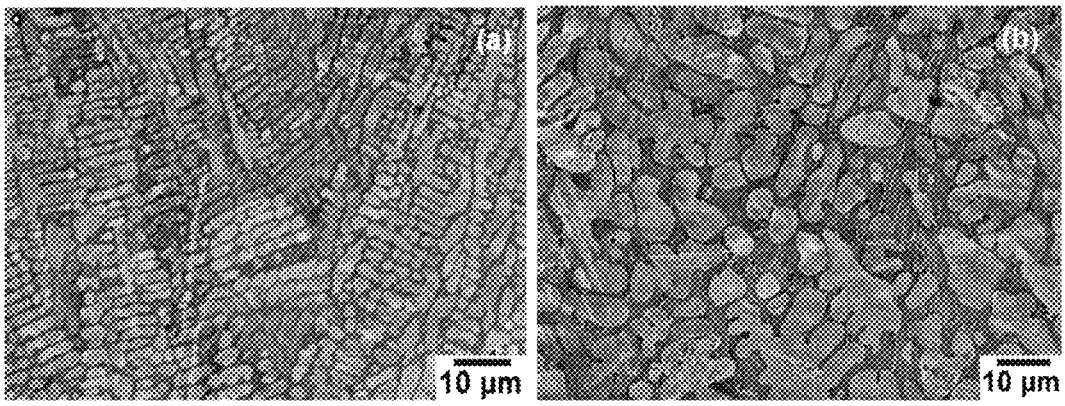
FIG. 9 Backscattered SEM micrographs of the as-solidified microstructure in the sheet from Alloy 260 with cast thickness of 1.8 mm in: (a) Outer layer region; (b) Central layer region.
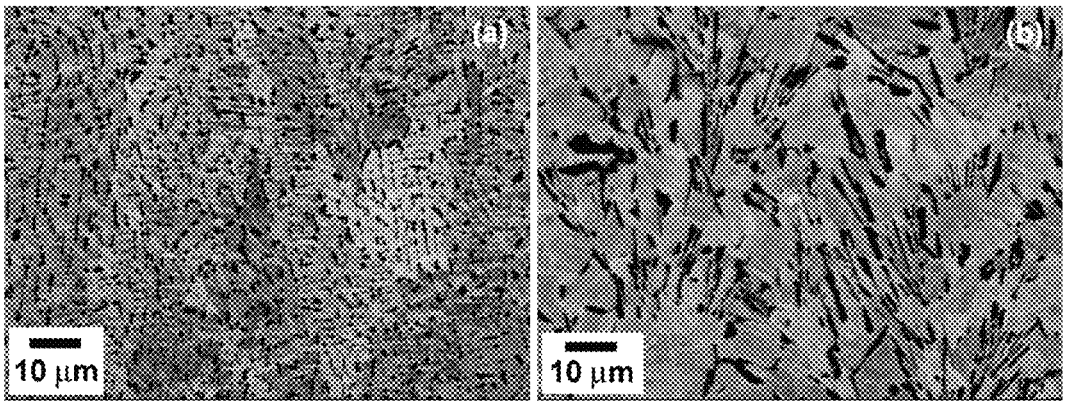
FIG. 10 Backscattered SEM micrographs of the as-solidified microstructure in Alloy 260 industrial sheet: (a) Outer layer region; (b) Central layer region.

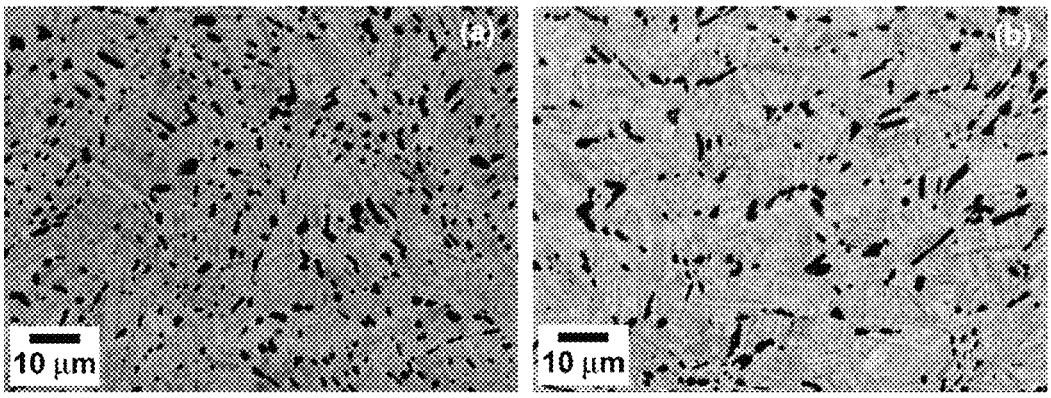
FIG. 11 Backscattered SEM micrographs of the microstructure in the industrial sheet from Alloy 260 after heat treatment at 1150°C for 2 hr: (a) Outer layer region; (b) Central layer region.
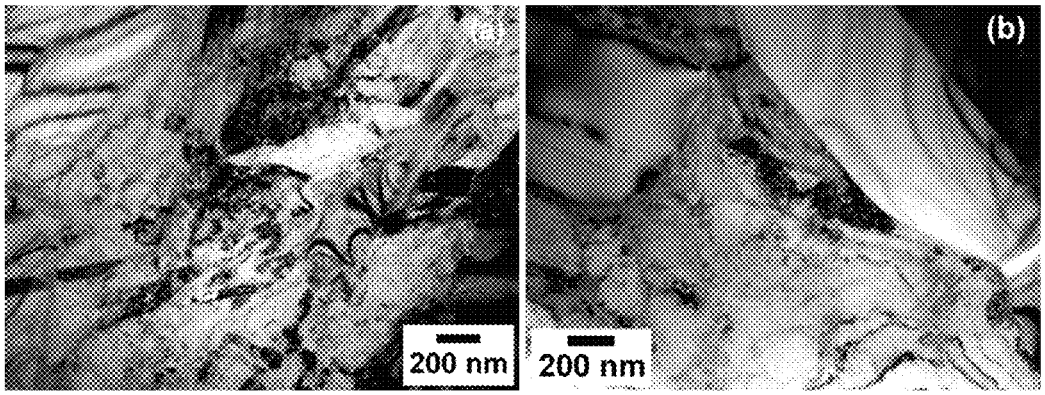
FIG. 12 Bright-field TEM images of the microstructure in the industrial sheet from Alloy 260 after heat treatment at 1150°C for 2 hr.

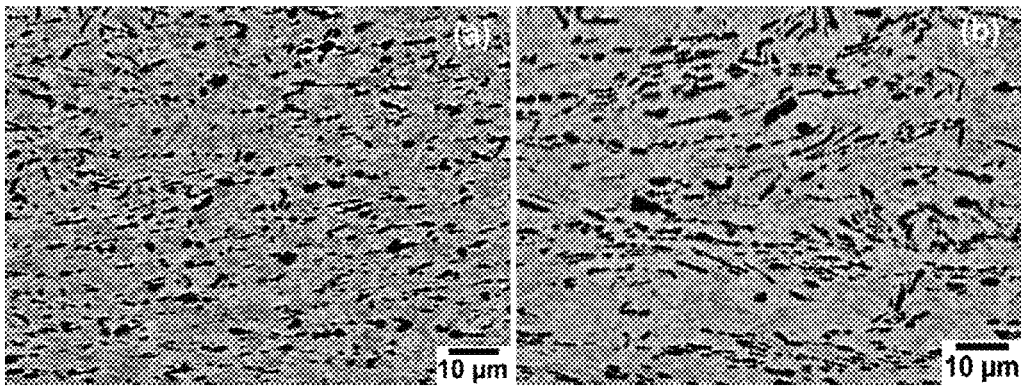
FIG. 13 Backscattered SEM micrographs of the microstructure in the cold-rolled sheet from Alloy 260 with 50% reduction: (a) Outer layer region; (b) Central layer region.
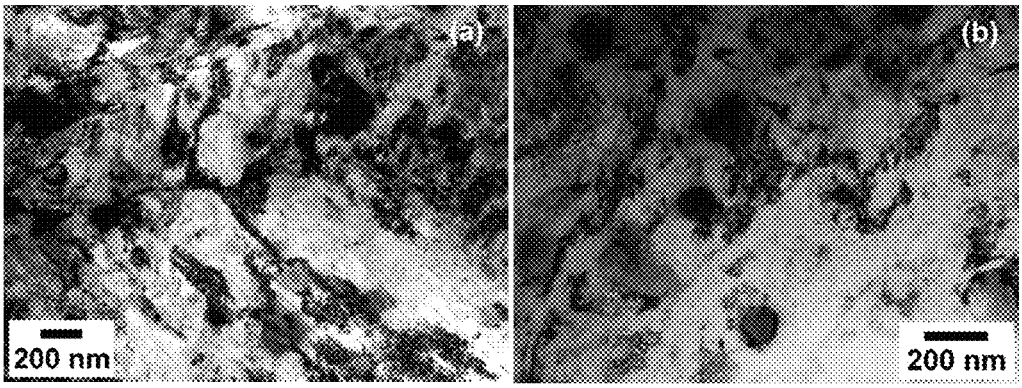
FIG. 14 Bright-field TEM images of the microstructure in the cold-rolled sheet from Alloy 260 with 50% reduction.

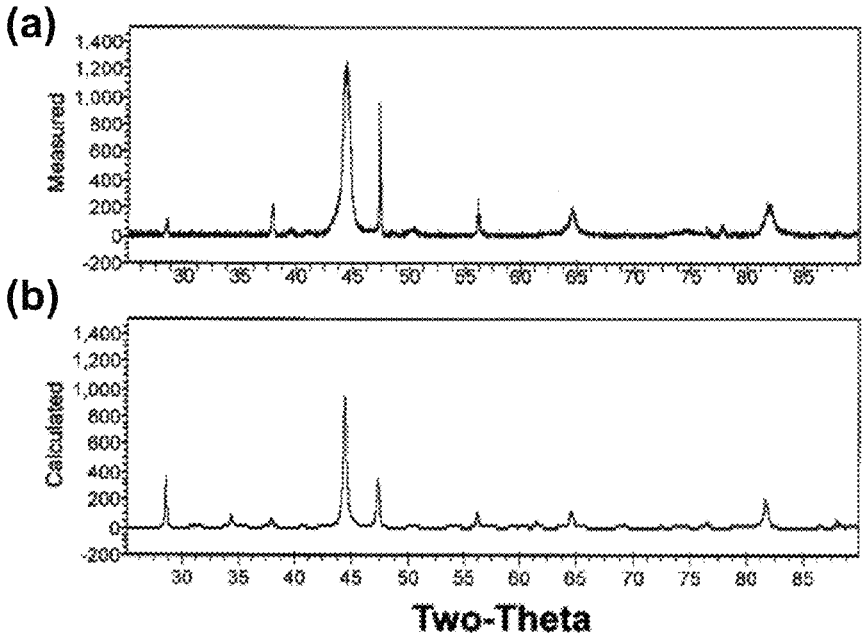
FIG. 15 X-ray diffraction data (intensity vs two-theta) for Alloy 260 sheet in the cold rolled condition; a) Measured pattern, b) Rietveld calculated pattern with peaks identified.
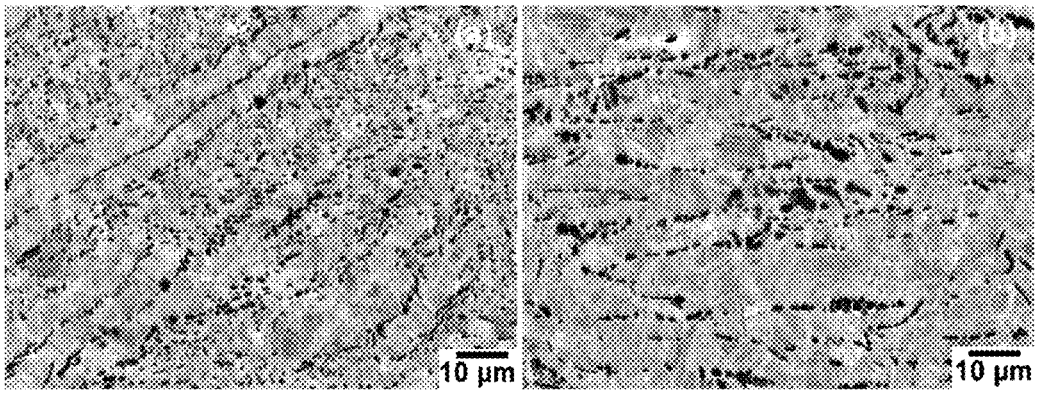
FIG. 16 Backscattered SEM micrographs of the microstructure in the cold-rolled sheet from Alloy 260 after heat treatment at 1150°C for 5 minutes: (a) Outer layer region; (b) Central layer region.

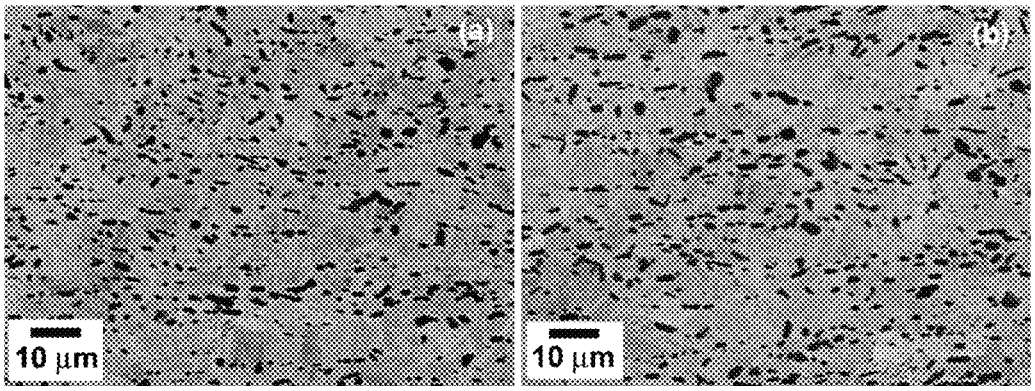
FIG. 17 Backscattered SEM micrographs of the microstructure in the cold-rolled sheet from Alloy 260 after heat treatment at 1150°C for 2 hours: (a) Outer layer region; (b) Central layer region.
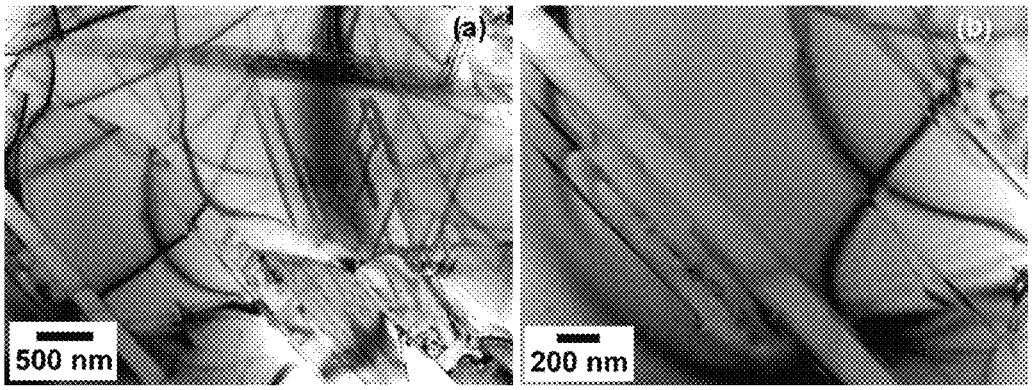
FIG. 18 Bright-field TEM micrographs of the microstructure in the cold-rolled sheet from Alloy 260 after heat treatment at 1150°C for 5 minutes at different magnifications.

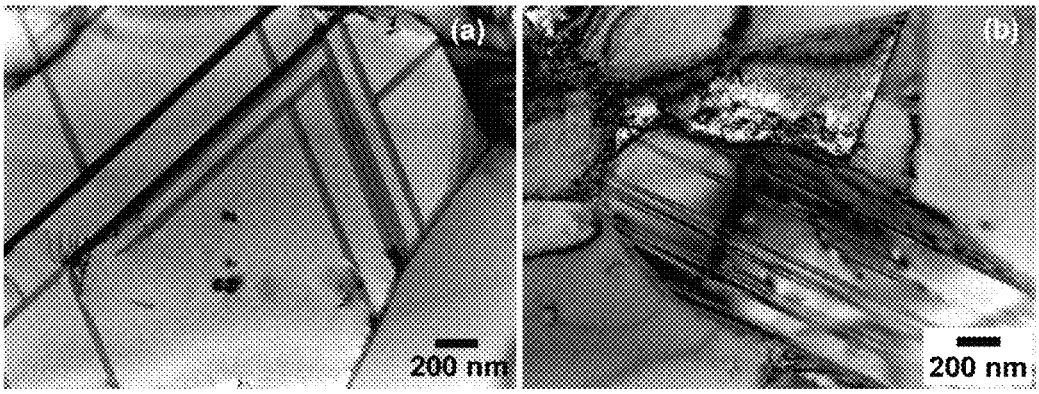
FIG. 19 Bright-field TEM micrographs of the microstructure in the cold-rolled sheet from Alloy 260 after heat treatment at 1150°C for 2 hr at different magnifications.
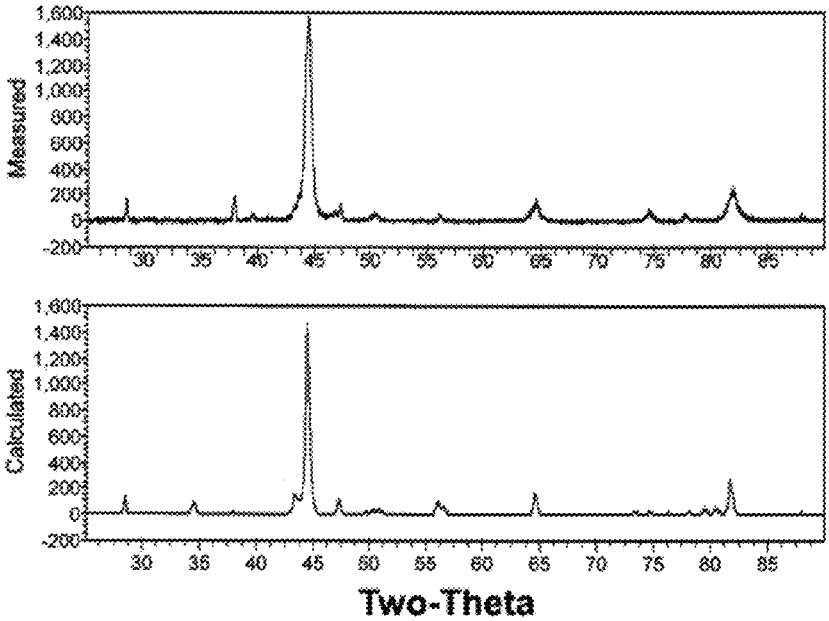
FIG. 20 X-ray diffraction data (intensity vs two-theta) for Alloy 260 sheet in the cold rolled and heat treated condition; a) Measured pattern, b) Rietveld calculated pattern with peaks identified.

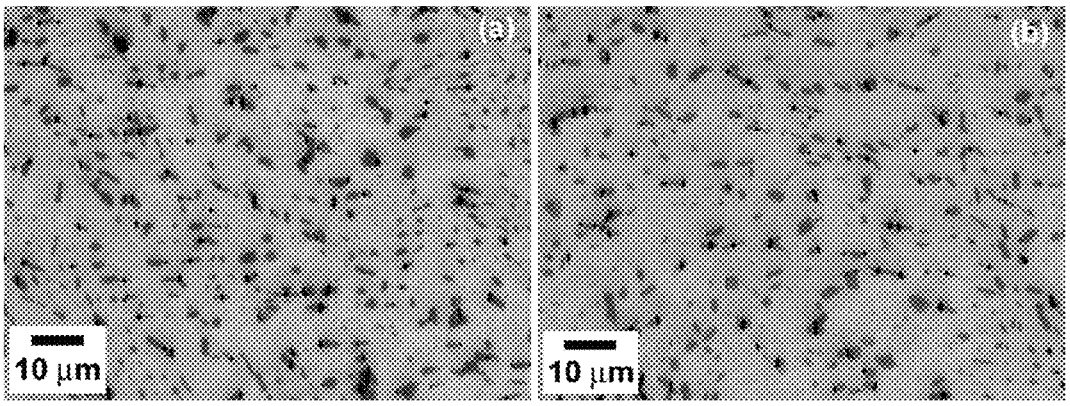
FIG. 21 Back-scattered SEM micrographs of the microstructure in the gage section of tensile specimen from Alloy 260: (a) Outer layer region; (b) Central layer region
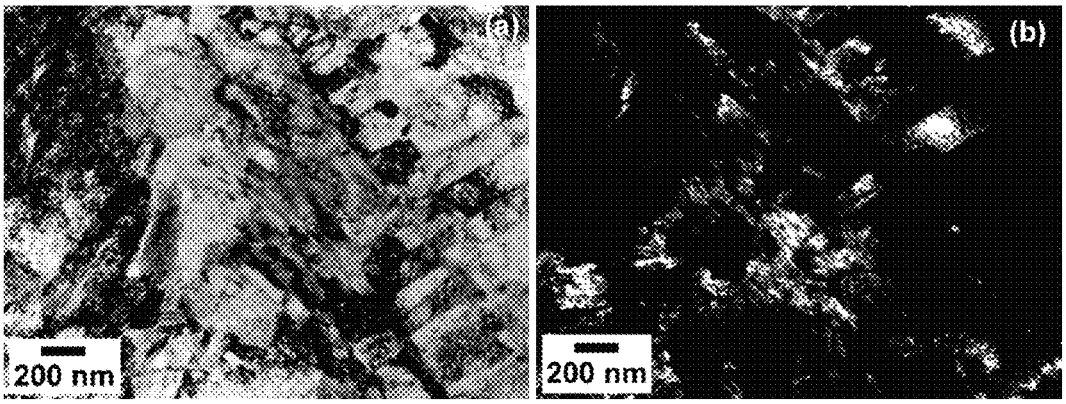
FIG. 22 Bright-field (a) and dark-field (b) TEM micrographs of the microstructure in the gage section of tensile specimen from Alloy 260.

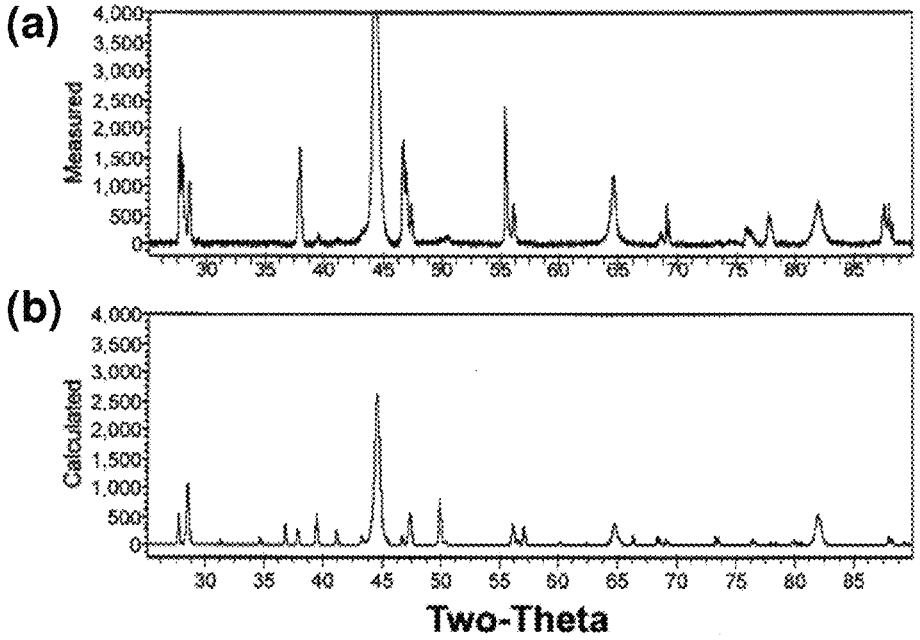
FIG. 23 X-ray diffraction data (intensity vs two-theta) for Alloy 260 sheet in the tensile gage of deformed sample; a) Measured pattern, b) Rietveld calculated pattern with peaks identified.

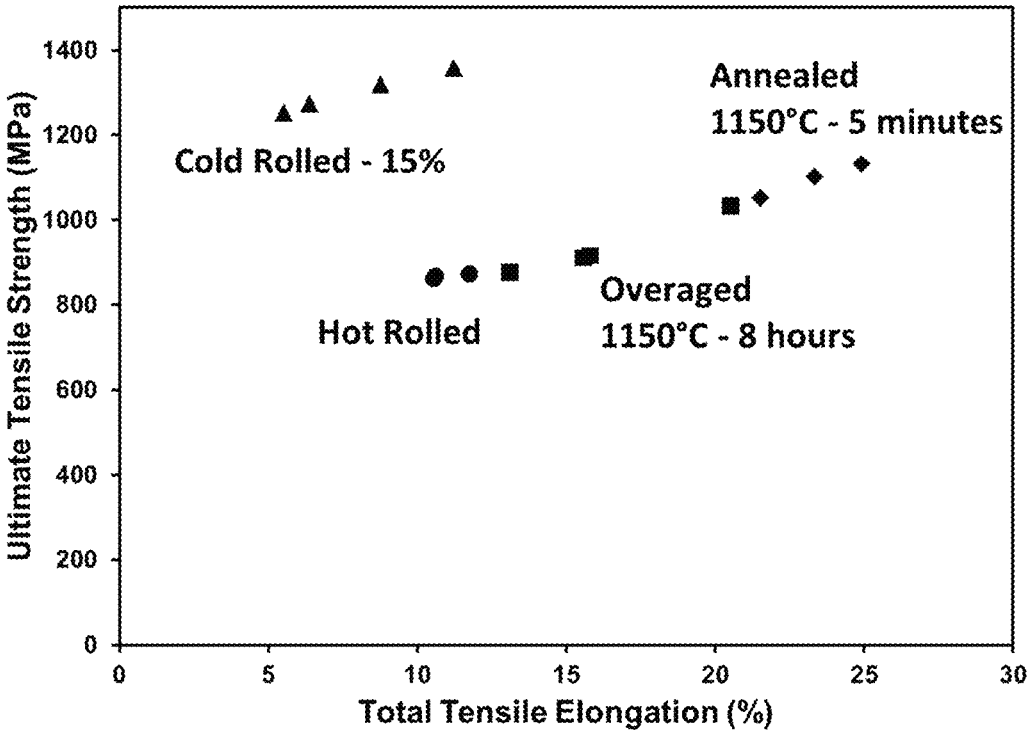
FIG. 24 Recovery of tensile properties in the industrial sheet from Alloy 260 after overaging at 1150°C for 8 hours.

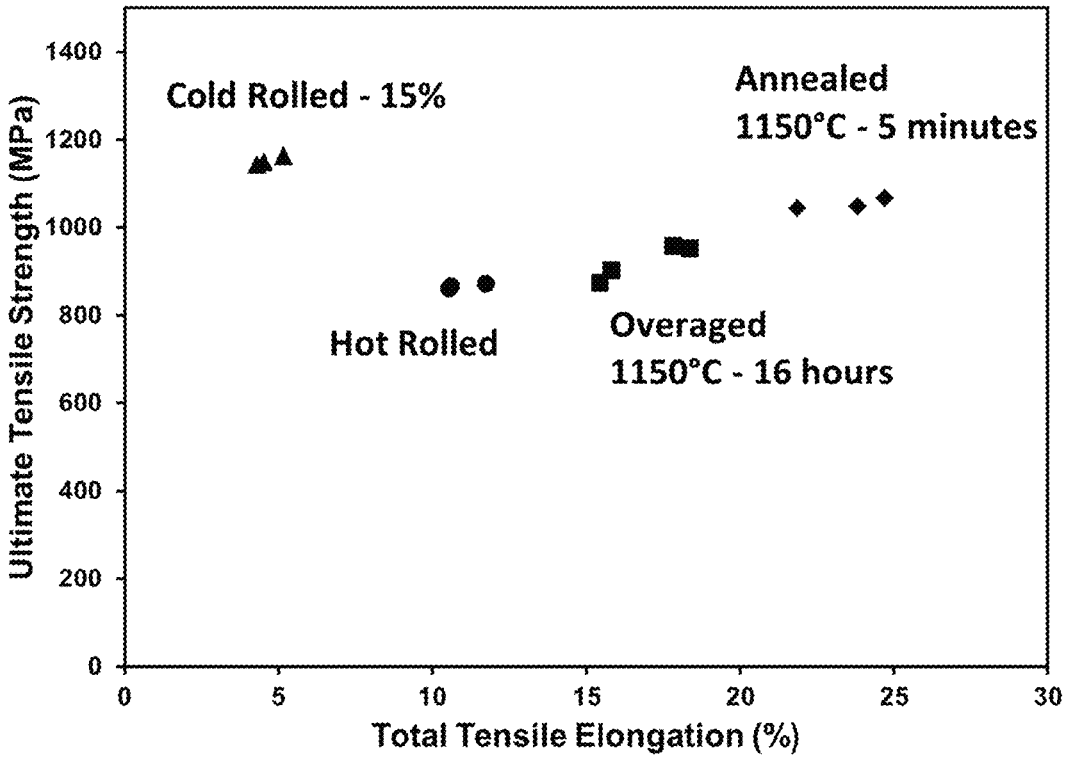
FIG. 25 Recovery of tensile properties in the industrial sheet from Alloy 260 after overaging at 1150°C for 16 hours.

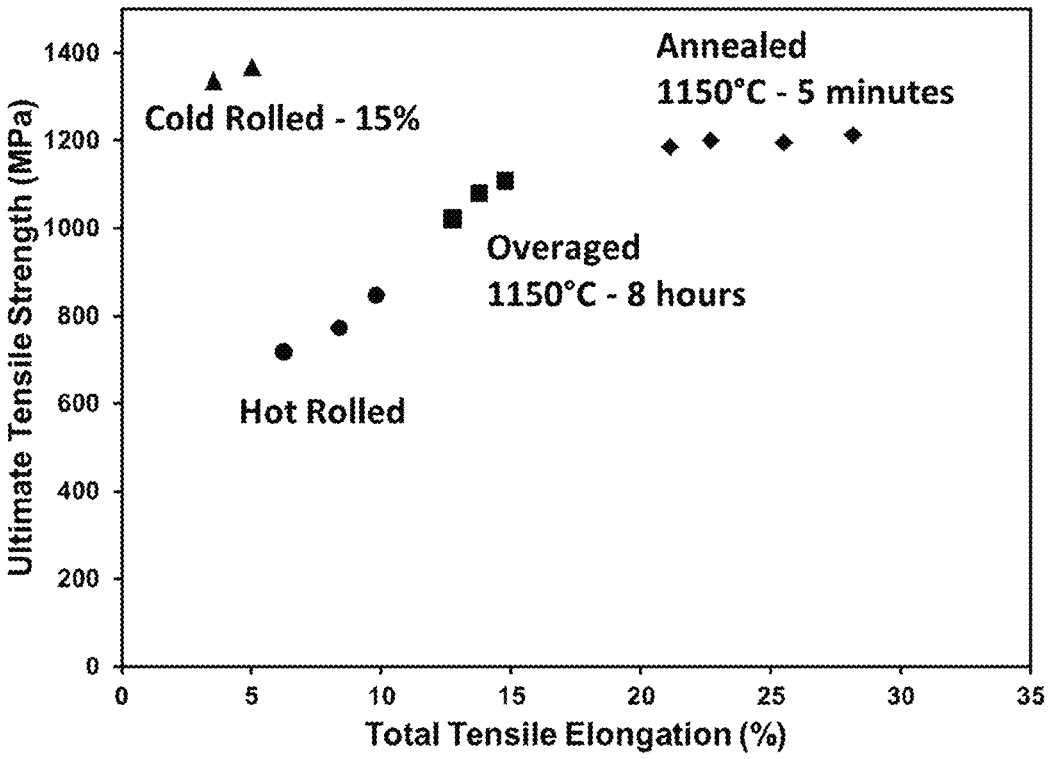
FIG. 26 Recovery of tensile properties in the industrial sheet from Alloy 284 after overaging at 1150°C for 8 hours.

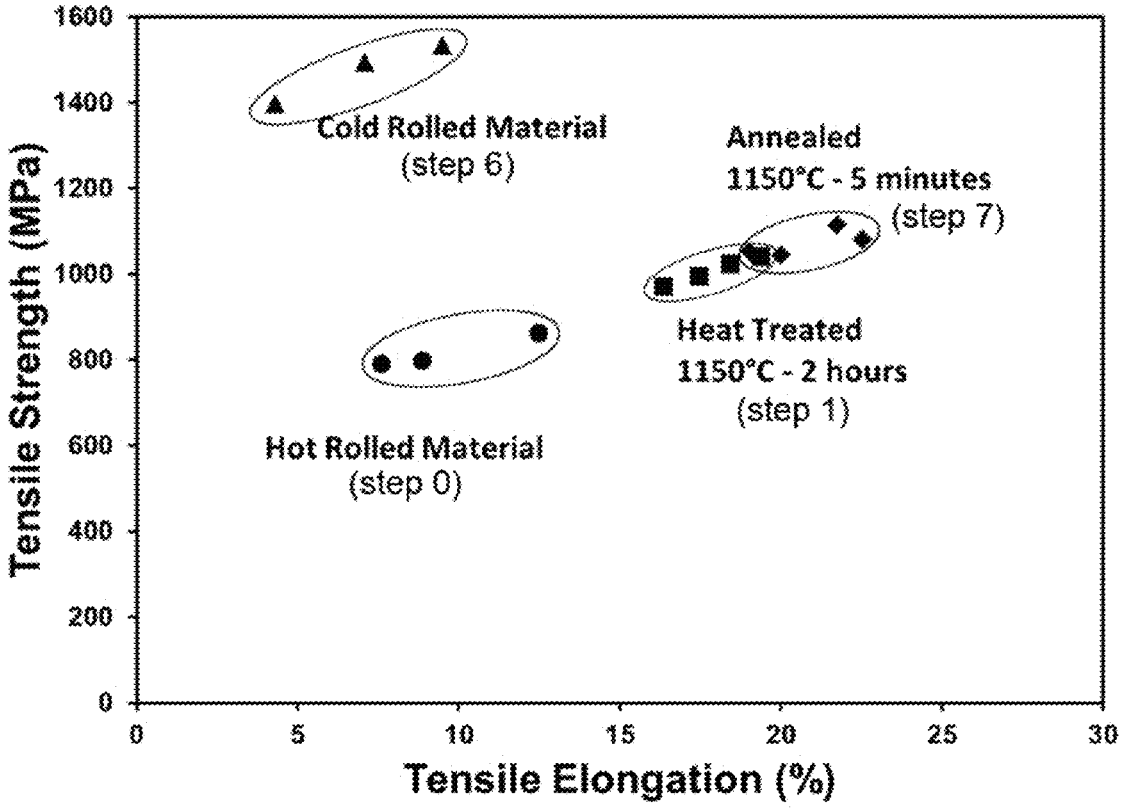
FIG. 27 Property recovery in Alloy 260 after multiple steps of cold rolling and annealing.

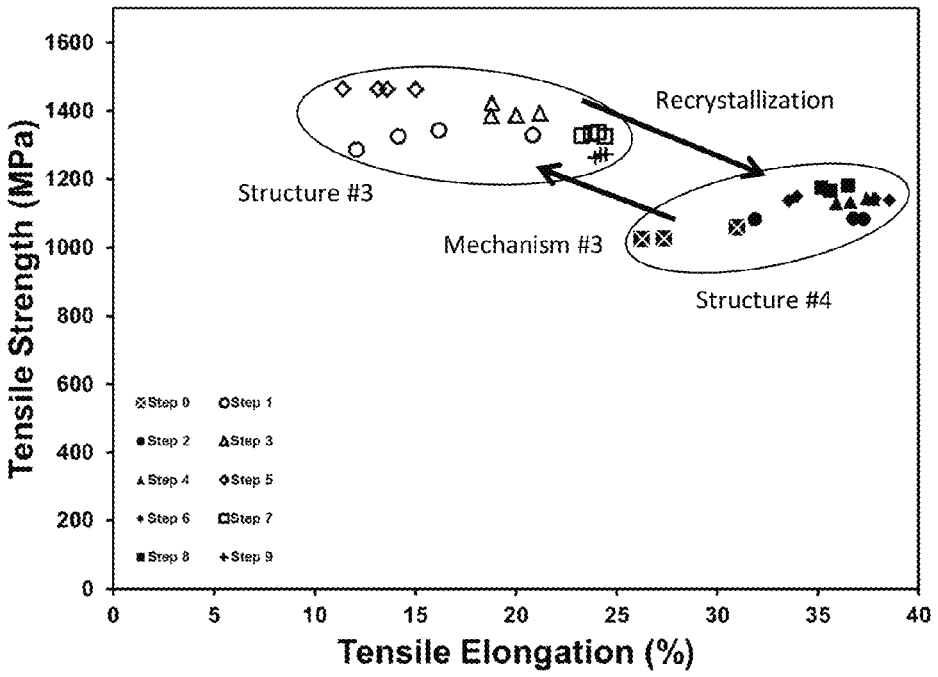
FIG. 28 Tensile properties of Alloy 260 sheet after each step of processing described in Table 15. Note that tensile properties fall into two distinct groups determined by the structure in the Alloy 260 sheet prior to tensile testing and that the process may be applied cyclically to transition between the structures utilizing the mechanisms shown.

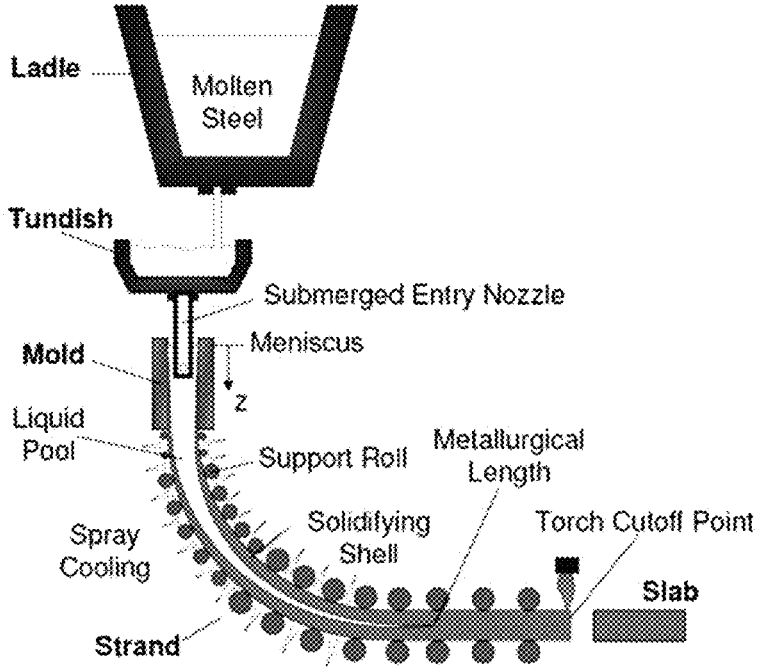
FIG. 29 Continuous slab casting process flow diagram.
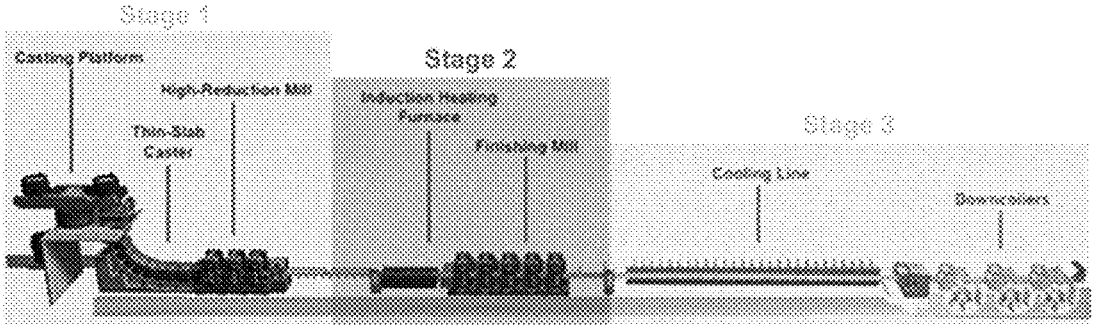
FIG. 30 Thin slab casting process flow diagram showing steel sheet production steps. Note that the process can be broken up into 3 process stages as shown.

RECRYSTALLIZATION, REFINEMENT, AND STRENGTHENING MECHANISMS FOR PRODUCTION OF ADVANCED HIGH STRENGTH METAL ALLOYS

CROSS REFERENCE TO RELATED APPLICATIONS

This application is a continuation of U.S. application Ser. No. 14/505,175 filed Oct. 2, 2014 which claims the benefit of U.S. Provisional Application Ser. No. 61/885,842 filed Oct. 2, 2013.

FIELD OF INVENTION

This application deals with a class of metal alloys with advanced property combinations applicable to metallic sheet production. More specifically, the present application identifies the formation of metal alloys of relatively high strength and ductility and the use of one or more cycles of elevated temperature treatment and cold deformation to produce metallic sheet at reduced thickness with relatively high strength and ductility.

BACKGROUND

Steels have been used by mankind for at least 3,000 years and are widely utilized in industry comprising over 80% by weight of all metallic alloys in industrial use. Existing steel technology is based on manipulating the eutectoid transformation. The first step is to heat up the alloy into the single phase region (austenite) and then cool or quench the steel at various cooling rates to form multiphase structures which are often combinations of ferrite, austenite, and cementite. Depending on steel compositions and thermal processing, a wide variety of characteristic microstructures (i.e. polygonal ferrite, pearlite, bainite, austenite and martensite) can be obtained with a wide range of properties. This manipulation of the eutectoid transformation has resulted in the wide variety of steels available nowadays.

Currently, there are over 25,000 worldwide equivalents in 51 different ferrous alloy metal groups. For steel produced in sheet form, broad classifications may be employed based on tensile strength characteristics. Low-Strength Steels (LSS) may be defined as exhibiting ultimate tensile strengths less than 270 MPa and include types such as interstitial free and mild steels. High-Strength Steels (HSS) may be steel defined as exhibiting ultimate tensile strengths from 270 to 700 MPa and include types such as high strength low alloy, high strength interstitial free and bake hardenable steels. Advanced High-Strength Steels (AHSS) steels may have ultimate tensile strengths greater than 700 MPa and include types such as martensitic steels (MS), dual phase (DP) steels, transformation induced plasticity (TRIP) steels, complex phase (CP) steels and twin induced plasticity (TWIP) steels. As the strength level increases, the ductility of the steel generally decreases. For example, LSS, HSS and AHSS may indicate tensile elongations at levels of 25% to 55%, 10% to 45% and 4% to 50%, respectively.

AHSS have been developed for automotive applications. See, e.g., U.S. Pat. Nos. 8,257,512 and 8,419,869. These steels are characterized by improved formability and crashworthiness compared to conventional steel grades. Current AHSS are produced in processes involving thermo-mechanical processing followed by controlled cooling. To achieve the desired final microstructures in either uncoated or coated automotive products requires a control of a large number of variable parameters with respect to alloy composition and processing conditions.

Further developments of AHSS steels, designed for specific applications, will require careful control of alloying, microstructure and thermo-mechanical processing routes to optimize the specific strengthening and plasticity mechanisms responsible, respectively, for the desirable final strength and ductility characteristics.

SUMMARY

The present disclosure is directed at alloys and their associated methods of production. The method comprises:

a. supplying a metal alloy comprising Fe at a level of 55.0 to 88.0 atomic percent, B at a level of 0.50 to 8.0 atomic percent, Si at a level of 0.5 to 12.0 atomic percent and Mn at a level of 1.0 to 19.0 atomic percent;
b. melting said alloy and solidifying to provide a matrix grain size of 200 nm to 200,000 nm;
c. heating said alloy to form a refined matrix grain size of 50 nm to 5000 nm where the alloy has a yield strength of 200 MPa to 1225 MPa;
d. stressing said alloy that exceeds said yield strength of 200 MPa to 1225 MPa wherein said alloy indicates tensile strength of 400 MPa to 1825 MPa and an elongation of 1.0% to 59.2%.

Optionally, one may then apply the following steps:

e. heating to a temperature in the range 700° C. and below the melting point of said alloy wherein said alloy has grains of 100 nm to 50,000 nm, borides of 20 nm to 10,000 nm in size, precipitations of 1 nm to 200 nm in size, and said alloy has a yield strength of 200 MPa to 1650 MPa; and
f. stressing said alloy above said yield strength and forming an alloy having grain sizes of 10 nm to 2500 nm, boride grains of 20 nm to 10000 nm, precipitation grains of 1 nm to 200 nm, results in yield strength of 200 MPa to 1650 MPa, tensile strength of 400 MPa to 1825 MPa and an elongation of 1.0% to 59.2%.

In the above, the solidified alloy in step (b) and step (c) may have a thickness in the range of 1 mm to 500 mm. In steps (d), (e) and (f), the thickness may be reduced to a desired level, without compromising the mechanical properties.

The present disclosure also relates to a method comprising:

a. supplying metal alloy comprising Fe at a level of 55.0 to 88.0 atomic percent, B at a level of 0.50 to 8.0 atomic percent, Si at a level of 0.5 to 12.0 atomic percent and Mn at a level of 1.0 to 19.0 atomic percent, wherein said alloy indicates a yield strength of 200 MPa to 1650 MPa, and said alloy has a first thickness;
b. heating said alloy to a temperature in the range 700° C. and below the melting point of said alloy and stressing said alloy and forming an alloy having grain sizes of 10 nm to 2500 nm, borides of 20 nm to 10000 nm in size, precipitations of 1 nm to 200 nm in size, wherein said alloy indicates a yield strength of 200 MPa to 1650 MPa, tensile strength of 400 MPa to 1825 MPa and an elongation of 1.0% to 59.2%, and said alloy has a second thickness less than said first thickness.

In the above embodiment the heating and stressing of the alloy (step b) may be repeated in order to achieve a particular reduced thickness for the alloy that is targeted for a selected application.

Accordingly, the alloys of the present disclosure have application to continuous casting processes including belt casting, thin strip/twin roll casting, thin slab casting and thick slab casting. The alloys find particular application in vehicles, drill collars, drill pipe, pipe casing, tool joint, wellhead, compressed gas storage tanks or liquefied natural gas canisters.

BRIEF DESCRIPTION OF THE DRAWINGS

The detailed description below may be better understood with reference to the accompanying FIGS. which are provided for illustrative purposes and are not to be considered as limiting any aspect of this invention.

FIG. 8 illustrates tensile properties of industrial sheet from (a) Alloy 260 at different steps of sheet production and (b) Alloy 284 after post-processing with different parameters.

FIG. 9 illustrates backscattered SEM micrographs of the as-solidified microstructure in the laboratory cast sheet from Alloy 260 with cast thickness of 1.8 mm in: (a) Outer layer region; (b) Central layer region.

FIG. 10 illustrates backscattered SEM micrographs of the as-solidified microstructure in Alloy 260 industrial sheet: (a) Outer layer region; (b) Central layer region.

FIG. 11 illustrates backscattered SEM micrographs of the microstructure in the industrial sheet from Alloy 260 after heat treatment at 1150° C. for 2 hr: (a) Outer layer region; (b) Central layer region.

FIG. 12 illustrates bright-field TEM images of the microstructure in the industrial sheet from Alloy 260 after heat treatment at 1150° C. for 2 hr.

FIG. 13 illustrates backscattered SEM micrographs of the microstructure in the cold-rolled sheet from Alloy 260 with 50% reduction: (a) Outer layer region; (b) Central layer region.

FIG. 14 illustrates bright-field TEM images of the microstructure in the cold-rolled sheet from Alloy 260 with 50% reduction.

FIG. 15 illustrates x-ray diffraction data (intensity vs two-theta) for Alloy 260 sheet in the cold rolled condition; a) Measured pattern, b) Rietveld calculated pattern with peaks identified.

FIG. 16 illustrates backscattered SEM micrographs of the microstructure in the cold-rolled sheet from Alloy 260 after heat treatment at 1150° C. for 5 minutes: (a) Outer layer region; (b) Central layer region.

FIG. 17 illustrates backscattered SEM micrographs of the microstructure in the cold-rolled sheet from Alloy 260 after heat treatment at 1150° C. for 2 hr: (a) Outer layer region; (b) Central layer region.

FIG. 18 illustrates bright-field TEM micrographs of the microstructure in the cold-rolled sheet from Alloy 260 after heat treatment at 1150° C. for 5 minutes.

FIG. 19 illustrates bright-field TEM micrographs of the microstructure in the cold-rolled sheet from Alloy 260 after heat treatment at 1150° C. for 2 hr.

FIG. 20 illustrates x-ray diffraction data (intensity vs two theta) for Alloy 260 sheet in the cold rolled and heat treated condition; (a) measured pattern; (b) Rietveld calculated pattern with peaks identified.

FIG. 21 illustrates backscattered SEM micrographs of the microstructure in the gage section of tensile specimen from Alloy 260: (a) Outer layer region; (b) Central layer region.

FIG. 22 illustrates bright-field (a) and dark-field (b) TEM micrographs of the microstructure in the gage section of tensile specimen from Alloy 260.

FIG. 23 illustrates x-ray diffraction data (intensity vs two-theta) for Alloy 260 sheet in the tensile gage of deformed sample; a) Measured pattern, b) Rietveld calculated pattern with peaks identified.

FIG. 24 illustrates recovery of tensile properties in the industrial sheet from Alloy 260 after overaging at 1150° C. for 8 hours.

FIG. 25 illustrates recovery of tensile properties in the industrial sheet from Alloy 260 after overaging at 1150° C. for 16 hours.

FIG. 26 illustrates recovery of tensile properties tensile properties in the industrial sheet from Alloy 284 after over aging at 1150° C. for 8 hours.

FIG. 27 illustrates property recovery in Alloy 260 after multiple steps of cold rolling and annealing.

FIG. 28 illustrates tensile properties of Alloy 260 sheet after each step of processing described in Table 15 showing that tensile properties fall into two distinct groups determined by the structure in the Alloy 260 sheet prior to tensile testing and that the process may be applied cyclically to transition between the structures utilizing the mechanisms shown.

FIG. 29 illustrates continuous slab casting process flow diagram showing slab production steps.

FIG. 30 illustrates thin slab casting process flow diagram showing steel sheet production steps that can be broken up into 3 process stages similar to Thin Strip Casting.

DETAILED DESCRIPTION

The steel alloys herein are such that they are initially capable of formation of what is described herein as Class 1 or Class 2 Steel which are preferably crystalline (non-glassy) with identifiable crystalline grain size morphology and mechanical properties. The present disclosure focuses upon improvements to the Class 2 Steel and the discussion below regarding Class 1 is intended to provide clarifying context.

Class 1 Steel

Figure 1:
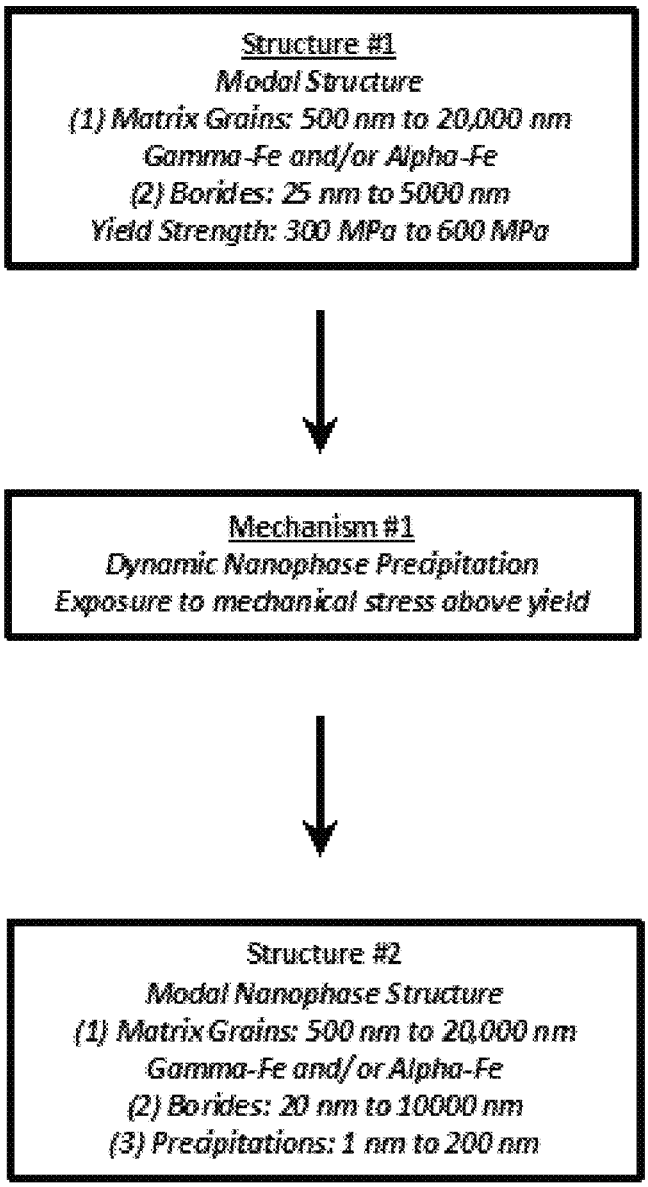
FIG. 1 illustrates the formation of Class 1 Steel.

The formation of Class 1 Steel herein is illustrated in FIG. 1. As shown therein, a Modal Structure (Structure #1, FIG. 1) is initially formed as a result of starting with a liquid melt of the alloy and solidifying by cooling, which provides nucleation and growth of particular phases having particular grain sizes. Reference herein to "modal" may therefore be understood as a structure having at least two grain size distributions. Grain size herein may be understood as the size of a single crystal of a specific particular phase preferably identifiable by methods such as scanning electron microscopy or transmission electron microscopy. Accordingly, Structure #1 of the Class 1 Steel may be preferably achieved by processing through either laboratory scale procedures as shown and/or through industrial scale methods involving chill surface processing methodology such as twin roll processing, thick or thin slab casting.

The Modal Structure of Class 1 Steel will therefore initially possess, when cooled from the melt, the following grain sizes: (1) matrix grain size of 500 nm to 20,000 nm containing austenite and/or ferrite; (2) boride size of 25 nm to 5000 nm (i.e. non-metallic grains such as $M_2B$ where M is the metal and is covalently bonded to B). The borides may also preferably be "pinning" type phases which is reference to the feature that the matrix grains will effectively be stabilized by the pinning phases which resist coarsening at elevated temperature. Note that the metal borides have been identified as exhibiting the $M_2B$ stoichiometry but other stoichiometry's are possible and may provide pinning including $M_3B$, MB ($M_1B_1$), $M_{23}B_6$, and $M_7B_3$.

The Modal Structure of Class 1 Steel may be deformed by thermomechanical deformation and through heat treatment, resulting in some variation in properties, but the Modal Structure may be maintained.

Figure 2:
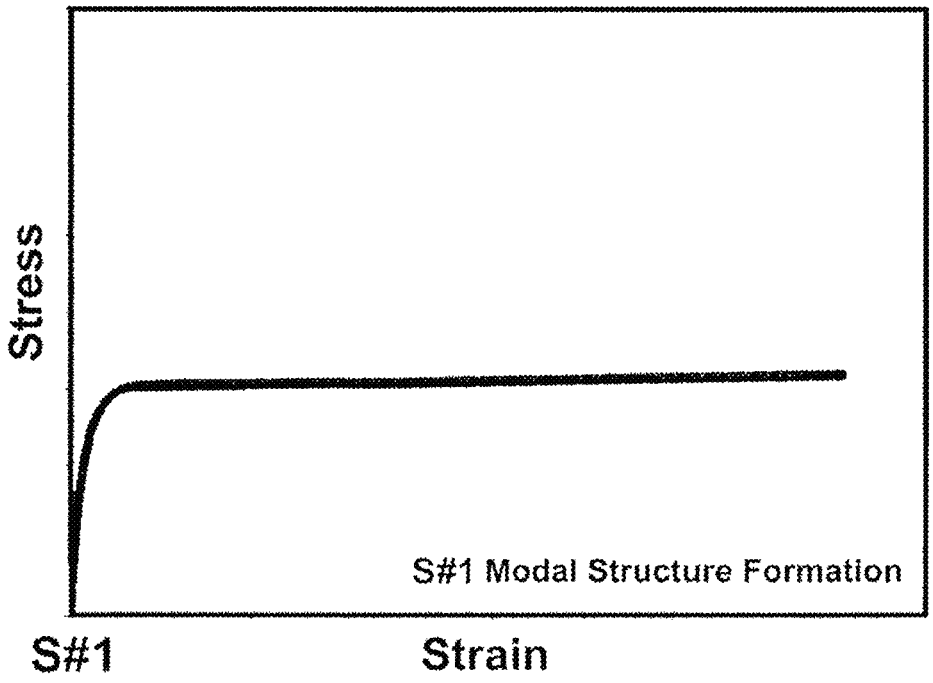
FIG. 2 is a stress v. strain diagram illustrating mechanical response of Class 1 Steel with Modal Nanophase Structure.

When the Class 1 Steel noted above is exposed to a mechanical stress, the observed stress versus strain diagram is illustrated in FIG. 2. It is therefore observed that the Modal Structure undergoes what is identified as Dynamic Nanophase Precipitation (Mechanism #1, FIG. 1) leading to a Modal Nanophase Structure (Structure #2, FIG. 1). Such Dynamic Nanophase Precipitation is therefore triggered when the alloy experiences a yield under stress, and it has been found that the yield strength of Class 1 Steels which undergo Dynamic Nanophase Precipitation may preferably occur at 300 MPa to 840 MPa. Accordingly, it may be appreciated that Dynamic Nanophase Precipitation occurs due to the application of mechanical stress that exceeds such indicated yield strength. Dynamic Nanophase Precipitation itself may be understood as the formation of a further identifiable phase in the Class 1 Steel which is termed a precipitation phase with an associated grain size. That is, the result of such Dynamic Nanophase Precipitation is to form an alloy with Modal Nanophase Structure (Structure #2, FIG. 1), which still possesses identifiable matrix grain size of 500 nm to 20,000 nm, boride pinning phases of 20 nm to 10000 nm in size, along with the formation of precipitations of hexagonal phases with 1.0 nm to 200 nm in size. As noted above, the matrix grains therefore do not coarsen when the alloy is stressed, but do lead to the development of the precipitation as noted.

Reference to the hexagonal phases may be understood as a dihexagonal pyramidal class hexagonal phase with a $P6_3mc$ space group (#186) and/or a ditrigonal dipyramidal class with a hexagonal P6bar2C space group (#190). In addition, the mechanical properties of such second type structure of the Class 1 Steel are such that the tensile strength is observed to fall in the range of 630 MPa to 1100 MPa, with an elongation of 10-40%. Furthermore, the second structure type of the Class 1 Steel is such that it exhibits a strain hardening coefficient between 0.1 to 0.4 that is nearly flat after undergoing the indicated yield. The strain hardening coefficient is reference to the value of n in the formula $\sigma = K\epsilon^n$, where $\sigma$ represents the applied stress on the material, $\epsilon$ is the strain and K is the strength coefficient. The value of the strain hardening exponent n lies between 0 and 1. A value of 0 means that the alloy is a perfectly plastic solid (i.e. the material undergoes non-reversible changes to applied force), while a value of 1 represents a 100% elastic solid (i.e. the material undergoes reversible changes to an applied force). Table 1 below provides a summary on structures and mechanisms in Class 1 Steel herein.

TABLE 1

Comparison of Structure and Performance for Class 1 Steel

| | Class 1 Steel | |
|---|---|---|
| Property/ Mechanism | Structure Type #1 Modal Structure | Structure Type #2 Modal Nanophase Structure |
| Structure Formation | Starting with a liquid melt, solidifying this liquid melt and forming directly | Dynamic Nanophase Precipitation occurring through the application of mechanical stress |
| Transformations | Liquid solidification followed by nucleation and growth | Stress induced transformation involving phase formation and precipitation |
| Enabling Phases | Austenite and/or ferrite with boride pinning | Austenite, optionally ferrite, boride pinning phases, and hexagonal phase(s) precipitation |
| Matrix Grain Size | 500 to 20,000 nm<br>Austenite and/or ferrite | 500 to 20,000 nm<br>Austenite optionally ferrite |
| Boride Sizes | 25 to 5000 nm<br>Non metallic (e.g. metal boride) | 25 to 500 nm<br>Non-metallic (e.g. metal boride) |
| Precipitation Sizes | — | 1 nm to 200 nm<br>Hexagonal phase(s) |
| Tensile Response | Intermediate structure; transforms into Structure #2 when undergoing yield | Actual with properties achieved based on structure type #2 |
| Yield Strength | 300 to 600 MPa | 300 to 840 MPa |
| Tensile Strength | — | 630 to 1100 MPa |
| Total Elongation | — | 10 to 40% |
| Strain Hardening Response | — | Exhibits a strain hardening coefficient between 0.1 to 0.4 and a strain hardening coefficient as a function of strain which is nearly flat or experiencing a slow increase until failure |

Class 2 Steel

Figure 3A:
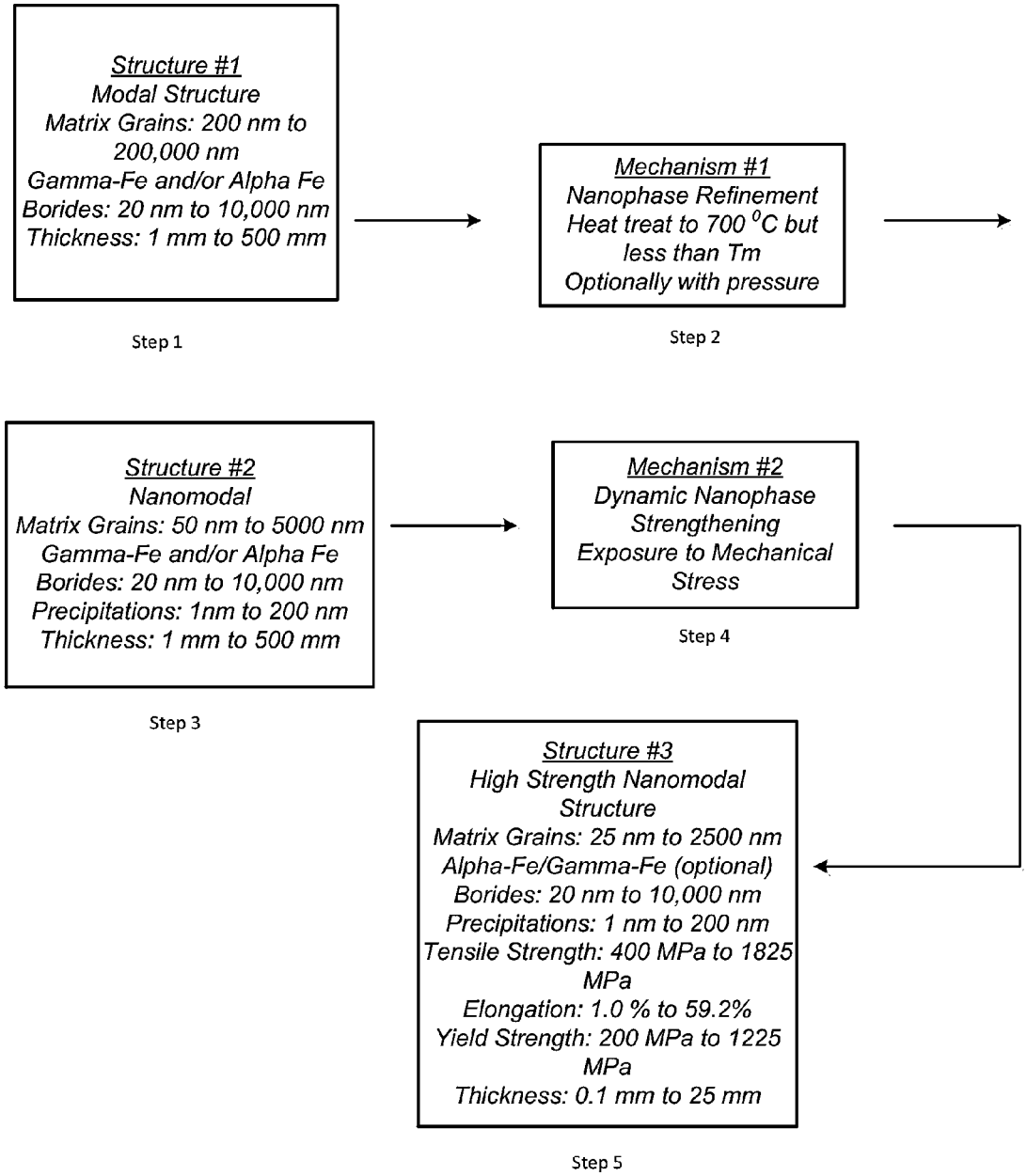
FIG. 3A illustrates the formation of Class 2 Steel.

The formation of Class 2 Steel herein is illustrated in FIG. 3A. Class 2 steel may also be formed herein from the identified alloys, which involves two new structure types after starting with Modal Structure (Structure #1, FIG. 3A) followed by two new mechanisms identified herein as Nanophase Refinement (Mechanism #1, FIG. 3A) and Dynamic Nanophase Strengthening (Mechanism #2, FIG. 3A). The structure types for Class 2 Steel are described herein as Nanomodal Structure (Structure #2, FIG. 3A) and High Strength Nanomodal Structure (Structure #3, FIG. 3A). Accordingly, Class 2 Steel herein may be characterized as follows: Structure #1-Modal Structure (Step #1), Mechanism #1—Nanophase Refinement (Step #2), Structure #2-Nanomodal Structure (Step #3), Mechanism #2—Dynamic Nanophase Strengthening (Step #4), and Structure #3—High Strength Nanomodal Structure (Step #5).

As shown therein, Modal Structure (Structure #1) is initially formed as the result of starting with a liquid melt of the alloy and solidifying by cooling, which provides nucleation and growth of particular phases having particular grain sizes. Grain size herein may again be understood as the size of a single crystal of a specific particular phase preferably identifiable by methods such as scanning electron microscopy or transmission electron microscopy. Accordingly, Structure #1 of the Class 2 Steel may be preferably achieved by processing through either laboratory scale procedures as shown and/or through industrial scale methods involving chill surface processing methodology such as twin roll processing, thick or thin slab casting.

The Modal Structure of Class 2 Steel will therefore initially indicate, when cooled from the melt, the following grain sizes: (1) matrix grain size of 200 nm to 200,000 nm containing austenite and/or ferrite; (2) boride sizes of 20 nm to 10000 nm (i.e. non-metallic grains such as $M_2B$ where M is the metal and is covalently bonded to B). The borides may also preferably be "pinning" type phases which are referenced to the feature that the matrix grains will effectively be stabilized by the pinning phases which resist coarsening at elevated temperature. Note that the metal borides have been identified as exhibiting the $M_2B$ stoichiometry but other stoichiometry's are possible and may provide pinning including $M_3B$, MB ($M_1B_1$), $M_{23}B_6$, and $M_7B_3$ and which are unaffected by Mechanisms #1 or #2 noted above). Furthermore, Structure #1 of Class 2 steel herein includes austenite and/or ferrite along with such boride phases.

The Modal Structure is preferably first created (Structure #1, FIG. 3A) and then after the creation, the Modal Structure may now be uniquely refined through Mechanism #1, which is a Nanophase Refinement, leading to Structure #2. Nanophase Refinement is reference to the feature that the matrix grain sizes of Structure #1 which initially fall in the range of 200 nm to 200,000 nm are reduced in size to provide Structure #2 which has matrix grain sizes that typically fall in the range of 50 nm to 5000 nm. Note that the boride pinning phase can change size significantly in some alloys, while it is designed to resist matrix grain coarsening during the heat treatments. Due to the presence of these boride pinning sites, the motion of a grain boundaries leading to coarsening would be expected to be retarded by a process called Zener pinning or Zener drag. Thus, while grain growth of the matrix may be energetically favorable due to the reduction of total interfacial area, the presence of the boride pinning phase will counteract this driving force of coarsening due to the high interfacial energies of these phases.

Characteristic of the Nanophase Refinement (Mechanism #1, FIG. 3A) in Class 2 steel, the micron scale austenite phase (gamma-Fe) which was noted as falling in the range of 200 nm to 200,000 nm is partially or completely transformed into new phases (e.g. ferrite or alpha-Fe). The volume fraction of ferrite (alpha-iron) initially present in the Modal Structure (Structure #1, FIG. 3A) of Class 2 steel is 0 to 45%. The volume fraction of ferrite (alpha-iron) in Structure #2 as a result of Nanophase Refinement (Mechanism #1, FIG. 3A) is typically from 20 to 80%. The static transformation (Mechanism #1, FIG. 3A) preferably occurs during elevated temperature heat treatment (optionally with pressure) and thus involves a unique refinement mechanism since grain coarsening rather than grain refinement is the conventional material response at elevated temperature. Preferably, one heats to a temperature of 700° C. and less than the Tm of the alloy. Such temperature may therefore fall within the range of, e.g., 700° C. to 1200° C. depending upon a particular alloy. The pressure applied is such at the elevated temperature yield strength of the material is exceeded which may be in the range of 5 MPa to 1000 MPa Accordingly, grain coarsening does not occur with the alloys of Class 2 Steel herein during the Nanophase Refinement. Structure #2 is uniquely able to transform to Structure #3 during Dynamic Nanophase Strengthening (Mechanism #2, FIG. 3A) and indicates tensile strength values in the range from 400 to 1825 MPa with 1.0% to 59.2% total elongation.

Depending on alloy chemistries, nano-scale precipitates can form during Nanophase Refinement and the subsequent thermal process in some of the non-stainless high-strength steels. The nano-precipitates are in the range of 1 nm to 200 nm in size, with the majority (>50%) of these phases 10~20 nm in size, which are much smaller than the boride pinning phase formed in Structure #1 for retarding matrix grain coarsening. The borides are found to be in a range from 20 to 10000 nm in size.

Figure 4:
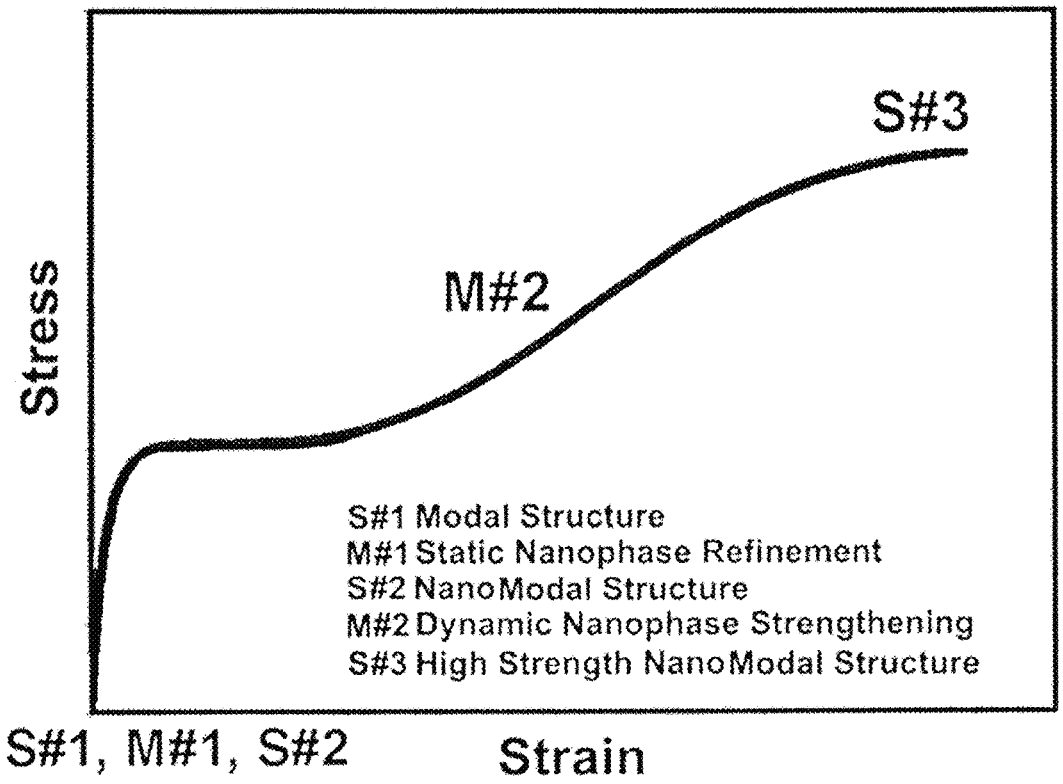
FIG. 4 is a stress v. strain diagram illustrating mechanical response of Class 2 Steel with High Strength Nanomodal Structure.

Expanding upon the above, in the case of the alloys herein that provide Class 2 Steel, when such alloys exceed their yield point, plastic deformation at constant stress occurs followed by a dynamic phase transformation leading toward the creation of Structure #3. More specifically, after enough strain is induced, an inflection point occurs where the slope of the stress versus strain curve changes and increases. In FIG. 4, a stress strain curve is shown that represents the steel alloys herein which undergo a deformation behavior of Class 2 steel. The strength increases with strain indicating an activation of Mechanism #2 (Dynamic Nanophase Strengthening).

With further straining during Dynamic Nanophase Strengthening, the strength continues to increase but with a gradual decrease in strain hardening coefficient value up to nearly failure. Some strain softening occurs but only near the breaking point which may be due to reductions in localized cross sectional area at necking. Note that the strengthening transformation that occurs at the material straining under the stress generally defines Mechanism #2 as a dynamic process, leading to Structure #3. By "dynamic", it is meant that the process may occur through the application of a stress which exceeds the yield point of the material. The tensile properties that can be achieved for alloys that achieve Structure #3 include tensile strength values in the range from 400 MPa to 1825 MPa and 1.0% to 59.2% total elongation. The level of tensile properties achieved is also dependent on the amount of transformation occurring as the strain increases corresponding to the characteristic stress strain curve for a Class 2 steel.

With regards to this dynamic mechanism, new and/or additional precipitation phase or phases are observed that possesses identifiable grain sizes of 1 nm to 200 nm. In addition, there is the further identification in said precipitation phase of a dihexagonal pyramidal class hexagonal phase with a $P6_3mc$ space group (#186), a ditrigonal dipyramidal class with a hexagonal P6bar2C space group (#190), and/or a $M_3Si$ cubic phase with a Fm3m space group (#225). Accordingly, the dynamic transformation can occur partially or completely and results in the formation of a microstructure with novel nanoscale/near nanoscale phases providing relatively high strength in the material. That is, Structure #3 may be understood as a microstructure having matrix grains sized generally from 25 nm to 2500 nm which are pinned by boride phases which are in the range of 20 nm to 10000 nm and with precipitate phases which are in the range of 1 nm to 200 nm.

formation of large grains from small grains so that it is not a refinement mechanism but a coarsening mechanism. Additionally, as new undeformed grains are replaced by deformed grains no phase changes occur in contrast to the mechanisms presented here and this also results in a corresponding reduction in strength in contrast to the strengthening mechanism here. Note also that metastable austenite in steels is known to transform to martensite under mechanical stress but, preferably, no evidence for martensite or body centered tetragonal iron phases are found in the new steel alloys described in this application. Table 2 below provides a summary on structures and mechanisms in Class 2 Steel herein.

TABLE 2

Comparison Of Structure and Performance of Class 2 Steel

| | Class 2 Steel | | |
|---|---|---|---|
| Property/ Mechanism | Structure Type #1 Modal Structure | Structure Type #2 Nanomodal Structure | Structure Type #3 High Strength Nanomodal Structure |
| Structure Formation | Starting with a liquid melt, solidifying this liquid melt and forming directly | Nanophase Refinement mechanism occurring during heat treatment | Dynamic Nanophase Strengthening mechanism occurring through application of mechanical stress |
| Transformations | Liquid solidification followed by nucleation and growth | Solid state phase transformation of supersaturated gamma iron | Stress induced transformation involving phase formation and precipitation |
| Enabling Phases | Austenite and/or ferrite with boride pinning phases | Austenite, optionally ferrite, boride pinning phases, and hexagonal phase precipitation | Ferrite, optionally austenite, boride pinning phases, hexagonal and additional phases precipitation |
| Matrix Grain Size | 200 nm to 200,000 nm Austenite | Grain Refinement (50 nm to 5000 nm) Austenite to ferrite and precipitation phase transformation | Grain size remains refined at 25 nm to 2500 nm/ Additional precipitation formation |
| Boride Sizes | 20 nm to 10000 nm borides (e.g. metal boride) | 20 nm to 10000 nm borides (e.g. metal boride) | 20 to 10000 nm borides (e.g. metal boride) |
| Precipitation Sizes | — | 1 nm to 200 nm | 1 nm to 200 nm |
| Tensile Response | Actual with properties achieved based on structure type #1 | Intermediate structure; transforms into Structure #3 when undergoing yield | Actual with properties achieved based on formation of structure type #3 and fraction of transformation. |
| Yield Strength | 300 to 600 MPa | 200 to 1225 MPa | 200 to 1225 MPa |
| Tensile Strength | — | — | 400 to 1825 MPa |
| Total Elongation | — | — | 1.0% to 59.2% |
| Strain Hardening Response | — | After yield point, exhibit a strain softening at initial straining as a result of phase transformation, followed by a significant strain hardening effect leading to a distinct maxima | Strain hardening coefficient may vary from 0.2 to 1.0 depending on amount of deformation and transformation |

The initial formation of the above referenced precipitation phase with grain sizes of 1 nm to 200 nm starts at Nanophase Refinement and continues during Dynamic Nanophase Strengthening leading to Structure #3 formation. The volume fraction of the precipitation phase/grains of 1 nm to 200 nm in size in Structure #2 increases during transformation into Structure #3 and assists with the identified strengthening mechanism. It should also be noted that in Structure #3, the level of gamma-iron is optional and may be eliminated depending on the specific alloy chemistry and austenite stability.

Note that dynamic recrystallization is a known process but differs from Mechanism #2 (FIG. 3A) since it involves the

Recrystallization and Cold Forming of Class 2 Steel

As noted above, the steel alloys herein are such that they are capable of formation of High Strength Nanomodal Structure (Structure #3, FIG. 3A and Table 2). It should be noted that in FIG. 3A, Structure #1 can be formed at solidification of material at thicknesses range from 1 mm to 500 mm, Structure #2 (after Nanophase Refinement) relates to a thicknesses from 1 mm to 500 mm, and Structure #3 (after Dynamic Nanophase Strengthening) forms at a reduced thickness of 0.1 mm to 25 mm.

Figure 3B:
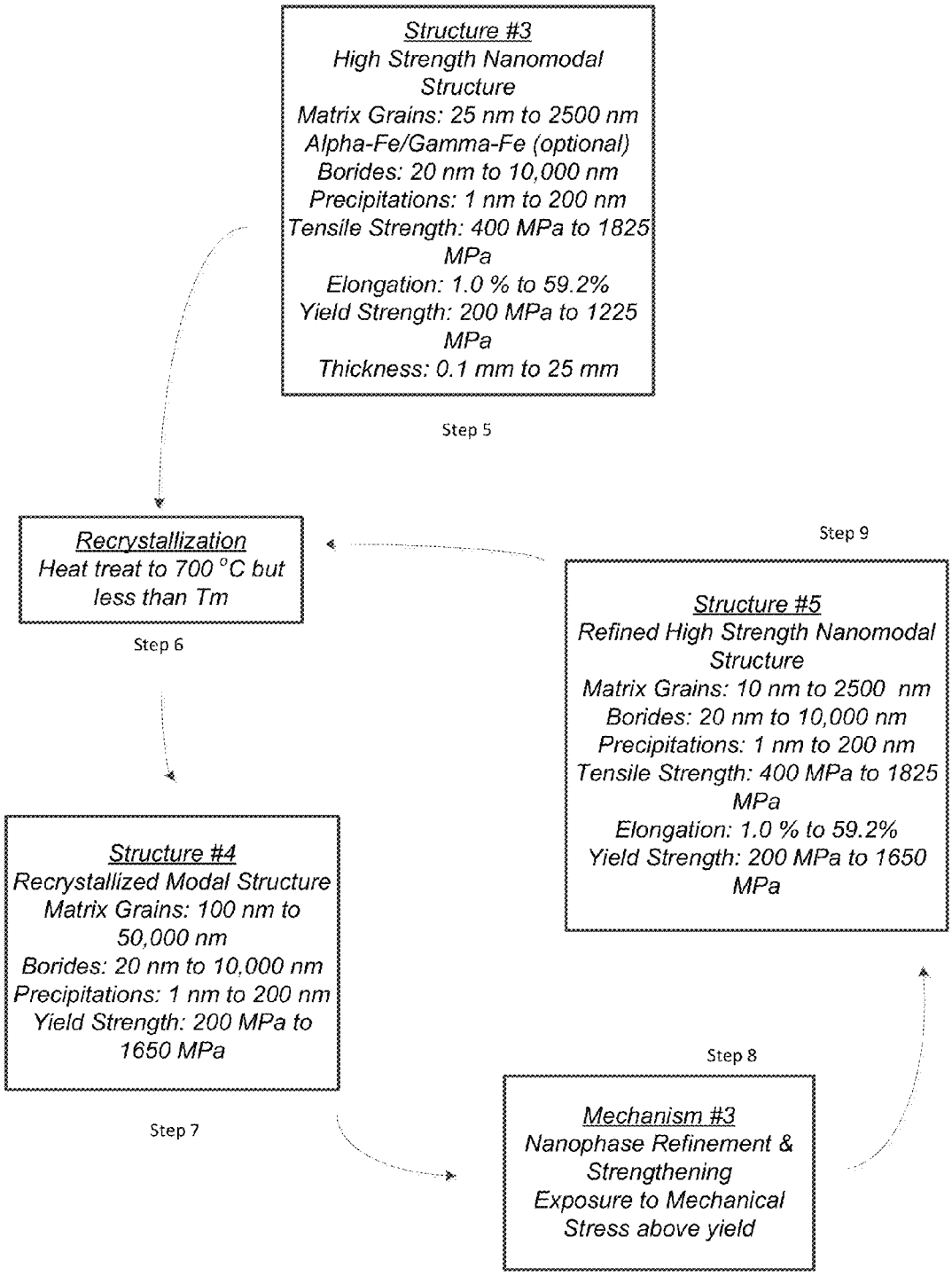
FIG. 3B illustrates the application of Recrystallization and Nanophase Refinement & Strengthening as applied to Structure 3 (Class 2 Steel) and the formation of Refined High Strength Nanomodal Structure.

With reference to FIG. 3B, it has now been recognized that the indicated High Strength Nanomodal Structure (Structure

#3) can undergo recrystallization to provide Recrystallized Modal Structure (Structure #4, FIG. 3B) which during subsequent deformation undergoes Nanophase Refinement and Strengthening (Mechanism #3, FIG. 3B) leading to transformation into Refined High Strength Nanomodal Structure (Structure #5, FIG. 3B). The thickness of the alloys during these steps is in the range of 0.1 mm to <25 mm. As can be seen, however, heating resulting in recrystallization followed by stressing above the yield point, which are steps that would be realized during alloy processing to provide reduced thickness sheet, does not compromise the mechanical properties of Structure #3. That is, Structure #3, when undergoing heating and recrystallization, followed by stress above yield, which may be realized in sheet processing aimed at reducing thickness, does not, herein, compromise the alloy mechanical strength characteristics (e.g. reductions of more than 10%). Resultant Structure #5 provides similar behavior (FIG. 5) and mechanical properties as initial Structure #3 and depending on the specific alloy and processing conditions can result in improvements in properties.

In addition, as illustrated in FIG. 3B, recrystallization (step 6) and subsequent deformation (step 8) can be repeatedly applied to the High Strength Nanomodal Structure, as explained herein. Note that after at least one cycle of going through developmental processes in FIG. 3A and FIG. 3B up to step 9, further cycles may be considered and one can end either at Step 7, Step 8, or Step 9 depending on the requirements of a particular end-user application, desired thickness objective (i.e. targeting a final thickness in the range of 0.1 mm to 25 mm) and final tailoring of properties such as cold rolling to an intermediate level without applying subsequent annealing.

Expanding upon the above, when steel alloys with full or partial High Strength Nanomodal Structure (Structure #3) are subjected to high temperature exposure (temperatures greater than or equal to 700° C. but less than the melting point) recrystallization takes place leading to formation of Recrystallized Modal Structure (Structure #4, FIG. 3B). Such recrystallization occurs after the alloys were previously subjected to a significant amount of plastic deformation (i.e. stress above the yield point). An example of such deformation is represented by cold rolling but can occur with a wide variety of cold processing steps including cold stamping, hydroforming, roll forming etc. Cold rolling into the plastic range introduces high densities of dislocations in the matrix grains with strengthening occurring through the identified Dynamic Nanophase Strengthening (Mechanism #2, FIG. 3A) creating the High Strength Nanomodal Structure (Structure #3, FIG. 3A). The High Strength Nanomodal Structure with high densities of dislocations stored in the matrix grains has been now shown to undergo recrystallization upon exposure to elevated temperature, which causes dislocation removal, phase changes, and matrix grain growth leading to the formation of the Recrystallized Modal Structure (Structure #4, FIG. 3B). Note that while matrix grain growth occurs, the extent of growth is limited by the pinning effect of boride phase at grain boundaries.

The Recrystallized Modal Structure (Structure #4, FIG. 3B) is thus characterized by matrix grain growth to the size of 100 nm to 50,000 nm which are pinned by boride phases with the size in the range of 20 nm to 10000 nm and precipitate phases randomly distributed in the matrix which are in the range of 1 nm to 200 nm in size. Structure analysis shows gamma-Fe (Austenite) is the primary matrix phase (25% to 90%) and that it coincides with a complex mixed transitional metal boride phase typically with the $M_2B_1$ stoichiometry present. Depending on the initial status of High Strength Nanomodal Structure (Structure #3) in the material, parameters of cold rolling and heat treatment and specific chemistry, additional phases can be represented by alpha-Fe (ferrite) (0 to 50%) and residual nanoprecipitates (0 to 30%).

Figure 5:
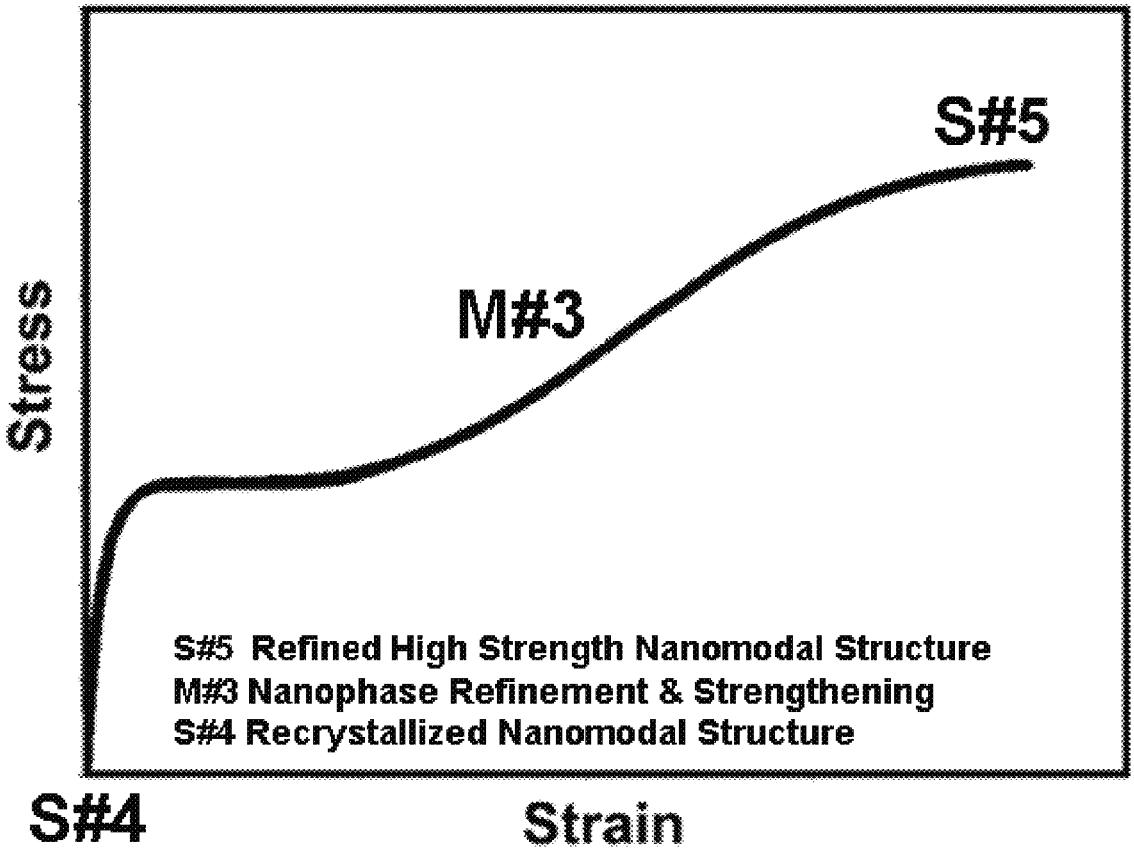
FIG. 5 is a stress v. strain diagram illustrating mechanical response of steel alloys with Refined High Strength Nanomodal Structure.

Expanding upon the above, in the case of straining of the alloys herein with the Recrystallized Modal Structure (Structure #4, FIG. 3B), when such alloys exceed their yield point, plastic deformation at constant stress occurs followed by a dynamic phase transformation through Nanophase Refinement and Strengthening (Mechanism #3, FIG. 3B) leading toward the creation of Refined High Strength Nanomodal Structure (Structure #5, FIG. 3B). More specifically, after enough strain is induced, an inflection point occurs where the slope of the stress versus strain curve changes and increases. In FIG. 5, a stress strain curve is shown that represents the steel alloys herein which undergo a deformation behavior of Class 2 steel with the Recrystallized Modal Structure (Structure #4, FIG. 3B). The strength increases with strain indicating an activation of Mechanism #3 (Nanophase Refinement and Strengthening). With further straining, the strength continues to increase but with a gradual decrease in strain hardening coefficient value up to nearly failure. Some strain softening occurs but only near the breaking point which may be due to reductions in localized cross sectional area at necking. The tensile properties that can be achieved in the alloys herein along with formation of Refined High Strength Nanomodal Structure (Structure #5, FIG. 3B) include tensile strength values in the range from 400 to 1825 MPa and 1.0% to 59.2% total elongation. The level of tensile properties achieved is also dependent on the amount of transformation occurring as the strain increases corresponding to the characteristic stress strain curve for a Class 2 steel.

With regards to Mechanism #3) (FIG. 3B), new and/or additional precipitation phase or phases are observed that possesses identifiable grain sizes of 1 nm to 200 nm. In addition, there is the further identification in said precipitation phase of a dihexagonal pyramidal class hexagonal phase with a $P6_3mc$ space group (#186), a ditrigonal dipyramidal class with a hexagonal P6bar2C space group (#190), and/or a $M_3Si$ cubic phase with a Fm3m space group (#225). Accordingly, the dynamic transformation can occur partially or completely and results in the formation of a microstructure with novel nanoscale/near nanoscale phases providing relatively high strength in the material. That is, Structure #5 (FIG. 3B) may be understood as a microstructure having matrix grains sized generally from 10 nm to 2000 nm which are pinned by boride phases which are in the range of 20 nm to 10000 nm and with precipitate phases which are in the range of 1 nm to 200 nm. The volume fraction of the precipitation phase of 1 nm to 200 nm in size in Structure #5 increases during transformation through Mechanism #3. It should also be noted that in Structure #5, the level of gamma-iron is optional and may be eliminated depending on the specific alloy chemistry and austenite stability.

As shown by the arrows in FIG. 3B, the newly identified structure and mechanisms can be applied cyclically in a sequential manner. For example, once the High Strength Nanomodal Structure (Structure #3) is formed either partially or completely, it can be recrystallized through high temperature exposure to form the Recrystallized Modal Structure (Structure #4). This structure has the unique ability to be subsequently transformed by cold deformation by a range of processes including cold rolling, cold stamping, hydroforming, roll forming etc. into the Refined High Strength Nanomodal Structure (Structure #5). Once this cycle is complete, the cycle can then be repeated as many times as necessary (i.e. additional cycles including Structure #3 formation, recrystallizing into Structure #4, subsequently cold deformation through Nanophase Refinement and Strengthening (Mechanism #3) to produce Refined High Strength Nanomodal Structure (Structure #5). For example, it is contemplated that one may undergo 2 to 20 cycles.

There are many examples regarding the use of the cyclic nature of these transformations in industrial processing. For example, consider a sheet with the chemistries and operable mechanisms and enabling microstructures which is cast initially at 50 mm thick by the thin slab process and then hot rolled through several steps to produce a 3 mm sheet. However, the sheet targeted gauge thickness is ~1 mm for a particular application in an automobile. Thus, the as-hot rolled 3 mm thick sheet must then be cold rolled down to the targeted gauge. After 30% of reduction the 3 mm sheet is now ~2.1 mm thick and has formed the High Strength Nanomodal Structure (Structure #3 in FIGS. 3A and 3B). Further cold reduction would result in breakage of the sheet in this example as the ductility is too low.

The sheet is now heat treated (heating above 700° C. but below the Tm) and the Recrystallized Modal Structure (Structure #4) is formed. This sheet is then cold rolled another 30% of reduction to a gauge thickness of ~1.5 mm and the formation of the Refined High Strength Nanomodal Structure (Structure #5). Further cold reduction would again result in breakage of the sheet. A heat treatment is then applied to recrystallize the sheet resulting in a high ductility Recrystallized Modal Structure (Structure #4). The sheet is then cold rolled another 30% to yield a gauge thickness of ~1.0 mm thickness with a Refined High Strength Nanomodal Structure (Structure #5) obtained. After the gauge thickness target is reached, no further cold rolling reduction is necessary. Depending on the specific application, the sheet may or may not be heated again to be recrystallized. For example, for subsequent cold stamping of parts, it would be advantageous to recrystallize the sheet to form the high ductility Recrystallized Modal Structure (Structure #4). This resulting sheet may then be cold stamped by the end user and during the stamping process, would partially or completely transform into the Refined High Strength Nanomodal Structure (Structure #5).

Another example after forming the Recrystallized Modal Structure (Structure #4), in one or multiple steps, would be to expose this structure to cold deformation through cold rolling and after exceeding the yield strength to Nanophase Refinement and Strengthening (Mechanism #3). As a variant, however, the material could be only partially cold rolled and then not annealed (i.e. recrystallized). For example, a particular sheet material with the Recrystallized Modal Structure (Structure #4) which can be cold rolled up to 40% before breaking for example could instead be only cold rolled 10%, 20% or 30% and then not annealed. This would results in partial transformation through Nanophase Refinement and Strengthening (Mechanism #3) and would result in unique combinations of yield strength, ultimate tensile strength, and ductility which could be tailored for specific applications with different requirements. For example, high yield strength and high tensile strength is needed in a passenger compartment of an automobile to avoid impingement during a crash event while low yield strength and high tensile strength with high ductility might be quite attractive in use in the front or back end of the automobile in what is often termed the crash energy management zones.

It should now be appreciated that a specific feature herein is the ability of the steel alloys herein to undergo Nanophase Refinement & Strengthening (Mechanism #3) after forming the Recrystallized Modal Structure (Structure #4). An example of mechanical behavior of the steel alloys herein with Recrystallized Modal Structure (Structure #4) is schematically shown in FIG. 5. The mechanical behavior is similar to that for the steel alloys herein with Nanomodal Structure (Structure #2) shown in FIG. 4. When such alloys with Recrystallized Modal Structure exceed their yield point, plastic deformation at constant stress occurs followed by a dynamic phase transformation with simultaneous structural refinement leading to the formation of Refined High Strength Nanomodal Structure (Structure #5). More specifically, after enough strain is induced, an inflection point occurs where the slope of the stress versus strain curve changes and increases (FIG. 5) and the strength increases with strain indicating an activation of Nanophase Refinement & Strengthening (Mechanism #3). Table 3 below provides a summary on the structure and mechanisms in steel alloys herein.

TABLE 3

Structure and Performance of Steel Alloys

| Property/ Mechanism | Structure Type #4 Recrystallized Modal Structure | Structure Type #5 Refined High Strength Nanomodal Structure |
|---|---|---|
| Structure Formation | Recrystallization of High Strength Nanomodal Structure occurring during heat treatment | Stress above yield of Recrystallized Modal Structure |
| Transformations | Solid state phase transformation back to austenite and/or ferrite | Stress induced transformation involving phase formation and precipitation |
| Enabling Phases | Austenite and/or ferrite with boride pinning phases | Ferrite, optionally austenite, boride pinning phases, hexagonal and additional phase precipitation |
| Matrix Grain Size | Grain growth to 100 nm to 50,000 nm | Grain size refined at 10 nm to 2500 nm Additional precipitation formation |
| Boride Sizes | 20 nm to 10000 nm Borides (e.g. metal boride) | 20 nm to 10000 nm (Borides (e.g metal boride) |
| Precipitation Sizes | 1 nm to 200 nm | 1 nm to 200 nm |
| Tensile Response | Intermediate structure; transforms into Structure #5 when undergoing yield | Actual with properties achieved based on formation of Structure # 5 and fraction of transformation |
| Yield Strength | 200 MPa to 1650 MPa | 200 MPa to 1650 MPa |
| Tensile Strength | — | 400 MPa to 1825 MPa |
| Total Elongation | — | 1.0% to 59.2% |

TABLE 3-continued

| Structure and Performance of Steel Alloys | | |
|---|---|---|
| Property/ Mechanism | Structure Type #4 Recrystallized Modal Structure | Structure Type #5 Refined High Strength Nanomodal Structure |
| Strain Hardening Response | After yield point, may exhibit a strain softening at initial straining as a result of phase transformation, followed by a significant strain hardening effect leading to distinct maxima | Strain hardening coefficient may vary from 0.2 to 1.0 depending upon amount of deformation and transformation |

Preferred Alloy Chemistries and Sample Preparation

The chemical composition of the alloys studied is shown in Table 4 which provides the preferred atomic ratios utilized. Initial studies were done by sheet casting in a Pressure Vacuum Caster (PVC). Using high purity elements (>99 wt %), four 35 g alloy feedstock's of the targeted alloys were weighed out according to the atomic ratios provided in Table 4. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then placed in a PVC chamber, melted using RF induction and then ejected onto a copper die designed for casting 3 inch by 4 inch sheets with thickness of 3.3 mm.

TABLE 4

| Chemical Composition of the Alloys | | | | | | | | | |
|---|---|---|---|---|---|---|---|---|---|
| Alloy | Fe | Cr | Ni | Mn | B | Si | Cu | Ti | C |
| Alloy 1 | 72.98 | 3.66 | 6.16 | 5.25 | 5.24 | 6.71 | — | — | — |
| Alloy 2 | 77.23 | 3.66 | 3.52 | 3.63 | 5.23 | 6.73 | — | — | — |
| Alloy 3 | 76.89 | 1.83 | 4.84 | 4.48 | 5.24 | 6.72 | — | — | — |
| Alloy 4 | 79.42 | 1.47 | 2.64 | 4.51 | 5.23 | 6.73 | — | — | — |
| Alloy 5 | 77.99 | 2.93 | 2.64 | 4.48 | 5.23 | 6.73 | — | — | — |
| Alloy 6 | 77.93 | 2.34 | 2.63 | 4.47 | 5.21 | 7.42 | — | — | — |
| Alloy 7 | 77.06 | 2.34 | 3.51 | 4.46 | 5.21 | 7.42 | — | — | — |
| Alloy 8 | 77.13 | 2.18 | 3.50 | 4.44 | 5.80 | 6.95 | — | — | — |
| Alloy 9 | 76.88 | 1.09 | 4.82 | 4.45 | 5.81 | 6.95 | — | — | — |
| Alloy 10 | 74.27 | 2.18 | 8.29 | 2.76 | 4.70 | 7.80 | — | — | — |
| Alloy 11 | 69.52 | 1.79 | 5.28 | 11.28 | 4.78 | 7.35 | — | — | — |
| Alloy 12 | 67.59 | 1.78 | 3.51 | 15.01 | 4.77 | 7.34 | — | — | — |
| Alloy 13 | 65.64 | 1.78 | 1.75 | 18.74 | 4.76 | 7.33 | — | — | — |
| Alloy 14 | 69.85 | 3.37 | 5.27 | 9.39 | 4.77 | 7.35 | — | — | — |
| Alloy 15 | 67.88 | 3.37 | 3.51 | 13.13 | 4.77 | 7.34 | — | — | — |
| Alloy 16 | 65.95 | 3.36 | 1.75 | 16.85 | 4.76 | 7.33 | — | — | — |
| Alloy 17 | 70.15 | 4.96 | 5.27 | 7.51 | 4.77 | 7.34 | — | — | — |
| Alloy 18 | 68.21 | 4.95 | 3.51 | 11.24 | 4.76 | 7.33 | — | — | — |
| Alloy 19 | 66.27 | 4.94 | 1.75 | 14.97 | 4.75 | 7.32 | — | — | — |
| Alloy 20 | 70.46 | 6.54 | 5.27 | 5.63 | 4.76 | 7.34 | — | — | — |
| Alloy 21 | 68.50 | 6.54 | 3.51 | 9.36 | 4.76 | 7.33 | — | — | — |
| Alloy 22 | 66.58 | 6.52 | 1.75 | 13.09 | 4.75 | 7.31 | — | — | — |
| Alloy 23 | 70.78 | 8.12 | 5.26 | 3.75 | 4.76 | 7.33 | — | — | — |
| Alloy 24 | 68.85 | 8.10 | 3.50 | 7.48 | 4.75 | 7.32 | — | — | — |
| Alloy 25 | 66.89 | 8.09 | 1.75 | 11.21 | 4.75 | 7.31 | — | — | — |
| Alloy 26 | 65.86 | 6.93 | 4.82 | 10.30 | 4.76 | 7.33 | — | — | — |
| Alloy 27 | 64.41 | 6.92 | 3.50 | 13.10 | 4.75 | 7.32 | — | — | — |
| Alloy 28 | 62.96 | 6.91 | 2.19 | 15.88 | 4.75 | 7.31 | — | — | — |
| Alloy 29 | 68.70 | 5.94 | 4.83 | 8.44 | 4.76 | 7.33 | — | — | — |
| Alloy 30 | 67.22 | 5.94 | 3.51 | 11.24 | 4.76 | 7.33 | — | — | — |
| Alloy 31 | 65.78 | 5.93 | 2.19 | 14.03 | 4.75 | 7.32 | — | — | — |
| Alloy 32 | 66.77 | 7.91 | 4.82 | 8.42 | 4.76 | 7.32 | — | — | — |
| Alloy 33 | 65.31 | 7.90 | 3.50 | 11.22 | 4.75 | 7.32 | — | — | — |
| Alloy 34 | 63.85 | 7.89 | 2.19 | 14.01 | 4.75 | 7.31 | — | — | — |
| Alloy 35 | 71.53 | 4.96 | 4.83 | 6.57 | 4.77 | 7.34 | — | — | — |
| Alloy 36 | 70.08 | 4.95 | 3.51 | 9.37 | 4.76 | 7.33 | — | — | — |
| Alloy 37 | 68.61 | 4.95 | 2.19 | 12.17 | 4.76 | 7.32 | — | — | — |
| Alloy 38 | 69.60 | 6.93 | 4.82 | 6.56 | 4.76 | 7.33 | — | — | — |
| Alloy 39 | 68.14 | 6.92 | 3.50 | 9.36 | 4.76 | 7.32 | — | — | — |
| Alloy 40 | 66.69 | 6.91 | 2.19 | 12.15 | 4.75 | 7.31 | — | — | — |
| Alloy 41 | 67.65 | 8.90 | 4.82 | 6.55 | 4.76 | 7.32 | — | — | — |
| Alloy 42 | 66.20 | 8.89 | 3.50 | 9.35 | 4.75 | 7.31 | — | — | — |
| Alloy 43 | 64.76 | 8.88 | 2.18 | 12.14 | 4.74 | 7.30 | — | — | — |
| Alloy 44 | 72.42 | 5.95 | 4.83 | 4.69 | 4.77 | 7.34 | — | — | — |
| Alloy 45 | 70.97 | 5.94 | 3.51 | 7.49 | 4.76 | 7.33 | — | — | — |
| Alloy 46 | 69.51 | 5.93 | 2.19 | 10.29 | 4.76 | 7.32 | — | — | — |
| Alloy 47 | 73.33 | 6.93 | 4.83 | 2.81 | 4.76 | 7.34 | — | — | — |
| Alloy 48 | 71.85 | 6.93 | 3.51 | 5.62 | 4.76 | 7.33 | — | — | — |
| Alloy 49 | 70.40 | 6.92 | 2.19 | 8.42 | 4.75 | 7.32 | — | — | — |

TABLE 4-continued

| Chemical Composition of the Alloys | | | | | | | | | |
|---|---|---|---|---|---|---|---|---|---|
| Alloy | Fe | Cr | Ni | Mn | B | Si | Cu | Ti | C |
| Alloy 50 | 59.35 | 18.87 | 5.06 | 4.61 | 5.51 | 6.60 | — | — | — |
| Alloy 51 | 57.45 | 18.84 | 3.32 | 8.30 | 5.50 | 6.59 | — | — | — |
| Alloy 52 | 55.56 | 18.81 | 1.58 | 11.98 | 5.49 | 6.58 | — | — | — |
| Alloy 53 | 60.70 | 12.70 | 4.94 | 4.50 | 5.39 | 11.77 | — | — | — |
| Alloy 54 | 58.84 | 12.68 | 3.24 | 8.11 | 5.38 | 11.75 | — | — | — |
| Alloy 55 | 56.98 | 12.66 | 1.55 | 11.71 | 5.37 | 11.73 | — | — | — |
| Alloy 56 | 65.10 | 13.05 | 5.08 | 4.62 | 5.53 | 6.62 | — | — | — |
| Alloy 57 | 63.18 | 13.03 | 3.33 | 8.33 | 5.52 | 6.61 | — | — | — |
| Alloy 58 | 61.24 | 13.01 | 1.59 | 12.03 | 5.52 | 6.61 | — | — | — |
| Alloy 59 | 67.21 | 4.95 | 3.51 | 11.24 | 5.76 | 7.33 | — | — | — |
| Alloy 60 | 69.21 | 4.95 | 3.51 | 11.24 | 3.76 | 7.33 | — | — | — |
| Alloy 61 | 69.21 | 4.95 | 3.51 | 11.24 | 4.76 | 6.33 | — | — | — |
| Alloy 62 | 70.21 | 4.95 | 3.51 | 11.24 | 3.76 | 6.33 | — | — | — |
| Alloy 63 | 69.66 | 3.50 | 3.51 | 11.24 | 4.76 | 7.33 | — | — | — |
| Alloy 64 | 66.21 | 4.95 | 3.51 | 11.24 | 4.76 | 7.33 | 2.00 | — | — |
| Alloy 65 | 66.71 | 4.95 | 3.51 | 11.24 | 4.76 | 7.33 | — | — | 1.50 |
| Alloy 66 | 66.65 | 8.90 | 4.82 | 6.55 | 5.76 | 7.32 | — | — | — |
| Alloy 67 | 68.65 | 8.90 | 4.82 | 6.55 | 3.76 | 7.32 | — | — | — |
| Alloy 68 | 68.65 | 8.90 | 4.82 | 6.55 | 4.76 | 6.32 | — | — | — |
| Alloy 69 | 69.65 | 8.90 | 4.82 | 6.55 | 3.76 | 6.32 | — | — | — |
| Alloy 70 | 71.60 | 4.95 | 4.82 | 6.55 | 4.76 | 7.32 | — | — | — |
| Alloy 71 | 73.05 | 3.50 | 4.82 | 6.55 | 4.76 | 7.32 | — | — | — |
| Alloy 72 | 65.65 | 8.90 | 4.82 | 6.55 | 4.76 | 7.32 | 2.00 | — | — |
| Alloy 73 | 66.15 | 8.90 | 4.82 | 6.55 | 4.76 | 7.32 | — | — | 1.50 |
| Alloy 74 | 67.73 | 4.95 | 3.51 | 9.72 | 4.76 | 7.33 | 2.00 | — | — |
| Alloy 75 | 65.21 | 4.95 | 3.51 | 11.24 | 4.76 | 7.33 | 3.00 | — | — |
| Alloy 76 | 67.49 | 4.95 | 3.51 | 8.96 | 4.76 | 7.33 | 3.00 | — | — |
| Alloy 77 | 70.32 | 4.95 | 4.10 | 6.55 | 4.76 | 7.32 | 2.00 | — | — |
| Alloy 78 | 68.60 | 4.95 | 4.82 | 6.55 | 4.76 | 7.32 | 3.00 | — | — |
| Alloy 79 | 69.68 | 4.95 | 3.74 | 6.55 | 4.76 | 7.32 | 3.00 | — | — |
| Alloy 80 | 68.73 | 4.95 | 3.51 | 9.72 | 3.76 | 7.33 | 2.00 | — | — |
| Alloy 81 | 66.21 | 4.95 | 3.51 | 11.24 | 3.76 | 7.33 | 3.00 | — | — |
| Alloy 82 | 68.49 | 4.95 | 3.51 | 8.96 | 3.76 | 7.33 | 3.00 | — | — |
| Alloy 83 | 71.32 | 4.95 | 4.10 | 6.55 | 3.76 | 7.32 | 2.00 | — | — |
| Alloy 84 | 69.60 | 4.95 | 4.82 | 6.55 | 3.76 | 7.32 | 3.00 | — | — |
| Alloy 85 | 70.68 | 4.95 | 3.74 | 6.55 | 3.76 | 7.32 | 3.00 | — | — |
| Alloy 86 | 67.21 | 4.95 | 3.51 | 11.24 | 3.76 | 7.33 | 2.00 | — | — |
| Alloy 87 | 71.32 | 4.95 | 4.10 | 6.55 | 3.76 | 7.32 | 2.00 | — | — |
| Alloy 88 | 69.60 | 4.95 | 4.82 | 6.55 | 3.76 | 7.32 | 3.00 | — | — |
| Alloy 89 | 70.68 | 4.95 | 3.74 | 6.55 | 3.76 | 7.32 | 3.00 | — | — |
| Alloy 90 | 71.82 | 4.95 | 4.10 | 6.55 | 3.26 | 7.32 | 2.00 | — | — |
| Alloy 91 | 70.10 | 4.95 | 4.82 | 6.55 | 3.26 | 7.32 | 3.00 | — | — |
| Alloy 92 | 71.18 | 4.95 | 3.74 | 6.55 | 3.26 | 7.32 | 3.00 | — | — |
| Alloy 93 | 72.32 | 4.95 | 4.10 | 6.55 | 2.76 | 7.32 | 2.00 | — | — |
| Alloy 94 | 70.60 | 4.95 | 4.82 | 6.55 | 2.76 | 7.32 | 3.00 | — | — |
| Alloy 95 | 71.68 | 4.95 | 3.74 | 6.55 | 2.76 | 7.32 | 3.00 | — | — |
| Alloy 96 | 72.82 | 3.45 | 4.10 | 6.55 | 3.76 | 7.32 | 2.00 | — | — |
| Alloy 97 | 71.10 | 3.45 | 4.82 | 6.55 | 3.76 | 7.32 | 3.00 | — | — |
| Alloy 98 | 72.18 | 3.45 | 3.74 | 6.55 | 3.76 | 7.32 | 3.00 | — | — |
| Alloy 99 | 70.32 | 4.95 | 4.10 | 6.55 | 3.76 | 7.32 | 3.00 | — | — |
| Alloy 100 | 71.82 | 4.95 | 4.10 | 6.55 | 3.76 | 7.32 | 1.50 | — | — |
| Alloy 101 | 71.10 | 4.95 | 4.82 | 6.55 | 3.76 | 7.32 | 1.50 | — | — |
| Alloy 102 | 72.18 | 4.95 | 3.74 | 6.55 | 3.76 | 7.32 | 1.50 | — | — |
| Alloy 103 | 71.82 | 4.95 | 4.10 | 6.05 | 3.76 | 7.32 | 2.00 | — | — |
| Alloy 104 | 72.32 | 4.95 | 4.10 | 5.55 | 3.76 | 7.32 | 2.00 | — | — |
| Alloy 105 | 71.62 | 4.95 | 4.10 | 6.55 | 3.76 | 7.02 | 2.00 | — | — |
| Alloy 106 | 71.92 | 4.95 | 4.10 | 6.55 | 3.76 | 6.72 | 2.00 | — | — |
| Alloy 107 | 72.12 | 4.95 | 4.10 | 6.05 | 3.76 | 7.02 | 2.00 | — | — |
| Alloy 108 | 69.62 | 4.95 | 2.10 | 10.55 | 3.76 | 7.02 | 2.00 | — | — |
| Alloy 109 | 70.62 | 4.95 | 2.10 | 9.55 | 3.76 | 7.02 | 2.00 | — | — |
| Alloy 110 | 71.62 | 4.95 | 2.10 | 8.55 | 3.76 | 7.02 | 2.00 | — | — |
| Alloy 111 | 72.62 | 4.95 | 2.10 | 7.55 | 3.76 | 7.02 | 2.00 | — | — |
| Alloy 112 | 69.62 | 4.95 | 2.10 | 6.55 | 3.76 | 7.02 | 6.00 | — | — |
| Alloy 113 | 70.62 | 4.95 | 2.10 | 6.55 | 3.76 | 7.02 | 5.00 | — | — |
| Alloy 114 | 71.62 | 4.95 | 2.10 | 6.55 | 3.76 | 7.02 | 4.00 | — | — |
| Alloy 115 | 72.62 | 4.95 | 2.10 | 6.55 | 3.76 | 7.02 | 3.00 | — | — |
| Alloy 116 | 69.62 | 6.95 | 2.10 | 8.55 | 3.76 | 7.02 | 2.00 | — | — |
| Alloy 117 | 73.62 | 2.95 | 2.10 | 8.55 | 3.76 | 7.02 | 2.00 | — | — |
| Alloy 118 | 71.12 | 4.95 | 2.60 | 8.55 | 3.76 | 7.02 | 2.00 | — | — |
| Alloy 119 | 72.12 | 4.95 | 1.60 | 8.55 | 3.76 | 7.02 | 2.00 | — | — |
| Alloy 120 | 71.12 | 4.95 | 2.10 | 8.55 | 4.26 | 7.02 | 2.00 | — | — |
| Alloy 121 | 72.12 | 4.95 | 2.10 | 8.55 | 3.26 | 7.02 | 2.00 | — | — |
| Alloy 122 | 70.92 | 4.95 | 2.10 | 8.55 | 3.76 | 7.72 | 2.00 | — | — |
| Alloy 123 | 72.32 | 4.95 | 2.10 | 8.55 | 3.76 | 6.32 | 2.00 | — | — |
| Alloy 124 | 71.12 | 4.95 | 2.10 | 8.55 | 3.76 | 7.02 | 2.50 | — | — |
| Alloy 125 | 72.12 | 4.95 | 2.10 | 8.55 | 3.76 | 7.02 | 1.50 | — | — |

TABLE 4-continued

| Chemical Composition of the Alloys | | | | | | | | | |
|---|---|---|---|---|---|---|---|---|---|
| Alloy | Fe | Cr | Ni | Mn | B | Si | Cu | Ti | C |
| Alloy 126 | 70.12 | 4.95 | 1.60 | 10.55 | 3.76 | 7.02 | 2.00 | — | — |
| Alloy 127 | 70.62 | 4.95 | 1.10 | 10.55 | 3.76 | 7.02 | 2.00 | — | — |
| Alloy 128 | 66.62 | 7.95 | 2.10 | 10.55 | 3.76 | 7.02 | 2.00 | — | — |
| Alloy 129 | 68.12 | 6.45 | 2.10 | 10.55 | 3.76 | 7.02 | 2.00 | — | — |
| Alloy 130 | 68.22 | 4.95 | 2.10 | 10.55 | 3.76 | 8.42 | 2.00 | — | — |
| Alloy 131 | 68.92 | 4.95 | 2.10 | 10.55 | 3.76 | 7.72 | 2.00 | — | — |
| Alloy 132 | 68.62 | 4.95 | 2.10 | 10.55 | 3.76 | 7.02 | 3.00 | — | — |
| Alloy 133 | 70.62 | 4.95 | 2.10 | 10.55 | 3.76 | 7.02 | 1.00 | — | — |
| Alloy 134 | 69.12 | 4.95 | 1.60 | 10.55 | 3.76 | 7.02 | 3.00 | — | — |
| Alloy 135 | 69.62 | 4.95 | 1.10 | 10.55 | 3.76 | 7.02 | 3.00 | — | — |
| Alloy 136 | 65.62 | 7.95 | 2.10 | 10.55 | 4.76 | 7.02 | 2.00 | — | — |
| Alloy 137 | 66.62 | 6.95 | 2.10 | 10.55 | 4.76 | 7.02 | 2.00 | — | — |
| Alloy 138 | 67.62 | 5.95 | 2.10 | 10.55 | 4.76 | 7.02 | 2.00 | — | — |
| Alloy 139 | 65.42 | 7.95 | 2.10 | 10.55 | 4.26 | 7.72 | 2.00 | — | — |
| Alloy 140 | 66.42 | 6.95 | 2.10 | 10.55 | 4.26 | 7.72 | 2.00 | — | — |
| Alloy 141 | 67.42 | 5.95 | 2.10 | 10.55 | 4.26 | 7.72 | 2.00 | — | — |
| Alloy 142 | 68.97 | 7.95 | 1.25 | 10.55 | 4.76 | 5.52 | 1.00 | — | — |
| Alloy 143 | 69.47 | 6.95 | 1.25 | 10.55 | 4.76 | 6.02 | 1.00 | — | — |
| Alloy 144 | 69.97 | 5.95 | 1.25 | 10.55 | 4.76 | 6.52 | 1.00 | — | — |
| Alloy 145 | 71.67 | 3.55 | 1.25 | 10.55 | 4.26 | 7.72 | 1.00 | — | — |
| Alloy 146 | 72.17 | 3.05 | 1.25 | 10.55 | 4.26 | 7.72 | 1.00 | — | — |
| Alloy 147 | 72.37 | 3.55 | 1.25 | 10.55 | 4.26 | 7.02 | 1.00 | — | — |
| Alloy 148 | 69.22 | 4.95 | 1.75 | 10.55 | 3.76 | 7.77 | 2.00 | — | — |
| Alloy 149 | 69.27 | 4.95 | 2.10 | 10.55 | 3.76 | 7.77 | 1.60 | — | — |
| Alloy 150 | 68.02 | 4.95 | 2.10 | 10.55 | 4.61 | 7.77 | 2.00 | — | — |
| Alloy 151 | 68.29 | 5.53 | 2.10 | 10.55 | 3.76 | 7.77 | 2.00 | — | — |
| Alloy 152 | 68.43 | 4.95 | 2.10 | 10.99 | 3.76 | 7.77 | 2.00 | — | — |
| Alloy 153 | 69.31 | 4.95 | 2.10 | 10.11 | 3.76 | 7.77 | 2.00 | — | — |
| Alloy 154 | 68.52 | 4.95 | 2.45 | 10.55 | 3.76 | 7.77 | 2.00 | — | — |
| Alloy 155 | 68.17 | 4.95 | 2.80 | 10.55 | 3.76 | 7.77 | 2.00 | — | — |
| Alloy 156 | 68.37 | 4.95 | 2.10 | 10.55 | 3.76 | 7.77 | 2.50 | — | — |
| Alloy 157 | 72.20 | 4.37 | 2.10 | 8.55 | 3.76 | 7.02 | 2.00 | — | — |
| Alloy 158 | 71.27 | 4.95 | 2.45 | 8.55 | 3.76 | 7.02 | 2.00 | — | — |
| Alloy 159 | 72.06 | 4.95 | 2.10 | 8.11 | 3.76 | 7.02 | 2.00 | — | — |
| Alloy 160 | 70.77 | 4.95 | 2.10 | 8.55 | 4.61 | 7.02 | 2.00 | — | — |
| Alloy 161 | 70.97 | 4.95 | 2.10 | 8.55 | 3.76 | 7.67 | 2.00 | — | — |
| Alloy 162 | 70.62 | 4.95 | 2.10 | 8.55 | 3.76 | 7.02 | 3.00 | — | — |
| Alloy 163 | 70.69 | 4.66 | 2.28 | 8.33 | 4.19 | 7.35 | 2.50 | — | — |
| Alloy 164 | 70.19 | 5.53 | 2.10 | 8.55 | 4.61 | 7.02 | 2.00 | — | — |
| Alloy 165 | 71.12 | 4.95 | 1.75 | 8.55 | 4.61 | 7.02 | 2.00 | — | — |
| Alloy 166 | 70.42 | 4.95 | 2.45 | 8.55 | 4.61 | 7.02 | 2.00 | — | — |
| Alloy 167 | 71.65 | 4.95 | 2.10 | 7.67 | 4.61 | 7.02 | 2.00 | — | — |
| Alloy 168 | 69.92 | 4.95 | 2.10 | 8.55 | 5.46 | 7.02 | 2.00 | — | — |
| Alloy 169 | 70.12 | 4.95 | 2.10 | 8.55 | 4.61 | 7.67 | 2.00 | — | — |
| Alloy 170 | 70.27 | 4.95 | 2.10 | 8.55 | 4.61 | 7.02 | 2.50 | — | — |
| Alloy 171 | 69.91 | 5.24 | 2.10 | 8.11 | 5.04 | 7.35 | 2.25 | — | — |
| Alloy 172 | 68.40 | 4.95 | 2.10 | 8.55 | 6.98 | 7.02 | 2.00 | — | — |
| Alloy 173 | 69.29 | 4.95 | 2.10 | 8.55 | 6.09 | 7.02 | 2.00 | — | — |
| Alloy 174 | 70.20 | 4.95 | 2.10 | 8.55 | 5.18 | 7.02 | 2.00 | — | — |
| Alloy 175 | 70.79 | 4.95 | 2.10 | 8.55 | 6.09 | 5.52 | 2.00 | — | — |
| Alloy 176 | 72.29 | 4.95 | 2.10 | 8.55 | 6.09 | 4.02 | 2.00 | — | — |
| Alloy 177 | 73.79 | 4.95 | 2.10 | 8.55 | 6.09 | 2.52 | 2.00 | — | — |
| Alloy 178 | 68.29 | 5.95 | 2.10 | 8.55 | 6.09 | 7.02 | 2.00 | — | — |
| Alloy 179 | 70.29 | 3.95 | 2.10 | 8.55 | 6.09 | 7.02 | 2.00 | — | — |
| Alloy 180 | 70.30 | 4.95 | 2.10 | 8.55 | 5.50 | 6.60 | 2.00 | — | — |
| Alloy 181 | 71.29 | 4.95 | 2.10 | 6.55 | 6.09 | 7.02 | 2.00 | — | — |
| Alloy 182 | 67.29 | 4.95 | 2.10 | 10.55 | 6.09 | 7.02 | 2.00 | — | — |
| Alloy 183 | 70.29 | 4.95 | 2.10 | 8.55 | 6.09 | 7.02 | 1.00 | — | — |
| Alloy 184 | 71.29 | 4.95 | 2.10 | 8.55 | 6.09 | 7.02 | 0.00 | — | — |
| Alloy 185 | 68.54 | 4.95 | 2.10 | 8.55 | 6.09 | 7.02 | 2.00 | 0.75 | — |
| Alloy 186 | 68.29 | 4.95 | 2.10 | 8.55 | 6.09 | 7.02 | 2.00 | 1.00 | — |
| Alloy 187 | 68.79 | 4.95 | 2.10 | 9.30 | 6.09 | 7.02 | 1.00 | 0.75 | — |
| Alloy 188 | 72.79 | 4.95 | 2.10 | 8.55 | 6.09 | 4.02 | 1.50 | — | — |
| Alloy 189 | 71.79 | 5.95 | 2.10 | 8.55 | 6.09 | 4.02 | 1.50 | — | — |
| Alloy 190 | 72.42 | 4.95 | 2.10 | 8.92 | 6.09 | 4.02 | 1.50 | — | — |
| Alloy 191 | 71.42 | 5.95 | 2.10 | 8.92 | 6.09 | 4.02 | 1.50 | — | — |
| Alloy 192 | 73.17 | 6.13 | 2.28 | 9.77 | 4.52 | 4.13 | | — | — |
| Alloy 193 | 70.42 | 6.95 | 2.10 | 8.92 | 6.09 | 4.02 | 1.50 | — | — |
| Alloy 194 | 70.80 | 4.95 | 2.10 | 8.55 | 5.50 | 6.60 | 1.50 | — | — |
| Alloy 195 | 69.80 | 5.95 | 2.10 | 8.55 | 5.50 | 6.60 | 1.50 | — | — |
| Alloy 196 | 70.43 | 4.95 | 2.10 | 8.92 | 5.50 | 6.60 | 1.50 | — | — |
| Alloy 197 | 69.43 | 5.95 | 2.10 | 8.92 | 5.50 | 6.60 | 1.50 | — | — |
| Alloy 198 | 68.43 | 6.95 | 2.10 | 8.92 | 5.50 | 6.60 | 1.50 | — | — |
| Alloy 199 | 71.79 | 4.95 | 2.10 | 6.55 | 6.09 | 7.02 | 1.50 | — | — |
| Alloy 200 | 72.29 | 4.95 | 2.10 | 5.55 | 6.09 | 7.02 | 2.00 | — | — |
| Alloy 201 | 73.29 | 4.95 | 2.10 | 4.55 | 6.09 | 7.02 | 2.00 | — | — |

TABLE 4-continued

| Chemical Composition of the Alloys | | | | | | | | | |
|---|---|---|---|---|---|---|---|---|---|
| Alloy | Fe | Cr | Ni | Mn | B | Si | Cu | Ti | C |
| Alloy 202 | 71.48 | 5.45 | 2.10 | 8.92 | 6.53 | 4.02 | 1.50 | — | — |
| Alloy 203 | 71.03 | 5.45 | 2.10 | 8.92 | 6.98 | 4.02 | 1.50 | — | — |
| Alloy 204 | 72.18 | 5.45 | 2.10 | 8.92 | 6.53 | 3.32 | 1.50 | — | — |
| Alloy 205 | 71.73 | 5.45 | 2.10 | 8.92 | 6.98 | 3.32 | 1.50 | — | — |
| Alloy 206 | 70.98 | 5.45 | 2.10 | 9.42 | 6.53 | 4.02 | 1.50 | — | — |
| Alloy 207 | 70.53 | 5.45 | 2.10 | 9.42 | 6.98 | 4.02 | 1.50 | — | — |
| Alloy 208 | 71.68 | 5.45 | 2.10 | 9.42 | 6.53 | 3.32 | 1.50 | — | — |
| Alloy 209 | 71.23 | 5.45 | 2.10 | 9.42 | 6.98 | 3.32 | 1.50 | — | — |
| Alloy 210 | 72.45 | 5.45 | 2.10 | 8.92 | 6.76 | 2.82 | 1.50 | — | — |
| Alloy 211 | 72.95 | 5.45 | 2.10 | 8.92 | 6.76 | 2.32 | 1.50 | — | — |
| Alloy 212 | 72.07 | 5.45 | 2.10 | 9.30 | 6.76 | 3.32 | 1.00 | — | — |
| Alloy 213 | 72.57 | 5.45 | 2.10 | 9.30 | 6.76 | 2.82 | 1.00 | — | — |
| Alloy 214 | 73.07 | 5.45 | 2.10 | 9.30 | 6.76 | 2.32 | 1.00 | — | — |
| Alloy 215 | 71.58 | 5.45 | 2.10 | 9.79 | 6.76 | 3.32 | 1.00 | — | — |
| Alloy 216 | 72.08 | 5.45 | 2.10 | 9.79 | 6.76 | 2.82 | 1.00 | — | — |
| Alloy 217 | 72.58 | 5.45 | 2.10 | 9.79 | 6.76 | 2.32 | 1.00 | — | — |
| Alloy 218 | 71.08 | 5.45 | 2.10 | 10.29 | 6.76 | 3.32 | 1.00 | — | — |
| Alloy 219 | 71.58 | 5.45 | 2.10 | 10.29 | 6.76 | 2.82 | 1.00 | — | — |
| Alloy 220 | 72.08 | 5.45 | 2.10 | 10.29 | 6.76 | 2.32 | 1.00 | — | — |
| Alloy 221 | 73.33 | 5.45 | 2.10 | 9.30 | 5.50 | 3.32 | 1.00 | — | — |
| Alloy 222 | 73.83 | 5.45 | 2.10 | 9.30 | 5.50 | 2.82 | 1.00 | — | — |
| Alloy 223 | 74.33 | 5.45 | 2.10 | 9.30 | 5.50 | 2.32 | 1.00 | — | — |
| Alloy 224 | 72.57 | 5.45 | 2.10 | 8.80 | 6.76 | 3.32 | 1.00 | — | — |
| Alloy 225 | 73.07 | 5.45 | 2.10 | 8.80 | 6.76 | 2.82 | 1.00 | — | — |
| Alloy 226 | 73.57 | 5.45 | 2.10 | 8.80 | 6.76 | 2.32 | 1.00 | — | — |
| Alloy 227 | 73.07 | 5.45 | 2.10 | 8.30 | 6.76 | 3.32 | 1.00 | — | — |
| Alloy 228 | 73.57 | 5.45 | 2.10 | 8.30 | 6.76 | 2.82 | 1.00 | — | — |
| Alloy 229 | 74.07 | 5.45 | 2.10 | 8.30 | 6.76 | 2.32 | 1.00 | — | — |
| Alloy 230 | 71.03 | 5.45 | — | 12.44 | 6.76 | 3.32 | 1.00 | — | — |
| Alloy 231 | 71.53 | 5.45 | — | 12.44 | 6.76 | 2.82 | 1.00 | — | — |
| Alloy 232 | 72.03 | 5.45 | — | 12.44 | 6.76 | 2.32 | 1.00 | — | — |
| Alloy 233 | 65.07 | 12.45 | 2.10 | 9.30 | 6.76 | 3.32 | 1.00 | — | — |
| Alloy 234 | 65.57 | 12.45 | 2.10 | 9.30 | 6.76 | 2.82 | 1.00 | — | — |
| Alloy 235 | 66.07 | 12.45 | 2.10 | 9.30 | 6.76 | 2.32 | 1.00 | — | — |
| Alloy 236 | 65.29 | 12.45 | — | 12.44 | 5.50 | 3.32 | 1.00 | — | — |
| Alloy 237 | 65.79 | 12.45 | — | 12.44 | 5.50 | 2.82 | 1.00 | — | — |
| Alloy 238 | 66.29 | 12.45 | — | 12.44 | 5.50 | 2.32 | 1.00 | — | — |
| Alloy 239 | 55.82 | 18.90 | — | 13.18 | 5.50 | 6.60 | — | — | — |
| Alloy 240 | 57.95 | 18.90 | — | 11.05 | 5.50 | 6.60 | — | — | — |
| Alloy 241 | 69.83 | 4.89 | — | 13.18 | 5.50 | 6.60 | — | — | — |
| Alloy 242 | 71.96 | 4.89 | — | 11.05 | 5.50 | 6.60 | — | — | — |
| Alloy 243 | 63.55 | 14.45 | — | 13.18 | 5.50 | 3.32 | — | — | — |
| Alloy 244 | 66.55 | 11.45 | — | 13.18 | 5.50 | 3.32 | — | — | — |
| Alloy 245 | 69.55 | 8.45 | — | 13.18 | 5.50 | 3.32 | — | — | — |
| Alloy 246 | 72.55 | 5.45 | — | 13.18 | 5.50 | 3.32 | — | — | — |
| Alloy 247 | 68.05 | 9.95 | — | 13.18 | 5.50 | 3.32 | — | — | — |
| Alloy 248 | 68.71 | 9.95 | 2.10 | 8.92 | 5.50 | 3.32 | 1.50 | — | — |
| Alloy 249 | 70.21 | 8.45 | 2.10 | 8.92 | 5.50 | 3.32 | 1.50 | — | — |
| Alloy 250 | 69.55 | 9.95 | — | 13.18 | 4.00 | 3.32 | — | — | — |
| Alloy 251 | 71.05 | 8.45 | — | 13.18 | 4.00 | 3.32 | — | — | — |
| Alloy 252 | 70.21 | 9.95 | 2.10 | 8.92 | 4.00 | 3.32 | 1.50 | — | — |
| Alloy 253 | 71.71 | 8.45 | 2.10 | 8.92 | 4.00 | 3.32 | 1.50 | — | — |
| Alloy 254 | 68.85 | 9.95 | — | 13.18 | 4.00 | 4.02 | — | — | — |
| Alloy 255 | 70.35 | 8.45 | — | 13.18 | 4.00 | 4.02 | — | — | — |
| Alloy 256 | 69.51 | 9.95 | 2.10 | 8.92 | 4.00 | 4.02 | 1.50 | — | — |
| Alloy 257 | 71.01 | 8.45 | 2.10 | 8.92 | 4.00 | 4.02 | 1.50 | — | — |
| Alloy 258 | 68.52 | 9.95 | 2.10 | 9.91 | 4.00 | 4.02 | 1.50 | — | — |
| Alloy 259 | 70.02 | 8.45 | 2.10 | 9.91 | 4.00 | 4.02 | 1.50 | — | — |
| Alloy 260 | 67.36 | 10.70 | 1.25 | 10.56 | 5.00 | 4.13 | 1.00 | — | — |
| Alloy 261 | 66.74 | 10.70 | — | 12.43 | 5.00 | 4.13 | 1.00 | — | — |
| Alloy 262 | 74.50 | 10.70 | 1.25 | 2.17 | 5.00 | 4.13 | 1.00 | — | 1.25 |
| Alloy 263 | 72.64 | 10.70 | 1.25 | 4.03 | 5.00 | 4.13 | 1.00 | — | 1.25 |
| Alloy 264 | 70.77 | 10.70 | 1.25 | 5.90 | 5.00 | 4.13 | 1.00 | — | 1.25 |
| Alloy 265 | 68.90 | 10.70 | 1.25 | 7.77 | 5.00 | 4.13 | 1.00 | — | 1.25 |
| Alloy 266 | 67.04 | 10.70 | 1.25 | 9.63 | 5.00 | 4.13 | 1.00 | — | 1.25 |
| Alloy 267 | 72.29 | 5.45 | 1.25 | 9.63 | 5.00 | 4.13 | 1.00 | — | 1.25 |
| Alloy 268 | 67.86 | 10.70 | 1.25 | 10.06 | 5.00 | 4.13 | 1.00 | — | — |
| Alloy 269 | 68.37 | 10.70 | 1.25 | 9.55 | 5.00 | 4.13 | 1.00 | — | — |
| Alloy 270 | 68.86 | 10.70 | 1.25 | 9.06 | 5.00 | 4.13 | 1.00 | — | — |
| Alloy 271 | 66.46 | 10.70 | 1.25 | 10.06 | 5.00 | 5.53 | 1.00 | — | — |
| Alloy 272 | 66.97 | 10.70 | 1.25 | 9.55 | 5.00 | 5.53 | 1.00 | — | — |
| Alloy 273 | 67.46 | 10.70 | 1.25 | 9.06 | 5.00 | 5.53 | 1.00 | — | — |
| Alloy 274 | 66.86 | 10.70 | 1.25 | 11.06 | 5.00 | 4.13 | 1.00 | — | — |
| Alloy 275 | 65.96 | 10.70 | 1.25 | 10.56 | 5.00 | 5.53 | 1.00 | — | — |
| Alloy 276 | 65.46 | 10.70 | 1.25 | 11.06 | 5.00 | 5.53 | 1.00 | — | — |
| Alloy 277 | 64.01 | 10.95 | 0.75 | 10.56 | 4.76 | 7.72 | 1.25 | — | — |

TABLE 4-continued

Chemical Composition of the Alloys

| Alloy | Fe | Cr | Ni | Mn | B | Si | Cu | Ti | C |
|---|---|---|---|---|---|---|---|---|---|
| Alloy 278 | 64.51 | 10.95 | 0.75 | 10.06 | 4.76 | 7.72 | 1.25 | — | — |
| Alloy 279 | 65.02 | 10.95 | 0.75 | 9.55 | 4.76 | 7.72 | 1.25 | — | — |
| Alloy 280 | 67.24 | 10.70 | 0.50 | 12.43 | 5.00 | 4.13 | — | — | — |
| Alloy 281 | 68.17 | 10.70 | 0.50 | 11.50 | 5.00 | 4.13 | — | — | — |
| Alloy 282 | 66.77 | 10.70 | 0.50 | 11.50 | 5.00 | 5.53 | — | — | — |
| Alloy 283 | 66.37 | 10.70 | 0.50 | 11.50 | 5.40 | 5.53 | — | — | — |
| Alloy 284 | 67.90 | 10.80 | 0.80 | 10.12 | 5.00 | 4.13 | 1.25 | — | — |
| Alloy 285 | 68.50 | 10.80 | 0.80 | 9.52 | 5.00 | 4.13 | 1.25 | — | — |
| Alloy 286 | 68.63 | 10.80 | 0.80 | 9.89 | 5.00 | 4.13 | 0.75 | — | — |
| Alloy 287 | 67.40 | 11.30 | 0.80 | 10.12 | 5.00 | 4.13 | 1.25 | — | — |
| Alloy 288 | 68.40 | 10.30 | 0.80 | 10.12 | 5.00 | 4.13 | 1.25 | — | — |
| Alloy 289 | 67.40 | 10.80 | 0.80 | 10.12 | 5.00 | 4.13 | 1.25 | — | 0.50 |
| Alloy 290 | 66.90 | 10.80 | 0.80 | 10.12 | 5.00 | 4.13 | 1.25 | — | 1.00 |
| Alloy 291 | 78.07 | — | — | 12.80 | 5.00 | 4.13 | — | — | — |
| Alloy 292 | 69.36 | 10.70 | 1.25 | 10.56 | 3.00 | 4.13 | 1.00 | — | — |
| Alloy 293 | 74.69 | 3.00 | — | 13.18 | 3.00 | 6.13 | — | — | — |
| Alloy 294 | 78.07 | — | — | 12.80 | 3.00 | 6.13 | — | — | — |
| Alloy 295 | 74.99 | 2.13 | 4.38 | 11.84 | 1.94 | 2.13 | 1.55 | — | 1.04 |
| Alloy 296 | 67.63 | 6.22 | 8.55 | 6.49 | 2.52 | 4.13 | 0.90 | | 3.56 |
| Alloy 297 | 66.00 | 11.30 | 0.77 | 9.30 | 7.88 | 1.20 | 3.55 | — | |
| Alloy 298 | 87.05 | — | 4.58 | 1.74 | 3.05 | 3.07 | 0.25 | — | 0.26 |
| Alloy 299 | 80.69 | 3.00 | — | 11.18 | 2.00 | 2.13 | — | — | 1.00 |
| Alloy 300 | 77.39 | 2.13 | 2.38 | 11.84 | 1.54 | 2.13 | 1.55 | — | 1.04 |
| Alloy 301 | 70.47 | 10.70 | 7.58 | 1.12 | 5.00 | 4.13 | 1.00 | — | — |
| Alloy 302 | 75.88 | 1.06 | 1.09 | 13.77 | 5.23 | 0.65 | 0.36 | — | 1.96 |
| Alloy 303 | 80.19 | — | 0.95 | 13.28 | 2.25 | 0.88 | 1.66 | — | 0.79 |
| Alloy 304 | 67.67 | 6.22 | 1.15 | 11.52 | 0.65 | 8.55 | 1.09 | — | 3.15 |

From the above it can be seen that the alloys herein that are susceptible to the transformations illustrated in FIGS. 3A and 3B fall into the following groupings: (1) Fe/Cr/Ni/Mn/B/Si (alloys 1 to 63, 66 to 71, 184, 192, 280 to 283); (2) Fe/Cr/Ni/Mn/B/Si/Cu (alloys 64, 72, 74 to 183, 188 to 191, 193 to 229, 233 to 235, 248, 249, 252, 253, 256 to 260, 268 to 279, 284 to 288, 292 to 297, 301); (3) Fe/Cr/Ni/Mn/B/Si/C (alloys 65, 73); (4) Fe/Cr/Ni/Mn/B/Si/Cu/Ti (alloys 185 to 187); (5) Fe/Cr/Mn/B/Si/Cu (alloys 230 to 232, 236 to 238, 261); (6) Fe/Cr/Mn/B/Si (alloys 239 to 247, 250, 251, 254, 255, 293); (7) Fe/Cr/Ni/Mn/B/Si/Cu/C (alloys 262 to 267, 289 to 290, 295, 296, 300, 302, 304); (8) Fe/Mn/B/Si (alloys 291, 294); (9) Fe/Ni/Mn/B/Si/Cu/C (alloy 298, 303); (10) Fe/Cr/Mn/B/Si/C (alloy 299).

From the above, one of skill in the art would understand the alloy composition herein to include the following four elements at the following indicated atomic percent: Fe (55.0 to 88.0 at. %); B (0.50 to 8.0 at. %); Si (0.5 to 12.0 at. %); Mn (1.0 to 19.0 at. %). In addition, it can be appreciated that the following elements are optional and may be present at the indicated atomic percent: Ni (0.1 to 9.0 at. %); Cr (0.1 to 19.0 at. %); Cu (0.1 to 6.00 at. %); Ti (0.1 to 1.00 at. %); C (0.1 to 4.0 at. %). Impurities may be present including atoms such as Al, Mo, Nb, S, O, N, P, W, Co, Sn, Zr, Pd and V, which may be present up to 10 atomic percent.

Accordingly, the alloys may herein also be more broadly described as Fe-based alloys (with Fe content greater than 50.0 atomic percent) and further including B, Si and Mn, and capable of forming Class 2 steel (FIG. 3A) and further capable of undergoing recrystallization (heat treatment to 700° C. but below Tm) followed by stress above yield to provide Refined High Strength Nanomodal Structure (Structure #5, FIG. 3B), which steps of recrystallization and stress above yield may be repeated. The alloys may be further defined by the mechanical properties that are achieved for the identified structures with respect to yield strength, tensile strength, and tensile elongation characteristics.

Steel Alloy Properties

Thermal analysis was performed on material in the as cast state for all alloys of interest. Measurements were taken on a Netzsch Pegasus 404 Differential Scanning calorimeter (DSC). Measurement profiles consisted of a rapid ramp up to 900° C., followed by a controlled ramp to 1400° C. at a rate of 10° C./minute, a controlled cooling from 1400° C. to 900° C. at a rate of 10° C./min, and a second heating to 1400° C. at a rate of 10° C./min. Measurements of solidus, liquidus, and peak temperatures were taken from the final heating stage, in order to ensure a representative measurement of the material in an equilibrium state with the best possible measurement contact. In the alloys listed in Table 4, melting occurs in one or multiple stages with initial melting from ~1120° C. depending on alloy chemistry and final melting temperature exceeding 1425° C. in some instances (marked N/A in Table 5). Accordingly, the melting point range for the alloys herein capable of Class 2 Steel formation and subsequent recrystallization and cold forming (FIG. 3B) may be from 1000° C. to 1500° C. Variations in melting behavior reflect a complex phase formation at solidification of the alloys depending on their chemistry.

TABLE 5

Differential Thermal Analysis Data for Melting Behavior

| Alloy | Solidus (° C.) | Liquidus (° C.) | Peak #1 (° C.) | Peak #2 (° C.) | Peak #3 (° C.) | Peak #4 (° C.) |
|---|---|---|---|---|---|---|
| Alloy 1 | 1163 | 1358 | 1187 | 1319 | — | — |
| Alloy 2 | 1171 | 1368 | 1194 | 1353 | — | — |
| Alloy 3 | 1152 | 1365 | 1173 | 1351 | — | — |
| Alloy 4 | 1157 | 1375 | 1177 | 1350 | — | — |
| Alloy 5 | 1152 | 1369 | 1179 | 1351 | — | — |
| Alloy 6 | 1156 | 1366 | 1178 | 1212 | 1344 | — |
| Alloy 7 | 1161 | 1362 | 1181 | 1216 | 1319 | 1342 |
| Alloy 8 | 1153 | 1357 | 1176 | 1214 | 1330 | — |

TABLE 5-continued

Differential Thermal Analysis Data for Melting Behavior

| Alloy | Solidus (° C.) | Liquidus (° C.) | Peak #1 (° C.) | Peak #2 (° C.) | Peak #3 (° C.) | Peak #4 (° C.) |
|---|---|---|---|---|---|---|
| Alloy 9 | 1150 | 1351 | 1170 | 1315 | 1333 | — |
| Alloy 10 | 1152 | 1369 | 1173 | 1349 | — | — |
| Alloy 11 | 1142 | 1325 | 1169 | 1290 | — | — |
| Alloy 12 | 1140 | 1325 | 1168 | — | — | — |
| Alloy 13 | 1142 | 1321 | 1162 | 1291 | — | — |
| Alloy 14 | 1154 | 1353 | 1181 | 1320 | — | — |
| Alloy 15 | 1155 | 1356 | 1181 | 1343 | — | — |
| Alloy 16 | 1159 | 1329 | 1182 | 1312 | — | — |
| Alloy 17 | 1162 | 1349 | 1201 | 1339 | — | — |
| Alloy 18 | 1166 | 1333 | 1194 | 1315 | — | — |
| Alloy 19 | 1164 | 1333 | 1201 | 1318 | — | — |
| Alloy 20 | 1176 | 1360 | 1211 | 1342 | — | — |
| Alloy 21 | 1175 | 1353 | 1199 | 1320 | — | — |
| Alloy 22 | 1181 | 1351 | 1205 | 1293 | — | — |
| Alloy 23 | 1192 | 1359 | 1228 | 1345 | — | — |
| Alloy 24 | 1189 | 1369 | 1225 | 1363 | — | — |
| Alloy 25 | 1193 | 1351 | 1229 | 1337 | — | — |
| Alloy 26 | 1167 | 1329 | 1203 | 1305 | — | — |
| Alloy 27 | 1168 | 1312 | 1194 | 1296 | — | — |
| Alloy 28 | 1158 | 1300 | 1197 | 1292 | — | — |
| Alloy 29 | 1164 | 1327 | 1192 | 1310 | — | — |
| Alloy 30 | 1162 | 1323 | 1193 | 1306 | — | — |
| Alloy 31 | 1163 | 1310 | 1199 | 1300 | — | — |
| Alloy 32 | 1172 | 1325 | 1214 | 1313 | — | — |
| Alloy 33 | 1164 | 1318 | 1209 | 1306 | — | — |
| Alloy 34 | 1172 | 1315 | 1212 | 1302 | — | — |
| Alloy 35 | 1156 | 1333 | 1188 | 1321 | — | — |
| Alloy 36 | 1160 | 1330 | 1185 | 1315 | — | — |
| Alloy 37 | 1158 | 1319 | 1191 | 1312 | — | — |
| Alloy 38 | 1171 | 1333 | 1207 | 1315 | — | — |
| Alloy 39 | 1165 | 1330 | 1206 | 1312 | — | — |
| Alloy 40 | 1160 | 1322 | 1207 | 1307 | — | — |
| Alloy 41 | 1180 | 1332 | 1225 | 1315 | — | — |
| Alloy 42 | 1176 | 1324 | 1217 | 1311 | — | — |
| Alloy 43 | 1165 | 1339 | 1215 | 1304 | — | — |
| Alloy 44 | 1171 | 1349 | 1206 | 1337 | — | — |
| Alloy 45 | 1163 | 1340 | 1205 | 1321 | — | — |
| Alloy 46 | 1161 | 1329 | 1200 | 1320 | — | — |
| Alloy 47 | 1175 | 1352 | 1208 | 1310 | — | — |
| Alloy 48 | 1172 | 1344 | 1209 | 1334 | — | — |
| Alloy 49 | 1176 | 1346 | 1212 | 1323 | — | — |
| Alloy 50 | 1232 | 1338 | 1261 | 1311 | — | — |
| Alloy 51 | 1223 | 1330 | 1234 | 1260 | 1306 | — |
| Alloy 52 | 1209 | 1337 | 1220 | 1254 | 1303 | — |
| Alloy 53 | 1158 | 1276 | 1209 | 1225 | 1263 | — |
| Alloy 54 | 1138 | 1275 | 1144 | 1223 | 1247 | — |
| Alloy 55 | 1181 | 1260 | 1227 | 1250 | — | — |
| Alloy 56 | 1224 | 1332 | 1254 | 1317 | — | — |
| Alloy 57 | 1223 | 1336 | 1252 | 1308 | — | — |
| Alloy 58 | 1218 | 1315 | 1248 | 1306 | — | — |
| Alloy 59 | 1153 | 1315 | 1188 | 1288 | — | — |
| Alloy 60 | 1163 | 1354 | 1191 | 1337 | — | — |
| Alloy 61 | 1163 | 1347 | 1187 | 1326 | — | — |
| Alloy 62 | 1171 | 1365 | 1191 | 1352 | — | — |
| Alloy 63 | 1153 | 1337 | 1182 | 1312 | — | — |
| Alloy 64 | 1152 | 1317 | 1187 | 1301 | — | — |
| Alloy 65 | 1120 | 1320 | 1169 | 1302 | — | — |
| Alloy 66 | 1181 | 1324 | 1210 | 1304 | — | — |
| Alloy 67 | 1193 | 1371 | 1215 | 1338 | — | — |
| Alloy 68 | 1178 | 1350 | 1213 | 1329 | — | — |
| Alloy 69 | 1187 | 1371 | 1217 | 1353 | — | — |
| Alloy 70 | 1159 | 1376 | 1189 | 1334 | — | — |
| Alloy 71 | 1145 | 1356 | 1175 | 1335 | — | — |
| Alloy 72 | 1176 | 1354 | 1217 | 1304 | — | — |
| Alloy 73 | 1143 | 1330 | 1196 | 1307 | — | — |
| Alloy 74 | 1163 | 1336 | 1197 | 1308 | — | — |
| Alloy 75 | 1150 | 1310 | 1185 | 1293 | — | — |
| Alloy 76 | 1150 | 1316 | 1184 | 1295 | — | — |
| Alloy 77 | 1159 | 1340 | 1189 | 1317 | — | — |
| Alloy 78 | 1156 | 1331 | 1188 | 1303 | — | — |
| Alloy 79 | 1159 | 1330 | 1188 | 1312 | — | — |
| Alloy 80 | 1156 | 1343 | 1192 | 1333 | — | — |
| Alloy 81 | 1154 | 1324 | 1191 | 1314 | — | — |
| Alloy 82 | 1157 | 1335 | 1196 | 1325 | — | — |

TABLE 5-continued

Differential Thermal Analysis Data for Melting Behavior

| Alloy | Solidus (° C.) | Liquidus (° C.) | Peak #1 (° C.) | Peak #2 (° C.) | Peak #3 (° C.) | Peak #4 (° C.) |
|---|---|---|---|---|---|---|
| Alloy 83 | 1159 | 1354 | 1196 | 1343 | — | — |
| Alloy 84 | 1156 | 1346 | 1194 | 1337 | — | — |
| Alloy 85 | 1159 | 1349 | 1198 | 1339 | — | — |
| Alloy 86 | 1152 | 1336 | 1189 | 1324 | — | — |
| Alloy 87 | 1153 | 1347 | 1181 | 1340 | — | — |
| Alloy 88 | 1155 | 1327 | 1181 | 1327 | — | — |
| Alloy 89 | 1160 | 1347 | 1185 | 1330 | — | — |
| Alloy 90 | 1162 | 1368 | 1184 | 1352 | — | — |
| Alloy 91 | 1157 | 1359 | 1182 | 1351 | — | — |
| Alloy 92 | 1161 | 1358 | 1183 | 1349 | — | — |
| Alloy 93 | 1158 | 1375 | 1185 | 1364 | — | — |
| Alloy 94 | 1163 | 1368 | 1183 | 1358 | — | — |
| Alloy 95 | 1162 | 1364 | 1180 | 1356 | — | — |
| Alloy 96 | 1151 | 1352 | 1172 | 1347 | — | — |
| Alloy 97 | 1147 | 1344 | 1170 | 1340 | — | — |
| Alloy 98 | 1148 | 1353 | 1170 | 1342 | — | — |
| Alloy 99 | 1156 | 1348 | 1181 | 1328 | — | — |
| Alloy 100 | 1159 | 1353 | 1181 | 1343 | — | — |
| Alloy 101 | 1151 | 1353 | 1177 | 1346 | — | — |
| Alloy 102 | 1157 | 1352 | 1181 | 1338 | — | — |
| Alloy 103 | 1160 | 1354 | 1184 | 1343 | — | — |
| Alloy 104 | 1162 | 1355 | 1187 | 1342 | — | — |
| Alloy 105 | 1160 | 1363 | 1197 | 1348 | — | — |
| Alloy 106 | 1164 | 1353 | 1185 | 1343 | — | — |
| Alloy 107 | 1162 | 1355 | 1187 | 1338 | — | — |
| Alloy 108 | 1166 | 1356 | 1187 | 1315 | — | — |
| Alloy 109 | 1166 | 1349 | 1183 | 1319 | — | — |
| Alloy 110 | 1169 | 1351 | 1186 | 1330 | — | — |
| Alloy 111 | 1170 | 1356 | 1186 | 1330 | — | — |
| Alloy 112 | 1177 | 1334 | 1187 | 1309 | — | — |
| Alloy 113 | 1173 | 1343 | 1191 | 1329 | — | — |
| Alloy 114 | 1173 | 1354 | 1186 | 1332 | — | — |
| Alloy 115 | 1171 | 1350 | 1191 | 1332 | — | — |
| Alloy 116 | 1184 | 1361 | 1214 | 1299 | 1345 | — |
| Alloy 117 | 1156 | 1365 | 1182 | 1354 | — | — |
| Alloy 118 | 1174 | 1362 | 1199 | 1346 | — | — |
| Alloy 119 | 1170 | 1359 | 1196 | 1347 | — | — |
| Alloy 120 | 1175 | 1348 | 1202 | 1337 | — | — |
| Alloy 121 | 1181 | 1371 | 1200 | 1335 | 1358 | — |
| Alloy 122 | 1170 | 1346 | 1307 | 1338 | — | — |
| Alloy 123 | 1178 | 1363 | 1198 | 1351 | — | — |
| Alloy 124 | 1172 | 1355 | 1194 | 1323 | 1334 | — |
| Alloy 125 | 1173 | 1359 | 1203 | 1332 | — | — |
| Alloy 126 | 1184 | 1361 | 1214 | 1299 | 1345 | — |
| Alloy 127 | 1156 | 1365 | 1182 | 1354 | — | — |
| Alloy 128 | 1174 | 1362 | 1199 | 1346 | — | — |
| Alloy 129 | 1170 | 1359 | 1196 | 1347 | — | — |
| Alloy 130 | 1175 | 1348 | 1202 | 1337 | — | — |
| Alloy 131 | 1181 | 1371 | 1200 | 1335 | 1358 | — |
| Alloy 132 | 1170 | 1346 | 1307 | 1338 | — | — |
| Alloy 133 | 1178 | 1363 | 1198 | 1351 | — | — |
| Alloy 134 | 1172 | 1355 | 1194 | 1323 | 1334 | — |
| Alloy 135 | 1173 | 1359 | 1203 | 1332 | — | — |
| Alloy 136 | 1188 | 1322 | 1218 | 1304 | — | — |
| Alloy 137 | 1184 | 1323 | 1213 | 1312 | — | — |
| Alloy 138 | 1176 | 1325 | 1206 | 1314 | — | — |
| Alloy 139 | 1197 | 1329 | 1222 | 1275 | 1317 | — |
| Alloy 140 | 1186 | 1327 | 1212 | 1293 | 1316 | — |
| Alloy 141 | 1168 | 1327 | 1205 | 1310 | — | — |
| Alloy 142 | 1197 | 1348 | 1224 | 1324 | 1338 | — |
| Alloy 143 | 1195 | 1349 | 1219 | 1336 | — | — |
| Alloy 144 | 1174 | 1340 | 1207 | 1326 | — | — |
| Alloy 145 | 1153 | 1337 | 1180 | 1323 | — | — |
| Alloy 146 | 1156 | 1342 | 1180 | 1330 | — | — |
| Alloy 147 | 1163 | 1347 | 1186 | 1339 | — | — |
| Alloy 148 | 1168 | 1351 | 1197 | 1294 | 1338 | — |
| Alloy 149 | 1168 | 1344 | 1192 | 1328 | — | — |
| Alloy 150 | 1161 | 1319 | 1198 | 1309 | — | — |
| Alloy 151 | 1170 | 1340 | 1202 | 1314 | — | — |
| Alloy 152 | 1172 | 1338 | 1194 | 1322 | — | — |
| Alloy 153 | 1160 | 1335 | 1188 | 1325 | — | — |
| Alloy 154 | 1163 | 1338 | 1190 | 1326 | — | — |
| Alloy 157 | 1169 | 1357 | 1194 | 1349 | — | — |
| Alloy 158 | 1172 | 1353 | 1199 | 1344 | — | — |

TABLE 5-continued

Differential Thermal Analysis Data for Melting Behavior

| Alloy | Solidus (° C.) | Liquidus (° C.) | Peak #1 (° C.) | Peak #2 (° C.) | Peak #3 (° C.) | Peak #4 (° C.) |
|---|---|---|---|---|---|---|
| Alloy 159 | 1169 | 1354 | 1196 | 1346 | — | — |
| Alloy 160 | 1163 | 1332 | 1197 | 1321 | — | — |
| Alloy 161 | 1171 | 1347 | 1191 | 1301 | 1337 | — |
| Alloy 162 | 1170 | 1348 | 1199 | 1339 | — | — |
| Alloy 163 | 1158 | 1338 | 1192 | 1330 | — | — |
| Alloy 164 | 1171 | 1338 | 1204 | 1323 | — | — |
| Alloy 165 | 1168 | 1341 | 1202 | 1332 | — | — |
| Alloy 166 | 1168 | 1341 | 1202 | 1329 | — | — |
| Alloy 167 | 1164 | 1343 | 1197 | 1324 | — | — |
| Alloy 168 | 1162 | 1319 | 1198 | 1307 | — | — |
| Alloy 169 | 1157 | 1329 | 1195 | 1307 | — | — |
| Alloy 170 | 1162 | 1335 | 1197 | 1325 | | — |
| Alloy 171 | 1162 | 1325 | 1199 | 1309 | | — |
| Alloy 172 | 1169 | 1287 | 1201 | 1264 | — | — |
| Alloy 173 | 1160 | 1304 | 1199 | 1288 | — | — |
| Alloy 174 | 1162 | 1320 | 1193 | 1309 | — | — |
| Alloy 175 | 1170 | 1320 | 1202 | 1301 | — | — |
| Alloy 176 | 1164 | 1327 | 1198 | 1317 | — | — |
| Alloy 177 | 1175 | 1350 | 1206 | 1333 | — | — |
| Alloy 178 | 1168 | 1303 | 1203 | 1291 | — | — |
| Alloy 179 | 1145 | 1297 | 1188 | 1278 | — | — |
| Alloy 180 | 1166 | 1321 | 1204 | 1309 | — | — |
| Alloy 181 | 1172 | 1314 | 1206 | 1296 | — | — |
| Alloy 182 | 1135 | 1285 | 1187 | — | — | — |
| Alloy 183 | 1163 | 1308 | 1197 | 1290 | — | — |
| Alloy 184 | 1165 | 1316 | 1197 | 1298 | — | — |
| Alloy 185 | 1164 | 1296 | 1192 | 1282 | — | — |
| Alloy 186 | 1153 | 1286 | 1187 | 1210 | 1269 | — |
| Alloy 187 | 1160 | 1295 | 1189 | 1274 | — | — |
| Alloy 188 | 1171 | 1339 | 1205 | 1322 | — | — |
| Alloy 189 | 1182 | 1335 | 1212 | 1324 | — | — |
| Alloy 190 | 1173 | 1334 | 1207 | 1324 | — | — |
| Alloy 191 | 1181 | 1335 | 1214 | 1320 | — | — |
| Alloy 192 | 1175 | 1365 | 1202 | 1356 | — | — |
| Alloy 193 | 1183 | 1333 | 1217 | 1318 | — | — |
| Alloy 194 | 1170 | 1323 | 1195 | 1306 | — | — |
| Alloy 195 | 1175 | 1322 | 1209 | 1307 | — | — |
| Alloy 196 | 1165 | 1322 | 1198 | 1308 | — | — |
| Alloy 197 | 1175 | 1319 | 1208 | 1307 | — | — |
| Alloy 198 | 1178 | 1316 | 1215 | 1304 | — | — |
| Alloy 199 | 1162 | 1310 | 1199 | 1299 | — | — |
| Alloy 200 | 1162 | 1314 | 1200 | 1294 | — | — |
| Alloy 201 | 1166 | 1314 | 1202 | 1284 | 1302 | — |
| Alloy 202 | 1170 | 1323 | 1202 | 1312 | — | — |
| Alloy 203 | 1174 | 1324 | 1207 | 1298 | — | — |
| Alloy 204 | 1175 | 1334 | 1205 | — | — | — |
| Alloy 205 | 1176 | 1334 | 1209 | 1307 | — | — |
| Alloy 206 | 1175 | 1324 | 1206 | — | — | — |
| Alloy 207 | 1174 | 1317 | 1207 | 1296 | — | — |
| Alloy 208 | 1173 | 1329 | 1207 | — | — | — |
| Alloy 209 | 1178 | 1327 | 1208 | — | — | — |
| Alloy 210 | 1177 | 1333 | 1206 | 1314 | — | — |
| Alloy 211 | 1173 | 1336 | 1204 | 1320 | — | — |
| Alloy 212 | 1167 | 1332 | 1200 | 1307 | — | — |
| Alloy 213 | 1174 | 1331 | 1207 | 1317 | — | — |
| Alloy 214 | 1175 | 1337 | 1202 | 1322 | — | — |
| Alloy 215 | 1177 | 1327 | 1206 | 1318 | — | — |
| Alloy 216 | 1168 | 1326 | 1202 | 1310 | — | — |
| Alloy 217 | 1178 | 1328 | 1206 | 1318 | — | — |
| Alloy 218 | 1168 | 1321 | 1206 | 1312 | — | — |
| Alloy 219 | 1170 | 1327 | 1206 | 1307 | — | — |
| Alloy 220 | 1174 | 1338 | 1208 | 1318 | — | — |
| Alloy 221 | 1180 | 1356 | 1207 | 1339 | — | — |
| Alloy 222 | 1174 | 1358 | 1204 | 1347 | — | — |
| Alloy 223 | 1175 | 1362 | 1201 | 1350 | — | — |
| Alloy 224 | 1177 | 1333 | 1208 | 1310 | — | — |
| Alloy 225 | 1179 | 1330 | 1205 | 1322 | — | — |
| Alloy 226 | 1170 | 1331 | 1202 | 1318 | — | — |
| Alloy 227 | 1177 | 1328 | 1205 | 1317 | — | — |
| Alloy 228 | 1173 | 1333 | 1206 | 1323 | — | — |
| Alloy 229 | 1177 | 1339 | 1205 | 1325 | — | — |
| Alloy 230 | 1167 | 1323 | 1302 | 1302 | — | — |
| Alloy 231 | 1174 | 1329 | 1206 | 1305 | — | — |
| Alloy 232 | 1175 | 1337 | 1203 | 1300 | — | — |

TABLE 5-continued

Differential Thermal Analysis Data for Melting Behavior

| Alloy | Solidus (° C.) | Liquidus (° C.) | Peak #1 (° C.) | Peak #2 (° C.) | Peak #3 (° C.) | Peak #4 (° C.) |
|---|---|---|---|---|---|---|
| Alloy 233 | 1210 | 1315 | 1245 | 1293 | — | — |
| Alloy 234 | 1207 | 1310 | 1245 | 1297 | — | — |
| Alloy 235 | 1208 | 1316 | 1248 | 1304 | — | — |
| Alloy 236 | 1208 | 1335 | 1244 | 1315 | — | — |
| Alloy 237 | 1214 | 1340 | 1247 | 1323 | — | — |
| Alloy 238 | 1216 | 1349 | 1246 | 1331 | — | — |
| Alloy 239 | 1185 | 1309 | 1196 | 1253 | 1297 | — |
| Alloy 240 | 1190 | 1323 | 1197 | 1261 | 1311 | — |
| Alloy 241 | 1160 | 1315 | 1189 | 1298 | — | |
| Alloy 242 | 1163 | 1329 | 1194 | 1279 | 1308 | |
| Alloy 243 | 1214 | 1341 | 1236 | 1320 | — | |
| Alloy 244 | 1210 | 1341 | 1235 | 1327 | — | |
| Alloy 245 | 1195 | 1351 | 1221 | 1319 | 1332 | |
| Alloy 246 | 1174 | 1352 | 1198 | 1338 | — | |
| Alloy 247 | 1199 | 1340 | 1227 | 1294 | 1326 | |
| Alloy 248 | 1202 | 1343 | 1233 | 1326 | — | |
| Alloy 249 | 1192 | 1347 | 1221 | 1329 | — | |
| Alloy 250 | 1199 | 1372 | 1228 | 1305 | 1362 | |
| Alloy 251 | 1194 | 1377 | 1219 | 1319 | 1366 | |
| Alloy 252 | 1206 | 1367 | 1233 | 1354 | — | |
| Alloy 253 | 1200 | 1375 | 1226 | 1361 | — | |
| Alloy 254 | 1199 | 1369 | 1227 | 1288 | 1356 | |
| Alloy 255 | 1193 | 1373 | 1219 | 1308 | 1359 | |
| Alloy 256 | 1204 | 1365 | 1231 | 1339 | 1356 | |
| Alloy 257 | 1196 | 1371 | 1221 | 1358 | — | |
| Alloy 258 | 1194 | 1354 | 1224 | 1346 | — | |
| Alloy 259 | 1191 | 1360 | 1220 | 1354 | — | |
| Alloy 260 | 1208 | 1343 | 1234 | 1283 | 1332 | — |
| Alloy 261 | 1203 | 1343 | 1234 | 1268 | 1329 | — |
| Alloy 262 | 1189 | 1366 | 1225 | 1298 | 1355 | — |
| Alloy 263 | 1195 | 1365 | 1229 | 1289 | 1348 | — |
| Alloy 264 | 1192 | 1352 | 1228 | 1303 | 1336 | — |
| Alloy 265 | 1169 | 1332 | 1216 | 1322 | — | — |
| Alloy 266 | 1184 | 1331 | 1222 | 1320 | — | — |
| Alloy 267 | 1165 | 1344 | 1192 | 1336 | — | — |
| Alloy 268 | 1202 | 1343 | 1233 | 1303 | 1333 | — |
| Alloy 269 | 1194 | 1341 | 1229 | 1304 | 1328 | — |
| Alloy 270 | 1208 | 1354 | 1235 | 1281 | 1339 | — |
| Alloy 271 | 1202 | 1338 | 1232 | 1319 | — | — |
| Alloy 272 | 1203 | 1342 | 1231 | 1319 | — | — |
| Alloy 273 | 1203 | 1344 | 1235 | 1321 | — | — |
| Alloy 274 | 1202 | 1342 | 1230 | 1292 | 1342 | — |
| Alloy 275 | 1197 | 1334 | 1228 | 1258 | 1313 | — |
| Alloy 276 | 1189 | 1327 | 1225 | 1269 | 1309 | — |
| Alloy 277 | 1193 | 1318 | 1205 | 1222 | 1308 | — |
| Alloy 278 | 1193 | 1321 | 1205 | 1222 | 1309 | — |
| Alloy 279 | 1192 | 1329 | 1226 | 1310 | — | — |
| Alloy 280 | 1201 | 1347 | 1229 | 1269 | 1330 | — |
| Alloy 281 | 1199 | 1352 | 1231 | 1270 | 1334 | — |
| Alloy 282 | 1201 | 1343 | 1227 | 1322 | — | — |
| Alloy 283 | 1188 | 1327 | 1221 | 1308 | — | — |
| Alloy 284 | 1206 | 1348 | 1233 | 1282 | 1333 | — |
| Alloy 285 | 1207 | 1355 | 1235 | 1269 | 1338 | — |
| Alloy 286 | 1207 | 1357 | 1233 | 1263 | 1343 | — |
| Alloy 287 | 1199 | 1340 | 1231 | 1283 | 1326 | — |
| Alloy 288 | 1203 | 1346 | 1231 | 1285 | 1332 | — |
| Alloy 289 | 1200 | 1343 | 1228 | 1284 | 1326 | — |
| Alloy 290 | 1189 | 1338 | 1224 | 1292 | 1321 | — |
| Alloy 291 | 1142 | 1364 | 1162 | 1349 | — | — |
| Alloy 292 | 1208 | 1392 | 1230 | 1290 | 1377 | — |
| Alloy 293 | 1158 | >1400 | 1178 | 1332 | 1376 | 1395 |
| Alloy 294 | 1137 | 1383 | 1156 | 1371 | — | |
| Alloy 295 | 1131 | 1398 | 1151 | 1389 | — | — |
| Alloy 296 | 1100 | 1339 | 1133 | 1328 | — | — |
| Alloy 297 | 1206 | 1286 | 1241 | 1273 | — | — |
| Alloy 298 | 1147 | NA | 1160 | — | — | — |
| Alloy 299 | 1170 | NA | 1185 | >1425 | — | — |
| Alloy 300 | 1157 | NA | 1173 | >1425 | | |
| Alloy 301 | 1200 | 1392 | 1228 | 1380 | — | — |
| Alloy 302 | 1131 | 1376 | 1154 | 1359 | — | — |
| Alloy 303 | 1146 | 1439 | 1158 | 1430 | 1436 | — |
| Alloy 304 | 1083 | 1346 | 1108 | 1137 | 1385 | — |

The density of the alloys was measured on arc-melt ingots using the Archimedes method in a specially constructed balance allowing weighing in both air and distilled water. The density of each alloy is tabulated in Table 6 and was found to vary from 7.30 g/cm$^3$ to 7.89 g/cm$^3$. Experimental results have revealed that the accuracy of this technique is ±0.01 g/cm$^3$.

TABLE 6

Average Alloy Densities

| Alloy | Density [g/cm$^3$] |
|---|---|
| Alloy 1 | 7.53 |
| Alloy 2 | 7.51 |
| Alloy 3 | 7.52 |
| Alloy 4 | 7.52 |
| Alloy 5 | 7.51 |
| Alloy 6 | 7.50 |
| Alloy 7 | 7.49 |
| Alloy 8 | 7.50 |
| Alloy 9 | 7.52 |
| Alloy 10 | 7.54 |
| Alloy 11 | 7.60 |
| Alloy 12 | 7.60 |
| Alloy 13 | 7.57 |
| Alloy 14 | 7.61 |
| Alloy 15 | 7.59 |
| Alloy 16 | 7.57 |
| Alloy 17 | 7.57 |
| Alloy 18 | 7.60 |
| Alloy 19 | 7.59 |
| Alloy 20 | 7.55 |
| Alloy 21 | 7.61 |
| Alloy 22 | 7.57 |
| Alloy 23 | 7.49 |
| Alloy 24 | 7.54 |
| Alloy 25 | 7.58 |
| Alloy 26 | 7.58 |
| Alloy 27 | 7.55 |
| Alloy 28 | 7.54 |
| Alloy 29 | 7.57 |
| Alloy 30 | 7.58 |
| Alloy 31 | 7.56 |
| Alloy 32 | 7.56 |
| Alloy 33 | 7.58 |
| Alloy 34 | 7.54 |
| Alloy 35 | 7.53 |
| Alloy 36 | 7.56 |
| Alloy 37 | 7.58 |
| Alloy 38 | 7.55 |
| Alloy 39 | 7.58 |
| Alloy 40 | 7.58 |
| Alloy 41 | 7.56 |
| Alloy 42 | 7.57 |
| Alloy 43 | 7.55 |
| Alloy 44 | 7.49 |
| Alloy 45 | 7.52 |
| Alloy 46 | 7.57 |
| Alloy 47 | 7.48 |
| Alloy 48 | 7.48 |
| Alloy 49 | 7.52 |
| Alloy 50 | 7.51 |
| Alloy 51 | 7.46 |
| Alloy 52 | 7.35 |
| Alloy 53 | 7.33 |
| Alloy 54 | 7.31 |
| Alloy 55 | 7.30 |
| Alloy 56 | 7.56 |
| Alloy 57 | 7.55 |
| Alloy 58 | 7.54 |
| Alloy 59 | 7.58 |
| Alloy 60 | 7.62 |
| Alloy 61 | 7.65 |
| Alloy 62 | 7.65 |
| Alloy 63 | 7.62 |

TABLE 6-continued

Average Alloy Densities

| Alloy | Density [g/cm$^3$] |
|---|---|
| Alloy 64 | 7.58 |
| Alloy 65 | 7.58 |
| Alloy 66 | 7.59 |
| Alloy 67 | 7.62 |
| Alloy 68 | 7.62 |
| Alloy 69 | 7.66 |
| Alloy 70 | 7.61 |
| Alloy 71 | 7.58 |
| Alloy 72 | 7.60 |
| Alloy 73 | 7.56 |
| Alloy 74 | 7.62 |
| Alloy 75 | 7.60 |
| Alloy 76 | 7.63 |
| Alloy 77 | 7.60 |
| Alloy 78 | 7.65 |
| Alloy 79 | 7.61 |
| Alloy 80 | 7.64 |
| Alloy 81 | 7.59 |
| Alloy 82 | 7.66 |
| Alloy 83 | 7.59 |
| Alloy 84 | 7.64 |
| Alloy 85 | 7.60 |
| Alloy 86 | 7.64 |
| Alloy 87 | 7.60 |
| Alloy 88 | 7.65 |
| Alloy 89 | 7.61 |
| Alloy 90 | 7.61 |
| Alloy 91 | 7.65 |
| Alloy 92 | 7.61 |
| Alloy 93 | 7.61 |
| Alloy 94 | 7.67 |
| Alloy 95 | 7.63 |
| Alloy 96 | 7.61 |
| Alloy 97 | 7.62 |
| Alloy 98 | 7.61 |
| Alloy 99 | 7.62 |
| Alloy 100 | 7.60 |
| Alloy 101 | 7.61 |
| Alloy 102 | 7.59 |
| Alloy 103 | 7.61 |
| Alloy 104 | 7.58 |
| Alloy 105 | 7.60 |
| Alloy 106 | 7.61 |
| Alloy 107 | 7.61 |
| Alloy 108 | 7.64 |
| Alloy 109 | 7.64 |
| Alloy 110 | 7.60 |
| Alloy 111 | 7.59 |
| Alloy 112 | 7.60 |
| Alloy 113 | 7.60 |
| Alloy 114 | 7.58 |
| Alloy 115 | 7.56 |
| Alloy 116 | 7.64 |
| Alloy 117 | 7.60 |
| Alloy 118 | 7.63 |
| Alloy 119 | 7.60 |
| Alloy 120 | 7.61 |
| Alloy 121 | 7.63 |
| Alloy 122 | 7.59 |
| Alloy 123 | 7.63 |
| Alloy 124 | 7.64 |
| Alloy 125 | 7.60 |
| Alloy 126 | 7.65 |
| Alloy 127 | 7.62 |
| Alloy 128 | 7.63 |
| Alloy 129 | 7.65 |
| Alloy 130 | 7.58 |
| Alloy 131 | 7.62 |
| Alloy 132 | 7.67 |
| Alloy 133 | 7.65 |
| Alloy 134 | 7.66 |
| Alloy 135 | 7.67 |
| Alloy 136 | 7.58 |

TABLE 6-continued

Average Alloy Densities

| Alloy | Density [g/cm$^3$] |
|---|---|
| Alloy 137 | 7.60 |
| Alloy 138 | 7.62 |
| Alloy 139 | 7.55 |
| Alloy 140 | 7.57 |
| Alloy 141 | 7.60 |
| Alloy 142 | 7.64 |
| Alloy 143 | 7.64 |
| Alloy 144 | 7.63 |
| Alloy 145 | 7.60 |
| Alloy 146 | 7.60 |
| Alloy 147 | 7.63 |
| Alloy 148 | 7.59 |
| Alloy 149 | 7.60 |
| Alloy 150 | 7.59 |
| Alloy 151 | 7.59 |
| Alloy 152 | 7.59 |
| Alloy 153 | 7.60 |
| Alloy 154 | 7.60 |
| Alloy 155 | 7.60 |
| Alloy 156 | 7.60 |
| Alloy 157 | 7.60 |
| Alloy 158 | 7.62 |
| Alloy 159 | 7.58 |
| Alloy 160 | 7.60 |
| Alloy 161 | 7.58 |
| Alloy 162 | 7.65 |
| Alloy 163 | 7.61 |
| Alloy 164 | 7.61 |
| Alloy 165 | 7.61 |
| Alloy 166 | 7.64 |
| Alloy 167 | 7.58 |
| Alloy 168 | 7.62 |
| Alloy 169 | 7.61 |
| Alloy 170 | 7.64 |
| Alloy 171 | 7.61 |
| Alloy 172 | 7.58 |
| Alloy 173 | 7.60 |
| Alloy 174 | 7.58 |
| Alloy 175 | 7.65 |
| Alloy 176 | 7.69 |
| Alloy 177 | 7.69 |
| Alloy 178 | 7.58 |
| Alloy 179 | 7.60 |
| Alloy 180 | 7.64 |
| Alloy 181 | 7.53 |
| Alloy 182 | 7.58 |
| Alloy 183 | 7.57 |
| Alloy 184 | 7.56 |
| Alloy 185 | 7.53 |
| Alloy 186 | 7.51 |
| Alloy 187 | 7.53 |
| Alloy 188 | 7.68 |
| Alloy 189 | 7.67 |
| Alloy 190 | 7.69 |
| Alloy 191 | 7.70 |
| Alloy 193 | 7.70 |
| Alloy 194 | 7.61 |
| Alloy 195 | 7.60 |
| Alloy 196 | 7.64 |
| Alloy 197 | 7.63 |
| Alloy 198 | 7.62 |
| Alloy 199 | 7.54 |
| Alloy 200 | 7.51 |
| Alloy 201 | 7.51 |
| Alloy 202 | 7.71 |
| Alloy 203 | 7.70 |
| Alloy 204 | 7.71 |
| Alloy 205 | 7.73 |
| Alloy 206 | 7.71 |
| Alloy 207 | 7.71 |
| Alloy 208 | 7.74 |
| Alloy 209 | 7.74 |
| Alloy 210 | 7.74 |

TABLE 6-continued

Average Alloy Densities

| Alloy | Density [g/cm$^3$] |
|---|---|
| Alloy 211 | 7.74 |
| Alloy 212 | 7.73 |
| Alloy 213 | 7.72 |
| Alloy 214 | 7.75 |
| Alloy 215 | 7.72 |
| Alloy 216 | 7.73 |
| Alloy 217 | 7.75 |
| Alloy 218 | 7.70 |
| Alloy 219 | 7.73 |
| Alloy 220 | 7.74 |
| Alloy 221 | 7.75 |
| Alloy 222 | 7.77 |
| Alloy 223 | 7.79 |
| Alloy 224 | 7.73 |
| Alloy 225 | 7.74 |
| Alloy 226 | 7.75 |
| Alloy 227 | 7.68 |
| Alloy 228 | 7.72 |
| Alloy 229 | 7.73 |
| Alloy 230 | 7.71 |
| Alloy 232 | 7.76 |
| Alloy 233 | 7.66 |
| Alloy 234 | 7.66 |
| Alloy 235 | 7.70 |
| Alloy 236 | 7.66 |
| Alloy 237 | 7.68 |
| Alloy 238 | 7.70 |
| Alloy 239 | 7.41 |
| Alloy 240 | 7.39 |
| Alloy 241 | 7.62 |
| Alloy 242 | 7.62 |
| Alloy 243 | 7.64 |
| Alloy 244 | 7.67 |
| Alloy 245 | 7.73 |
| Alloy 246 | 7.76 |
| Alloy 247 | 7.68 |
| Alloy 248 | 7.73 |
| Alloy 249 | 7.75 |
| Alloy 250 | 7.71 |
| Alloy 251 | 7.76 |
| Alloy 252 | 7.74 |
| Alloy 253 | 7.75 |
| Alloy 254 | 7.67 |
| Alloy 255 | 7.71 |
| Alloy 256 | 7.72 |
| Alloy 257 | 7.72 |
| Alloy 258 | 7.69 |
| Alloy 259 | 7.72 |
| Alloy 260 | 7.66 |
| Alloy 261 | 7.62 |
| Alloy 262 | 7.57 |
| Alloy 263 | 7.68 |
| Alloy 264 | 7.66 |
| Alloy 265 | 7.65 |
| Alloy 266 | 7.64 |
| Alloy 267 | 7.69 |
| Alloy 268 | 7.66 |
| Alloy 269 | 7.68 |
| Alloy 270 | 7.68 |
| Alloy 271 | 7.62 |
| Alloy 272 | 7.62 |
| Alloy 273 | 7.64 |
| Alloy 274 | 7.68 |
| Alloy 275 | 7.62 |
| Alloy 276 | 7.62 |
| Alloy 277 | 7.54 |
| Alloy 278 | 7.53 |
| Alloy 279 | 7.52 |
| Alloy 280 | 7.65 |
| Alloy 281 | 7.66 |
| Alloy 282 | 7.60 |

TABLE 6-continued

| Average Alloy Densities | |
|---|---|
| Alloy | Density [g/cm$^3$] |
| Alloy 283 | 7.60 |
| Alloy 284 | 7.67 |
| Alloy 285 | 7.69 |
| Alloy 286 | 7.66 |
| Alloy 287 | 7.67 |
| Alloy 288 | 7.69 |
| Alloy 289 | 7.64 |
| Alloy 290 | 7.63 |
| Alloy 291 | 7.74 |
| Alloy 292 | 7.77 |
| Alloy 293 | 7.70 |
| Alloy 294 | 7.70 |
| Alloy 295 | 7.73 |
| Alloy 296 | 7.80 |
| Alloy 297 | 7.69 |
| Alloy 298 | 7.72 |
| Alloy 299 | 7.85 |
| Alloy 300 | 7.87 |
| Alloy 301 | 7.75 |
| Alloy 302 | 7.80 |
| Alloy 303 | 7.89 |
| Alloy 304 | 7.55 |

TABLE 7

| HIP Cycle Parameters | | | |
|---|---|---|---|
| | HIP Temperature [° C.] | HIP Time [min] | HIP Pressure [ksi] |
| HIP 1 | 1000 | 60 | 30 |
| HIP 2 | 1100 | 60 | 30 |
| HIP 3 | 1125 | 60 | 30 |
| HIP 4 | 1150 | 60 | 30 |
| HIP 5 | 1100 | 60 | 45 |
| HIP 6 | 1125 | 60 | 45 |
| HIP 7 | 1140 | 60 | 45 |
| HIP 8 | 1150 | 60 | 45 |
| HIP 9 | 1165 | 60 | 45 |
| HIP 10 | 1175 | 60 | 45 |

After HIP cycle, the plates were heat treated at parameters specified in Table 8. In the case of air cooling, the specimens were held at the target temperature for a target period of time, removed from the furnace and cooled down in air, modeling coiling conditions at commercial sheet production. In cases of controlled cooling, the furnace temperature was lowered at a specified rate, with samples loaded, allowing for a control of the sample cooling rate.

TABLE 8

| Heat Treatment Parameters | | | | | | |
|---|---|---|---|---|---|---|
| | Stage 1 Temperature [° C.] | Stage 1 Dwell [min] | Stage 1 Cooling | Stage 2 Temperature [° C.] | Stage 2 Dwell [min] | Stage 2 Cooling |
| HT1 | 700 | 60 | Air Normalized | — | — | — |
| HT2 | 700 | — | 1° C./min to <300° C. | — | — | — |
| HT3 | 850 | 60 | Air Normalized | — | — | — |
| HT4 | 850 | 240 | Air Normalized | — | — | — |
| HT5 | 850 | 360 | 0.75° C./min to <300° C. | — | — | — |
| HT6 | 700 | — | 1° C./min to <300° C. | 850 | 240 | Air Normalized |
| HT7 | 900 | 60 | Air Normalized | — | — | — |
| HT8 | 950 | 360 | Air Normalized | — | — | — |
| HT9 | 1150 | 120 | Air Normalized | — | — | — |
| HT10 | 1100 | 120 | Air Normalized | — | — | — |
| HT11 | 1050 | 120 | Air Normalized | | — | — |
| HT12 | 1075 | 120 | Air Normalized | | | |
| HT13 | 950 | 360 | 0.75° C./min to <500° C. | | | |
| HT14 | 850 | 5 | Air Normalized | | | |

Plates from each alloy from Alloy 1 to Alloy 283 was subjected to Hot Isostatic Pressing (HIP) using an American Isostatic Press Model 645 machine with a molybdenum furnace and with a furnace chamber size of 4 inch diameter by 5 inch height. The plates were heated at 10° C./min until the target temperature was reached and were exposed to gas pressure for specified time which was held at 1 hour for these studies. HIP cycle parameters are listed in Table 7. The key aspect of the HIP cycle was to remove macrodefects such as pores and small inclusions by mimicking hot rolling during sheet production by Thin Strip/Twin Roll Casting process or Thick/Thin Slab Casting process. The HIP cycle, which is a thermomechanical process allows the elimination of some fraction of internal and external macrodefects while smoothing the surface of the plate.

The tensile specimens were cut from the plates after HIP cycle and heat treatment using wire electrical discharge machining (EDM). Tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture. Tensile properties of the alloys after HIPing are listed in Table 9 and this relates to Structure 3 noted above. The ultimate tensile strength values vary from 403 to 1810 MPa with tensile elongation from 1.0 to 33.6%. The yield strength is in a range from 205 to 1223 MPa. The mechanical characteristic values in the steel alloys herein will depend on alloy chemistry and processing/treatment condition.

TABLE 9

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 1 | HIP 1 | HT1 | 485 | 836 | 3.35 |
| | | | 525 | 1436 | 8.23 |
| | | | 493 | 1019 | 4.44 |
| | | HT2 | 880 | 1058 | 1.66 |
| | | | 756 | 1040 | 1.59 |
| | | | 926 | 1072 | 2.01 |
| | | HT3 | 526 | 1487 | 5.11 |
| | | | 563 | 1404 | 3.32 |
| | | | 471 | 1372 | 3.13 |
| | HIP 2 | HT1 | 346 | 1466 | 10.51 |
| | | | 344 | 1365 | 6.88 |
| | | HT2 | 623 | 808 | 1.74 |
| | | | 661 | 1059 | 5.62 |
| | | HT3 | 622 | 1497 | 7.31 |
| | | | 563 | 1490 | 6.23 |
| | | | 590 | 1420 | 3.58 |
| Alloy 2 | HIP 1 | HT1 | 878 | 1240 | 2.76 |
| | | HT2 | 1061 | 1174 | 2.02 |
| | | | 1011 | 1175 | 1.77 |
| | | HT3 | 1142 | 1450 | 3.20 |
| | HIP 2 | HT2 | 930 | 1092 | 1.56 |
| | | | 1041 | 1223 | 3.32 |
| | | | 964 | 1107 | 1.74 |
| | | HT3 | 1025 | 1443 | 6.86 |
| | | | 1113 | 1453 | 6.09 |
| | | | 1067 | 1432 | 3.59 |
| Alloy 3 | HIP 1 | HT1 | 538 | 1023 | 3.18 |
| | | | 471 | 903 | 2.62 |
| | | HT2 | 863 | 1051 | 1.75 |
| | | | 944 | 1014 | 1.02 |
| | | | 939 | 1060 | 1.64 |
| | | HT3 | 820 | 1650 | 3.14 |
| | | | 881 | 1532 | 2.02 |
| | | | 879 | 1118 | 1.02 |
| | HIP 2 | HT1 | 447 | 1419 | 6.60 |
| | | | 395 | 950 | 2.23 |
| | | HT2 | 1014 | 1186 | 4.37 |
| | | | 1025 | 1083 | 1.79 |
| | | | 1000 | 1214 | 5.33 |
| | | HT3 | 1097 | 1421 | 3.8 |
| | | | 977 | 1405 | 2.57 |
| Alloy 4 | HIP 1 | HT1 | 810 | 984 | 2.8 |
| | | | 849 | 1155 | 4.23 |
| | | | 831 | 1135 | 4.12 |
| | HIP 2 | HT1 | 772 | 1337 | 7.98 |
| | | HT2 | 1055 | 1185 | 2.07 |
| | | | 1030 | 1088 | 1.5 |
| | | HT3 | 911 | 1474 | 4.63 |
| | | | 1193 | 1491 | 4.53 |
| Alloy 5 | HIP 1 | HT1 | 809 | 1075 | 2.53 |
| | | | 769 | 1387 | 8.2 |
| | | | 823 | 1017 | 2.28 |
| | | HT2 | 1184 | 1223 | 1.01 |
| | | | 1179 | 1200 | 1.07 |
| | | HT3 | 1174 | 1549 | 4.49 |
| | | | 1038 | 1502 | 2.44 |
| | | | 1223 | 1549 | 5.71 |
| Alloy 6 | HIP 1 | HT1 | 844 | 1093 | 2.92 |
| | | | 427 | 1010 | 2.61 |
| | | | 877 | 1074 | 2.64 |
| | | HT3 | 1067 | 1400 | 2.4 |
| | | | 939 | 1457 | 4.9 |
| Alloy 7 | HIP 1 | HT1 | 859 | 1231 | 4.21 |
| | | | 763 | 992 | 2.02 |
| | | HT3 | 941 | 1527 | 3.94 |
| | | | 961 | 1477 | 2.33 |
| | | | 945 | 1423 | 3.76 |
| Alloy 8 | HIP 1 | HT1 | 634 | 1051 | 3.22 |
| | | | 795 | 1037 | 2.59 |
| | | | 840 | 1016 | 2.72 |
| | | HT3 | 1106 | 1549 | 3.15 |
| | | | 1004 | 1427 | 1.94 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | HIP 2 | HT1 | 652 | 1284 | 4.42 |
| | | | 630 | 1418 | 8.03 |
| | | | 651 | 970 | 2.15 |
| | | HT3 | 1135 | 1443 | 2.3 |
| | | | 1081 | 1497 | 3.46 |
| Alloy 9 | HIP 1 | HT1 | 609 | 1398 | 5.14 |
| | | | 530 | 1182 | 3.19 |
| | | | 527 | 1241 | 3.35 |
| | | HT3 | 1057 | 1394 | 3.31 |
| | | | 1124 | 1436 | 2.98 |
| | | | 1149 | 1445 | 4.41 |
| Alloy 10 | HIP 1 | HT1 | 577 | 1221 | 2.1 |
| | | | 606 | 1478 | 3.8 |
| | | | 580 | 1225 | 2.2 |
| | | | 567 | 1075 | 1.7 |
| | | HT3 | 1117 | 1485 | 3.7 |
| | | | 994 | 1467 | 3.3 |
| | | | 846 | 1165 | 2.4 |
| | | | 1052 | 1368 | 1.8 |
| | | | 1127 | 1487 | 4.1 |
| | HIP 2 | HT1 | 550 | 1345 | 2.8 |
| | | | 627 | 1470 | 4.1 |
| | | | 617 | 1225 | 2 |
| | | HT3 | 958 | 1441 | 3.9 |
| | | | 1043 | 1448 | 8.5 |
| | | | 1013 | 1423 | 7.1 |
| Alloy 11 | HIP 1 | HT2 | 477 | 767 | 4.97 |
| | | | 487 | 1117 | 21.05 |
| | | | 445 | 917 | 13.43 |
| | | HT3 | 449 | 1057 | 19.24 |
| | | | 456 | 875 | 10.3 |
| | | HT7 | 412 | 793 | 8.64 |
| | | | 436 | 894 | 13.47 |
| | | | 396 | 809 | 9.91 |
| | HIP 2 | HT2 | 390 | 934 | 15.5 |
| | | | 349 | 762 | 8.76 |
| | | | 361 | 998 | 18.96 |
| | | HT3 | 390 | 937 | 15.28 |
| | | | 397 | 794 | 8.87 |
| | | | 388 | 1125 | 25 |
| | | HT7 | 373 | 987 | 17.76 |
| Alloy 12 | HIP 1 | HT2 | 454 | 888 | 7.49 |
| | | | 493 | 968 | 12.64 |
| | | | 418 | 854 | 6.69 |
| | | HT3 | 429 | 999 | 15.37 |
| | | | 444 | 1041 | 17.25 |
| | | HT7 | 443 | 879 | 10.05 |
| Alloy 13 | HIP 1 | HT2 | 473 | 938 | 8.11 |
| | | HT3 | 468 | 941 | 8.73 |
| | | | 444 | 765 | 2.48 |
| | | HT7 | 443 | 809 | 3.16 |
| | | | 459 | 971 | 9.41 |
| | | | 460 | 854 | 4.19 |
| Alloy 14 | HIP 1 | HT2 | 464 | 902 | 11.54 |
| | | HT3 | 450 | 1051 | 14.37 |
| | HIP 2 | HT2 | 400 | 1251 | 19.73 |
| | | | 374 | 1194 | 18.29 |
| | | | 413 | 1241 | 19.56 |
| | | | 384 | 1209 | 18.65 |
| | | HT3 | 331 | 1042 | 16.08 |
| | | HT7 | 394 | 980 | 14.03 |
| | | | 394 | 865 | 10.89 |
| | | | 415 | 933 | 13.29 |
| Alloy 15 | HIP 1 | HT2 | 466 | 761 | 3.03 |
| | | HT3 | 495 | 977 | 11.73 |
| | | | 488 | 1053 | 15.13 |
| | HIP 2 | HT2 | 370 | 1071 | 22.28 |
| | | | 380 | 1014 | 17.84 |
| | | | 359 | 831 | 7.95 |
| | | | 345 | 904 | 11.12 |
| | | HT3 | 363 | 813 | 7.6 |
| | | | 398 | 1132 | 28.98 |
| | | | 363 | 908 | 12.25 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 16 | HIP 1 | HT2 | 533 | 1061 | 11.71 |
| | | | 517 | 1025 | 7.76 |
| | | | 510 | 908 | 4.32 |
| | | HT3 | 557 | 1032 | 10.09 |
| | | | 523 | 1037 | 13.36 |
| | | HT7 | 559 | 1042 | 10.69 |
| | | | 515 | 1044 | 11.27 |
| Alloy 17 | HIP 1 | HT2 | 479 | 1004 | 9.2 |
| | | HT3 | 444 | 578 | 2.31 |
| | | | 461 | 1124 | 10.78 |
| | | HT7 | 515 | 805 | 6.59 |
| | HIP 2 | HT2 | 366 | 758 | 8.3 |
| | | | 362 | 1093 | 11.96 |
| | | | 360 | 1218 | 13.41 |
| | | HT3 | 355 | 796 | 8.4 |
| | | | 399 | 1362 | 15.43 |
| | | HT7 | 394 | 1117 | 12.59 |
| | | | 409 | 1258 | 13.95 |
| | HIP 4 | HT2 | 404 | 1245 | 14.05 |
| | | | 387 | 1079 | 11.93 |
| | | HT3 | 367 | 747 | 8.25 |
| | | | 362 | 1055 | 12.13 |
| | | HT7 | 374 | 962 | 11.03 |
| | | | 358 | 638 | 6.04 |
| Alloy 18 | HIP 1 | HT2 | 505 | 922 | 7.88 |
| | | HT3 | 510 | 1019 | 11.4 |
| | | | 521 | 791 | 3.44 |
| | | HT7 | 472 | 917 | 8.32 |
| | HIP 2 | HT2 | 388 | 1141 | 17.95 |
| | | | 472 | 1124 | 16.96 |
| | | | 410 | 1172 | 18.82 |
| | | | 376 | 973 | 14.48 |
| | | | 316 | 687 | 6.07 |
| | | HT7 | 425 | 1171 | 21.24 |
| | | | 430 | 1235 | 23.39 |
| | | | 439 | 1160 | 19.47 |
| | | | 453 | 1135 | 21.15 |
| | HIP 4 | HT2 | 360 | 999 | 12.3 |
| | | | 347 | 956 | 14.92 |
| | | | 342 | 861 | 10.31 |
| | | | 375 | 926 | 11.56 |
| | | | 315 | 986 | 16.2 |
| | | | 326 | 1029 | 17.69 |
| | | HT3 | 296 | 462 | 2.04 |
| | | | 365 | 1137 | 21.85 |
| | | | 323 | 858 | 13.41 |
| | | | 342 | 835 | 11.64 |
| | | | 352 | 972 | 16.07 |
| | | HT7 | 378 | 1132 | 20.86 |
| | | | 365 | 812 | 9.66 |
| | | | 357 | 846 | 10.53 |
| | | | 384 | 1066 | 17.58 |
| | | | 412 | 723 | 5.81 |
| | | | 415 | 890 | 10.86 |
| | | | 462 | 1016 | 15.01 |
| Alloy 19 | HIP 1 | HT2 | 513 | 1096 | 13.04 |
| | | HT3 | 540 | 746 | 1.57 |
| | | | 529 | 978 | 6.98 |
| | | HT7 | 544 | 1087 | 13.3 |
| | HIP 4 | HT2 | 445 | 918 | 10.3 |
| | | | 469 | 1074 | 22.39 |
| | | HT3 | 445 | 873 | 7.94 |
| | | | 477 | 1001 | 14.49 |
| | | HT7 | 469 | 927 | 11.41 |
| | | | 455 | 947 | 12.96 |
| Alloy 20 | HIP 1 | HT2 | 376 | 979 | 3.7 |
| | | HT3 | 329 | 1000 | 4.75 |
| | | | 326 | 587 | 3.02 |
| | | HT7 | 325 | 911 | 3.54 |
| | | | 321 | 860 | 3.68 |
| | HIP 2 | HT2 | 399 | 1482 | 6.29 |
| | | | 308 | 1165 | 4.84 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT3 | 327 | 1424 | 9.41 |
| | | | 326 | 1340 | 8.92 |
| | | HT7 | 289 | 1479 | 7.02 |
| | | | 321 | 1559 | 15.07 |
| | | | 294 | 1339 | 6.13 |
| Alloy 21 | HIP 1 | HT2 | 455 | 948 | 7.15 |
| | | | 424 | 1054 | 8.54 |
| | | HT3 | 445 | 1191 | 12.1 |
| | | HT7 | 429 | 1047 | 8.86 |
| | HIP 4 | HT2 | 362 | 1085 | 11 |
| | | | 373 | 1091 | 11.24 |
| | | HT3 | 402 | 1382 | 18.45 |
| | | | 413 | 1283 | 16.31 |
| | | HT7 | 371 | 986 | 9.54 |
| | | | 368 | 837 | 6.6 |
| | | | 431 | 1347 | 18.39 |
| Alloy 22 | HIP 1 | HT2 | 460 | 901 | 4.5 |
| | | | 555 | 968 | 6.12 |
| | | HT3 | 496 | 865 | 4.36 |
| | | | 511 | 945 | 6.68 |
| | | HT7 | 537 | 931 | 5.11 |
| | | | 482 | 983 | 7.45 |
| | HIP 4 | HT2 | 450 | 844 | 5.87 |
| | | | 475 | 785 | 3.61 |
| | | | 458 | 994 | 11.66 |
| | | HT3 | 644 | 1052 | 11.35 |
| | | | 464 | 1094 | 15.71 |
| | | HT7 | 525 | 1087 | 14.32 |
| | | | 476 | 1143 | 17.02 |
| Alloy 23 | HIP 1 | HT2 | 737 | 1056 | 1.35 |
| | | | 910 | 1063 | 1.03 |
| | | HT3 | 557 | 1544 | 4.31 |
| | | | 486 | 1130 | 1.82 |
| | | HT7 | 741 | 1099 | 1.55 |
| | HIP 4 | HT2 | 779 | 1432 | 4.51 |
| | | HT7 | 651 | 1097 | 1.47 |
| | | | 478 | 1543 | 4.54 |
| Alloy 24 | HIP 1 | HT2 | 409 | 803 | 4.73 |
| | | HT3 | 450 | 1154 | 7.59 |
| | | | 431 | 1248 | 7.69 |
| | | HT7 | 476 | 1185 | 9.07 |
| | | | 445 | 757 | 4.19 |
| | HIP 2 | HT2 | 369 | 1094 | 8.47 |
| | | | 369 | 1230 | 10.39 |
| | | HT7 | 383 | 849 | 6.26 |
| Alloy 25 | HIP 1 | HT2 | 366 | 728 | 2.63 |
| | | | 381 | 854 | 4.32 |
| | | | 396 | 1130 | 9.25 |
| | | HT3 | 374 | 744 | 2.78 |
| | | | 379 | 500 | 1.01 |
| | | HT7 | 401 | 868 | 4.55 |
| | HIP 2 | HT2 | 338 | 991 | 6.87 |
| | | | 347 | 1062 | 9.99 |
| | | | 354 | 1208 | 12.11 |
| | | HT3 | 364 | 1053 | 10.18 |
| | | | 354 | 1101 | 10.15 |
| | | | 338 | 1003 | 9.05 |
| | | HT7 | 356 | 1053 | 9.41 |
| | | | 388 | 1263 | 15.58 |
| | | | 319 | 918 | 5.95 |
| Alloy 26 | HIP 2 | HT2 | 412 | 911 | 14.5 |
| | | | 464 | 775 | 4.83 |
| | | HT3 | 426 | 757 | 5.75 |
| | | | 404 | 995 | 17.44 |
| | | HT7 | 425 | 801 | 5.95 |
| | | | 442 | 1077 | 18.93 |
| | HIP 4 | HT7 | 418 | 1090 | 23.96 |
| | | | 391 | 1004 | 18.05 |
| | HIP 3 | HT2 | 442 | 1102 | 24.5 |
| Alloy 27 | HIP 2 | HT2 | 431 | 989 | 13.69 |
| | | | 457 | 901 | 8.03 |
| | | | 464 | 878 | 7.81 |
| | | | 383 | 764 | 4.79 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 398 | 764 | 4.71 |
| | | | 407 | 953 | 15.17 |
| | | HT7 | 449 | 951 | 11.93 |
| | | | 457 | 943 | 10.47 |
| | HIP 4 | HT2 | 392 | 989 | 18.68 |
| | | | 404 | 785 | 5.6 |
| | | | 365 | 800 | 7.02 |
| | | HT3 | 409 | 961 | 14.29 |
| | | | 437 | 1113 | 25.13 |
| | | | 454 | 1147 | 28.31 |
| Alloy 28 | HIP 2 | HT2 | 405 | 915 | 9.78 |
| | | | 393 | 1016 | 17.1 |
| | | | 394 | 948 | 12.07 |
| | | HT3 | 458 | 1033 | 14.41 |
| | | | 480 | 1037 | 13.77 |
| | | | 445 | 908 | 7.38 |
| | HIP 4 | HT2 | 359 | 979 | 14.53 |
| | | | 405 | 901 | 8.59 |
| | | | 383 | 864 | 7.31 |
| | | HT7 | 417 | 949 | 11.62 |
| | | | 409 | 987 | 14.86 |
| | | | 444 | 982 | 14.75 |
| Alloy 29 | HIP 2 | HT2 | 365 | 1111 | 15.18 |
| | | | 367 | 976 | 12.66 |
| | | | 375 | 993 | 13.65 |
| | | HT3 | 407 | 1061 | 14.26 |
| | | | 367 | 995 | 13.38 |
| | | | 373 | 885 | 10.79 |
| | | HT7 | 403 | 1047 | 13.75 |
| | | | 330 | 1037 | 13.92 |
| | | | 403 | 1128 | 15.29 |
| | HIP 4 | HT2 | 391 | 910 | 10.95 |
| | | | 385 | 987 | 13.18 |
| | | | 396 | 1019 | 13.36 |
| | | HT3 | 409 | 946 | 11.5 |
| | | | 432 | 972 | 12.18 |
| | | HT7 | 386 | 1099 | 15.58 |
| | | | 404 | 1060 | 15.13 |
| Alloy 30 | HIP 2 | HT3 | 422 | 1080 | 15.49 |
| | | | 450 | 1132 | 17.81 |
| | | HT7 | 426 | 932 | 9.9 |
| | | | 425 | 1124 | 19.76 |
| | | | 441 | 1121 | 17.46 |
| | | HT3 | 403 | 948 | 13.12 |
| | | | 408 | 1026 | 15.48 |
| | | | 388 | 952 | 12.29 |
| | | HT7 | 422 | 1066 | 18.06 |
| | | | 392 | 1127 | 21.01 |
| Alloy 31 | HIP 2 | HT2 | 549 | 1004 | 12.6 |
| | | | 497 | 942 | 9.94 |
| | | | 411 | 842 | 6.21 |
| | | HT3 | 580 | 1046 | 16.39 |
| | | | 461 | 974 | 11.72 |
| | | HT7 | 442 | 789 | 4.27 |
| | | | 458 | 957 | 11.07 |
| | HIP 4 | HT3 | 686 | 963 | 9.04 |
| | | | 623 | 1082 | 16.87 |
| | | | 437 | 990 | 12.25 |
| Alloy 32 | HIP 2 | HT2 | 387 | 1072 | 16.87 |
| | | | 395 | 883 | 12.46 |
| | | | 376 | 755 | 7.7 |
| | | HT3 | 405 | 1027 | 15.4 |
| | | | 428 | 1134 | 18.66 |
| | | | 407 | 700 | 6.59 |
| | | HT7 | 410 | 818 | 9.53 |
| | | | 425 | 855 | 10.61 |
| | | | 401 | 838 | 10.47 |
| | | | 400 | 985 | 14.54 |
| | HIP 4 | HT2 | 380 | 1083 | 17.32 |
| | | | 394 | 1043 | 16.64 |
| | | | 356 | 722 | 6.32 |
| | | HT3 | 390 | 968 | 13.88 |
| | | | 373 | 879 | 11.89 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 33 | HIP 2 | HT2 | 370 | 1002 | 16.4 |
| | | | 359 | 782 | 8.27 |
| | | | 350 | 1034 | 19.83 |
| | | HT3 | 417 | 901 | 10.25 |
| | | | 391 | 1023 | 17.56 |
| | | | 383 | 980 | 18.54 |
| | | HT7 | 374 | 966 | 15.17 |
| | | | 361 | 916 | 12.33 |
| | HIP 3 | HT2 | 375 | 1065 | 19.62 |
| | | | 378 | 1115 | 22.56 |
| | | | 379 | 1131 | 23.61 |
| | | HT3 | 370 | 1036 | 17.8 |
| | | | 387 | 953 | 13.28 |
| | | | 379 | 1064 | 18.76 |
| Alloy 34 | HIP 2 | HT2 | 505 | 1032 | 16.25 |
| | | | 414 | 1003 | 14.17 |
| | | HT7 | 450 | 941 | 10.23 |
| | | | 449 | 1052 | 17.83 |
| | | | 393 | 979 | 12.64 |
| | HIP 4 | HT2 | 418 | 849 | 6.09 |
| | | | 389 | 921 | 9.7 |
| | | HT7 | 438 | 1021 | 16.59 |
| | | | 422 | 1044 | 20.51 |
| | | | 450 | 951 | 11.58 |
| Alloy 35 | HIP 2 | HT2 | 316 | 1127 | 5.7 |
| | | | 302 | 823 | 3.66 |
| | | HT3 | 315 | 1077 | 6.3 |
| | | | 328 | 1170 | 7.19 |
| | | | 320 | 1074 | 6.84 |
| | | HT7 | 320 | 1246 | 7.38 |
| | | | 318 | 1210 | 7.29 |
| | HIP 4 | HT3 | 284 | 1128 | 6.45 |
| | | | 307 | 1462 | 9.62 |
| | | | 314 | 1532 | 13.02 |
| | | HT7 | 314 | 1454 | 10.68 |
| Alloy 36 | HIP 2 | HT2 | 380 | 1141 | 10.29 |
| | | | 331 | 616 | 3.9 |
| | | | 384 | 986 | 8.12 |
| | | HT7 | 358 | 1036 | 11.34 |
| | | | 305 | 745 | 5.62 |
| | | | 386 | 1245 | 14.86 |
| | HIP 4 | HT2 | 350 | 1285 | 12.93 |
| | | | 348 | 1189 | 10.25 |
| | | HT3 | 378 | 1245 | 12.81 |
| | | | 382 | 1195 | 11.43 |
| Alloy 37 | HIP 2 | HT2 | 409 | 1175 | 18.85 |
| | | | 385 | 1005 | 12.76 |
| | | HT3 | 430 | 1154 | 15.67 |
| | | | 436 | 1067 | 11.94 |
| | | | 411 | 1204 | 17.28 |
| | | HT7 | 433 | 1072 | 13.97 |
| | | | 444 | 1026 | 11.55 |
| | | | 437 | 1104 | 14.08 |
| | | | 415 | 1058 | 14.89 |
| | HIP 4 | HT2 | 398 | 976 | 9.83 |
| | | | 428 | 1048 | 12.69 |
| | | | 422 | 1056 | 12.1 |
| | | | 343 | 891 | 10.04 |
| | | | 358 | 1071 | 15.95 |
| | | | 368 | 1069 | 16.33 |
| | | | 349 | 959 | 12.05 |
| | | HT3 | 429 | 1232 | 20.42 |
| | | | 421 | 1060 | 13.59 |
| | | | 411 | 1020 | 11.18 |
| | | | 396 | 992 | 14.04 |
| | | | 366 | 886 | 10.35 |
| | | | 398 | 1009 | 13.39 |
| | | HT7 | 415 | 885 | 8.8 |
| | | | 414 | 1140 | 18.01 |
| | | | 411 | 973 | 11.8 |
| | | | 399 | 993 | 14.03 |
| | | | 379 | 1076 | 16.39 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 38 | HIP 2 | HT2 | 357 | 1215 | 9.68 |
| | | HT7 | 399 | 1465 | 13.3 |
| | | | 395 | 1235 | 8.64 |
| | HIP 4 | HT2 | 358 | 1481 | 15.55 |
| | | | 350 | 1182 | 9.96 |
| | | HT3 | 348 | 1466 | 15.37 |
| | | | 358 | 1124 | 9.22 |
| | | | 369 | 1432 | 13.11 |
| | | HT7 | 377 | 1380 | 13.19 |
| | | | 355 | 1339 | 11.75 |
| Alloy 39 | HIP 2 | HT2 | 380 | 1249 | 13.95 |
| | | | 366 | 984 | 8.23 |
| | | | 367 | 1216 | 13.79 |
| | | HT3 | 387 | 1271 | 15 |
| | | | 391 | 1175 | 12.19 |
| | | HT7 | 399 | 1150 | 12.21 |
| | HIP 4 | HT2 | 316 | 945 | 8.95 |
| | | | 321 | 884 | 8.42 |
| | | HT3 | 371 | 1131 | 12.55 |
| | | | 341 | 1095 | 11.89 |
| | | HT7 | 355 | 1052 | 10.83 |
| | | | 361 | 981 | 10.04 |
| Alloy 40 | HIP 2 | HT2 | 460 | 1153 | 17.67 |
| | | | 447 | 1019 | 11.86 |
| | | | 467 | 1067 | 12.71 |
| | | HT3 | 461 | 1026 | 11.14 |
| | | | 431 | 938 | 7.65 |
| | | | 418 | 1009 | 9.73 |
| | | HT7 | 418 | 974 | 10.36 |
| | | | 417 | 1175 | 13.71 |
| | | | 376 | 1233 | 14.17 |
| | HIP 4 | HT3 | 448 | 1169 | 18.28 |
| | | | 426 | 1045 | 14.44 |
| | | | 429 | 969 | 11.42 |
| | | HT7 | 432 | 1041 | 14.25 |
| | | | 424 | 937 | 10.91 |
| Alloy 41 | HIP 2 | HT2 | 376 | 1000 | 10.64 |
| | | | 387 | 1197 | 12.99 |
| | | | 381 | 1174 | 12.8 |
| | | | 372 | 1228 | 15.14 |
| | | | 372 | 956 | 11.03 |
| | | | 376 | 979 | 11.3 |
| | | HT3 | 439 | 1396 | 18.32 |
| | | | 455 | 984 | 11.34 |
| | | HT7 | 394 | 1317 | 15.35 |
| | | | 425 | 1187 | 13.07 |
| | | | 464 | 1111 | 13.41 |
| | | | 458 | 1084 | 12.86 |
| | | | 427 | 931 | 10.86 |
| | HIP 4 | HT2 | 374 | 1204 | 14.49 |
| | | | 396 | 1250 | 14.61 |
| | | HT7 | 415 | 757 | 7.33 |
| | | | 424 | 1369 | 18.23 |
| | | | 402 | 845 | 9.26 |
| | | | 413 | 792 | 8.24 |
| Alloy 42 | HIP 2 | HT2 | 366 | 804 | 8.05 |
| | | | 362 | 757 | 6.72 |
| | | HT3 | 387 | 1105 | 17.42 |
| | | | 406 | 1170 | 18.23 |
| | | HT7 | 409 | 1145 | 18.05 |
| | HIP 4 | HT2 | 438 | 919 | 11.2 |
| | | | 442 | 1042 | 14.71 |
| | | HT3 | 417 | 996 | 14.3 |
| | | | 379 | 907 | 11.7 |
| | | HT7 | 431 | 917 | 11.71 |
| | | | 414 | 1115 | 18.38 |
| Alloy 43 | HIP 2 | HT2 | 466 | 929 | 9.56 |
| | | | 442 | 888 | 8.06 |
| | | HT3 | 416 | 1009 | 12.7 |
| | | | 464 | 1140 | 19.4 |
| | | HT7 | 444 | 795 | 4.65 |
| | HIP 4 | | 412 | 1038 | 15.53 |
| | | | 444 | 1051 | 15.35 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | HIP 3 | HT2 | 438 | 1158 | 22.88 |
| | | | 438 | 1118 | 20.27 |
| | | HT3 | 433 | 856 | 7.16 |
| | | | 446 | 1143 | 19.35 |
| | | | 436 | 991 | 11.68 |
| Alloy 44 | HIP 4 | HT3 | 745 | 1485 | 3.09 |
| | | | 720 | 1479 | 3.24 |
| | | HT7 | 622 | 1375 | 2.61 |
| | | | 590 | 1367 | 2.09 |
| Alloy 45 | HIP 2 | HT2 | 392 | 1290 | 4.78 |
| | | | 384 | 1250 | 4.41 |
| | | | 383 | 1229 | 4.63 |
| | | HT3 | 347 | 1388 | 7.03 |
| | | | 356 | 1390 | 7.22 |
| | | | 364 | 1402 | 7.36 |
| | HIP 4 | HT2 | 293 | 1171 | 5.25 |
| | | | 323 | 1190 | 5.85 |
| | | | 318 | 1456 | 7.45 |
| | | HT3 | 320 | 1177 | 5.95 |
| | | | 336 | 1410 | 8.63 |
| | | HT7 | 327 | 1154 | 6.23 |
| | | | 351 | 1347 | 8.76 |
| | | | 351 | 1561 | 13.31 |
| Alloy 46 | HIP 2 | HT2 | 320 | 808 | 5.00 |
| | | | 347 | 1209 | 11.42 |
| | | | 348 | 758 | 4.59 |
| | | HT7 | 310 | 851 | 5.53 |
| | | | 354 | 1110 | 9.95 |
| | | | 325 | 970 | 6.8 |
| | | | 338 | 1078 | 8.63 |
| | HIP 4 | HT2 | 384 | 1281 | 12.25 |
| | | HT3 | 372 | 971 | 7.12 |
| | | | 399 | 1270 | 11.8 |
| | | HT7 | 322 | 810 | 4.69 |
| Alloy 47 | HIP 2 | HT2 | 1016 | 1465 | 3.64 |
| | | | 1036 | 1461 | 2.71 |
| | | | 1013 | 1384 | 1.68 |
| | | HT3 | 847 | 1474 | 3.22 |
| | | | 970 | 1531 | 7.67 |
| | | | 1026 | 1477 | 5.17 |
| Alloy 48 | HIP 2 | HT2 | 686 | 1340 | 4.47 |
| | | HT3 | 350 | 1426 | 3.93 |
| | | | 392 | 1583 | 5.46 |
| | | HT7 | 395 | 1269 | 2.62 |
| | | | 505 | 1085 | 1.69 |
| | HIP 4 | HT7 | 599 | 1521 | 3.93 |
| | HIP 3 | HT3 | 530 | 1514 | 3.75 |
| Alloy 49 | HIP 2 | HT2 | 421 | 1347 | 5.41 |
| | | | 423 | 1452 | 7.01 |
| | | | 403 | 1443 | 8.90 |
| | | HT3 | 417 | 1596 | 10.89 |
| | | | 382 | 1384 | 7.03 |
| | | HT7 | 372 | 1458 | 7.92 |
| | | | 391 | 1537 | 9.51 |
| | | | 360 | 1302 | 6.4 |
| | HIP 4 | HT2 | 410 | 1423 | 8.39 |
| | | | 428 | 1356 | 6.43 |
| | | HT3 | 447 | 1310 | 6.53 |
| | | | 396 | 1268 | 5.89 |
| | | HT7 | 362 | 1453 | 8.61 |
| | | | 385 | 1404 | 8.17 |
| Alloy 50 | HIP 2 | HT2 | 528 | 959 | 11.74 |
| | | | 467 | 943 | 11.79 |
| | | HT3 | 470 | 968 | 11.59 |
| | | | 507 | 1079 | 14.9 |
| | | HT7 | 493 | 900 | 9.08 |
| | | | 522 | 984 | 11.85 |
| | | | 477 | 999 | 12.73 |
| | HIP 4 | HT2 | 470 | 1160 | 20.81 |
| | | | 488 | 1193 | 21.8 |
| | | | 442 | 1160 | 20.13 |
| | | HT3 | 436 | 1208 | 22.93 |
| | | | 449 | 1175 | 20.99 |
| | | | 482 | 1215 | 23.2 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT7 | 409 | 1039 | 18.52 |
| | | | 431 | 953 | 14.35 |
| Alloy 51 | HIP 2 | HT2 | 556 | 936 | 8.4 |
| | | | 546 | 909 | 7.02 |
| | | HT7 | 524 | 947 | 11.3 |
| | HIP 4 | HT2 | 450 | 830 | 6.24 |
| | | | 505 | 1002 | 14.39 |
| | | HT3 | 498 | 966 | 11.92 |
| | | | 487 | 987 | 12.83 |
| | | | 491 | 1025 | 16.23 |
| | | HT7 | 510 | 1110 | 20.02 |
| | | | 522 | 984 | 12.59 |
| Alloy 52 | HIP 2 | HT2 | 552 | 1036 | 10.25 |
| | | | 572 | 993 | 5.93 |
| | | HT3 | 533 | 997 | 7.08 |
| | | | 549 | 1020 | 8.79 |
| | | HT7 | 544 | 991 | 6.39 |
| Alloy 56 | HIP 2 | HT2 | 479 | 798 | 6.01 |
| | | | 429 | 1007 | 9.25 |
| | | | 458 | 1052 | 9.65 |
| | | HT3 | 458 | 751 | 6.72 |
| | | | 448 | 1187 | 11.98 |
| | | | 450 | 1163 | 11.22 |
| | | | 460 | 1173 | 11.2 |
| | | HT7 | 437 | 892 | 8.73 |
| | | | 453 | 1199 | 12.14 |
| | | | 434 | 1219 | 13.16 |
| | HIP 4 | HT2 | 446 | 1252 | 13.37 |
| | | | 464 | 1239 | 13.05 |
| | | | 445 | 1231 | 12.92 |
| | | HT7 | 441 | 1290 | 15.8 |
| | | | 401 | 888 | 8.92 |
| | | | 417 | 1186 | 13.79 |
| Alloy 57 | HIP 2 | HT2 | 471 | 1061 | 12.48 |
| | | | 465 | 837 | 6.53 |
| | | | 466 | 1011 | 11.61 |
| | | HT3 | 444 | 1238 | 17.04 |
| | | | 448 | 1210 | 16.54 |
| | | HT7 | 427 | 1015 | 12.89 |
| | | | 439 | 1053 | 13.32 |
| | | | 416 | 1175 | 17.07 |
| | | HT3 | 428 | 1141 | 15.48 |
| | | | 440 | 1146 | 15.56 |
| | | HT7 | 406 | 933 | 11.09 |
| Alloy 58 | HIP 2 | HT2 | 393 | 939 | 9.04 |
| | | | 430 | 1033 | 12.67 |
| | | HT3 | 469 | 1143 | 16.64 |
| | | | 472 | 1163 | 16.99 |
| | | | 452 | 983 | 9.13 |
| | | HT7 | 454 | 987 | 11.27 |
| | | | 433 | 1134 | 18.2 |
| | | | 354 | 938 | 9.75 |
| | HIP 4 | HT2 | 433 | 957 | 9.14 |
| | | | 399 | 1084 | 15.54 |
| | | | 390 | 1060 | 14.18 |
| | | HT3 | 440 | 1144 | 17.95 |
| | | | 408 | 886 | 6.42 |
| | | | 456 | 1141 | 17.1 |
| | | HT7 | 430 | 1023 | 13.34 |
| | | | 416 | 973 | 11.43 |
| | | | 419 | 1070 | 16.47 |
| Alloy 59 | HIP 2 | HT2 | 350 | 793 | 6.02 |
| | | | 359 | 941 | 11.23 |
| | | | 375 | 842 | 7.7 |
| | | HT3 | 378 | 1126 | 18.3 |
| | | | 391 | 905 | 10.25 |
| | | | 381 | 1024 | 14.34 |
| | | HT7 | 377 | 1079 | 17.22 |
| | | | 384 | 1023 | 14.95 |
| | | | 370 | 967 | 12.89 |
| | HIP 3 | HT2 | 445 | 1017 | 12.44 |
| | | | 426 | 1005 | 12.4 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 430 | 941 | 9.91 |
| | | | 460 | 1024 | 12.42 |
| | | HT7 | 432 | 1140 | 17.82 |
| | | | 446 | 1140 | 18.17 |
| | | | 388 | 1107 | 17.4 |
| | | | 399 | 1142 | 18.79 |
| | | | 401 | 1107 | 17.13 |
| Alloy 60 | HIP 2 | HT2 | 330 | 817 | 11.36 |
| | | | 329 | 915 | 14.38 |
| | | | 320 | 897 | 13.61 |
| | | | 320 | 832 | 11.42 |
| | | HT3 | 321 | 865 | 12.86 |
| | | | 325 | 793 | 10.45 |
| | | | 373 | 1005 | 15.94 |
| | | | 423 | 1036 | 18.15 |
| | | | 381 | 1053 | 19.07 |
| | | HT7 | 388 | 864 | 11.88 |
| | | | 393 | 999 | 17.87 |
| | | | 340 | 986 | 17.3 |
| | | | 349 | 929 | 15.35 |
| | | | 338 | 1068 | 20.94 |
| | HIP 3 | HT2 | 398 | 853 | 10.07 |
| | | | 370 | 960 | 14.7 |
| | | | 423 | 890 | 11.31 |
| | | | 401 | 885 | 11.25 |
| | | | 387 | 868 | 11.06 |
| | | HT3 | 357 | 869 | 11.2 |
| | | | 375 | 969 | 15.59 |
| | | | 368 | 837 | 11.24 |
| | | | 380 | 1019 | 18.86 |
| | | | 348 | 1017 | 18.42 |
| | | | 353 | 1024 | 19.65 |
| Alloy 61 | HIP 2 | HT2 | 326 | 1020 | 17.22 |
| | | | 351 | 1008 | 17.42 |
| | | HT7 | 387 | 775 | 7.27 |
| | | | 383 | 850 | 11.42 |
| | | | 425 | 1031 | 17.99 |
| | HIP 3 | HT3 | 379 | 1064 | 18.76 |
| | | | 386 | 1067 | 19.45 |
| | | | 371 | 1035 | 17.95 |
| | | HT7 | 380 | 906 | 11.42 |
| | | | 373 | 923 | 12.63 |
| | | | 400 | 957 | 14.01 |
| Alloy 62 | HIP 2 | HT2 | 321 | 700 | 7.19 |
| | | | 329 | 805 | 10.81 |
| | | | 329 | 878 | 13.93 |
| | | | 316 | 832 | 12.35 |
| | | HT3 | 383 | 1055 | 20.22 |
| | | | 375 | 897 | 14.4 |
| | | | 322 | 986 | 18.01 |
| | | HT7 | 319 | 1019 | 20.45 |
| | | | 390 | 998 | 17.28 |
| | | | 395 | 839 | 10.63 |
| | HIP 3 | HT2 | 345 | 963 | 16.53 |
| | | | 334 | 959 | 16.53 |
| | | | 322 | 995 | 17.48 |
| | | HT3 | 354 | 949 | 16.79 |
| | | | 362 | 872 | 13.21 |
| | | HT7 | 388 | 957 | 15.23 |
| | | | 372 | 1103 | 20.43 |
| Alloy 63 | HIP 2 | HT2 | 332 | 778 | 8.17 |
| | | | 359 | 939 | 13.5 |
| | | HT3 | 382 | 930 | 12.68 |
| | | | 337 | 863 | 11.6 |
| | | | 354 | 951 | 14.79 |
| | | HT7 | 372 | 823 | 9.39 |
| | | | 411 | 1011 | 15.59 |
| | | | 377 | 1019 | 15.98 |
| | HIP 3 | HT2 | 438 | 905 | 12.73 |
| | | | 427 | 943 | 11.67 |
| | | | 400 | 1024 | 16.72 |
| | | HT3 | 332 | 807 | 9.68 |
| | | | 357 | 856 | 11.47 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 375 | 920 | 13.19 |
| | | | 423 | 856 | 11.8 |
| | | HT7 | 386 | 964 | 13.58 |
| | | | 417 | 885 | 11.94 |
| Alloy 64 | HIP 2 | HT2 | 400 | 880 | 14.93 |
| | | | 393 | 1068 | 21.06 |
| | | HT3 | 388 | 880 | 15.99 |
| | | | 376 | 860 | 15.49 |
| | | | 373 | 1056 | 31.48 |
| | | | 448 | 933 | 18.46 |
| | | | 480 | 958 | 20.51 |
| | | HT7 | 416 | 964 | 22.91 |
| | | | 440 | 966 | 22.76 |
| | | | 429 | 906 | 18.16 |
| Alloy 65 | HIP 2 | HT2 | 471 | 812 | 3.4 |
| | | | 461 | 909 | 6.59 |
| | | | 485 | 920 | 6.36 |
| | | HT3 | 420 | 904 | 7.19 |
| | | | 417 | 923 | 9.07 |
| | | | 432 | 903 | 7.3 |
| | | HT7 | 527 | 1003 | 11.75 |
| | | | 498 | 959 | 10.35 |
| Alloy 66 | HIP 2 | HT2 | 436 | 972 | 10.66 |
| | | | 429 | 930 | 10.01 |
| | | HT7 | 406 | 732 | 6.45 |
| | | | 413 | 908 | 10.57 |
| | | | 411 | 1130 | 14.74 |
| | HIP 4 | HT2 | 445 | 739 | 5.23 |
| | | | 446 | 888 | 9.21 |
| | | | 452 | 957 | 10.44 |
| | | HT3 | 434 | 969 | 9.94 |
| | | | 454 | 982 | 10.18 |
| | | | 428 | 968 | 10.45 |
| | | HT7 | 421 | 1015 | 11.68 |
| | | | 421 | 901 | 9.96 |
| | | | 441 | 894 | 9.59 |
| Alloy 67 | HIP 2 | HT2 | 360 | 1147 | 15.1 |
| | | HT3 | 350 | 817 | 10.2 |
| | | | 382 | 1257 | 16.72 |
| | | | 341 | 1047 | 13.51 |
| | | HT7 | 337 | 1075 | 15.19 |
| | | | 341 | 970 | 13.43 |
| | HIP 4 | HT2 | 406 | 1159 | 14.67 |
| | | HT3 | 337 | 1055 | 13.26 |
| | | HT7 | 325 | 1041 | 14.32 |
| | | | 328 | 1029 | 13.63 |
| Alloy 68 | HIP 2 | HT3 | 381 | 921 | 10.54 |
| | | | 361 | 885 | 9.82 |
| | | HT7 | 346 | 793 | 9.21 |
| | | | 358 | 999 | 11.94 |
| | | | 379 | 1012 | 12.15 |
| | HIP 4 | HT2 | 419 | 1095 | 12.28 |
| | | | 396 | 1190 | 13.76 |
| | | HT3 | 394 | 1076 | 12.81 |
| | | | 411 | 918 | 10.61 |
| | | | 385 | 1109 | 12.74 |
| | | | 406 | 924 | 10.43 |
| | | HT7 | 398 | 1113 | 13.36 |
| | | | 385 | 985 | 11.62 |
| | | | 407 | 1233 | 16.76 |
| Alloy 69 | HIP 2 | HT2 | 416 | 858 | 9.92 |
| | | | 398 | 758 | 8.8 |
| | | HT7 | 332 | 776 | 10.28 |
| | | | 348 | 1060 | 13.41 |
| | | | 339 | 1119 | 15.97 |
| | HIP 4 | HT2 | 309 | 822 | 9.25 |
| | | HT3 | 399 | 1235 | 14.98 |
| | | | 336 | 1045 | 12.42 |
| | | | 347 | 1357 | 18.63 |
| Alloy 70 | HIP 2 | HT2 | 390 | 1233 | 9.05 |
| | | | 366 | 754 | 6.42 |
| | | | 389 | 1093 | 8.44 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT7 | 346 | 1315 | 10.65 |
| | HIP 3 | HT2 | 411 | 711 | 6.45 |
| | | | 404 | 1207 | 6.79 |
| | | | 347 | 614 | 4.96 |
| | | | 357 | 893 | 6.84 |
| | | HT7 | 351 | 524 | 4.24 |
| | | | 410 | 1182 | 8.96 |
| | | | 326 | 1148 | 8.19 |
| Alloy 71 | HIP 2 | HT2 | 272 | 1406 | 8.13 |
| | | | 257 | 586 | 4.03 |
| | | | 253 | 1293 | 6.61 |
| | | HT3 | 239 | 1061 | 5.53 |
| | | | 251 | 1151 | 5.95 |
| | HIP 3 | HT2 | 248 | 981 | 4.22 |
| | | | 257 | 1008 | 4.37 |
| | | | 224 | 904 | 3.29 |
| | | HT3 | 251 | 1099 | 5.18 |
| | | HT7 | 250 | 1129 | 5.9 |
| | | | 268 | 1222 | 6.73 |
| Alloy 72 | HIP 2 | HT2 | 434 | 736 | 7.32 |
| | | HT3 | 391 | 773 | 11.11 |
| | | | 422 | 880 | 16 |
| | | HT7 | 395 | 871 | 15.49 |
| | | | 375 | 954 | 19.25 |
| | | | 383 | 951 | 19.77 |
| Alloy 73 | HIP 2 | HT2 | 523 | 943 | 7.66 |
| | | | 488 | 989 | 9.1 |
| | | HT3 | 427 | 703 | 4.16 |
| | | | 426 | 817 | 7.37 |
| | | | 410 | 976 | 10.27 |
| | HIP 3 | HT2 | 455 | 688 | 2.65 |
| | | | 471 | 914 | 8.11 |
| | | | 466 | 919 | 8.43 |
| | | HT3 | 455 | 724 | 4.07 |
| | | | 449 | 845 | 7.41 |
| | | | 469 | 960 | 9.11 |
| Alloy 74 | HIP 3 | HT2 | 415 | 809 | 9.73 |
| | | | 437 | 831 | 10.47 |
| | | HT3 | 421 | 905 | 15.48 |
| | | | 417 | 994 | 19.02 |
| | | | 397 | 865 | 13.86 |
| | | HT7 | 386 | 881 | 15.97 |
| | | | 395 | 828 | 13.65 |
| | | | 400 | 973 | 19.38 |
| Alloy 75 | HIP 3 | HT2 | 463 | 826 | 8.08 |
| | | HT3 | 411 | 788 | 7.66 |
| | | | 403 | 858 | 14.18 |
| | | HT7 | 401 | 911 | 18.72 |
| | | | 412 | 730 | 6.67 |
| Alloy 76 | HIP 3 | HT2 | 483 | 826 | 10.31 |
| | | | 452 | 914 | 12.71 |
| | | | 433 | 872 | 11.86 |
| | | HT3 | 452 | 1024 | 17.57 |
| | | | 469 | 906 | 14.57 |
| | | | 417 | 855 | 12.71 |
| | | HT7 | 420 | 973 | 17.71 |
| | | | 399 | 838 | 13.92 |
| | | | 407 | 766 | 10.71 |
| Alloy 77 | HIP 3 | HT2 | 410 | 1044 | 7.13 |
| | | HT3 | 369 | 930 | 8.26 |
| | | | 401 | 1343 | 11.43 |
| | | HT7 | 400 | 886 | 8.85 |
| | | | 345 | 1255 | 11.38 |
| Alloy 78 | HIP 3 | HT2 | 449 | 1108 | 12.09 |
| | | | 451 | 982 | 10.71 |
| | | | 461 | 1101 | 11.89 |
| | | HT3 | 407 | 1059 | 14.63 |
| | | | 390 | 915 | 12.04 |
| | | | 396 | 969 | 12.4 |
| | | HT7 | 392 | 934 | 13.51 |
| | | | 379 | 641 | 8.22 |
| | | | 390 | 1031 | 14.78 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 79 | HIP 3 | HT2 | 406 | 880 | 6.44 |
| | | | 410 | 991 | 7 |
| | | | 413 | 890 | 6.56 |
| | | HT3 | 390 | 875 | 7.59 |
| | | | 388 | 1087 | 9.21 |
| | | | 457 | 1278 | 11.19 |
| | | HT7 | 378 | 1117 | 10.76 |
| | | | 368 | 1240 | 12.06 |
| Alloy 80 | HIP 3 | HT2 | 421 | 867 | 12.26 |
| | | | 448 | 968 | 15.35 |
| | | HT3 | 332 | 1026 | 22 |
| | | HT7 | 372 | 904 | 18.44 |
| Alloy 81 | HIP 3 | HT3 | 374 | 795 | 13.52 |
| | | | 383 | 895 | 20.87 |
| | | HT7 | 375 | 1013 | 33.61 |
| | | | 362 | 815 | 16.84 |
| Alloy 82 | HIP 3 | HT2 | 365 | 969 | 14.96 |
| | | | 367 | 809 | 12.4 |
| Alloy 83 | HIP 2 | HT2 | 396 | 1640 | 16.64 |
| | | | 390 | 1627 | 13.78 |
| | | | 308 | 1509 | 10.62 |
| | | | 408 | 1467 | 13.14 |
| | | | 396 | 1494 | 13.46 |
| | | HT3 | 391 | 1450 | 17.97 |
| | | | 410 | 1443 | 13.76 |
| | | | 398 | 1395 | 14.41 |
| | | | 368 | 1430 | 20.7 |
| | | | 385 | 1438 | 22.03 |
| | HIP 3 | HT2 | 339 | 1252 | 10.73 |
| | | HT7 | 334 | 1251 | 14.57 |
| | | | 343 | 1158 | 13.25 |
| | | | 327 | 1321 | 16.07 |
| | | | 367 | 1525 | 24.08 |
| | | | 369 | 1398 | 16.23 |
| Alloy 84 | HIP 2 | HT2 | 434 | 1074 | 10.82 |
| | | HT3 | 371 | 911 | 11.9 |
| | | | 395 | 1058 | 14.04 |
| | | HT7 | 403 | 787 | 10.41 |
| | | | 425 | 1328 | 17.9 |
| | HIP 3 | HT2 | 427 | 894 | 10.4 |
| | | | 430 | 1223 | 14.24 |
| | | HT3 | 356 | 1208 | 20.23 |
| | | HT7 | 397 | 1269 | 20.09 |
| | | | 395 | 1088 | 16.33 |
| Alloy 85 | HIP 2 | HT2 | 365 | 743 | 6.48 |
| | | HT3 | 406 | 1261 | 12.59 |
| | | HT7 | 405 | 1173 | 12.74 |
| | | | 432 | 1290 | 13.18 |
| | | | 395 | 1369 | 14.74 |
| Alloy 86 | HIP 3 | HT2 | 380 | 845 | 14.82 |
| | | HT3 | 383 | 900 | 20.47 |
| | | | 382 | 860 | 19.09 |
| Alloy 90 | HIP 3 | HT2 | 371 | 1255 | 10.16 |
| | | | 387 | 1581 | 18.93 |
| | | HT7 | 347 | 1405 | 18.47 |
| | | | 321 | 661 | 6.98 |
| | | | 337 | 1107 | 11.46 |
| Alloy 92 | HIP 3 | HT2 | 386 | 1167 | 9.74 |
| | | | 379 | 884 | 6.9 |
| | | HT7 | 347 | 605 | 8.1 |
| | | | 373 | 930 | 11.46 |
| | | | 336 | 1121 | 14.64 |
| Alloy 93 | HIP 3 | HT2 | 367 | 887 | 8.53 |
| | | | 361 | 730 | 5.88 |
| | | | 385 | 956 | 7.19 |
| | | HT7 | 312 | 763 | 7.24 |
| | | | 336 | 1325 | 13.44 |
| Alloy 94 | HIP 3 | HT2 | 392 | 607 | 7.34 |
| | | HT7 | 341 | 883 | 16 |
| Alloy 95 | HIP 3 | HT7 | 345 | 756 | 8.19 |
| | | | 296 | 403 | 5.61 |
| Alloy 96 | HIP 3 | HT2 | 281 | 1353 | 8.07 |
| | | | 271 | 1215 | 6.96 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT7 | 262 | 1281 | 8.31 |
| | | | 264 | 1274 | 7.48 |
| | | | 296 | 1372 | 11.64 |
| | | | 266 | 933 | 5.56 |
| | | | 278 | 1368 | 12.24 |
| Alloy 97 | HIP 3 | HT7 | 334 | 584 | 6.1 |
| | | | 345 | 499 | 5.21 |
| | | | 342 | 1296 | 16.62 |
| Alloy 98 | HIP 3 | HT2 | 329 | 1246 | 7.03 |
| | | | 267 | 1290 | 6.14 |
| | | HT7 | 360 | 1041 | 8.89 |
| | | | 305 | 1340 | 10.04 |
| | | | 340 | 1480 | 13.52 |
| | | | 329 | 1393 | 12.11 |
| | | | 322 | 1422 | 14.16 |
| Alloy 99 | HIP 3 | HT2 | 351 | 1454 | 12.9 |
| | | HT7 | 372 | 1362 | 23.38 |
| | | | 347 | 483 | 4.3 |
| | | | 343 | 982 | 12.39 |
| | | | 365 | 669 | 9.94 |
| Alloy 100 | HIP 3 | HT2 | 349 | 1178 | 8.94 |
| | | | 350 | 1408 | 11.81 |
| | | | 291 | 1475 | 18.74 |
| | | HT7 | 331 | 820 | 6.05 |
| | | | 362 | 1475 | 15.06 |
| | | | 353 | 1469 | 18.85 |
| | | | 353 | 1476 | 19.53 |
| Alloy 101 | HIP 3 | HT2 | 394 | 1166 | 16.3 |
| | | | 381 | 820 | 10.31 |
| | | HT7 | 374 | 1193 | 18.13 |
| | | | 366 | 1124 | 17.22 |
| | | | 409 | 1291 | 21.21 |
| | | | 365 | 1367 | 22.59 |
| | | | 384 | 1245 | 20.1 |
| Alloy 102 | HIP 3 | HT2 | 303 | 1069 | 6.9 |
| | | | 291 | 1029 | 6.51 |
| | | HT7 | 288 | 1423 | 13.31 |
| | | | 320 | 1434 | 15 |
| | | | 313 | 1406 | 12.04 |
| Alloy 103 | HIP 3 | HT2 | 319 | 947 | 6.47 |
| | | HT7 | 305 | 1455 | 15.72 |
| | | | 300 | 1450 | 18.2 |
| | | | 299 | 1441 | 11.66 |
| | | | 409 | 1467 | 14.42 |
| | | | 405 | 1487 | 15.74 |
| Alloy 104 | HIP 3 | HT2 | 443 | 1598 | 5.8 |
| | | | 523 | 1567 | 6.05 |
| | | | 584 | 1502 | 6.08 |
| | | | 610 | 1501 | 6.36 |
| | | HT7 | 257 | 1509 | 13.39 |
| | | | 258 | 1522 | 13.07 |
| Alloy 105 | HIP 2 | HT2 | 358 | 1615 | 15.02 |
| | | | 285 | 1545 | 11.23 |
| | | | 380 | 1589 | 14.38 |
| | | HT7 | 367 | 1432 | 21.8 |
| | | | 362 | 1441 | 20.33 |
| | | | 367 | 1408 | 19.83 |
| | | | 363 | 1427 | 17.5 |
| | | | 372 | 1405 | 17.83 |
| | | | 363 | 1395 | 20.05 |
| Alloy 106 | HIP 2 | HT2 | 368 | 1392 | 10.67 |
| | | | 362 | 1380 | 10.74 |
| | | | 353 | 1637 | 18.15 |
| | | | 373 | 1629 | 16.75 |
| | | HT7 | 331 | 1420 | 16.21 |
| | | | 321 | 1423 | 14.53 |
| | | | 363 | 1425 | 14.74 |
| | HIP 3 | HT2 | 294 | 1555 | 16.83 |
| | | | 283 | 1515 | 11.22 |
| | | | 285 | 1527 | 14.91 |
| | | | 299 | 1548 | 13.19 |
| | | | 309 | 1588 | 15.39 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT7 | 334 | 1376 | 20.58 |
| | | | 331 | 1375 | 17.97 |
| | | | 292 | 1361 | 18.13 |
| Alloy 107 | HIP 3 | HT2 | 353 | 1577 | 7.04 |
| | | | 282 | 1620 | 11.21 |
| | | HT7 | 307 | 1462 | 18.55 |
| | | | 300 | 1467 | 18.55 |
| Alloy 108 | HIP 1 | HT4 | 453 | 1098 | 18.69 |
| | | | 458 | 1206 | 21.52 |
| | | HT4 | 395 | 1110 | 19.16 |
| | | | 401 | 1039 | 17.71 |
| | | HT6 | 439 | 943 | 14.1 |
| | | | 448 | 907 | 12.91 |
| | | | 326 | 864 | 12.85 |
| | HIP 2 | HT2 | 393 | 985 | 14.57 |
| | | | 414 | 1134 | 17.58 |
| | | HT3 | 392 | 1115 | 22.19 |
| | | HT7 | 360 | 884 | 15.34 |
| | | | 390 | 1193 | 25.47 |
| | HIP 3 | HT2 | 402 | 1100 | 16.49 |
| | | | 411 | 1115 | 16.22 |
| | | | 360 | 1242 | 19.83 |
| | | | 401 | 1267 | 19.98 |
| | | | 365 | 1159 | 17.92 |
| | | | 383 | 1202 | 18.08 |
| | | HT4 | 395 | 1252 | 23.5 |
| | | HT6 | 335 | 1152 | 22.67 |
| | | | 354 | 1229 | 23.14 |
| | | HT7 | 355 | 1265 | 30.75 |
| | | | 347 | 1273 | 28.51 |
| | | | 384 | 1262 | 27.92 |
| | | | 373 | 1123 | 22.34 |
| | | | 354 | 1143 | 22.42 |
| Alloy 109 | HIP 2 | HT2 | 407 | 870 | 10.65 |
| | | | 414 | 1036 | 12.58 |
| | | HT3 | 393 | 901 | 12.55 |
| | | | 406 | 1131 | 15.63 |
| | | | 398 | 1365 | 21.56 |
| | | HT7 | 407 | 1318 | 21.01 |
| | | | 427 | 1192 | 17.65 |
| | | | 395 | 1229 | 18.27 |
| | HIP 3 | HT2 | 398 | 1269 | 15.94 |
| | | | 410 | 948 | 11.92 |
| | | | 415 | 1264 | 15.64 |
| | | HT3 | 377 | 1154 | 17.55 |
| | | | 329 | 1220 | 19.33 |
| | | | 360 | 1021 | 15.79 |
| | | HT7 | 346 | 1350 | 25.2 |
| | | | 346 | 1269 | 23.24 |
| | | | 356 | 1264 | 22.66 |
| | | | 369 | 1242 | 21.57 |
| Alloy 110 | HIP 1 | HT6 | 371 | 1362 | 11.19 |
| | | | 401 | 1370 | 11.2 |
| | | HT4 | 357 | 1489 | 14.91 |
| | | | 335 | 1472 | 19.64 |
| | | | 362 | 1500 | 17.03 |
| | HIP 2 | HT2 | 339 | 1288 | 8.92 |
| | | | 344 | 1200 | 8.21 |
| | | HT3 | 333 | 1443 | 17.67 |
| | | HT7 | 383 | 1426 | 18.71 |
| | | | 353 | 1413 | 18.81 |
| | HIP 3 | HT6 | 382 | 1286 | 14.85 |
| | | HT4 | 333 | 1417 | 17.74 |
| | | HT2 | 332 | 1453 | 17.82 |
| | | | 361 | 1483 | 17.55 |
| | | HT3 | 322 | 1159 | 11.11 |
| | | | 346 | 1422 | 17.5 |
| | | | 341 | 1413 | 17.04 |
| | | HT7 | 343 | 1408 | 22.19 |
| | | | 356 | 1391 | 21.16 |
| | | | 368 | 1413 | 21.21 |
| Alloy 111 | HIP 2 | HT2 | 288 | 1381 | 6.8 |
| | | HT3 | 306 | 1500 | 18.29 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 316 | 1500 | 16.89 |
| | | | 318 | 1315 | 10.57 |
| | HIP 3 | HT2 | 284 | 966 | 5.39 |
| | | HT3 | 282 | 1562 | 15.67 |
| | | HT7 | 292 | 1507 | 16.58 |
| Alloy 112 | HIP 2 | HT2 | 737 | 1257 | 3.26 |
| | | HT3 | 295 | 1416 | 5.41 |
| | | HT7 | 282 | 1456 | 8.83 |
| | | | 294 | 1506 | 9.51 |
| | | | 277 | 1456 | 8.85 |
| | HIP 3 | HT2 | 616 | 1252 | 5.19 |
| | | | 655 | 1305 | 5.08 |
| | | HT3 | 402 | 1513 | 10.37 |
| Alloy 113 | HIP 2 | HT2 | 754 | 1246 | 2.92 |
| | | | 667 | 1202 | 2.82 |
| | | | 601 | 1075 | 1.87 |
| | | HT3 | 453 | 1548 | 5.11 |
| | | HT7 | 419 | 1450 | 4.7 |
| | | | 419 | 1497 | 8.55 |
| | HIP 3 | HT2 | 536 | 1021 | 2.98 |
| | | | 701 | 1046 | 2.86 |
| | | | 703 | 1152 | 3.54 |
| | | HT3 | 504 | 1466 | 4.4 |
| | | | 534 | 1473 | 5.89 |
| | | HT7 | 390 | 1493 | 7.37 |
| | | | 397 | 1491 | 10.32 |
| | | | 421 | 1501 | 11.76 |
| Alloy 114 | HIP 2 | HT3 | 288 | 1518 | 9.2 |
| | | HT7 | 289 | 1115 | 5.58 |
| | | | 336 | 1139 | 6.74 |
| | HIP 3 | HT2 | 460 | 1496 | 4.92 |
| | | | 268 | 1346 | 3.56 |
| | | HT3 | 482 | 1565 | 6.27 |
| | | | 266 | 1611 | 9.9 |
| | | HT7 | 343 | 1526 | 10.6 |
| | | | 309 | 1592 | 14.16 |
| Alloy 115 | HIP 2 | HT2 | 849 | 1418 | 6.48 |
| | | HT3 | 421 | 1671 | 8.4 |
| | | | 275 | 1162 | 4.55 |
| | | | 410 | 1655 | 9.24 |
| | | HT7 | 337 | 1619 | 11.78 |
| | | | 409 | 1622 | 9.12 |
| | HIP 3 | HT2 | 640 | 1357 | 7.16 |
| | | | 711 | 1450 | 9.06 |
| | | | 603 | 1153 | 4.03 |
| | | | 600 | 1269 | 5.71 |
| | | HT3 | 525 | 1616 | 10.4 |
| | | | 551 | 1648 | 11.99 |
| | | HT7 | 517 | 1514 | 12.39 |
| | | | 415 | 1522 | 10.09 |
| | | | 408 | 1562 | 8.45 |
| Alloy 116 | HIP 2 | HT3 | 376 | 1280 | 18.4 |
| | | HT7 | 401 | 1238 | 19.03 |
| | | HT7 | 369 | 1078 | 16.72 |
| | | | 434 | 1029 | 13.5 |
| Alloy 117 | HIP 2 | HT2 | 317 | 832 | 6.2 |
| | | HT3 | 300 | 1403 | 12.67 |
| | | | 320 | 1276 | 10.96 |
| | | HT7 | 324 | 1282 | 10.82 |
| | | | 353 | 1308 | 11.42 |
| | HIP 3 | HT3 | 320 | 1468 | 14.27 |
| Alloy 118 | HIP 2 | HT2 | 381 | 1014 | 9.87 |
| | | | 381 | 1067 | 9.82 |
| | | HT7 | 406 | 1350 | 17.59 |
| | | | 381 | 1003 | 12.23 |
| | | | 430 | 1237 | 18.81 |
| | HIP 3 | HT2 | 392 | 984 | 10.09 |
| | | | 383 | 994 | 10.53 |
| | | HT3 | 468 | 897 | 12.17 |
| | | HT7 | 372 | 900 | 11.06 |
| | | | 403 | 1344 | 18.53 |
| | | | 385 | 1002 | 12.22 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 119 | HIP 2 | HT2 | 313 | 1196 | 6.85 |
| | | HT7 | 351 | 1408 | 12.05 |
| | | HT3 | 322 | 934 | 11.26 |
| | | | 312 | 985 | 11.49 |
| | | HT7 | 364 | 1429 | 15.5 |
| Alloy 120 | HIP 2 | HT2 | 371 | 1129 | 7.95 |
| | | | 375 | 1415 | 10.54 |
| | | HT3 | 349 | 1058 | 10.36 |
| | | | 397 | 1456 | 21.36 |
| | | HT7 | 369 | 1419 | 20.33 |
| | | | 384 | 1417 | 18.78 |
| | | | 427 | 1551 | 24.44 |
| Alloy 121 | HIP 2 | HT2 | 324 | 1087 | 10.42 |
| | | | 280 | 1341 | 12.55 |
| | | HT3 | 372 | 1079 | 11.67 |
| | | | 312 | 1314 | 14.34 |
| | | HT7 | 344 | 1433 | 19.79 |
| | HIP 3 | HT2 | 334 | 1186 | 9.95 |
| | | | 304 | 871 | 8.38 |
| | | | 309 | 800 | 6.65 |
| | | HT7 | 284 | 1012 | 10.33 |
| | | | 394 | 1354 | 15.92 |
| | | | 359 | 1376 | 21.66 |
| Alloy 122 | HIP 2 | HT2 | 417 | 957 | 10.29 |
| | | | 412 | 1086 | 11.28 |
| | | HT3 | 355 | 1448 | 18.06 |
| | | | 291 | 1457 | 19.02 |
| | | | 355 | 1422 | 17.92 |
| | | HT7 | 475 | 1546 | 24.13 |
| | | | 394 | 1396 | 16.92 |
| | HIP 3 | HT2 | 366 | 957 | 9.21 |
| | | HT3 | 348 | 1414 | 18.78 |
| | | | 379 | 1385 | 17.12 |
| | | | 404 | 1381 | 17.45 |
| | | HT7 | 399 | 1357 | 15.83 |
| | | | 422 | 1308 | 16.76 |
| Alloy 123 | HIP 2 | HT2 | 349 | 1551 | 13.5 |
| | | | 260 | 1522 | 11.66 |
| | | HT3 | 345 | 1244 | 10.32 |
| | | | 345 | 1317 | 11.28 |
| | | | 375 | 1407 | 20.26 |
| | | HT7 | 332 | 1374 | 19.91 |
| | | | 324 | 1362 | 20.93 |
| | HIP 3 | HT2 | 343 | 1083 | 10.42 |
| | | HT3 | 358 | 1197 | 13.92 |
| | | | 396 | 1099 | 12.79 |
| | | HT7 | 387 | 1178 | 15.04 |
| Alloy 124 | HIP 2 | HT3 | 348 | 1427 | 18.83 |
| | | | 349 | 1409 | 15.97 |
| | | | 374 | 1437 | 21.27 |
| | | HT7 | 374 | 1387 | 22.64 |
| | | | 390 | 1368 | 20.57 |
| | | | 385 | 1383 | 22.91 |
| | HIP 3 | HT2 | 383 | 906 | 8.53 |
| | | | 392 | 1201 | 10.89 |
| | | | 314 | 825 | 8.12 |
| | | HT3 | 394 | 1291 | 14.11 |
| | | | 360 | 836 | 8.5 |
| | | | 390 | 991 | 11.54 |
| | | HT7 | 364 | 572 | 6.14 |
| | | | 381 | 1300 | 15.9 |
| Alloy 125 | HIP 1 | HT6 | 382 | 1330 | 9.14 |
| | | HT4 | 352 | 1432 | 10.74 |
| | | | 372 | 1209 | 10.19 |
| | | HT2 | 373 | 1509 | 12.16 |
| | | | 383 | 1522 | 12.51 |
| | HIP 2 | HT2 | 369 | 1246 | 11.2 |
| | | HT7 | 369 | 1486 | 17.71 |
| | | | 381 | 1403 | 14.75 |
| | | | 390 | 1471 | 17.11 |
| | HIP 3 | HT6 | 343 | 1397 | 12.51 |
| | | HT4 | 374 | 1389 | 14.62 |
| | | | 366 | 1098 | 10.83 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 394 | 1522 | 19.89 |
| | | | 373 | 1517 | 18 |
| | | HT2 | 311 | 890 | 6.03 |
| | | | 352 | 1366 | 10.52 |
| | | | 325 | 1289 | 7.84 |
| | | | 335 | 1462 | 14.39 |
| | | | 334 | 1141 | 10.89 |
| | | | 389 | 1058 | 10.9 |
| | | HT3 | 321 | 1457 | 19.3 |
| | | | 328 | 1455 | 15.9 |
| | | | 325 | 1443 | 17.95 |
| | | | 370 | 1193 | 11.98 |
| | | | 393 | 1430 | 16.04 |
| | | HT7 | 335 | 1444 | 15.8 |
| | | | 333 | 1457 | 16.85 |
| | | | 344 | 1452 | 15.72 |
| | | | 325 | 1409 | 14.8 |
| | | | 353 | 1454 | 16.65 |
| Alloy 126 | HIP 2 | HT2 | 413 | 887 | 11.82 |
| | | | 382 | 992 | 13.24 |
| | | HT3 | 379 | 1015 | 16.32 |
| | | HT7 | 401 | 1013 | 16.36 |
| | HIP 3 | HT2 | 400 | 994 | 13.19 |
| | | | 397 | 991 | 13.5 |
| | | HT3 | 401 | 1291 | 23.92 |
| | | | 361 | 978 | 15.8 |
| | | HT7 | 357 | 1224 | 22.57 |
| | | | 363 | 1327 | 27.14 |
| | | | 381 | 1109 | 18.78 |
| | | | 375 | 1004 | 16.99 |
| Alloy 127 | HIP 1 | HT6 | 439 | 1246 | 14.72 |
| | | HT4 | 425 | 979 | 10.06 |
| | | | 420 | 1004 | 10.98 |
| | | | 413 | 979 | 11.62 |
| | HIP 2 | HT2 | 313 | 929 | 10.81 |
| | | HT7 | 407 | 1036 | 15.51 |
| | | | 421 | 1016 | 14.25 |
| | HIP 3 | HT6 | 355 | 1144 | 17.65 |
| | | | 308 | 1049 | 15.8 |
| | | | 373 | 1085 | 13.76 |
| | | HT4 | 361 | 1133 | 16.17 |
| | | | 344 | 1120 | 14.81 |
| | | | 342 | 1055 | 15.47 |
| | | | 385 | 1003 | 14.74 |
| | | HT2 | 359 | 972 | 11.98 |
| | | | 308 | 958 | 12.05 |
| | | | 373 | 984 | 12.61 |
| | | | 412 | 1300 | 15.07 |
| | | | 388 | 900 | 9.51 |
| | | | 405 | 1053 | 11.33 |
| Alloy 128 | HIP 2 | HT2 | 377 | 901 | 14.22 |
| | | HT3 | 463 | 1036 | 20.75 |
| | | | 453 | 832 | 12.45 |
| | | | 450 | 866 | 14.16 |
| | | HT7 | 551 | 1020 | 17.66 |
| | | | 437 | 1094 | 24.99 |
| | HIP 3 | HT2 | 353 | 967 | 15.69 |
| | | | 335 | 865 | 13.15 |
| | | | 362 | 826 | 11.72 |
| | | HT7 | 383 | 1150 | 27.79 |
| | | | 362 | 1079 | 24.48 |
| Alloy 129 | HIP 2 | HT2 | 344 | 690 | 7.41 |
| | | HT7 | 405 | 1194 | 28.29 |
| | | | 442 | 1014 | 19.12 |
| | | | 419 | 754 | 10.74 |
| | HIP 3 | HT2 | 357 | 1043 | 16.93 |
| | | | 421 | 1094 | 17.69 |
| | | | 373 | 953 | 14.67 |
| | | HT3 | 409 | 1032 | 20.14 |
| | | | 385 | 993 | 18.53 |
| | | | 416 | 1170 | 25.01 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT7 | 424 | 1172 | 26.55 |
| | | | 434 | 1127 | 24.28 |
| | | | 427 | 1115 | 23.33 |
| Alloy 130 | HIP 1 | HT6 | 455 | 834 | 10.59 |
| | | | 473 | 857 | 11.28 |
| | | | 438 | 937 | 13.97 |
| | | HT4 | 434 | 945 | 13.68 |
| | | | 456 | 1009 | 14.93 |
| | | HT2 | 395 | 936 | 12.55 |
| | | | 428 | 1027 | 14.45 |
| | | | 408 | 1065 | 15.22 |
| | HIP 3 | HT6 | 382 | 1109 | 18.89 |
| | | | 395 | 1158 | 20.46 |
| | | HT4 | 374 | 1073 | 17.8 |
| | | | 400 | 1218 | 21.68 |
| | | | 391 | 1153 | 20.3 |
| | | HT3 | 413 | 1236 | 22.96 |
| | | | 390 | 1173 | 20.83 |
| | | HT7 | 285 | 1252 | 25.41 |
| | | | 427 | 1335 | 29.62 |
| | | | 396 | 1324 | 29.19 |
| | | | 415 | 1253 | 23.74 |
| Alloy 131 | HIP 2 | HT2 | 398 | 895 | 12.71 |
| | | HT7 | 467 | 1113 | 20.44 |
| | HIP 3 | HT2 | 354 | 911 | 13.23 |
| | | | 366 | 957 | 13.76 |
| | | HT3 | 363 | 1014 | 17.63 |
| | | | 288 | 1141 | 21.76 |
| | | HT7 | 417 | 1114 | 22.09 |
| | | | 411 | 1027 | 19.55 |
| | | | 415 | 998 | 17.52 |
| | | | 437 | 1077 | 19.73 |
| | | | 430 | 1250 | 25.64 |
| | | | 424 | 1264 | 26.84 |
| Alloy 132 | HIP 2 | HT2 | 350 | 979 | 15.2 |
| | | | 440 | 1027 | 15.43 |
| | | HT3 | 416 | 1233 | 25.11 |
| | | HT7 | 418 | 1108 | 22.14 |
| | HIP 3 | HT2 | 321 | 913 | 13.71 |
| | | | 350 | 904 | 13.44 |
| | | HT7 | 408 | 1014 | 18.87 |
| | | | 407 | 1036 | 20.29 |
| | | | 403 | 886 | 15.06 |
| Alloy 133 | HIP 2 | HT2 | 355 | 797 | 9.11 |
| | | | 361 | 804 | 9.32 |
| | | | 375 | 838 | 10.57 |
| | | HT3 | 404 | 1014 | 14.82 |
| | | | 374 | 1128 | 16.47 |
| | | HT7 | 368 | 944 | 13.63 |
| | | | 371 | 874 | 11.88 |
| | | | 375 | 1041 | 16.02 |
| | HIP 3 | HT2 | 388 | 1325 | 21.45 |
| | | | 375 | 1062 | 13.48 |
| | | HT7 | 334 | 1018 | 13.63 |
| | | | 363 | 1096 | 15.12 |
| Alloy 134 | HIP 2 | HT3 | 431 | 846 | 12.36 |
| | | | 408 | 1035 | 16.9 |
| | | | 397 | 821 | 11.38 |
| | | HT7 | 418 | 1123 | 20.2 |
| | | | 403 | 1010 | 16.89 |
| Alloy 135 | HIP 2 | HT2 | 407 | 1053 | 13.37 |
| | | HT3 | 417 | 1235 | 19.08 |
| | | | 410 | 1203 | 19.92 |
| | HIP 3 | HT2 | 362 | 982 | 11.84 |
| | | | 346 | 921 | 10.91 |
| | | | 302 | 919 | 11.37 |
| | | HT3 | 361 | 976 | 13.21 |
| | | | 377 | 987 | 13.71 |
| | | | 403 | 939 | 12.56 |
| | | | 395 | 889 | 11.52 |
| | | HT7 | 364 | 881 | 12.45 |
| | | | 430 | 1028 | 15.57 |
| | | | 407 | 998 | 14.36 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 136 | HIP 1 | HT2 | 460 | 960 | 11.36 |
| | | | 461 | 973 | 12.48 |
| | | | 476 | 950 | 12.04 |
| | | HT4 | 468 | 996 | 15.87 |
| | | | 411 | 929 | 12.8 |
| | HIP 3 | HT2 | 451 | 1080 | 16.35 |
| | | HT4 | 394 | 1053 | 18.89 |
| Alloy 137 | HIP 1 | HT2 | 407 | 869 | 8.47 |
| | | | 414 | 936 | 9.14 |
| | | HT6 | 369 | 956 | 15.09 |
| | | | 458 | 846 | 9.02 |
| | | HT4 | 439 | 832 | 7.68 |
| | | | 446 | 908 | 12.97 |
| | HIP 3 | HT6 | 393 | 892 | 13.51 |
| | | | 388 | 1019 | 17.41 |
| | | | 361 | 945 | 14.95 |
| | | HT4 | 375 | 884 | 12.86 |
| | | | 335 | 1014 | 17.52 |
| | | | 376 | 964 | 15.73 |
| Alloy 138 | HIP 1 | HT2 | 443 | 927 | 11.54 |
| | | | 469 | 916 | 11.24 |
| | | | 456 | 973 | 12.18 |
| | | HT4 | 436 | 991 | 14.12 |
| | | | 492 | 927 | 11.98 |
| | | | 479 | 978 | 13.48 |
| | HIP 3 | HT2 | 453 | 1121 | 15.75 |
| | | | 437 | 1109 | 15.82 |
| | | | 434 | 1074 | 14.64 |
| | | HT6 | 376 | 1040 | 17.51 |
| | | | 417 | 1041 | 16.93 |
| | | HT4 | 317 | 954 | 15.29 |
| | | | 408 | 1042 | 16.69 |
| | | | 415 | 1032 | 16.78 |
| Alloy 139 | HIP 1 | HT6 | 471 | 952 | 13.74 |
| | | | 448 | 837 | 10.71 |
| | | | 466 | 951 | 13.56 |
| | | | 443 | 896 | 12.8 |
| | HIP 3 | HT6 | 420 | 968 | 15.9 |
| | | | 356 | 862 | 11 |
| | | HT4 | 379 | 941 | 15.28 |
| | | | 397 | 935 | 14.76 |
| | | | 369 | 827 | 11.36 |
| Alloy 140 | HIP 1 | HT6 | 446 | 807 | 7.23 |
| | | | 504 | 957 | 14.33 |
| | | | 492 | 914 | 11.18 |
| | | HT4 | 453 | 825 | 10.18 |
| | | | 452 | 952 | 14.48 |
| | | | 437 | 956 | 14.53 |
| | HIP 3 | HT2 | 395 | 976 | 14.07 |
| | | | 393 | 867 | 9.83 |
| | | | 404 | 965 | 13.29 |
| | | HT6 | 346 | 915 | 14.81 |
| | | | 399 | 845 | 11.58 |
| | | | 372 | 956 | 16.36 |
| Alloy 141 | HIP 3 | HT2 | 381 | 1032 | 15.01 |
| | | | 400 | 994 | 13.82 |
| | | | 345 | 1010 | 15.21 |
| | | HT6 | 371 | 1060 | 18.19 |
| | | | 349 | 1049 | 18.78 |
| | | HT4 | 400 | 981 | 15.66 |
| | | | 404 | 981 | 16.42 |
| | | | 392 | 963 | 15.08 |
| Alloy 142 | HIP 1 | HT2 | 389 | 949 | 10.03 |
| | | | 417 | 836 | 8.05 |
| | | | 429 | 884 | 8.92 |
| | | HT6 | 433 | 931 | 10.21 |
| | | | 425 | 942 | 10.45 |
| | | | 449 | 941 | 10.56 |
| | | HT4 | 426 | 979 | 11.26 |
| | | | 448 | 920 | 10.39 |
| | | | 436 | 961 | 10.48 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 143 | HIP 1 | HT2 | 448 | 901 | 6.88 |
| | | | 332 | 959 | 8.59 |
| | | | 456 | 970 | 8.3 |
| | HIP 3 | HT6 | 327 | 1158 | 14.58 |
| | | | 323 | 1157 | 15.92 |
| | | HT4 | 394 | 1202 | 12.29 |
| | | | 303 | 944 | 10.45 |
| Alloy 144 | HIP 3 | HT2 | 324 | 971 | 11.28 |
| | | | 358 | 1041 | 12.26 |
| | | HT6 | 404 | 972 | 10.88 |
| | | | 319 | 893 | 11.02 |
| | | | 375 | 1013 | 11.58 |
| | | | 325 | 968 | 11.5 |
| | | HT4 | 421 | 1038 | 12.42 |
| | | | 424 | 981 | 11.55 |
| | | | 430 | 996 | 11.6 |
| Alloy 145 | HIP 1 | HT2 | 361 | 1021 | 9.57 |
| | | | 383 | 1075 | 8.41 |
| | | | 420 | 899 | 8.85 |
| Alloy 147 | HIP 1 | HT6 | 354 | 1206 | 8.63 |
| | | | 370 | 1211 | 8.98 |
| | | HT4 | 367 | 1133 | 8.23 |
| | | | 379 | 1188 | 8.4 |
| | | | 369 | 1084 | 7.66 |
| | HIP 3 | HT6 | 324 | 957 | 7.67 |
| | | | 333 | 1295 | 12.93 |
| | | HT4 | 360 | 1160 | 10.39 |
| Alloy 148 | HIP 1 | HT6 | 440 | 981 | 15.06 |
| | | | 457 | 971 | 14.96 |
| | | HT4 | 422 | 1018 | 14.36 |
| | | | 433 | 925 | 12.54 |
| Alloy 149 | HIP 1 | HT6 | 419 | 1034 | 16.39 |
| | | | 428 | 935 | 15.07 |
| | | HT4 | 379 | 950 | 14.67 |
| | | HT2 | 433 | 939 | 12.11 |
| | | | 426 | 901 | 11.5 |
| | HIP 3 | HT6 | 392 | 965 | 15.98 |
| | | | 351 | 961 | 16.07 |
| | | HT2 | 370 | 1032 | 15.36 |
| | | | 386 | 1119 | 16.11 |
| Alloy 150 | HIP 1 | HT6 | 481 | 948 | 12.61 |
| | | | 471 | 955 | 13.23 |
| | | | 491 | 882 | 8.07 |
| | | HT2 | 508 | 1009 | 12.45 |
| | | | 540 | 961 | 10.78 |
| | | | 503 | 976 | 11.58 |
| | HIP 3 | HT6 | 368 | 909 | 13.41 |
| | | | 401 | 917 | 13.31 |
| | | HT4 | 426 | 990 | 15.11 |
| | | | 388 | 931 | 13.19 |
| Alloy 151 | HIP 1 | HT6 | 428 | 894 | 13.9 |
| | | | 431 | 1027 | 17.16 |
| | | HT4 | 491 | 916 | 12.77 |
| | | | 481 | 925 | 14.05 |
| | HIP 3 | HT6 | 363 | 1024 | 17.47 |
| | | | 377 | 1097 | 19.75 |
| Alloy 152 | HIP 1 | HT6 | 457 | 928 | 14.34 |
| | | | 458 | 936 | 14.56 |
| | | HT4 | 474 | 1077 | 18.08 |
| | | | 410 | 1028 | 16.3 |
| | | | 415 | 962 | 15.29 |
| | | HT2 | 479 | 945 | 12.65 |
| | | | 473 | 1004 | 14.05 |
| Alloy 153 | HIP 1 | HT6 | 480 | 993 | 14.33 |
| | | | 464 | 936 | 12.97 |
| | | | 422 | 998 | 14.16 |
| | HIP 3 | HT6 | 348 | 999 | 16.81 |
| | | | 367 | 1156 | 20.15 |
| | | | 404 | 1018 | 17.02 |
| | | | 350 | 957 | 15.3 |
| | | HT4 | 395 | 1146 | 19.28 |
| | | | 357 | 970 | 15.27 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 384 | 971 | 16.52 |
| | | | 365 | 977 | 15.85 |
| Alloy 157 | HIP 1 | HT2 | 367 | 1070 | 6.7 |
| | | | 379 | 767 | 6.34 |
| | | | 362 | 894 | 5.87 |
| | | HT6 | 383 | 782 | 8.89 |
| | | | 370 | 1374 | 9.47 |
| | | | 402 | 1191 | 9.99 |
| | | | 350 | 1320 | 10.98 |
| | | HT4 | 390 | 793 | 7.1 |
| | | | 326 | 941 | 8.36 |
| | | | 372 | 1090 | 8.55 |
| | | | 402 | 1200 | 8.87 |
| | HIP 3 | HT2 | 271 | 873 | 9.6 |
| | | | 318 | 855 | 6.39 |
| | | | 306 | 936 | 6.11 |
| | | | 327 | 976 | 8.86 |
| | | HT6 | 349 | 1377 | 13.21 |
| | | | 345 | 1442 | 15.92 |
| | | | 311 | 1200 | 13.28 |
| | | | 355 | 1064 | 11.46 |
| | | | 347 | 1307 | 12.74 |
| | | HT4 | 374 | 1278 | 13.01 |
| | | | 380 | 1479 | 20.33 |
| | | | 341 | 1330 | 13.75 |
| Alloy 158 | HIP 1 | HT2 | 415 | 764 | 7.52 |
| | | | 463 | 1036 | 9.73 |
| | | HT6 | 405 | 1152 | 12.39 |
| | | | 456 | 1091 | 11.72 |
| | | | 499 | 1217 | 13.79 |
| | | HT4 | 416 | 1099 | 12.68 |
| | | | 410 | 998 | 11.48 |
| | | | 371 | 1049 | 10.9 |
| Alloy 159 | HIP 1 | HT2 | 395 | 892 | 6.53 |
| | | | 375 | 831 | 5.27 |
| | | | 375 | 880 | 5.81 |
| | | HT6 | 437 | 1011 | 10.07 |
| | | | 459 | 1241 | 10.65 |
| | | | 430 | 916 | 10.69 |
| | | HT4 | 312 | 916 | 7.03 |
| | | | 389 | 1279 | 10.53 |
| | | | 350 | 1104 | 8.04 |
| Alloy 160 | HIP 1 | HT2 | 429 | 763 | 6.06 |
| | | | 434 | 787 | 6.57 |
| | | | 439 | 815 | 7.02 |
| | | HT6 | 456 | 980 | 10.55 |
| | | | 470 | 918 | 9.42 |
| | HIP 2 | HT2 | 411 | 943 | 7.37 |
| | | | 375 | 802 | 8.46 |
| | | HT6 | 414 | 1193 | 10.09 |
| | HIP 3 | HT2 | 404 | 803 | 7.68 |
| | | | 375 | 752 | 6.93 |
| | | | 356 | 728 | 7.6 |
| | | HT6 | 392 | 897 | 10.36 |
| | | | 382 | 872 | 10.15 |
| | | | 379 | 904 | 10.22 |
| | | | 349 | 886 | 10.77 |
| Alloy 161 | HIP 1 | HT2 | 474 | 1152 | 9.49 |
| | | | 429 | 904 | 7.78 |
| | | HT6 | 384 | 979 | 10.63 |
| | | | 334 | 845 | 11.31 |
| | | | 410 | 1116 | 11.55 |
| | | HT4 | 407 | 1259 | 12.9 |
| | | | 426 | 942 | 10.86 |
| Alloy 162 | HIP 1 | HT2 | 418 | 835 | 8.89 |
| | | | 350 | 922 | 9.23 |
| | | | 409 | 892 | 8.01 |
| | | HT6 | 430 | 995 | 9.51 |
| | | | 464 | 1067 | 11.06 |
| | | | 451 | 1022 | 10.58 |
| | HIP 3 | HT2 | 301 | 757 | 10.32 |
| | | | 353 | 774 | 8.42 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 345 | 735 | 8.03 |
| | | | 329 | 814 | 8.59 |
| | | HT4 | 378 | 1010 | 13.15 |
| | | | 398 | 975 | 10.83 |
| | | | 324 | 1034 | 12.8 |
| | | | 394 | 1020 | 10.83 |
| Alloy 163 | HIP 1 | HT2 | 370 | 824 | 9.35 |
| | | | 412 | 850 | 6.45 |
| | | HT6 | 410 | 873 | 8.59 |
| | | | 417 | 841 | 7.37 |
| | | HT4 | 434 | 803 | 7.98 |
| | HIP 3 | HT6 | 355 | 944 | 9.73 |
| | | | 277 | 873 | 10.01 |
| | | HT4 | 410 | 1065 | 11.79 |
| | | | 416 | 1009 | 9.89 |
| | | | 367 | 868 | 9.02 |
| Alloy 164 | HIP 2 | HT2 | 404 | 871 | 8.25 |
| | | | 380 | 797 | 7.23 |
| | | | 415 | 800 | 7.09 |
| | | HT6 | 425 | 875 | 8.78 |
| | | | 428 | 990 | 10.18 |
| | | HT4 | 391 | 875 | 9.62 |
| Alloy 165 | HIP 2 | HT2 | 388 | 1012 | 7.22 |
| | | | 423 | 834 | 6.83 |
| | | | 399 | 1252 | 8.37 |
| | | | 367 | 862 | 5.99 |
| | | | 382 | 924 | 5.95 |
| | | HT6 | 381 | 922 | 8.3 |
| | | | 403 | 1194 | 10.09 |
| | | | 366 | 1120 | 9.9 |
| | | HT4 | 347 | 806 | 8.63 |
| | | | 373 | 987 | 9.58 |
| | | | 350 | 1048 | 11.4 |
| Alloy 166 | HIP 2 | HT2 | 372 | 952 | 9.24 |
| | | | 366 | 1133 | 10.59 |
| | | HT6 | 355 | 1247 | 14.38 |
| | | HT4 | 429 | 1407 | 18.14 |
| | | | 399 | 1463 | 23.93 |
| | HIP 3 | HT2 | 328 | 1030 | 10.84 |
| | | | 398 | 988 | 8.72 |
| | | HT6 | 403 | 995 | 10.58 |
| | | HT4 | 396 | 1090 | 12.8 |
| | | | 419 | 1224 | 12.87 |
| | | | 412 | 1324 | 15.29 |
| Alloy 167 | HIP 2 | HT2 | 357 | 1209 | 7.07 |
| | | | 370 | 1005 | 6.31 |
| | | HT6 | 360 | 1336 | 8.31 |
| | | | 336 | 1192 | 9.93 |
| | | | 384 | 1189 | 10.08 |
| | | | 361 | 1435 | 11.15 |
| | | HT4 | 383 | 1204 | 8.02 |
| | | | 387 | 1211 | 8.18 |
| | | | 362 | 1328 | 8.83 |
| | | | 356 | 1403 | 9.71 |
| | HIP 3 | HT2 | 379 | 744 | 5.87 |
| | | HT6 | 402 | 1185 | 10.67 |
| | | | 339 | 1492 | 10.66 |
| Alloy 168 | HIP 2 | HT2 | 424 | 792 | 7.02 |
| | | HT6 | 410 | 945 | 9.63 |
| | | | 411 | 900 | 9.35 |
| | | | 448 | 1130 | 11.26 |
| | | HT4 | 387 | 1026 | 10.48 |
| Alloy 169 | HIP 2 | HT2 | 353 | 811 | 8.78 |
| | | | 376 | 851 | 8.62 |
| | | HT6 | 405 | 872 | 9.16 |
| | | | 374 | 1318 | 13.75 |
| | | | 389 | 881 | 8.95 |
| | | HT4 | 392 | 1005 | 11.47 |
| | | | 379 | 958 | 11.14 |
| Alloy 170 | HIP 2 | HT2 | 405 | 1064 | 10.74 |
| | | | 407 | 813 | 7.16 |
| | | | 435 | 889 | 8.32 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT6 | 388 | 871 | 8.69 |
| | | | 418 | 931 | 10.83 |
| | | HT4 | 414 | 968 | 10.77 |
| | | | 371 | 970 | 11.26 |
| | | | 354 | 937 | 9.64 |
| | HIP 3 | HT2 | 451 | 1043 | 9.04 |
| | | | 366 | 935 | 8.22 |
| | | | 432 | 906 | 8.02 |
| | | HT6 | 399 | 878 | 9.76 |
| | | | 404 | 1195 | 12.47 |
| | | | 397 | 1101 | 10.9 |
| Alloy 171 | HIP 2 | HT2 | 411 | 761 | 5.69 |
| | | HT6 | 420 | 848 | 8.37 |
| | | | 421 | 982 | 9.65 |
| | | HT4 | 368 | 810 | 8.58 |
| | | | 347 | 950 | 9.67 |
| | HIP 3 | HT2 | 379 | 892 | 6.91 |
| | | | 458 | 799 | 6.49 |
| | | | 400 | 771 | 6.32 |
| | | HT6 | 401 | 1007 | 9.44 |
| | | | 387 | 833 | 8.14 |
| | | | 357 | 899 | 8.51 |
| Alloy 172 | HIP 2 | HT2 | 474 | 804 | 4.97 |
| | | | 455 | 820 | 5.62 |
| | | | 452 | 896 | 6.33 |
| | | HT6 | 470 | 934 | 7.66 |
| | | | 449 | 868 | 7.06 |
| | | | 418 | 921 | 7.55 |
| | | | 455 | 981 | 8.44 |
| | | | 489 | 861 | 6.64 |
| | | | 467 | 933 | 7.92 |
| | | HT4 | 461 | 895 | 7.51 |
| | | | 472 | 1159 | 10.1 |
| | | | 503 | 858 | 6.66 |
| Alloy 173 | HIP 2 | HT2 | 468 | 727 | 4.7 |
| | | | 471 | 833 | 6.54 |
| | | | 433 | 773 | 5.33 |
| | | | 426 | 819 | 5.75 |
| | | | 447 | 795 | 5.61 |
| | | HT6 | 425 | 883 | 8.21 |
| | | | 409 | 917 | 8.72 |
| | | | 416 | 897 | 8.17 |
| | | | 434 | 926 | 7.73 |
| | | HT4 | 473 | 1052 | 10.22 |
| | | | 434 | 917 | 8.6 |
| | | | 448 | 1004 | 9.68 |
| | | | 429 | 948 | 9.01 |
| | | | 447 | 935 | 7.97 |
| | | | 404 | 897 | 7.88 |
| Alloy 174 | HIP 2 | HT2 | 463 | 852 | 7.02 |
| | | | 431 | 971 | 7.38 |
| | | HT6 | 418 | 916 | 8.12 |
| | | | 374 | 1263 | 12.99 |
| | | | 427 | 1373 | 13 |
| | | | 446 | 1227 | 11.58 |
| | | HT4 | 398 | 1196 | 10.97 |
| | | | 389 | 1305 | 11.38 |
| | | | 410 | 1198 | 11.11 |
| | | | 421 | 1103 | 9.11 |
| | HIP 3 | HT2 | 536 | 705 | 3.49 |
| | | | 421 | 817 | 6.04 |
| | | | 410 | 824 | 6.73 |
| | | | 370 | 891 | 6.78 |
| | | | 372 | 1030 | 7.65 |
| | | HT6 | 431 | 1184 | 11.57 |
| | | | 380 | 1216 | 10.48 |
| | | | 399 | 1144 | 9.81 |
| | | | 385 | 1225 | 10.63 |
| | | | 388 | 984 | 10.07 |
| | | HT4 | 409 | 887 | 10.14 |
| | | | 390 | 953 | 9.15 |
| | | | 407 | 1390 | 13.53 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 386 | 1231 | 10.96 |
| | | | 378 | 1337 | 12.64 |
| Alloy 175 | HIP 5 | HT6 | 512 | 927 | 9.25 |
| | | HT4 | 385 | 1081 | 11.52 |
| | HIP 7 | HT2 | 395 | 841 | 5.42 |
| | | | 406 | 1015 | 6.89 |
| | | HT6 | 404 | 1213 | 10.55 |
| | | | 393 | 1042 | 9.31 |
| | | | 401 | 1004 | 11.07 |
| | | | 383 | 1111 | 11.15 |
| | | | 411 | 1183 | 11.88 |
| | | HT4 | 398 | 1372 | 12.95 |
| | | | 421 | 1089 | 10.02 |
| Alloy 176 | HIP 5 | HT2 | 453 | 840 | 5.98 |
| | | HT6 | 420 | 1080 | 9.13 |
| | | | 428 | 1144 | 9.52 |
| | | | 441 | 1103 | 10.26 |
| | | HT4 | 358 | 910 | 9.97 |
| | | | 401 | 933 | 8.86 |
| | | | 418 | 986 | 8.56 |
| | HIP 7 | HT2 | 459 | 876 | 6.57 |
| | | | 304 | 1021 | 7.35 |
| | | HT6 | 418 | 1355 | 14.5 |
| | | | 371 | 1131 | 10.66 |
| | | | 419 | 986 | 12.28 |
| | | HT4 | 405 | 1029 | 14.04 |
| | | | 347 | 1279 | 12.71 |
| | | | 338 | 1393 | 13.94 |
| | | | 367 | 1446 | 15.82 |
| Alloy 177 | HIP 5 | HT2 | 263 | 1061 | 4.48 |
| | | | 390 | 1236 | 7.62 |
| | | | 295 | 1297 | 6.21 |
| | | HT6 | 271 | 1361 | 12.62 |
| | | | 269 | 1352 | 9.6 |
| | | | 268 | 1273 | 7.32 |
| | | HT4 | 275 | 1382 | 12.49 |
| | | | 272 | 1370 | 11.25 |
| | HIP 7 | HT2 | 328 | 1434 | 10.7 |
| | | | 323 | 1276 | 7.89 |
| | | | 289 | 1245 | 6.33 |
| | | HT6 | 361 | 1371 | 12.11 |
| | | HT4 | 318 | 1369 | 14.49 |
| | | | 293 | 1373 | 12.84 |
| | | | 302 | 1338 | 8.82 |
| Alloy 178 | HIP 5 | HT2 | 486 | 859 | 6.17 |
| | | | 442 | 898 | 7.03 |
| | | | 478 | 854 | 6.54 |
| | HIP 7 | HT2 | 441 | 886 | 7.28 |
| | | | 431 | 796 | 6.25 |
| | | | 416 | 876 | 7.62 |
| | | HT6 | 476 | 1010 | 9.77 |
| | | | 444 | 989 | 9.93 |
| | | | 468 | 1040 | 11.08 |
| | | HT4 | 453 | 1047 | 10.75 |
| | | | 479 | 776 | 6.63 |
| | | | 451 | 905 | 9.26 |
| Alloy 179 | HIP 5 | HT2 | 427 | 788 | 6.1 |
| | | | 396 | 902 | 7.31 |
| | | | 370 | 865 | 6.56 |
| | | HT6 | 425 | 1111 | 7.4 |
| | | | 440 | 1044 | 7.66 |
| | | | 459 | 1015 | 8.18 |
| | | | 470 | 1075 | 8.51 |
| | | | 460 | 1119 | 9.5 |
| | | HT4 | 439 | 1218 | 8.71 |
| | | | 424 | 1026 | 7.37 |
| | | | 438 | 1124 | 7.91 |
| | | | 427 | 973 | 8.22 |
| Alloy 180 | HIP 5 | HT2 | 465 | 1054 | 7.65 |
| | | | 458 | 1035 | 7.48 |
| | | | 444 | 978 | 6.78 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 410 | 1033 | 8.33 |
| | | | 432 | 1233 | 9.83 |
| | | | 424 | 1173 | 9.31 |
| | HIP 7 | HT2 | 348 | 774 | 5.62 |
| | | | 330 | 663 | 4.84 |
| | | | 414 | 888 | 6.39 |
| | | HT6 | 418 | 1471 | 15.88 |
| | | | 412 | 1474 | 17.25 |
| | | | 411 | 1379 | 12.32 |
| Alloy 181 | HIP 5 | HT2 | 371 | 671 | 3.59 |
| | | | 387 | 590 | 2.17 |
| | | HT6 | 314 | 1525 | 6.74 |
| | | HT4 | 294 | 1417 | 4.04 |
| | HIP 7 | HT2 | 796 | 1087 | 1.37 |
| | | | 818 | 1129 | 1.71 |
| | | HT6 | 477 | 1392 | 2.6 |
| | | | 577 | 1634 | 7.61 |
| | | HT4 | 354 | 1675 | 8.16 |
| | | | 386 | 1678 | 9.7 |
| | | | 383 | 1674 | 8.89 |
| Alloy 182 | HIP 5 | HT2 | 390 | 1044 | 12.08 |
| | | | 449 | 1037 | 11.57 |
| | | HT6 | 479 | 1061 | 14.79 |
| | | | 464 | 1078 | 14.86 |
| | | HT4 | 488 | 1015 | 13.3 |
| | | | 452 | 1050 | 14.54 |
| | | | 468 | 1058 | 14.83 |
| Alloy 183 | HIP 2 | HT2 | 351 | 1188 | 7.36 |
| | | | 374 | 1143 | 7.12 |
| | | | 372 | 1217 | 7.44 |
| | | HT6 | 393 | 1182 | 8.04 |
| | | | 406 | 1197 | 7.5 |
| | | | 390 | 1217 | 8.3 |
| | | HT4 | 386 | 1039 | 6.57 |
| | | | 397 | 1250 | 7.95 |
| | HIP 3 | HT2 | 379 | 1210 | 7.03 |
| | | | 367 | 1109 | 6.42 |
| | | | 399 | 1074 | 6.45 |
| | | HT6 | 341 | 1139 | 7.2 |
| | | | 389 | 1098 | 7.45 |
| | | HT4 | 406 | 1194 | 7.83 |
| | | | 396 | 1491 | 10.39 |
| Alloy 184 | HIP 2 | HT2 | 360 | 1389 | 4.44 |
| | | | 361 | 1406 | 4.6 |
| | | | 403 | 1429 | 4.59 |
| | | HT6 | 373 | 1351 | 5.89 |
| | | | 419 | 1514 | 5.9 |
| | | | 340 | 1275 | 6.04 |
| | | HT4 | 377 | 1249 | 4.54 |
| | | | 370 | 1152 | 3.7 |
| | | | 375 | 1180 | 4.04 |
| | HIP 3 | HT2 | 438 | 1469 | 4.83 |
| | | | 411 | 1538 | 5.51 |
| | | | 473 | 1407 | 3.78 |
| | | HT6 | 332 | 971 | 3.79 |
| | | | 453 | 1618 | 7 |
| | | HT4 | 428 | 1673 | 8.72 |
| | | | 439 | 1686 | 12.76 |
| | | | 398 | 1310 | 4.33 |
| Alloy 185 | HIP 2 | HT2 | 398 | 875 | 5.11 |
| | | | 411 | 765 | 4.6 |
| | | | 412 | 844 | 4.64 |
| | | HT6 | 390 | 709 | 5.04 |
| | | | 396 | 1134 | 7.83 |
| | | | 405 | 777 | 5.34 |
| | | HT4 | 381 | 809 | 5.38 |
| | | | 378 | 815 | 5.5 |
| | | | 395 | 812 | 5.31 |
| | HIP 3 | HT2 | 376 | 960 | 4.99 |
| | | | 389 | 989 | 5.37 |
| | | | 398 | 1081 | 6.15 |
| | | HT6 | 343 | 953 | 6.67 |
| | | | 370 | 808 | 5.52 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 186 | HIP 2 | HT2 | 419 | 667 | 4.1 |
| | | | 398 | 696 | 4.19 |
| | | HT6 | 401 | 738 | 5.06 |
| | | | 356 | 945 | 6.63 |
| | | | 373 | 862 | 5.75 |
| | | HT4 | 406 | 875 | 5.8 |
| | | | 393 | 839 | 5.74 |
| | | | 424 | 864 | 5.82 |
| | HIP 3 | HT2 | 404 | 924 | 5.25 |
| | | | 388 | 897 | 4.86 |
| | | | 376 | 921 | 5.29 |
| | | HT6 | 368 | 894 | 6.32 |
| | | | 371 | 974 | 6.73 |
| | | | 386 | 888 | 6.42 |
| Alloy 187 | HIP 2 | HT2 | 417 | 940 | 5.44 |
| | | | 410 | 879 | 5.16 |
| | | | 426 | 881 | 4.89 |
| | | HT6 | 392 | 938 | 5.7 |
| | | | 400 | 703 | 3.53 |
| | | | 394 | 1016 | 6.43 |
| | HIP 3 | HT2 | 377 | 1103 | 6.89 |
| | | | 350 | 1016 | 6.49 |
| | | HT6 | 371 | 1246 | 8.4 |
| | | HT4 | 389 | 1216 | 7.86 |
| | | | 396 | 1225 | 7.99 |
| Alloy 188 | HIP 2 | HT2 | 319 | 1283 | 6.91 |
| | | | 321 | 1254 | 7.1 |
| | | | 315 | 1280 | 7.12 |
| | | HT6 | 303 | 1419 | 9.06 |
| | | | 304 | 1435 | 10.32 |
| | | | 313 | 1440 | 10.53 |
| | | HT3 | 328 | 1482 | 10.58 |
| | | | 327 | 1475 | 11.02 |
| | | | 312 | 1475 | 10.11 |
| | | HT4 | 285 | 1345 | 8.13 |
| | | | 304 | 1332 | 7.33 |
| | | | 331 | 1123 | 6.99 |
| | HIP 4 | HT2 | 372 | 1401 | 9 |
| | | | 380 | 1432 | 9.42 |
| | | | 371 | 1421 | 9.64 |
| | | HT6 | 326 | 1431 | 10.87 |
| | | | 343 | 1490 | 14.95 |
| | | | 295 | 1479 | 13.29 |
| | | HT4 | 354 | 1478 | 14.55 |
| Alloy 189 | HIP 2 | HT2 | 414 | 1029 | 6.76 |
| | | | 427 | 1201 | 7.5 |
| | | HT6 | 365 | 1421 | 11.17 |
| | | | 384 | 1432 | 11.58 |
| | | | 393 | 1435 | 11.54 |
| | | HT4 | 317 | 1248 | 8.17 |
| | HIP 4 | HT2 | 337 | 1432 | 10.74 |
| | | | 334 | 1471 | 11.79 |
| | | HT6 | 330 | 1388 | 14.19 |
| | | | 346 | 1450 | 13.53 |
| | | | 322 | 1413 | 14 |
| | | HT4 | 361 | 1155 | 7.39 |
| | | | 341 | 1414 | 14.17 |
| | | | 363 | 1395 | 11.38 |
| Alloy 190 | HIP 2 | HT2 | 367 | 1296 | 8.54 |
| | | | 378 | 1308 | 8.53 |
| | | | 373 | 1252 | 7.88 |
| | | HT6 | 361 | 1404 | 12.39 |
| | | | 339 | 1407 | 12.88 |
| | | | 359 | 1295 | 8.69 |
| | | HT4 | 334 | 1385 | 14 |
| | | | 371 | 1389 | 13.5 |
| | | | 343 | 1327 | 11.1 |
| | | HT7 | 390 | 1434 | 13.52 |
| | | | 367 | 1415 | 11.41 |
| | | | 383 | 1435 | 12.81 |
| | HIP 4 | HT2 | 387 | 1246 | 9.78 |
| | | | 374 | 1091 | 8.26 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT6 | 359 | 1429 | 15.19 |
| | | | 358 | 1387 | 13.01 |
| | | | 362 | 1370 | 12.03 |
| | | HT4 | 345 | 1430 | 15.76 |
| | | | 355 | 1434 | 16.5 |
| | | | 410 | 1105 | 11.18 |
| | | HT7 | 390 | 1279 | 11.42 |
| Alloy 191 | HIP 2 | HT2 | 370 | 1259 | 8.86 |
| | | | 401 | 1301 | 9.91 |
| | | | 368 | 1071 | 8.3 |
| | | HT6 | 405 | 1265 | 9.78 |
| | | | 396 | 1391 | 12.87 |
| | | | 405 | 1339 | 11.36 |
| | | HT4 | 383 | 885 | 7.2 |
| | | | 343 | 1294 | 11.05 |
| | | | 348 | 1325 | 12.69 |
| | | HT7 | 403 | 1172 | 10.57 |
| | | | 384 | 1213 | 8.98 |
| | | | 402 | 1210 | 9.44 |
| Alloy 192 | HIP 2 | HT2 | 433 | 1154 | 9.19 |
| | | | 429 | 1034 | 8.04 |
| | | | 428 | 1086 | 8.53 |
| | | HT6 | 440 | 1349 | 12.96 |
| | | | 408 | 1350 | 13.3 |
| | | | 428 | 1225 | 10.62 |
| | | HT4 | 415 | 1203 | 10 |
| | | | 424 | 1335 | 12.96 |
| | | | 401 | 1187 | 9.99 |
| Alloy 193 | HIP 2 | HT2 | 396 | 1081 | 6.57 |
| | | | 373 | 1099 | 6.8 |
| | | | 346 | 1070 | 6.55 |
| | | HT6 | 359 | 1191 | 9.28 |
| | | | 382 | 1178 | 9.65 |
| | | | 408 | 1407 | 11.17 |
| | HIP 3 | HT2 | 389 | 1328 | 8.76 |
| | | | 380 | 1240 | 7.91 |
| | | | 383 | 1300 | 8.65 |
| | | HT4 | 383 | 1406 | 12.54 |
| | | | 345 | 1400 | 13.49 |
| | | | 376 | 1424 | 14 |
| Alloy 194 | HIP 2 | HT2 | 446 | 1042 | 7.55 |
| | | | 418 | 808 | 5.95 |
| | | | 427 | 871 | 6.72 |
| | | HT6 | 432 | 1255 | 10.24 |
| | | | 440 | 1261 | 10.09 |
| | | | 417 | 1035 | 8.89 |
| | | HT4 | 418 | 1187 | 9.68 |
| | HIP 3 | HT2 | 388 | 984 | 7.31 |
| | | | 399 | 932 | 7.05 |
| | | | 410 | 985 | 7.5 |
| | | HT6 | 391 | 1127 | 9.53 |
| | | | 390 | 1233 | 10.74 |
| Alloy 195 | HIP 2 | HT2 | 423 | 948 | 7.83 |
| | | | 411 | 924 | 7.69 |
| | | | 429 | 895 | 7.61 |
| | | HT6 | 424 | 1188 | 10.82 |
| | | | 424 | 1230 | 11.44 |
| | | | 431 | 1191 | 10.83 |
| | | HT4 | 421 | 1285 | 12.95 |
| | | | 409 | 1085 | 10.4 |
| | | | 431 | 1232 | 12.08 |
| | HIP 3 | HT2 | 383 | 872 | 7.57 |
| | | | 377 | 831 | 7.48 |
| | | | 427 | 872 | 7.86 |
| Alloy 196 | HIP 2 | HT2 | 465 | 889 | 7.42 |
| | | | 422 | 834 | 7.19 |
| | | | 424 | 1006 | 9.17 |
| | | HT6 | 438 | 1111 | 10.55 |
| | | | 458 | 1189 | 11.81 |
| | | HT4 | 435 | 1001 | 9.37 |
| | | | 419 | 1072 | 10.15 |
| | | | 439 | 1060 | 10.42 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 197 | HIP 2 | HT2 | 465 | 858 | 7.15 |
| | | | 460 | 854 | 7.2 |
| | | HT6 | 486 | 896 | 8.78 |
| | | | 479 | 982 | 10.1 |
| | | | 462 | 903 | 8.98 |
| | | HT4 | 469 | 919 | 9.4 |
| | | | 469 | 944 | 10 |
| | | | 459 | 968 | 10.85 |
| Alloy 198 | HIP 5 | HT2 | 661 | 1139 | 2.79 |
| | | | 692 | 1081 | 2.39 |
| | | HT6 | 587 | 1760 | 6.64 |
| | HIP 6 | HT2 | 510 | 1046 | 2.24 |
| | | | 602 | 1174 | 2.69 |
| | | HT6 | 449 | 1614 | 7.09 |
| | | | 333 | 1272 | 3.09 |
| | | HT4 | 621 | 1675 | 6.88 |
| | | | 629 | 1582 | 3.89 |
| | | | 572 | 1673 | 9.18 |
| Alloy 199 | HIP 5 | HT2 | 892 | 1113 | 1.51 |
| | | | 1003 | 1190 | 2.3 |
| | | HT6 | 832 | 1673 | 6.87 |
| | | | 761 | 1675 | 3.81 |
| | | | 712 | 1754 | 6.18 |
| | | HT4 | 785 | 1628 | 6.68 |
| | | | 628 | 1625 | 8.1 |
| | | | 719 | 1681 | 4.33 |
| | HIP 6 | HT2 | 1116 | 1290 | 1.53 |
| | | | 839 | 1223 | 2.63 |
| | | HT6 | 677 | 1661 | 6.47 |
| | | | 708 | 1637 | 7.06 |
| | | | 674 | 1784 | 7.53 |
| | | | 718 | 1641 | 7.39 |
| | | | 707 | 1655 | 4.27 |
| | | HT4 | 642 | 1695 | 6.66 |
| | | | 677 | 1686 | 5.33 |
| | | | 665 | 1693 | 5.09 |
| | | | 682 | 1690 | 3.76 |
| | | | 807 | 1675 | 7.09 |
| | | | 806 | 1698 | 6.58 |
| Alloy 200 | HIP 5 | HT6 | 998 | 1651 | 7.27 |
| | | | 824 | 1810 | 4.56 |
| | | HT4 | 1006 | 1784 | 4.94 |
| | | | 954 | 1731 | 5.72 |
| | | | 906 | 1726 | 3.14 |
| | | HT6 | 1083 | 1612 | 7.73 |
| | | | 1028 | 1565 | 3.54 |
| | | | 1010 | 1615 | 5.48 |
| | | HT4 | 1027 | 1604 | 7.53 |
| | | | 1109 | 1671 | 6.24 |
| | | | 950 | 1660 | 6.45 |
| Alloy 201 | HIP 5 | HT2 | 396 | 1119 | 9.55 |
| | | | 445 | 1269 | 10.22 |
| | | | 414 | 1176 | 9.93 |
| | | HT6 | 411 | 1173 | 10.53 |
| | | | 406 | 815 | 7.8 |
| | | | 405 | 1419 | 13.98 |
| | HIP 8 | HT2 | 356 | 1062 | 9.28 |
| | | | 412 | 1057 | 8.71 |
| | | HT6 | 392 | 1382 | 13.57 |
| | | | 381 | 1331 | 12.82 |
| | | | 386 | 1365 | 13.4 |
| | | HT4 | 421 | 1358 | 13.12 |
| | | | 372 | 1270 | 11.47 |
| Alloy 202 | HIP 5 | HT2 | 410 | 876 | 7.81 |
| | | | 429 | 1013 | 9.16 |
| | | HT6 | 397 | 971 | 9.42 |
| | | | 409 | 1280 | 12.34 |
| | | | 401 | 1118 | 10.69 |
| | | | 407 | 1300 | 12.04 |
| | | HT4 | 424 | 1353 | 13.15 |
| | | | 393 | 930 | 8.15 |
| | | | 387 | 1091 | 9.89 |
| | | | 393 | 1099 | 9.16 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | | 397 | 1275 | 11.48 |
| | | | 387 | 1100 | 9.67 |
| Alloy 203 | HIP 5 | HT2 | 383 | 1019 | 7.35 |
| | | | 395 | 1150 | 9.02 |
| | | | 382 | 1224 | 8.97 |
| | | HT4 | 361 | 1434 | 14.71 |
| | | | 331 | 1369 | 11.51 |
| | | | 348 | 1295 | 10.44 |
| | HIP 8 | HT2 | 358 | 1246 | 10.66 |
| | | | 355 | 1159 | 9.87 |
| | | HT6 | 389 | 1447 | 17.47 |
| | | | 378 | 1379 | 12.83 |
| | | HT4 | 382 | 1423 | 15.27 |
| | | | 379 | 1408 | 15.37 |
| | | | 385 | 1423 | 17.47 |
| Alloy 204 | HIP 5 | HT2 | 391 | 1210 | 7.99 |
| | | | 387 | 1089 | 7.19 |
| | | | 386 | 1211 | 8.03 |
| | | HT6 | 388 | 1453 | 13.33 |
| | | | 373 | 1427 | 11.72 |
| | | | 354 | 1455 | 13.54 |
| | | HT4 | 374 | 1440 | 12.4 |
| | | | 382 | 1414 | 10.29 |
| | | HT2 | 358 | 1333 | 11.49 |
| | | | 357 | 1019 | 8.35 |
| | | HT6 | 372 | 1402 | 14.54 |
| | | HT4 | 401 | 1440 | 15.24 |
| | | | 393 | 1454 | 16.37 |
| Alloy 205 | HIP 5 | HT2 | 390 | 1157 | 11.18 |
| | | | 402 | 1215 | 11.78 |
| | | | 388 | 1022 | 9.4 |
| | | HT6 | 405 | 1178 | 11.43 |
| | | | 397 | 1093 | 10.87 |
| | | | 391 | 1078 | 10.51 |
| | | HT4 | 417 | 1258 | 12.73 |
| | | | 413 | 1270 | 12.82 |
| | | | 406 | 1281 | 13.13 |
| | HIP 8 | HT2 | 375 | 968 | 10.35 |
| | | | 362 | 1062 | 11.23 |
| | | | 377 | 1053 | 10.52 |
| | | HT6 | 379 | 1314 | 15.65 |
| | | | 385 | 1324 | 15.55 |
| | | | 370 | 1340 | 16.68 |
| | | HT4 | 410 | 1316 | 15.62 |
| | | | 361 | 1230 | 13.84 |
| | | | 383 | 1249 | 14.22 |
| Alloy 206 | HIP 5 | HT2 | 434 | 969 | 8.66 |
| | | | 422 | 962 | 8.66 |
| | | HT6 | 408 | 1160 | 11.64 |
| | | | 381 | 923 | 8.76 |
| | | | 432 | 946 | 8.92 |
| | | HT4 | 404 | 1054 | 10.22 |
| | | | 413 | 1147 | 11.33 |
| | | | 417 | 1030 | 9.7 |
| | | | 418 | 949 | 10.64 |
| Alloy 208 | HIP 5 | HT2 | 423 | 1189 | 12.07 |
| | | | 342 | 1062 | 10.47 |
| | | | 402 | 1000 | 9.64 |
| | | HT6 | 409 | 1303 | 13.56 |
| | | | 414 | 1379 | 16.62 |
| | | | 404 | 1160 | 11.16 |
| | | HT4 | 386 | 1247 | 12.83 |
| | | | 432 | 1199 | 10.41 |
| | HIP 8 | HT2 | 371 | 963 | 12.42 |
| | | | 363 | 1046 | 10.03 |
| | | | 351 | 1004 | 11.09 |
| | | HT6 | 400 | 1331 | 16.5 |
| | | | 406 | 1152 | 11.76 |
| | | | 399 | 1050 | 11.46 |
| | | HT4 | 392 | 1100 | 13.17 |
| | | | 368 | 1037 | 13.43 |
| | | | 396 | 1014 | 10.44 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 209 | | HT2 | 395 | 1044 | 10.51 |
| | | | 401 | 970 | 8.67 |
| | | HT4 | 422 | 1336 | 14.44 |
| | | | 416 | 1093 | 10.2 |
| | | | 422 | 1282 | 12.92 |
| | | HT2 | 390 | 1039 | 9.8 |
| | | | 351 | 1145 | 9.88 |
| | | | 349 | 1081 | 9.24 |
| | HIP 8 | HT6 | 392 | 1341 | 15.75 |
| | | | 395 | 1312 | 14.72 |
| | | | 397 | 1320 | 15.21 |
| Alloy 210 | HIP 5 | HT2 | 381 | 1033 | 7.53 |
| | | | 383 | 1087 | 8.53 |
| | | | 393 | 1150 | 8.96 |
| | | HT4 | 397 | 1408 | 12.93 |
| | | | 427 | 1432 | 13.62 |
| | | | 401 | 1327 | 10.96 |
| | HIP 7 | HT2 | 361 | 1105 | 8.19 |
| | | | 371 | 1153 | 8.89 |
| | | | 416 | 1056 | 8.49 |
| | | HT6 | 307 | 1381 | 16.18 |
| | | | 290 | 1276 | 10.88 |
| | | | 311 | 1381 | 16.73 |
| | | HT4 | 377 | 1400 | 12.47 |
| | | | 397 | 1027 | 10.4 |
| | | | 368 | 1319 | 10.87 |
| Alloy 211 | HIP 5 | HT2 | 367 | 1119 | 8.91 |
| | | | 362 | 1109 | 9.05 |
| | | | 416 | 961 | 8.76 |
| | HIP 7 | HT2 | 333 | 1023 | 8.02 |
| | | | 247 | 1216 | 10.57 |
| | | | 345 | 1011 | 8.11 |
| | | | 300 | 1361 | 11.09 |
| | | | 344 | 1323 | 10.38 |
| | | HT6 | 357 | 1377 | 12.76 |
| | | | 339 | 1381 | 12.8 |
| | | | 346 | 1389 | 13.19 |
| | | HT4 | 365 | 1416 | 14.69 |
| | | | 378 | 1403 | 13.26 |
| | | | 345 | 1347 | 11.57 |
| | | | 343 | 1366 | 10.89 |
| | | | 352 | 1375 | 11.81 |
| Alloy 212 | HIP 5 | HT2 | 409 | 1026 | 7.37 |
| | | | 383 | 1014 | 7.46 |
| | | | 403 | 1140 | 8.39 |
| | | HT6 | 399 | 1321 | 10.56 |
| | | | 396 | 1202 | 8.97 |
| | | | 389 | 1295 | 9.62 |
| | | HT4 | 412 | 1159 | 9.02 |
| | | | 411 | 1204 | 9.84 |
| | HIP 7 | HT2 | 386 | 1311 | 10.65 |
| | | | 358 | 1208 | 9.56 |
| | | | 370 | 1334 | 10.72 |
| | | HT6 | 365 | 1415 | 13.09 |
| | | | 379 | 1424 | 14.29 |
| | | | 376 | 1372 | 10.93 |
| | | HT4 | 370 | 1428 | 16.16 |
| | | | 384 | 1414 | 12.97 |
| | | | 366 | 1423 | 14.49 |
| Alloy 213 | HIP 5 | HT2 | 396 | 913 | 6.16 |
| | | | 377 | 1142 | 7.64 |
| | | HT6 | 366 | 1354 | 9.6 |
| | | | 387 | 1384 | 10.26 |
| | | | 354 | 1395 | 10.88 |
| | | HT4 | 384 | 1302 | 8.81 |
| | HIP 7 | HT2 | 381 | 1380 | 11.17 |
| | | | 374 | 1286 | 9.78 |
| | | | 368 | 1289 | 9.61 |
| | | | 368 | 1302 | 10.4 |
| | | | 359 | 1171 | 8.94 |
| | | | 353 | 1300 | 10.27 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT6 | 352 | 1411 | 15.37 |
| | | | 356 | 1418 | 16.06 |
| | | | 360 | 1413 | 17.44 |
| | | HT4 | 371 | 1419 | 15.58 |
| | | | 361 | 1353 | 11.21 |
| | | | 366 | 1416 | 13.71 |
| | | | 370 | 1417 | 12.84 |
| | | | 379 | 1421 | 13 |
| Alloy 214 | HIP 5 | HT2 | 416 | 1232 | 9.37 |
| | | | 352 | 1195 | 8.62 |
| | | | 370 | 1142 | 8.08 |
| | | HT6 | 352 | 1394 | 10.34 |
| | | | 412 | 1300 | 10.57 |
| | | | 370 | 1424 | 13.26 |
| | HIP 7 | HT2 | 341 | 1228 | 8.3 |
| | | | 364 | 1309 | 9.04 |
| | | | 321 | 1275 | 8.69 |
| | | HT6 | 333 | 1397 | 14.74 |
| | | | 325 | 1399 | 15.65 |
| | | HT4 | 359 | 1410 | 14.56 |
| | | | 344 | 1388 | 14.43 |
| | | | 349 | 1390 | 12.79 |
| Alloy 215 | HIP 5 | HT2 | 373 | 939 | 10.69 |
| | | | 396 | 887 | 9.36 |
| | | HT6 | 418 | 927 | 10.26 |
| | | | 450 | 1107 | 13.02 |
| | | | 466 | 1162 | 12.48 |
| | | HT4 | 434 | 1063 | 11.49 |
| | | | 445 | 1077 | 12 |
| | | | 449 | 1119 | 14.09 |
| Alloy 216 | HIP 5 | HT2 | 385 | 949 | 9.64 |
| | | | 388 | 965 | 9.5 |
| | | | 398 | 970 | 9.76 |
| | | HT6 | 378 | 969 | 11.59 |
| | | | 383 | 1135 | 12.61 |
| | | | 387 | 1097 | 11.82 |
| | | HT4 | 380 | 1014 | 10.26 |
| | | | 403 | 1216 | 12.84 |
| Alloy 217 | HIP 5 | HT2 | 371 | 980 | 10.69 |
| | | | 379 | 977 | 10.64 |
| | | | 397 | 1006 | 10.52 |
| | | HT6 | 365 | 966 | 10.79 |
| | | | 372 | 989 | 10.55 |
| | | | 382 | 1046 | 12.04 |
| | | HT4 | 383 | 960 | 9.84 |
| | | | 385 | 1006 | 10.91 |
| | | | 385 | 1040 | 11.13 |
| | HIP 7 | HT2 | 363 | 1067 | 12.44 |
| | | | 370 | 1037 | 11.66 |
| | | | 384 | 1134 | 13.77 |
| | | HT6 | 364 | 1345 | 17.62 |
| | | | 371 | 1310 | 17.12 |
| | | | 377 | 1333 | 16.95 |
| | | HT4 | 352 | 1005 | 11.44 |
| | | | 362 | 1141 | 13.31 |
| Alloy 218 | HIP 5 | HT2 | 382 | 891 | 10.07 |
| | | | 384 | 946 | 11.16 |
| | | | 390 | 949 | 11.07 |
| | | HT6 | 391 | 1180 | 15.74 |
| | | | 405 | 1167 | 15.47 |
| | | | 407 | 1238 | 17.29 |
| | | HT4 | 395 | 1146 | 15.61 |
| | | | 396 | 1005 | 12.41 |
| Alloy 219 | HIP 5 | HT2 | 371 | 953 | 11.59 |
| | | | 386 | 943 | 11.42 |
| | | HT6 | 387 | 1121 | 14.61 |
| | | | 391 | 1044 | 13.28 |
| | | | 422 | 1029 | 12.71 |
| | | HT4 | 371 | 1009 | 12.26 |
| | | | 380 | 1067 | 14.02 |
| | | | 381 | 1034 | 13.51 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 220 | HIP 5 | HT2 | 364 | 915 | 10.8 |
| | | | 369 | 940 | 11.38 |
| | | | 385 | 895 | 10.5 |
| | | HT6 | 360 | 1010 | 13 |
| | | | 380 | 991 | 12.96 |
| | | | 395 | 1121 | 15.07 |
| | | HT4 | 380 | 1007 | 12.73 |
| | | | 393 | 1030 | 13.34 |
| | | | 398 | 963 | 12.07 |
| | HIP 7 | HT2 | 395 | 1009 | 12.16 |
| | | | 401 | 1102 | 13.08 |
| | | | 406 | 1036 | 12.54 |
| | | HT6 | 361 | 1121 | 15.66 |
| | | | 369 | 1081 | 14.65 |
| | | | 371 | 1291 | 19.48 |
| | | HT4 | 372 | 1096 | 14.94 |
| | | | 376 | 1182 | 16.67 |
| Alloy 221 | HIP 5 | HT2 | 415 | 1147 | 9.07 |
| | | | 417 | 1098 | 9.57 |
| | | HT6 | 413 | 967 | 8.5 |
| | | | 430 | 998 | 8.06 |
| | | HT4 | 417 | 558 | 3.72 |
| | | | 418 | 1246 | 9.42 |
| | | | 427 | 897 | 6.9 |
| Alloy 222 | HIP 5 | HT2 | 405 | 1238 | 10.18 |
| | | | 414 | 1149 | 9.39 |
| | | HT6 | 398 | 1101 | 8.56 |
| | | | 404 | 1395 | 12.55 |
| | | | 421 | 1229 | 10.24 |
| | | HT4 | 396 | 1041 | 8.87 |
| | | | 411 | 1100 | 10.25 |
| | | | 416 | 1386 | 12.58 |
| | HIP 7 | HT2 | 334 | 924 | 7.71 |
| | | | 342 | 1198 | 10.93 |
| | | | 350 | 1333 | 12.08 |
| | | HT6 | 360 | 1414 | 14.93 |
| | | | 364 | 1448 | 15.58 |
| | | | 382 | 1451 | 13.21 |
| | | HT4 | 357 | 1264 | 11.18 |
| | | | 362 | 1405 | 15.77 |
| | | | 364 | 1343 | 13.24 |
| Alloy 223 | HIP 5 | HT2 | 360 | 1109 | 9.74 |
| | | | 370 | 1033 | 9.83 |
| | | | 387 | 978 | 9.71 |
| | | | 391 | 1007 | 10.3 |
| | | | 405 | 937 | 10.41 |
| | | | 424 | 774 | 7.04 |
| | | HT6 | 375 | 1207 | 12.34 |
| | | | 375 | 1268 | 12.24 |
| | | | 399 | 1363 | 12.06 |
| | | | 401 | 1182 | 11.95 |
| | | | 406 | 887 | 9.94 |
| | | | 409 | 1089 | 10.47 |
| | | | 418 | 1010 | 11.75 |
| | | | 429 | 1363 | 11.64 |
| | | HT4 | 321 | 654 | 6.4 |
| | | | 354 | 974 | 9.43 |
| | | | 401 | 1073 | 12.26 |
| | | | 407 | 1118 | 11.08 |
| | | | 415 | 1014 | 11.61 |
| Alloy 224 | HIPS 5 | HT2 | 334 | 892 | 6.03 |
| | | | 376 | 1054 | 7.38 |
| | | | 394 | 1067 | 7.11 |
| | | HT6 | 386 | 1244 | 8.04 |
| | | | 414 | 1120 | 6.97 |
| | | HT4 | 427 | 1062 | 6.51 |
| | | | 428 | 1315 | 8.34 |
| | | | 446 | 1207 | 10.16 |
| | HIP 7 | HT2 | 352 | 925 | 6.84 |
| | | HT6 | 385 | 1328 | 9.71 |
| | | | 390 | 1089 | 8.05 |
| | | | 393 | 1038 | 8.06 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 372 | 805 | 6.03 |
| | | | 377 | 1182 | 8.18 |
| | | | 387 | 961 | 8.85 |
| | | | 387 | 1055 | 9.5 |
| Alloy 225 | HIP 5 | HT2 | 316 | 1081 | 6.84 |
| | | | 400 | 830 | 6.53 |
| | | HT6 | 441 | 1257 | 9.66 |
| | | | 442 | 1143 | 9.9 |
| | | HT4 | 410 | 1025 | 7.19 |
| | | | 417 | 1314 | 8.35 |
| | | | 433 | 1294 | 8.74 |
| | HIP 7 | HT2 | 305 | 936 | 8.2 |
| | | | 363 | 1028 | 7.22 |
| | | HT6 | 343 | 1469 | 11.72 |
| | | | 378 | 1443 | 10.95 |
| | | | 379 | 1383 | 9.62 |
| | | HT4 | 367 | 1159 | 8.31 |
| | | | 376 | 1397 | 9.95 |
| | | | 376 | 1438 | 10.82 |
| Alloy 226 | HIP 5 | HT2 | 327 | 989 | 8.29 |
| | | | 392 | 1075 | 8.42 |
| | | HT6 | 427 | 1296 | 9.15 |
| | | HT4 | 443 | 1319 | 9.82 |
| | HIP 7 | HT2 | 364 | 1256 | 9.51 |
| | | | 372 | 1189 | 8.31 |
| | | | 414 | 1104 | 7.88 |
| | | HT6 | 377 | 1331 | 9.27 |
| | | | 394 | 1066 | 8.67 |
| | | | 409 | 1362 | 9.91 |
| | | HT4 | 330 | 1422 | 11.1 |
| | | | 364 | 1423 | 11.75 |
| | | | 372 | 1459 | 12.31 |
| Alloy 227 | HIP 5 | HT2 | 422 | 1080 | 6.11 |
| | | HT6 | 387 | 1259 | 6.98 |
| | | HT4 | 365 | 1274 | 6.29 |
| | | | 446 | 836 | 6.07 |
| | | | 449 | 1077 | 7.64 |
| | HIP 7 | HT2 | 321 | 1500 | 9.04 |
| | | | 323 | 1441 | 8.21 |
| | | | 337 | 1489 | 8.49 |
| | | HT6 | 351 | 1549 | 11.24 |
| | | | 368 | 1404 | 8.6 |
| | | HT4 | 291 | 1546 | 10.46 |
| | | | 305 | 1543 | 10.35 |
| Alloy 228 | HIP 5 | HT4 | 399 | 1581 | 9.66 |
| | HIP 7 | HT2 | 300 | 1355 | 6.85 |
| | | | 302 | 1458 | 7.61 |
| | | | 354 | 996 | 6.14 |
| Alloy 229 | HIP 5 | HT6 | 394 | 821 | 5.86 |
| | | | 395 | 840 | 6.19 |
| | | | 401 | 1054 | 8.61 |
| | | HT4 | 306 | 1165 | 7.77 |
| | | | 316 | 1240 | 8.64 |
| | | | 325 | 972 | 4.82 |
| | | | 325 | 1103 | 5.4 |
| | | | 337 | 1344 | 7.31 |
| | | | 374 | 1062 | 8.08 |
| Alloy 230 | HIP 5 | HT2 | 395 | 904 | 7.05 |
| | | | 415 | 921 | 7.58 |
| | | HT6 | 448 | 1013 | 8.87 |
| | | HT4 | 385 | 957 | 8.82 |
| | | | 405 | 969 | 9.73 |
| | | | 423 | 960 | 9.54 |
| | HIP 7 | HT2 | 428 | 973 | 8.26 |
| | | | 428 | 1021 | 8.9 |
| | | | 429 | 1001 | 8.7 |
| | | HT6 | 436 | 1099 | 10.66 |
| | | | 452 | 1144 | 11.96 |
| | | HT4 | 463 | 1092 | 10.59 |
| | | | 471 | 1048 | 9.9 |
| Alloy 231 | HIP 5 | HT2 | 417 | 1006 | 10.1 |
| | | HT6 | 460 | 985 | 8.61 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 393 | 886 | 7.3 |
| | | | 425 | 853 | 6.69 |
| | | | 437 | 1138 | 12.62 |
| | HIP 7 | HT2 | 347 | 1039 | 11.72 |
| | | | 356 | 981 | 9.44 |
| | | | 398 | 987 | 8.57 |
| | | HT6 | 415 | 1083 | 11.34 |
| | | | 421 | 990 | 9.67 |
| | | | 459 | 1181 | 13.57 |
| | | HT4 | 401 | 949 | 9.53 |
| | | | 415 | 1042 | 10.97 |
| Alloy 232 | HIP 5 | HT2 | 402 | 1015 | 9.1 |
| | | HT6 | 438 | 1151 | 10.88 |
| | | | 442 | 1162 | 12.41 |
| | | | 442 | 1202 | 12.48 |
| | | HT4 | 407 | 1092 | 11.2 |
| | | | 449 | 1037 | 9.83 |
| | | | 452 | 1202 | 12.73 |
| | HIP 7 | HT2 | 283 | 1051 | 10.84 |
| | | | 304 | 990 | 9.33 |
| | | HT6 | 416 | 1198 | 10.57 |
| | | | 426 | 947 | 8.07 |
| | | HT4 | 411 | 1065 | 10.03 |
| | | | 446 | 1148 | 10.83 |
| Alloy 233 | HIP 5 | HT2 | 444 | 879 | 8.06 |
| | | | 464 | 919 | 9.56 |
| | | HT6 | 362 | 965 | 12.56 |
| | | | 407 | 992 | 13.44 |
| | | HT4 | 484 | 993 | 12.28 |
| | | | 488 | 969 | 11.35 |
| | | | 491 | 1040 | 13.99 |
| | HIP 7 | HT2 | 309 | 976 | 14.02 |
| | | | 316 | 977 | 14.77 |
| | | | 387 | 1039 | 16.19 |
| | | HT6 | 480 | 1057 | 15.13 |
| | | | 484 | 1027 | 13.88 |
| | | | 484 | 1029 | 13.66 |
| | | HT4 | 450 | 915 | 9.82 |
| | | | 451 | 928 | 10.99 |
| | | | 463 | 910 | 9.68 |
| Alloy 234 | HIP 5 | HT2 | 449 | 1025 | 14.51 |
| | | | 452 | 994 | 13.33 |
| | | | 452 | 1027 | 13.91 |
| | | HT6 | 369 | 1066 | 15.31 |
| | | | 483 | 1012 | 12.97 |
| | | | 484 | 1026 | 13.55 |
| | | HT4 | 460 | 1076 | 16.86 |
| | | | 479 | 1004 | 14.04 |
| | HIP 7 | HT2 | 358 | 1026 | 14.22 |
| | | | 369 | 1027 | 16.22 |
| | | | 415 | 914 | 9.47 |
| | | HT6 | 458 | 1010 | 14.25 |
| | | | 478 | 994 | 12.43 |
| | | HT4 | 417 | 995 | 14.11 |
| | | | 436 | 867 | 12.14 |
| | | | 454 | 899 | 10.17 |
| | | | 487 | 1008 | 14.09 |
| Alloy 235 | HIP 5 | HT2 | 440 | 994 | 14.02 |
| | | | 459 | 971 | 13 |
| | | | 482 | 1004 | 14.24 |
| | | HT6 | 472 | 1086 | 15.62 |
| | | | 486 | 1026 | 13.78 |
| | | | 488 | 1001 | 12.17 |
| | | HT4 | 478 | 1033 | 14.56 |
| | | | 491 | 912 | 9.37 |
| | | | 534 | 897 | 7.85 |
| | HIP 7 | HT2 | 333 | 913 | 11.45 |
| | | | 358 | 939 | 13.09 |
| | | | 380 | 995 | 14.35 |
| | | HT6 | 465 | 1049 | 14.72 |
| | | | 470 | 936 | 10.82 |
| | | | 484 | 856 | 7.28 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 419 | 978 | 13.96 |
| | | | 429 | 1013 | 15.31 |
| | | | 430 | 957 | 13.23 |
| Alloy 236 | HIP 5 | HT2 | 419 | 980 | 13.39 |
| | | | 420 | 910 | 10.52 |
| | | | 479 | 999 | 13.2 |
| | | HT6 | 346 | 950 | 12.64 |
| | | | 368 | 977 | 13.76 |
| | | | 402 | 973 | 12.87 |
| | HIP 7 | HT6 | 424 | 995 | 12.71 |
| | | | 450 | 905 | 7.94 |
| | | | 484 | 976 | 10.84 |
| | | HT4 | 425 | 943 | 10.84 |
| | | | 428 | 920 | 10.57 |
| Alloy 237 | HIP 5 | HT2 | 427 | 1000 | 14.91 |
| | | | 430 | 1047 | 16.95 |
| | | HT6 | 427 | 919 | 10.5 |
| | | HT4 | 283 | 935 | 13.97 |
| | | | 407 | 911 | 10.45 |
| | | | 445 | 881 | 8.99 |
| | HIP 7 | HT2 | 355 | 1017 | 17.46 |
| | | | 362 | 1022 | 17.33 |
| | | | 379 | 1047 | 17.78 |
| | | HT6 | 443 | 932 | 11.18 |
| | | | 450 | 998 | 14.22 |
| | | HT4 | 409 | 985 | 14.31 |
| | | | 414 | 986 | 14.04 |
| | | | 426 | 1045 | 16.99 |
| Alloy 238 | HIP 5 | HT2 | 397 | 959 | 13.83 |
| | | | 423 | 1052 | 17.39 |
| | | HT6 | 350 | 950 | 13.91 |
| | | | 390 | 1013 | 16.85 |
| | HIP 7 | HT2 | 311 | 974 | 15.58 |
| | | | 353 | 1009 | 17.69 |
| | | | 384 | 1012 | 17.26 |
| | | HT6 | 431 | 1019 | 15.68 |
| | | | 433 | 985 | 13.42 |
| | | | 462 | 1014 | 14.89 |
| | | HT4 | 387 | 973 | 14.62 |
| | | | 413 | 985 | 15.15 |
| | | | 415 | 949 | 13.7 |
| Alloy 239 | HIP 5 | HT2 | 549 | 1005 | 7.32 |
| | | HT6 | 578 | 958 | 1.88 |
| | | HT4 | 408 | 955 | 3.27 |
| | HIP 6 | HT2 | 556 | 974 | 4.99 |
| | | | 574 | 951 | 3.49 |
| | | | 524 | 941 | 2.8 |
| | | HT6 | 648 | 952 | 2.35 |
| | | | 708 | 954 | 2.6 |
| | | | 345 | 946 | 2.3 |
| | | HT4 | 583 | 940 | 2.66 |
| | | | 591 | 932 | 3.46 |
| | | | 653 | 943 | 2.97 |
| Alloy 240 | HIP 5 | HT2 | 609 | 1000 | 7.66 |
| | | | 542 | 1052 | 10.59 |
| | | HT6 | 600 | 986 | 9.17 |
| | | | 617 | 982 | 6.88 |
| | | | 520 | 973 | 6.8 |
| | | HT4 | 351 | 980 | 11.07 |
| | | | 418 | 957 | 8.66 |
| | | | 467 | 990 | 10.64 |
| | HIP 9 | HT2 | 553 | 985 | 8.73 |
| | | | 538 | 989 | 9.36 |
| | | | 569 | 976 | 8.7 |
| | | HT6 | 384 | 959 | 9.15 |
| | | | 532 | 958 | 8 |
| | | HT4 | 578 | 1046 | 12.25 |
| | | | 579 | 1002 | 9.99 |
| Alloy 241 | HIP 5 | HT2 | 405 | 1154 | 9.48 |
| | | | 552 | 1141 | 8.67 |
| | | HT6 | 426 | 1216 | 12.08 |
| | | | 419 | 1207 | 12.19 |
| | | | 398 | 1078 | 8.5 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 401 | 1074 | 9.7 |
| | | | 370 | 1093 | 10.02 |
| | | | 377 | 1120 | 10.64 |
| Alloy 242 | HIP 5 | HT2 | 422 | 1452 | 8.03 |
| | | | 410 | 1294 | 5.83 |
| | | HT6 | 405 | 1382 | 6.39 |
| | | | 422 | 1555 | 8.74 |
| | | | 440 | 1538 | 8.27 |
| | | HT4 | 343 | 1360 | 7.47 |
| | | | 424 | 1405 | 7.64 |
| | | | 384 | 1413 | 7.58 |
| Alloy 243 | HIP 5 | HT2 | 496 | 1088 | 10.96 |
| | | | 523 | 1039 | 7.96 |
| | | HT6 | 445 | 1097 | 10.6 |
| | | | 490 | 1101 | 10.74 |
| | | | 501 | 1042 | 8.2 |
| | | HT4 | 345 | 1008 | 9.15 |
| | | | 459 | 1065 | 10.56 |
| | | | 482 | 1035 | 9.03 |
| Alloy 244 | HIP 5 | HT2 | 413 | 1142 | 12.7 |
| | | | 473 | 1113 | 10.69 |
| | | | 425 | 1047 | 8.92 |
| | | HT6 | 424 | 1071 | 10.32 |
| | | | 413 | 1110 | 10.73 |
| | | | 324 | 1060 | 10.28 |
| | | HT4 | 443 | 1080 | 11.24 |
| | | | 408 | 1104 | 12.05 |
| | | | 379 | 1073 | 11.76 |
| | HIP 9 | HT2 | 282 | 1146 | 16.5 |
| | | | 429 | 1139 | 14.26 |
| | | | 361 | 1111 | 14.35 |
| | | HT6 | 478 | 1064 | 12.18 |
| | | | 484 | 1094 | 12.65 |
| | | | 410 | 1019 | 10.54 |
| | | HT4 | 415 | 1016 | 10.75 |
| | | | 444 | 1044 | 11.83 |
| | | | 395 | 1087 | 13.61 |
| Alloy 245 | HIP 5 | HT2 | 438 | 1209 | 12.07 |
| | | | 406 | 1104 | 9.31 |
| | | HT6 | 475 | 1149 | 11.68 |
| | | | 642 | 1138 | 10.81 |
| | | | 454 | 1189 | 13.2 |
| | | HT4 | 358 | 1100 | 12.23 |
| | | | 362 | 1088 | 10.8 |
| | | | 376 | 985 | 8.79 |
| Alloy 246 | HIP 5 | HT2 | 363 | 1236 | 10.23 |
| | | | 365 | 1113 | 8.37 |
| | | HT6 | 286 | 1080 | 10.62 |
| | | | 411 | 1081 | 8.75 |
| | | HT4 | 426 | 1154 | 10.88 |
| | | | 423 | 1197 | 12.09 |
| | | | 400 | 1140 | 10.93 |
| | HIP 6 | HT2 | 370 | 1182 | 10.84 |
| | | | 375 | 1097 | 10.19 |
| | | HT6 | 382 | 1109 | 10.3 |
| | | | 349 | 1149 | 12.77 |
| Alloy 247 | HIP 5 | HT2 | 437 | 1096 | 10.58 |
| | | | 395 | 1058 | 10.34 |
| | | HT6 | 421 | 1086 | 11.22 |
| | | | 447 | 982 | 8.08 |
| | | HT4 | 484 | 1100 | 11 |
| | | | 399 | 1047 | 9.68 |
| | HIP 8 | HT2 | 419 | 1037 | 10.75 |
| | | | 421 | 1034 | 9.83 |
| | | | 414 | 1066 | 12.03 |
| | | HT6 | 514 | 1087 | 11.67 |
| | | | 469 | 1060 | 11.35 |
| | | | 513 | 1070 | 11.52 |
| Alloy 248 | HIP 5 | HT2 | 416 | 938 | 13.25 |
| | | | 403 | 917 | 12.02 |
| | | HT6 | 394 | 964 | 14.7 |
| | | | 402 | 973 | 14.57 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 419 | 866 | 11.42 |
| | | | 432 | 946 | 13.68 |
| | | | 429 | 953 | 14.1 |
| | HIP 8 | HT2 | 369 | 1010 | 14.9 |
| | | | 389 | 1060 | 15.29 |
| | | | 392 | 1018 | 14.55 |
| | | HT6 | 343 | 957 | 14.53 |
| | | | 356 | 1089 | 17.99 |
| Alloy 249 | HIP 5 | HT2 | 434 | 910 | 9.94 |
| | | | 441 | 1002 | 11.16 |
| | | | 469 | 978 | 11.27 |
| | | HT6 | 380 | 1018 | 12.68 |
| | | | 384 | 929 | 10.83 |
| | | | 426 | 1045 | 12.72 |
| | | HT4 | 437 | 1098 | 13.73 |
| | | | 441 | 1006 | 12.39 |
| | | | 445 | 1008 | 12.1 |
| | HIP 8 | HT2 | 417 | 1014 | 12.2 |
| | | | 356 | 1126 | 14.96 |
| | | | 400 | 983 | 12.94 |
| | | HT6 | 356 | 1175 | 15.3 |
| | | | 349 | 1047 | 13.62 |
| | | | 370 | 1221 | 16.28 |
| Alloy 250 | HIP 5 | HT2 | 393 | 1120 | 14.53 |
| | | HT6 | 347 | 923 | 8.23 |
| | | | 360 | 1137 | 14.63 |
| | | HT4 | 352 | 860 | 6.5 |
| | | | 361 | 1080 | 11.79 |
| | | | 380 | 1064 | 11.58 |
| | HIP 8 | HT2 | 379 | 1243 | 19.56 |
| | | | 354 | 847 | 7.31 |
| | | HT6 | 383 | 950 | 9.35 |
| | | | 379 | 1151 | 15.76 |
| Alloy 251 | HIP 5 | HT2 | 333 | 1212 | 16.42 |
| | | | 362 | 1130 | 13.14 |
| | | | 365 | 1236 | 17.94 |
| | | HT6 | 349 | 1093 | 12.14 |
| | | | 362 | 1073 | 11.73 |
| | | | 371 | 1152 | 14.92 |
| | | HT4 | 362 | 1188 | 15.66 |
| | | | 313 | 1103 | 12.84 |
| | HIP 8 | HT2 | 339 | 1123 | 14.09 |
| | | | 336 | 1056 | 11.73 |
| | | | 348 | 1273 | 18.48 |
| | | HT6 | 364 | 1201 | 17.17 |
| | | | 370 | 1189 | 17.07 |
| | | HT4 | 501 | 1211 | 19.22 |
| | | | 448 | 1210 | 17.46 |
| Alloy 252 | HIP 5 | HT2 | 372 | 860 | 13.51 |
| | | | 366 | 979 | 14.92 |
| | | | 363 | 888 | 15.4 |
| | | | 334 | 835 | 13.35 |
| | | | 362 | 936 | 15.73 |
| | | HT6 | 361 | 1033 | 15.99 |
| | | | 358 | 985 | 15.36 |
| | | | 373 | 1157 | 18.95 |
| | | | 358 | 931 | 14.51 |
| | | | 370 | 888 | 13.67 |
| | | | 349 | 870 | 13.74 |
| | | HT4 | 345 | 570 | 2.9 |
| | | | 363 | 976 | 15.5 |
| | | | 357 | 844 | 13.02 |
| | | | 351 | 1167 | 19.06 |
| | | | 349 | 995 | 15.62 |
| | HIP 8 | HT2 | 359 | 1101 | 19.08 |
| | | | 397 | 1095 | 18.62 |
| | | | 392 | 1067 | 17.99 |
| | | HT6 | 358 | 1056 | 17.42 |
| | | | 371 | 1155 | 19.98 |
| | | HT4 | — | 1109 | 19.97 |
| | | | 336 | 971 | 15.81 |
| | | | 395 | 1154 | 19.79 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 253 | HIP 5 | HT6 | 379 | 1183 | 16.13 |
| | | HT4 | 426 | 982 | 11.74 |
| | | | 407 | 931 | 12.43 |
| | | | 387 | 1001 | 13.26 |
| | HIP 8 | HT2 | 322 | 1182 | 16.45 |
| | | | 310 | 1050 | 13.9 |
| | | | 312 | 1305 | 20.12 |
| | | HT6 | 316 | 1294 | 21.05 |
| | | | 335 | 1261 | 20.28 |
| | | | 323 | 1307 | 22.02 |
| | | HT4 | 321 | 1288 | 22.86 |
| | | | 327 | 1286 | 22.75 |
| Alloy 254 | HIP 5 | HT2 | 331 | 1217 | 17.79 |
| | | | 339 | 1121 | 13.94 |
| | | HT6 | 350 | 1079 | 12.59 |
| | | HT4 | 343 | 1055 | 11.34 |
| | | | 361 | 1214 | 16.69 |
| | HIP 8 | HT2 | 350 | 1101 | 15.06 |
| | | HT4 | 357 | 1099 | 15.81 |
| | | | 375 | 1069 | 13.49 |
| Alloy 255 | HIP 5 | HT4 | 423 | 918 | 7.86 |
| | | HT2 | 391 | 1038 | 11.1 |
| | | | 399 | 984 | 9.71 |
| | | | 408 | 1032 | 11.09 |
| | | HT6 | 420 | 1043 | 10.34 |
| | | | 441 | 1014 | 9.66 |
| | | | 395 | 971 | 8.31 |
| | | HT4 | 425 | 930 | 7.67 |
| | | | 380 | 787 | 4.79 |
| | HIP 8 | HT2 | 333 | 1160 | 14.49 |
| | | | 338 | 1222 | 18.11 |
| | | HT6 | 376 | 1135 | 15.74 |
| | | | 318 | 1121 | 14.98 |
| | | HT4 | 384 | 1170 | 15.54 |
| Alloy 256 | HIP 5 | HT2 | 392 | 1044 | 16.83 |
| | | | 399 | 893 | 14.43 |
| | | | 366 | 914 | 14.55 |
| | | HT6 | 405 | 1127 | 19.19 |
| | | | 432 | 978 | 15.24 |
| | | | 348 | 859 | 13.23 |
| | | | 348 | 924 | 14.87 |
| | | HT4 | 405 | 971 | 15.44 |
| | | | 514 | 1052 | 16.31 |
| | | | 369 | 1017 | 16.21 |
| | | | 371 | 948 | 14.48 |
| | | | 419 | 993 | 15.75 |
| | HIP 8 | HT2 | 322 | 953 | 15.63 |
| | | | 329 | 1010 | 16.48 |
| | | | 324 | 811 | 12.82 |
| | | HT6 | 341 | 993 | 16.6 |
| | | | 329 | 983 | 17.48 |
| | | HT4 | 357 | 1045 | 17.94 |
| Alloy 257 | HIP 5 | HT2 | 352 | 1094 | 13.9 |
| | | HT6 | 370 | 966 | 13.11 |
| | | | 375 | 1206 | 15.71 |
| | | | 366 | 1115 | 13.76 |
| | | HT4 | 337 | 1135 | 14.05 |
| | | | 352 | 1183 | 16.29 |
| | HIP 8 | HT2 | 420 | 1154 | 15.15 |
| | | | 411 | 1108 | 14.7 |
| | | HT6 | 362 | 1269 | 19.28 |
| | | | 353 | 1271 | 19.86 |
| | | | 349 | 995 | 13.69 |
| | | HT4 | 372 | 1241 | 18.39 |
| | | | 342 | 1165 | 16.05 |
| | | | 346 | 1098 | 15.16 |
| Alloy 258 | HIP 5 | HT2 | 363 | 990 | 20.06 |
| | | | 349 | 965 | 19.22 |
| | | HT6 | 330 | 1066 | 23.23 |
| | | | 350 | 963 | 19.92 |
| | | | 407 | 1034 | 22.06 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 354 | 1047 | 22.15 |
| | | | 338 | 1035 | 21.16 |
| | | | 340 | 1071 | 23.65 |
| | HIP 8 | HT2 | 397 | 1037 | 21.94 |
| | | | 403 | 935 | 16.95 |
| | | | 392 | 995 | 19.45 |
| | | HT6 | 353 | 1040 | 22.32 |
| | | | 362 | 972 | 19.33 |
| | | | 338 | 830 | 14.87 |
| | | HT4 | 388 | 1041 | 22.39 |
| | | | 401 | 1123 | 25.38 |
| | | | 404 | 986 | 19.53 |
| Alloy 259 | HIP 5 | HT2 | 371 | 975 | 17.39 |
| | | | 343 | 1029 | 19.81 |
| | | HT6 | 308 | 1003 | 19.27 |
| | | | 339 | 915 | 16.29 |
| | | | 365 | 1102 | 21.57 |
| | | HT4 | 343 | 1153 | 22.67 |
| | | | 397 | 1179 | 24.67 |
| | | | 356 | 902 | 16.19 |
| | HIP 8 | HT2 | 396 | 1015 | 18.71 |
| | | | 380 | 993 | 19.31 |
| | | | 337 | 1029 | 19 |
| | | HT6 | 362 | 853 | 15.09 |
| | | | 398 | 1073 | 21.04 |
| | | | 329 | 1035 | 19.77 |
| | | HT4 | 346 | 900 | 16.52 |
| | | | 340 | 978 | 19.41 |
| | | | 301 | 980 | 19.48 |
| Alloy 260 | HIP 10 | HT4 | 357 | 1039 | 15.92 |
| | | | 401 | 1084 | 17.56 |
| | | | 335 | 965 | 14.17 |
| | | HT9 | 374 | 1084 | 17.41 |
| | | | 339 | 1054 | 16.11 |
| Alloy 261 | HIP 5 | HT2 | 438 | 1057 | 14.91 |
| | | | 451 | 1057 | 15.38 |
| | | HT6 | 372 | 972 | 13.56 |
| | | | 391 | 953 | 13.02 |
| | | HT4 | 430 | 970 | 12.65 |
| | | | 427 | 1012 | 14.24 |
| | | | 445 | 1034 | 14.96 |
| | HIP 6 | HT4 | 382 | 954 | 12.81 |
| | | | 396 | 938 | 12.63 |
| | | | 389 | 1045 | 16.66 |
| Alloy 262 | HIP 5 | HT2 | 1034 | 1254 | 2.06 |
| | | | 1013 | 1317 | 3.85 |
| | | | 997 | 1328 | 4.24 |
| | | HT6 | 1128 | 1619 | 2.38 |
| | | | 1138 | 1658 | 3.98 |
| | | | 1122 | 1640 | 2.42 |
| | | HT4 | 992 | 1682 | 4.99 |
| Alloy 263 | HIP 5 | HT2 | 961 | 1300 | 2.01 |
| | | | 981 | 1317 | 2.13 |
| | | HT6 | 1197 | 1633 | 1.63 |
| | | | 1105 | 1742 | 3.64 |
| | | | 1134 | 1759 | 3.72 |
| | | HT4 | 920 | 1780 | 4.14 |
| | | | 903 | 1734 | 2.91 |
| Alloy 264 | HIP 5 | HT2 | 255 | 731 | 2.08 |
| | | | 205 | 677 | 1.81 |
| | | HT6 | 454 | 1578 | 2.92 |
| | | | 541 | 1517 | 2.38 |
| | | | 560 | 1468 | 2.4 |
| | | HT4 | 604 | 1503 | 2.41 |
| | | | 573 | 1564 | 3.08 |
| | | | 649 | 1487 | 2.47 |
| Alloy 265 | HIP 5 | HT2 | 416 | 886 | 6.76 |
| | | | 430 | 913 | 7.3 |
| | | | 420 | 917 | 7.57 |
| | | HT6 | 389 | 731 | 4.35 |
| | | | 393 | 705 | 4.22 |
| | | | 375 | 672 | 4 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT4 | 400 | 819 | 4.83 |
| | | | 421 | 783 | 4.45 |
| | | | 421 | 852 | 5 |
| | HIP 6 | HT2 | 413 | 882 | 6.67 |
| | | | 399 | 915 | 7.46 |
| | | | 401 | 927 | 7.79 |
| | | HT6 | 381 | 737 | 4.62 |
| | | | 369 | 726 | 4.81 |
| | | | 375 | 857 | 5.52 |
| | | HT4 | 359 | 818 | 4.81 |
| | | | 364 | 789 | 4.68 |
| | | | 356 | 812 | 5.02 |
| Alloy 266 | HIP 5 | HT2 | 449 | 951 | 9.43 |
| | | | 463 | 960 | 8.97 |
| | | | 471 | 947 | 8.71 |
| | | HT6 | 434 | 904 | 8.51 |
| | | | 439 | 908 | 8.76 |
| | | | 438 | 896 | 8.23 |
| | | HT4 | 498 | 912 | 7.17 |
| | | | 489 | 882 | 6.35 |
| | | | 464 | 930 | 8.06 |
| | HIP 6 | HT2 | 456 | 977 | 9.52 |
| | | | 470 | 962 | 7.44 |
| | | | 448 | 882 | 5.13 |
| | | HT6 | 424 | 868 | 7.52 |
| | | | 430 | 845 | 7.18 |
| | | HT4 | 398 | 879 | 8.26 |
| | | | 399 | 854 | 7.25 |
| | | | 382 | 857 | 7.65 |
| Alloy 267 | HIP 5 | HT2 | 425 | 853 | 7.06 |
| | | | 436 | 882 | 7.71 |
| | | | 478 | 943 | 10.05 |
| | | HT6 | 414 | 839 | 7.44 |
| | | | 392 | 804 | 6.14 |
| | | | 403 | 759 | 5.4 |
| | | | 402 | 878 | 7.71 |
| | | | 459 | 870 | 7.32 |
| | | HT4 | 455 | 868 | 7.49 |
| | | | 444 | 898 | 8.21 |
| | | | 467 | 789 | 5.27 |
| | | | 466 | 933 | 8.51 |
| | | | 479 | 904 | 8.05 |
| | | | 348 | 853 | 7.28 |
| | HIP 6 | HT2 | 455 | 872 | 7.47 |
| | | | 418 | 832 | 7.53 |
| | | | 432 | 864 | 7.75 |
| | | HT6 | 401 | 828 | 7.81 |
| | | | 445 | 875 | 8.52 |
| | | | 393 | 761 | 5.68 |
| | | HT4 | 402 | 828 | 7.41 |
| | | | 412 | 859 | 8.25 |
| | | | 434 | 874 | 8.49 |
| Alloy 268 | HIP 5 | HT5 | 456 | 975 | 11.09 |
| | | | 475 | 954 | 10.4 |
| | | | 473 | 891 | 8.44 |
| | | HT8 | 558 | 1186 | 16.8 |
| | | | 417 | 1064 | 15.73 |
| | | | 410 | 998 | 15.24 |
| | | HT9 | 337 | 937 | 13.03 |
| | | | 364 | 974 | 13.92 |
| | | | 363 | 959 | 13.06 |
| | HIP 9 | HT5 | 370 | 932 | 12 |
| | | | 372 | 886 | 10.8 |
| | | HT8 | 389 | 1088 | 19.09 |
| | | HT9 | 369 | 918 | 13.07 |
| | | | 370 | 868 | 11.02 |
| Alloy 269 | HIP 5 | HT5 | 365 | 961 | 10.65 |
| | | | 394 | 1024 | 10.98 |
| | | | 343 | 967 | 10.58 |
| | | HT8 | 403 | 1200 | 17.27 |
| | | | 421 | 1081 | 14.24 |
| | | | 417 | 1081 | 14.48 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT9 | 381 | 1065 | 11.22 |
| | | | 418 | 1050 | 11.17 |
| | HIP 8 | HT5 | 372 | 897 | 9.82 |
| | | | 380 | 904 | 9.84 |
| | | | 371 | 883 | 9.51 |
| | | HT8 | 395 | 1275 | 20.98 |
| Alloy 270 | HIP 5 | HT5 | 454 | 1053 | 8.81 |
| | | | 464 | 1061 | 8.77 |
| | | | 439 | 946 | 7.71 |
| | | HT8 | 441 | 1143 | 11.45 |
| | | | 457 | 1234 | 13.82 |
| | | HT9 | 319 | 1199 | 13.33 |
| | | | 405 | 1277 | 13.58 |
| | | | 397 | 1139 | 10.96 |
| | HIP 9 | HT5 | 371 | 1282 | 14.36 |
| | | | 375 | 1003 | 9.9 |
| | | | 370 | 1157 | 11.95 |
| | | HT8 | 390 | 1327 | 16.66 |
| | | | 395 | 1294 | 16.21 |
| | | HT9 | 354 | 1289 | 13.51 |
| | | | 366 | 1072 | 9.37 |
| | | | 364 | 1245 | 12.63 |
| Alloy 271 | HIP 5 | HT5 | 459 | 906 | 9.48 |
| | | | 462 | 931 | 9.88 |
| | | | 456 | 1022 | 11.67 |
| | | HT8 | 426 | 995 | 12.65 |
| | | | 473 | 1093 | 14.94 |
| | | HT9 | 404 | 1157 | 15.32 |
| | | | 392 | 1158 | 16.16 |
| | | | 341 | 1059 | 14.08 |
| | HIP 9 | HT5 | 369 | 982 | 12.8 |
| | | HT8 | 390 | 1199 | 20.06 |
| | | | 388 | 1090 | 16.8 |
| | | | 367 | 1197 | 19.54 |
| | | HT9 | 395 | 1037 | 14.04 |
| | | | 397 | 1187 | 18.5 |
| Alloy 272 | HIP 5 | HT5 | 455 | 902 | 8.73 |
| | | | 451 | 1033 | 11.07 |
| | | | 464 | 1053 | 11.48 |
| | | HT8 | 469 | 1167 | 14.28 |
| | | | 466 | 1212 | 14.68 |
| | | | 412 | 1016 | 10.93 |
| | | HT9 | 382 | 1207 | 15.84 |
| | | | 378 | 1182 | 14.06 |
| | | | 392 | 1053 | 12.59 |
| | HIP 9 | HT5 | 419 | 1165 | 14.45 |
| | | | 387 | 996 | 11.5 |
| | | | 375 | 990 | 11.58 |
| | | HT8 | 406 | 1212 | 16.29 |
| | | | 391 | 1348 | 24.65 |
| | | | 384 | 1202 | 17.11 |
| | | HT9 | 385 | 1098 | 13.84 |
| | | | 367 | 1104 | 13.25 |
| | | | 384 | 1024 | 12.21 |
| Alloy 273 | HIP 5 | HT5 | 451 | 1078 | 10.31 |
| | | | 466 | 1130 | 10.92 |
| | | HT8 | 425 | 967 | 9.88 |
| | | | 451 | 977 | 9.82 |
| | | | 452 | 1383 | 18.26 |
| | | HT9 | 400 | 1378 | 18.71 |
| | | | 388 | 1178 | 10.86 |
| | | | 367 | 1309 | 14.01 |
| | HIP 9 | HT5 | 373 | 1040 | 10.66 |
| | | | 378 | 1207 | 13.82 |
| | | | 367 | 1101 | 11.86 |
| | | HT8 | 379 | 1206 | 14.7 |
| | | | 384 | 1262 | 17.27 |
| | | HT9 | 357 | 1187 | 11.87 |
| | | | 373 | 1295 | 17.24 |
| | | | 352 | 1262 | 17.6 |
| Alloy 274 | HIP 5 | HT5 | 470 | 1023 | 14.55 |
| | | | 475 | 995 | 14.17 |
| | | HT8 | 472 | 1106 | 20.16 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| | | HT9 | 370 | 1030 | 17.23 |
| | | | 424 | 1064 | 18.22 |
| | | | 389 | 970 | 14.96 |
| | HIP 9 | HT5 | 378 | 1018 | 16.58 |
| | | | 388 | 914 | 12.87 |
| | | HT8 | 375 | 947 | 16.42 |
| | | | 357 | 873 | 13.82 |
| | | | 375 | 1080 | 21.58 |
| | | HT9 | 361 | 913 | 13.67 |
| | | | 376 | 920 | 13.44 |
| Alloy 275 | HIP 5 | HT5 | 477 | 860 | 7.94 |
| | | | 485 | 1028 | 13.02 |
| | | | 444 | 881 | 8.98 |
| | | HT8 | 482 | 1101 | 17.75 |
| | | | 472 | 1127 | 19.77 |
| | | HT9 | 408 | 1014 | 14.67 |
| | | | 500 | 1171 | 14.64 |
| | HIP 8 | HT5 | 401 | 963 | 12.41 |
| | | | 398 | 919 | 11.63 |
| | | | 382 | 920 | 11.52 |
| | | HT8 | 403 | 1101 | 20.01 |
| | | | 411 | 980 | 15.34 |
| | | | 414 | 991 | 15.07 |
| | | HT9 | 428 | 956 | 12.21 |
| | | | 456 | 1033 | 15.61 |
| | | | 402 | 1014 | 15.13 |
| Alloy 276 | HIP 5 | HT8 | 478 | 1134 | 20.15 |
| | | | 463 | 1091 | 19.11 |
| | | | 470 | 978 | 14.44 |
| | | HT9 | 388 | 1065 | 17.75 |
| | | | 447 | 1054 | 16.28 |
| | | | 400 | 975 | 14.21 |
| | HIP 8 | HT5 | 405 | 968 | 13.38 |
| | | | 395 | 882 | 10.62 |
| | | | 404 | 975 | 13.87 |
| | | HT8 | 399 | 1047 | 18.56 |
| | | | 416 | 1007 | 17.04 |
| | | HT9 | 377 | 966 | 14.01 |
| | | | 381 | 978 | 14.6 |
| | | | 382 | 1020 | 16.14 |
| Alloy 277 | HIP 5 | HT5 | 439 | 932 | 10.41 |
| | | | 455 | 1015 | 12.04 |
| | | | 424 | 935 | 9.86 |
| | | HT8 | 429 | 971 | 11.64 |
| | | | 393 | 1057 | 15.02 |
| | | | 392 | 1245 | 20.8 |
| | | HT9 | 387 | 758 | 5.16 |
| | | | 441 | 744 | 4.15 |
| | | | 384 | 727 | 4.31 |
| | HIP 8 | HT5 | 371 | 984 | 12.56 |
| | | | 381 | 989 | 12.61 |
| | | | 380 | 1058 | 14.44 |
| | | HT8 | 378 | 1194 | 20.15 |
| | | | 379 | 1265 | 23.49 |
| | | | 377 | 1244 | 22.16 |
| | | HT9 | 404 | 719 | 4.25 |
| | | | 397 | 721 | 4.35 |
| | | | 377 | 714 | 4.33 |
| Alloy 278 | HIP 5 | HT5 | 403 | 892 | 7.52 |
| | | | 427 | 1062 | 28.03 |
| | | | 381 | 981 | 10.05 |
| | | HT8 | 386 | 1175 | 16.88 |
| | | | 373 | 1346 | 21.89 |
| | | HT9 | 430 | 784 | 5.85 |
| | | | 364 | 719 | 5.02 |
| | HIP 8 | HT5 | 397 | 967 | 11.38 |
| | | | 377 | 947 | 10.64 |
| | | HT8 | 397 | 1337 | 23.15 |
| | | | 378 | 1283 | 20.06 |
| | | HT9 | 394 | 709 | 3.54 |
| | | | 391 | 725 | 4.35 |

TABLE 9-continued

Tensile Properties of Alloys Subjected HIP Cycle

| Alloy | HIP Cycle | Heat Treatment | Yield Strength (MPa) | Ultimate Tensile Strength (MPa) | Tensile Elongation (%) |
|---|---|---|---|---|---|
| Alloy 279 | HIP 5 | HT5 | 385 | 907 | 7.63 |
| | | | 379 | 899 | 7.72 |
| | | | 349 | 1002 | 9.57 |
| | | HT8 | 433 | 1211 | 15.69 |
| | | HT9 | 440 | 742 | 4.12 |
| | | | 445 | 729 | 3.63 |
| | | | 438 | 694 | 3.43 |
| | HIP 8 | HT5 | 371 | 848 | 7.56 |
| | | | 357 | 1038 | 10.56 |
| | | HT8 | 389 | 1273 | 19.51 |
| | | | 382 | 1176 | 16.19 |
| | | | 376 | 1184 | 16.74 |
| | | HT9 | 446 | 682 | 2.56 |
| | | | 442 | 721 | 3.88 |
| | | | 428 | 669 | 2.55 |
| Alloy 280 | HIP 5 | HT5 | 448 | 1057 | 9.22 |
| | | | 440 | 1048 | 8.8 |
| | | | 422 | 922 | 6.37 |
| | | HT8 | 465 | 1052 | 11.54 |
| | | | 479 | 1103 | 13.03 |
| | | HT9 | 406 | 1090 | 13.69 |
| | HIP 9 | HT5 | 387 | 1053 | 11.7 |
| | | | 414 | 1118 | 14.3 |
| | | | 386 | 1088 | 13.27 |
| | | HT8 | 400 | 1134 | 16.57 |
| | | | 413 | 1211 | 19.47 |
| | | | 399 | 1095 | 14.54 |
| | | HT9 | 420 | 1111 | 14.31 |
| | | | 399 | 1119 | 15.03 |
| Alloy 281 | HIP 5 | HT5 | 418 | 955 | 6.12 |
| | | | 398 | 1051 | 7.35 |
| | | | 403 | 1058 | 7.82 |
| | | HT8 | 453 | 1104 | 11.56 |
| | | | 462 | 1082 | 11.23 |
| | | HT9 | 354 | 1212 | 13.76 |
| | | | 320 | 1119 | 10.59 |
| | HIP 9 | HT5 | 378 | 1080 | 9.72 |
| | | | 374 | 1138 | 10.9 |
| | | | 379 | 1073 | 9.13 |
| | | HT8 | 394 | 1165 | 13.98 |
| | | | 364 | 1241 | 15.55 |
| | | | 380 | 1196 | 15.03 |
| | | HT9 | 368 | 946 | 7.99 |
| | | | 377 | 1194 | 12.74 |
| | | | 388 | 994 | 9.64 |
| Alloy 282 | HIP 9 | HT5 | 391 | 953 | 6.23 |
| | | | 401 | 925 | 6.11 |
| | | HT8 | 432 | 1003 | 10.55 |
| | | | 389 | 992 | 10.45 |
| | | | 410 | 946 | 9.28 |
| | | HT9 | 424 | 948 | 8.12 |
| Alloy 283 | HIP 8 | HT5 | 380 | 1104 | 9.02 |
| | | | 385 | 1107 | 8.89 |
| | | HT8 | 389 | 974 | 8.9 |
| | | | 379 | 1119 | 10.61 |
| | | | 427 | 1212 | 14.79 |
| | | HT9 | 383 | 1160 | 12.68 |
| | | | 379 | 1206 | 13.38 |
| | | | 387 | 1184 | 13.28 |

Cast plates from selected alloys listed in Table 4 were thermo-mechanically processed via hot rolling. The plates were heated in a tunnel furnace to a target temperature equal to the nearest 25° C. temperature interval that was at least 50° C. below the solidus temperature previously determined (see Table 5). The rolls for the mill were held at a constant spacing for all samples rolled, such that the rolls were touching with minimal force. The resulting reductions varied between 21.0% and 41.9%. The primary importance of the hot rolling stage is to initiate Nanophase Refinement and to remove macrodefects such as pores and voids by mimicking the hot rolling at Stage 2 of Twin Roll Casting process or at Stage 1 or Stage 2 of Thin Slab Casting process. This process eliminates a fraction of internal macrodefects, in addition to smoothing out the sample surface. After hot rolling, the plates were heat treated at parameters specified in Table 8. The tensile specimens were cut from the plates after hot rolling and heat treatment using wire electrical discharge machining (EDM). Tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture. Samples were tested in the as-rolled state and after heat treatments defined in Table 8.

Tensile properties of selected alloys herein with Nanomodal Structure (Structure #2, FIG. 3A) that forms after hot rolling are listed in Table 10 (As Rolled). It can be seen, that in this state, the yield stress varies from 308 to 1020 MPa. After yielding, the Structure #2 transforms into High Strength Nanomodal Structure (Structure #3, FIG. 3A) and demonstrates tensile strength from 740 to 1435 MPa with ductility in a range from 2.2 to 41.3%.

Heat treatment after hot rolling leads to further development of Nanomodal Structure (Structure #2) that transforms into High Strength Nanomodal Structure (Structure #3) during deformation. Tensile properties of the selected alloys after hot rolling and heat treatment at different parameters are listed in Table 10. The ultimate tensile strength values may vary from 730 to 1435 MPa with tensile elongation from about 2 to 59.2%. The yield strength is in a range from 274 to 1020 MPa. The mechanical characteristic values in the steel alloys herein will depend on alloy chemistry and processing/treatment condition.

TABLE 10

Tensile Properties of Alloys Subjected Hot Rolling

| Alloy | Heat Treatment | Yield Strength (MPa) | Ultimate Tensile Strength (MPa) | Tensile Elongation (%) |
|---|---|---|---|---|
| Alloy 260 | As Rolled | 599 | 1088 | 13.11 |
| | | 620 | 1098 | 13.47 |
| | | 637 | 1082 | 10.23 |
| | | 549 | 1073 | 15.96 |
| | | 581 | 1132 | 17.97 |
| | | 572 | 1136 | 18.17 |
| | | 569 | 1088 | 13.15 |
| | | 612 | 1071 | 11.10 |
| | | 534 | 1093 | 14.12 |
| | HT5 | 548 | 935 | 11.15 |
| | | 515 | 977 | 12.67 |
| | | 556 | 921 | 11.15 |
| | | 526 | 994 | 14.87 |
| | | 532 | 1052 | 16.76 |
| | | 536 | 966 | 13.71 |
| | | 492 | 1096 | 16.89 |
| | | 510 | 1123 | 17.92 |
| | | 587 | 1129 | 18.00 |
| | HT8 | 492 | 1061 | 20.76 |
| | | 511 | 888 | 11.64 |
| | | 535 | 1066 | 20.59 |
| | | 450 | 1166 | 26.41 |
| | | 474 | 1162 | 25.95 |
| | | 501 | 1147 | 21.15 |
| | | 504 | 1155 | 21.85 |
| | | 515 | 1084 | 18.79 |
| | HT9 | 444 | 1059 | 20.57 |
| | | 423 | 1089 | 21.85 |
| | | 433 | 1003 | 17.96 |
| | | 480 | 1176 | 31.46 |

TABLE 10-continued

Tensile Properties of Alloys Subjected Hot Rolling

| Alloy | Heat Treatment | Yield Strength (MPa) | Ultimate Tensile Strength (MPa) | Tensile Elongation (%) |
|---|---|---|---|---|
| | | 457 | 1160 | 31.60 |
| | | 472 | 1177 | 32.50 |
| | | 419 | 1169 | 27.67 |
| | | 457 | 1174 | 25.06 |
| | | 482 | 1132 | 21.13 |
| Alloy 280 | As Rolled | 728 | 1135 | 9.06 |
| | HT9 | 398 | 1081 | 19.59 |
| | | 439 | 1073 | 19.26 |
| | | 456 | 1103 | 18.39 |
| | | 440 | 1127 | 18.71 |
| Alloy 281 | As Rolled | 750 | 1063 | 10.40 |
| | | 800 | 1082 | 10.77 |
| | HT9 | 416 | 1159 | 16.92 |
| | | 456 | 1146 | 15.30 |
| | | 529 | 1150 | 15.46 |
| Alloy 282 | HT9 | 424 | 1040 | 15.99 |
| | | 414 | 923 | 10.91 |
| | | 421 | 1014 | 15.10 |
| | | 409 | 974 | 13.46 |
| | | 398 | 946 | 13.57 |
| | | 428 | 1017 | 13.89 |
| Alloy 283 | As Rolled | 902 | 1216 | 7.48 |
| | | 905 | 1203 | 8.18 |
| | | 656 | 1048 | 9.69 |
| | | 677 | 1122 | 12.32 |
| | | 672 | 1113 | 11.77 |
| | HT9 | 429 | 1138 | 16.63 |
| | | 419 | 1001 | 14.97 |
| | | 397 | 1032 | 17.58 |
| | | 392 | 844 | 10.70 |
| | | 397 | 969 | 13.45 |
| | | 391 | 1167 | 26.72 |
| | | 396 | 1064 | 14.89 |
| | | 419 | 1090 | 16.25 |
| | | 384 | 1221 | 26.25 |
| | | 389 | 1195 | 18.60 |
| | | 411 | 1236 | 24.06 |
| Alloy 284 | As Rolled | 550 | 1121 | 15.51 |
| | | 524 | 1159 | 16.05 |
| | | 579 | 1088 | 14.49 |
| | | 763 | 1093 | 14.02 |
| | | 763 | 1163 | 15.82 |
| | | 731 | 1046 | 13.59 |
| | HT5 | 483 | 1119 | 14.64 |
| | | 496 | 1129 | 15.20 |
| | | 507 | 1082 | 13.63 |
| | HT8 | 482 | 1230 | 21.00 |
| | | 483 | 1248 | 25.24 |
| | | 475 | 1241 | 21.93 |
| | | 503 | 1273 | 18.79 |
| | | 504 | 1217 | 16.89 |
| | | 533 | 1299 | 19.35 |
| | | 493 | 1164 | 15.84 |
| | | 504 | 1276 | 18.45 |
| | | 494 | 1174 | 15.97 |
| | HT9 | 383 | 1149 | 27.60 |
| | | 395 | 1122 | 25.70 |
| | | 395 | 1160 | 28.83 |
| | | 414 | 1133 | 16.47 |
| | | 409 | 1074 | 18.55 |
| Alloy 285 | As Rolled | 833 | 1228 | 13.31 |
| | | 829 | 1245 | 14.72 |
| | | 798 | 1225 | 14.78 |
| | | 814 | 1321 | 13.68 |
| | | 822 | 1339 | 13.99 |
| | HT5 | 447 | 1082 | 13.73 |
| | | 433 | 1062 | 11.34 |
| | | 450 | 1280 | 18.92 |
| | | 429 | 1097 | 10.26 |
| | | 456 | 1328 | 19.91 |
| | | 457 | 1249 | 10.12 |
| | | 480 | 1310 | 16.64 |
| | | 498 | 1297 | 16.20 |

TABLE 10-continued

Tensile Properties of Alloys Subjected Hot Rolling

| Alloy | Heat Treatment | Yield Strength (MPa) | Ultimate Tensile Strength (MPa) | Tensile Elongation (%) |
|---|---|---|---|---|
| | HT8 | 474 | 1319 | 23.26 |
| | HT9 | 408 | 1207 | 20.39 |
| | | 399 | 1208 | 22.21 |
| | | 404 | 1207 | 20.59 |
| | | 402 | 1201 | 18.04 |
| | | 417 | 1237 | 20.36 |
| | | 396 | 1189 | 21.20 |
| Alloy 286 | As Rolled | 743 | 1350 | 14.02 |
| | | 727 | 1344 | 14.54 |
| | | 746 | 1357 | 15.56 |
| | | 776 | 1289 | 12.01 |
| | HT5 | 491 | 1349 | 16.29 |
| | | 505 | 1334 | 15.16 |
| | | 513 | 1311 | 14.87 |
| | | 501 | 1331 | 17.08 |
| | HT8 | 418 | 1267 | 15.86 |
| | | 434 | 1250 | 18.33 |
| | | 428 | 1237 | 14.55 |
| | | 420 | 1252 | 20.02 |
| | | 447 | 1269 | 20.28 |
| | HT9 | 396 | 1212 | 21.90 |
| | | 382 | 1196 | 24.16 |
| | | 387 | 1230 | 21.44 |
| | | 401 | 1248 | 23.94 |
| Alloy 287 | As Rolled | 855 | 1302 | 17.63 |
| | | 845 | 1251 | 17.37 |
| | | 876 | 1347 | 18.58 |
| | | 867 | 1274 | 14.88 |
| | HT5 | 487 | 1169 | 15.03 |
| | | 495 | 1198 | 15.72 |
| | | 489 | 1101 | 13.40 |
| | | 522 | 1283 | 23.88 |
| | HT8 | 499 | 1306 | 24.48 |
| | | 463 | 1093 | 16.81 |
| | | 484 | 1282 | 24.49 |
| | HT9 | 414 | 1174 | 23.88 |
| | | 417 | 1210 | 27.24 |
| | | 410 | 1185 | 22.70 |
| | | 410 | 1194 | 25.03 |
| | | 441 | 1174 | 21.29 |
| Alloy 288 | As Rolled | 789 | 1285 | 14.49 |
| | | 795 | 1327 | 16.31 |
| | | 811 | 1251 | 13.60 |
| | | 846 | 1268 | 15.63 |
| | | 819 | 1309 | 15.21 |
| | | 849 | 1243 | 14.96 |
| | HT5 | 498 | 1324 | 24.14 |
| | | 497 | 924 | 10.01 |
| | | 491 | 1267 | 17.38 |
| | | 501 | 1302 | 25.04 |
| | | 504 | 1226 | 15.34 |
| | | 499 | 1321 | 23.89 |
| | | 390 | 1149 | 26.61 |
| | HT8 | 377 | 1257 | 22.38 |
| | | 491 | 1242 | 21.68 |
| | | 496 | 1226 | 22.46 |
| | | 469 | 1240 | 22.32 |
| | | 480 | 1226 | 22.23 |
| | HT9 | 411 | 1194 | 23.52 |
| | | 404 | 1165 | 23.65 |
| | | 394 | 1164 | 25.58 |
| | | 391 | 1129 | 18.68 |
| Alloy 290 | As Rolled | 837 | 1314 | 14.93 |
| | | 806 | 1306 | 14.40 |
| | | 863 | 1174 | 5.08 |
| | | 966 | 1327 | 15.47 |
| | | 798 | 1331 | 16.40 |
| | HT5 | 524 | 937 | 8.03 |
| | | 456 | 999 | 9.22 |
| | | 508 | 1035 | 9.98 |
| | | 468 | 983 | 9.67 |
| | | 517 | 934 | 8.54 |

TABLE 10-continued

Tensile Properties of Alloys Subjected Hot Rolling

| Alloy | Heat Treatment | Yield Strength (MPa) | Ultimate Tensile Strength (MPa) | Tensile Elongation (%) |
|---|---|---|---|---|
| | HT8 | 486 | 1065 | 16.56 |
| | | 482 | 1049 | 16.50 |
| | | 453 | 1092 | 17.63 |
| | | 501 | 1028 | 14.56 |
| | | 480 | 1164 | 18.07 |
| | | 472 | 1205 | 20.74 |
| | HT9 | 424 | 908 | 13.02 |
| | | 454 | 929 | 14.01 |
| | | 407 | 965 | 14.43 |
| | | 427 | 1032 | 16.61 |
| | | 411 | 882 | 14.45 |
| Alloy 291 | As Rolled | 374 | 1104 | 8.25 |
| | | 320 | 1099 | 7.31 |
| | HT10 | 378 | 1404 | 19.03 |
| | | 371 | 1314 | 13.69 |
| | HT5 | 417 | 1037 | 8.34 |
| | | 440 | 987 | 6.62 |
| | HT8 | 482 | 1139 | 7.99 |
| | | 439 | 1248 | 8.81 |
| Alloy 292 | As Rolled | 513 | 1148 | 22.23 |
| | | 506 | 1148 | 22.97 |
| | | 502 | 1186 | 24.32 |
| | HT5 | 419 | 1173 | 30.55 |
| | | 429 | 1176 | 32.16 |
| | | 429 | 1177 | 30.52 |
| | HT8 | 425 | 1196 | 37.96 |
| | | 441 | 1174 | 36.16 |
| | HT9 | 381 | 1079 | 36.01 |
| | | 380 | 1082 | 26.75 |
| | | 387 | 1078 | 27.56 |
| Alloy 293 | As Rolled | 446 | 1211 | 12.92 |
| | | 427 | 1179 | 12.39 |
| | | 391 | 1022 | 8.53 |
| | | 330 | 1243 | 12.08 |
| | | 386 | 1250 | 13.37 |
| | | 390 | 1310 | 15.76 |
| | HT10 | 457 | 1065 | 12.86 |
| | | 448 | 1189 | 16.14 |
| | | 438 | 1226 | 17.54 |
| | | 417 | 1243 | 18.35 |
| | | 428 | 1319 | 27.92 |
| | HT5 | 483 | 1132 | 13.49 |
| | | 470 | 1075 | 12.05 |
| | | 483 | 1095 | 13.13 |
| | | 458 | 1290 | 18.88 |
| | | 452 | 1062 | 12.63 |
| | HT8 | 433 | 1139 | 15.24 |
| | | 403 | 1170 | 15.47 |
| | | 399 | 1089 | 13.88 |
| Alloy 294 | As Rolled | 379 | 1318 | 9.65 |
| | | 381 | 1385 | 10.78 |
| | | 372 | 1375 | 10.25 |
| | HT10 | 338 | 1283 | 20.04 |
| | | 342 | 1315 | 18.72 |
| | | 316 | 1236 | 19.47 |
| | HT5 | 343 | 1258 | 13.03 |
| | | 337 | 1181 | 11.09 |
| | HT8 | 326 | 1307 | 20.63 |
| | | 308 | 1267 | 20.71 |
| | | 349 | 1366 | 19.16 |
| Alloy 295 | As Rolled | 593 | 973 | 39.02 |
| | HT10 | 276 | 775 | 49.61 |
| | | 287 | 785 | 54.25 |
| | HT5 | 285 | 800 | 54.98 |
| | | 292 | 807 | 43.09 |
| | HT8 | 274 | 782 | 44.39 |
| | | 291 | 796 | 55.93 |
| | | 283 | 793 | 59.13 |
| Alloy 296 | As Rolled | 778 | 963 | 2.24 |
| | | 771 | 977 | 2.25 |
| | HT5 | 445 | 731 | 2.41 |
| | | 484 | 796 | 5.18 |

TABLE 10-continued

Tensile Properties of Alloys Subjected Hot Rolling

| Alloy | Heat Treatment | Yield Strength (MPa) | Ultimate Tensile Strength (MPa) | Tensile Elongation (%) |
|---|---|---|---|---|
| | | 485 | 784 | 4.01 |
| | | 475 | 829 | 6.93 |
| | HT8 | 428 | 837 | 12.61 |
| | | 433 | 811 | 10.03 |
| | HT11 | 417 | 835 | 15.33 |
| | | 421 | 757 | 8.20 |
| | | 411 | 843 | 18.30 |
| Alloy 297 | As Rolled | 699 | 1087 | 6.77 |
| | | 692 | 1063 | 7.14 |
| | | 757 | 1068 | 6.07 |
| | HT5 | 534 | 1019 | 7.64 |
| | | 543 | 1041 | 8.99 |
| | | 495 | 952 | 7.70 |
| | HT8 | 419 | 873 | 9.61 |
| | | 426 | 921 | 11.15 |
| | | 447 | 875 | 8.72 |
| | HT9 | 385 | 886 | 13.47 |
| | | 362 | 977 | 21.74 |
| Alloy 298 | As Rolled | 955 | 1382 | 8.00 |
| | | 1020 | 1435 | 5.79 |
| | HT5 | 847 | 1180 | 9.07 |
| | | 842 | 1178 | 11.66 |
| | HT8 | 766 | 1097 | 9.21 |
| | | 796 | 1123 | 6.74 |
| | | 702 | 1147 | 10.33 |
| | HT10 | 822 | 1094 | 8.80 |
| | | 831 | 1135 | 10.99 |
| | | 865 | 1111 | 10.40 |
| Alloy 299 | As Rolled | 388 | 804 | 8.72 |
| | | 386 | 743 | 7.31 |
| | HT5 | 324 | 950 | 4.50 |
| | | 352 | 1357 | 8.25 |
| | HT8 | 366 | 1155 | 5.40 |
| | HT10 | 380 | 900 | 8.71 |
| | | 354 | 837 | 7.56 |
| | | 362 | 900 | 7.75 |
| Alloy 300 | As Rolled | 598 | 1018 | 41.27 |
| | | 565 | 1015 | 41.08 |
| | HT5 | 354 | 1052 | 45.89 |
| | HT8 | 313 | 1048 | 46.05 |
| | | 320 | 1055 | 48.05 |
| | HT10 | 288 | 848 | 34.01 |
| Alloy 301 | As Rolled | 653 | 1158 | 18.18 |
| | | 702 | 1152 | 15.97 |
| | HT5 | 314 | 1063 | 3.83 |
| | | 339 | 1284 | 5.13 |
| | | 304 | 1392 | 9.57 |
| | HT8 | 428 | 1025 | 15.50 |
| | | 430 | 1043 | 16.73 |
| | | 432 | 874 | 11.38 |
| | HT9 | 372 | 987 | 17.10 |
| | | 385 | 1149 | 21.61 |
| | | 423 | 1024 | 20.19 |

Selected alloys from Table 4 were cast into plates with thickness of 50 mm using an Indutherm VTC800V vacuum tilt casting machine. Alloys of designated compositions were weighed out in 3 kilogram charges using designated quantities of commercially-available ferroadditive powders of known composition and impurity content, and additional alloying elements as needed, according to the atomic ratios provided in Table 4 for each alloy. Weighed out alloy charges were placed in zirconia coated silica-based crucibles and loaded into the casting machine. Melting took place under vacuum using a 14 kHz RF induction coil. Charges were heated until fully molten, with a period of time between 45 seconds and 60 seconds after the last point at which solid constituents were observed, in order to provide superheat and ensure melt homogeneity. Melts were then poured into a water-cooled copper die to form laboratory cast slabs of approximately 50 mm thick that is in the thickness range for Thin Slab Casting process (FIG. 31) and 75 mm×100 mm in size.

Cast plates with initial thickness of 50 mm were subjected to hot rolling at the temperatures between 1075 to 1100° C. depending on alloy solidus temperature. Rolling was done on a Fenn Model 061 single stage rolling mill, employing an in-line Lucifer EHS3GT-B18 tunnel furnace. Material was held at the hot rolling temperature for an initial dwell time of 40 minutes to ensure homogeneous temperature. After each pass on the rolling mill, the sample was returned to the tunnel furnace with a 4 minute temperature recovery hold to correct for temperature lost during the hot rolling pass. Hot rolling was conducted in two campaigns, with the first campaign achieving approximately 85% total reduction to a thickness of 6 mm. Following the first campaign of hot rolling, a section of sheet between 150 mm and 200 mm long was cut from the center of the hot rolled material. This cut section was then used for a second campaign of hot rolling for a total reduction between both campaigns of between 96% and 97%.

Tensile specimens were cut from hot rolled sheets via EDM. Tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture.

Tensile properties of the alloys in the as hot rolled condition are listed in Table 11. The ultimate tensile strength values may vary from 978 to 1281 MPa with tensile elongation from 14.0 to 29.2%. The yield stress is in a range from 396 to 746 MPa. The mechanical characteristic values in the steel alloys herein will depend on alloy chemistry and hot rolling conditions.

TABLE 11

Tensile Properties of Selected After Hot Rolling

| Alloy | Yield Stress (MPa) | Ultimate Tensile Strength (MPa) | Tensile Elongation (%) |
|---|---|---|---|
| Alloy 260 | 530 | 1172 | 25.7 |
| | 505 | 1161 | 26.2 |
| | 551 | 1192 | 27.4 |
| | 491 | 1017 | 17.1 |
| | 495 | 978 | 16.5 |
| | 505 | 1145 | 23.1 |
| Alloy 302 | 693 | 1099 | 14.8 |
| | 673 | 1071 | 14.0 |
| | 697 | 1111 | 16.2 |
| Alloy 303 | 401 | 1266 | 29.2 |
| | 396 | 1185 | 25.9 |
| | 403 | 1240 | 27.4 |
| Alloy 304 | 716 | 1254 | 17.4 |
| | 746 | 1281 | 18.4 |

Hot-rolled sheets from each alloy were then subjected to further cold rolling in multiple passes down to thickness of 1.2 mm. Rolling was done on a Fenn Model 061 single stage rolling mill. Tensile properties of the alloys after hot rolling and subsequent cold rolling are listed in Table 12. The ultimate tensile strength values in this specific example may vary from 1438 to 1787 MPa with tensile elongation from 1.0 to 20.8%. The yield stress is in a range from 809 to 1642 MPa. The mechanical characteristic values in the steel alloys herein will depend on alloy chemistry and processing conditions.

Cold rolling reduction influences the amount of austenite transformation leading to different level of strength in the alloys.

TABLE 12

Tensile Properties of Selected Alloys After Cold Rolling

| Alloy | Yield Stress (MPa) | Ultimate Tensile Strength (MPa) | Tensile Elongation (%) |
|---|---|---|---|
| Alloy 260 | 1485 | 1489 | 1.0 |
| | 1161 | 1550 | 7.2 |
| | 1222 | 1530 | 6.6 |
| | 1226 | 1532 | 6.9 |
| | 1642 | 1779 | 2.1 |
| | 1642 | 1787 | 2.1 |
| Alloy 302 | 1179 | 1492 | 3.5 |
| | 1133 | 1438 | 2.6 |
| | 1105 | 1469 | 4.3 |
| Alloy 303 | 823 | 1506 | 15.3 |
| | 895 | 1547 | 17.4 |
| | 809 | 1551 | 20.8 |

After cold rolling, alloys were heat treated at the parameters specified in Table 13. Heat treatments were conducted in a Lucifer 7GT-K12 sealed box furnace under an argon gas purge, or in a ThermCraft XSL-3-0-24-1C tube furnace. In the case of air cooling, the specimens were held at the target temperature for a target period of time, removed from the furnace and cooled down in air. In cases of controlled cooling, the furnace temperature was lowered at a specified rate with samples loaded.

TABLE 13

Heat Treatment Parameters

| Heat Treatment | Temperature (° C.) | Time (min) | Cooling |
|---|---|---|---|
| HT5 | 850 | 360 | 0.75° C./min to <500° C. then Air |
| HT8 | 950 | 360 | Air |
| HT12 | 1075 | 120 | Air |
| HT14 | 850 | 5 | Air |
| HT15 | 1125 | 120 | Air |

Tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture.

Tensile properties of the selected alloys after hot rolling with subsequent cold rolling and heat treatment at different parameters are listed in Table 14. The ultimate tensile strength values in this specific case example may vary from 813 MPa to 1316 MPa with tensile elongation from 6.6 to 35.9%. The yield stress is in a range from 274 to 815 MPa. The mechanical characteristic values in the steel alloys herein will depend on alloy chemistry and processing conditions.

TABLE 14

Tensile Properties of Selected Alloys After Cold Rolling and Heat Treatment

| Alloy | Heat Treatment | Yield Stress (MPa) | Ultimate Strength (MPa) | Tensile Elongation (%) |
|---|---|---|---|---|
| Alloy 260 | HT5 | 506 | 1146 | 25.4 |
| | | 481 | 1100 | 21.4 |
| | | 493 | 1072 | 19.3 |
| | | 519 | 1194 | 26.2 |
| | | 513 | 1185 | 27.6 |
| | | 513 | 1192 | 26.9 |
| | | 502 | 1168 | 24.7 |
| | | 498 | 1179 | 26.5 |
| | | 501 | 1176 | 27.3 |
| | HT14 | 586 | 1205 | 28.5 |
| | | 598 | 1221 | 28.4 |
| | | 600 | 1204 | 27.2 |
| Alloy 302 | HT5 | 502 | 1062 | 19.1 |
| | | 504 | 1078 | 20.4 |
| | | 488 | 1072 | 21.6 |
| | HT8 | 455 | 945 | 17.3 |
| | HT12 | 371 | 959 | 17.0 |
| | | 382 | 967 | 17.9 |
| | | 365 | 967 | 17.9 |
| | HT14 | 477 | 875 | 13.1 |
| | | 477 | 872 | 13.6 |
| | | 469 | 877 | 14.0 |
| Alloy 303 | HT5 | 274 | 1143 | 32.8 |
| | | 280 | 1181 | 29.1 |
| | | 280 | 1169 | 30.8 |
| | HT8 | 288 | 1272 | 29.9 |
| | | 281 | 1187 | 25.5 |
| | | 299 | 1240 | 31.2 |
| | HT10 | 274 | 1236 | 30.8 |
| | | 285 | 1255 | 30.5 |
| | | 289 | 1297 | 32.8 |
| | HT14 | 333 | 1316 | 35.0 |
| | | 341 | 1243 | 34.0 |
| | | 341 | 1260 | 35.9 |
| Alloy 304 | HT5 | 675 | 826 | 7.25 |
| | | 656 | 813 | 6.6 |
| | | 669 | 831 | 7.57 |
| | HT8 | 649 | 1012 | 13.78 |
| | | 588 | 1040 | 18.29 |
| | HT14 | 815 | 1144 | 15.25 |
| | | 808 | 1114 | 14.27 |
| | | 784 | 1107 | 13.63 |
| | HT15 | 566 | 1089 | 24.32 |
| | | 584 | 1054 | 21.47 |
| | | 578 | 1076 | 23.36 |

CASE EXAMPLES

Case Example #1

Industrial Sheet Production

Figure 6:
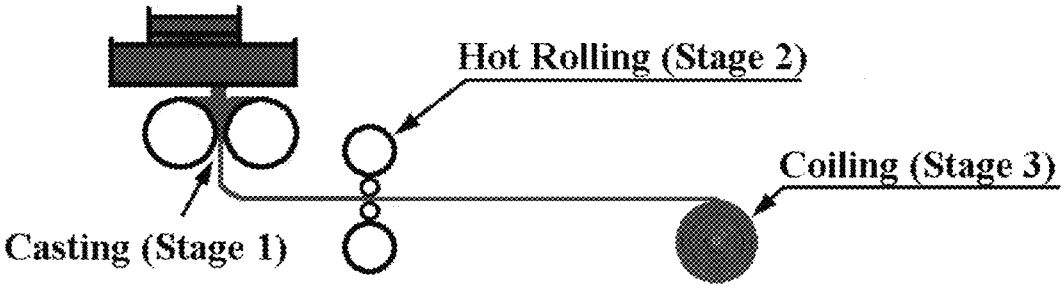
FIG. 6 illustrates Thin Strip Casting showing that the process can be broken up into 3 key process stages.
Figure 7:
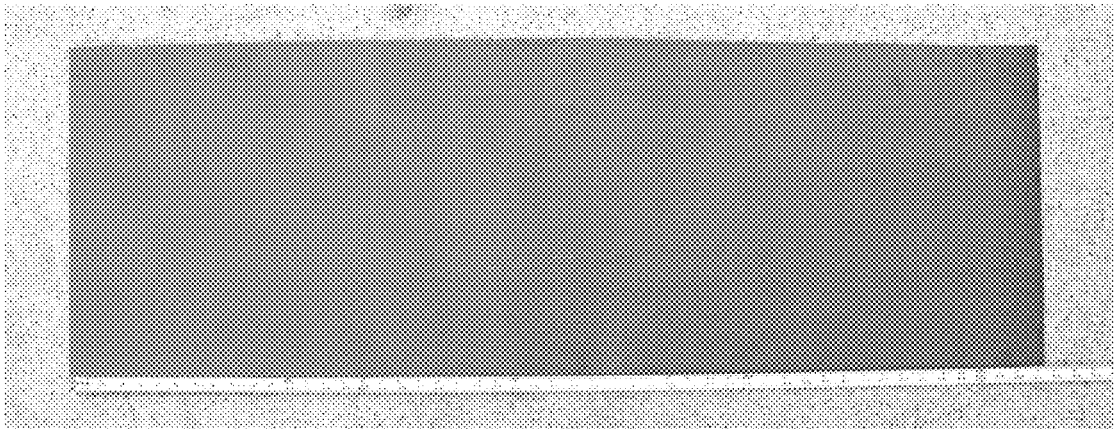
FIG. 7 illustrates an example of commercial sheet sample from Alloy 260 taken from a coil produced by the Thin Strip Casting process.

Industrial sheet from selected alloys was produced by Thin Strip Casting process. A schematic of the Thin Strip Casting process is shown in FIG. 6. As shown, the process includes three stages; Stage 1—Casting, Stage 2—Hot Rolling, and Stage 3—Strip Coiling. During Stage 1, the sheet was formed as the solidifying metal was brought together in the roll nip between the surfaces of the rollers. As solidified sheet thickness was in the range from 1.6 to 3.8 mm. During Stage 2, the solidified sheet was hot rolled at 1150° C. with 20 to 35% reduction. The thickness of the hot rolled sheet was varying from 2.0 to 3.5 mm. Produced sheet was collected on the coils. A sample of the produced sheet from Alloy 260 is shown in FIG. 7.

This Case Example demonstrates that the alloys provided for in Table 4 are applicable for industrial processing through continuous casting processes.

Case Example #2

Post-Processing of Industrial Sheet

In order to get targeted sheet thickness and optimized properties for different applications, produced sheet undergoes post-processing. To simulate post-processing conditions at industrial production, sheet strips with approximate size of 4 inches by 6 inches were cut from the industrial sheet produced by Thin Strip Casting process and then post-processed by various approaches. A summary of the various approaches used from several hundreds of experiments with variations noted is provided below.

To simulate the hot rolling process, the strips were subjected to rolling using a Fenn Model 061 Rolling Mill and a Lucifer 7-R24 Atmosphere Controlled Box Furnace. The plates were placed in a hot furnace typically from 850 to 1150° C. for 10 to 60 minutes prior to the start of rolling. The strips were then repeatedly rolled at between 10% and 25% reduction per pass and were placed in the furnace for 1 to 2 min between rolling steps to allow then to return to temperature. If the plates became too long to fit in the furnace they were cooled, cut to a shorter length, then reheated in the furnace for additional time before they were rolled again.

To simulate the cold rolling process, the strips were subjected to cold rolling using a Fenn Model 061 Rolling Mill with different reduction depending on the post-processing goal. To reduce sheet thickness, reduction of 10 to 15% per pass with typically 25 to 50% total was applied before intermediate annealing at various temperatures (800 to 1170° C.) and various times (2 minutes to 16 hours). To mimic the skin pass step for final production, sheet was cold rolled with reduction typically from 2 to 15%. Heat treatment studies were done by using a Lindberg Blue M Model "BF51731C-1" Box Furnace in air to simulate in-line annealing on a hot dip pickling line with temperatures typically from 800 to 1200° C. and times from typically 2 minutes to 15 minutes. To mimic coil batch annealing conditions, a Lucifer 7-R24 Atmosphere Controlled Box Furnace was utilized for heat treatments with temperatures typically from 800 to 1200° C. and times from typically 2 hours up to 1 week.

This case Example demonstrates that the alloys in Table 4 are applicable to the various post processing steps used industrially.

Case Example #3

Tensile Properties of Industrial Sheet from Selected Alloys

Industrial sheet from Alloy 260 and Alloy 284 was produced by Thin Strip Casting process. As-solidified thickness of the sheet was 3.2 and 3.6 mm, respectively (corresponds to Stage 1 of Thin Strip Casting process, FIG. 6). In-line hot rolling at temperatures from 1100 to 1170° C. was applied during sheet production (corresponds to Stage 2 of Thin Strip Casting process, FIG. 6) leading to final thickness of produced sheet of 2.2 mm (i.e. 31% reduction) for Alloy 260 and 2.6 mm (i.e. 28% reduction) for Alloy 284.

Samples from Alloy 260 industrial sheet were post-processed to mimic processing at commercial scale including (1) homogenization heat treatment at 1150° C. for 2 hr; (2) cold rolling with reduction of 15%; (3) annealing at 1150° C. for 5 min and skin pass with 5% reduction. The tensile specimens were cut from the sheets using a Brother HS-3100 wire electrical discharge machining (EDM). The tensile properties were measured on an Instron mechanical testing frame (Model 3369), utilizing Instron's Bluehill control and analysis software. All tests were run at room temperature in displacement control with the bottom fixture held rigid and the top fixture moving with the load cell attached to the top fixture.

Properties of the Alloy 260 sheet at each step of post-processing are shown in FIG. 8*a*. As it can be seen, the homogenization heat treatment improves sheet properties dramatically due to complete Nanomodal Structure (Structure #2, FIG. 3A) formation in the sheet volume through Nanophase Refinement (Mechanism #1, FIG. 3A). Note that in this commercial sheet, the structure was partially transformed by hot rolling into the Nanomodal Structure but an additional heat treatment was needed to cause complete transformation, especially in the center of the sheet. Cold rolling leads to material strengthening through Dynamic Nanophase Strengthening (Mechanism #2, FIG. 3A) and results in High Strength Nanomodal Structure formation (Structure #3, FIG. 3A). Following annealing for 5 min at 1150° C., the structure recrystallized into the Recrystallized Nanomodal Structure (Structure #4, FIG. 3B). In this case, a small level reduction (5%) was applied to the resulting sheet which while improving surface quality of the sheet causes partial transformation into the Refined High Strength Nanomodal Structure (Structure #5, FIG. 3B) through Nanophase Refinement and Strengthening (Mechanism #3, FIG. 3B). This process route thus provides advanced property combination in fully post-processed sheet.

Samples from Alloy 284 industrial sheet were also post-processed to mimic processing at commercial scale with different post-processing parameters. The post-processing includes (1) homogenization heat treatment at 1150° C. for 2 hr; (2) homogenization heat treatment at 1150° C. for 2 hr+cold rolling with 45% reduction+annealing at 1150° C. for 5 min; (3) homogenization heat treatment at 1150° C. for 8 hr+cold rolling with 15% reduction+annealing at 1150° C. for 5 min; (4) homogenization heat treatment at 1150° C. for 8 hr+cold rolling with 25% reduction+annealing at 1150° C. for 2 hr; (5) homogenization heat treatment at 1150° C. for 16 hr+cold rolling with 25% reduction+annealing at 1150° C. for 5 min. Structural development in the Alloy 284 sheet is similar to that in Alloy 260 sheet as described above for each step of post-processing and the intermediate step properties are not provided here. The resultant Alloy 284 sheet properties after these post-processing routes are shown in FIG. 8*b*. As it can be seen, all post-processing routes provide similar strength values between 1140 and 1220 MPa. Ductility varies from 19 to 28% depending on the post-processing parameters, sheet homogeneity, level of structural transformations, etc. However, independently from post-processing route, industrial sheet from Alloy 284 provides property combination with tensile strength above 1100 MPa and ductility higher than 19%.

This case Example demonstrates the enabling of advanced property combinations in sheet alloys herein in the fully post processed condition. Structure development in both alloys herein follows the pattern outlined in FIGS. 3A and 3B during post processing towards Recrystallized Modal Structure (Structure #4, FIG. 3B) formation which can undergo Nanophase Refinement & Strengthening (Mechanism #3, FIG. 3B) providing compelling combinations of mechanical properties.

Case Example #4

Modal Structure Formation

Modal Structure specified as Structure #1 (FIG. 3A) forms in the alloys listed in Table 4 at solidification as demonstrated herein. Two sheet samples from Alloy 260 are provided for this Case Example. The first sample was cast from Alloy 260 on the laboratory scale in a Pressure Vacuum Caster (PVC). Using commercial purity constituents, four 35 g alloy feedstocks of the targeted alloy were weighed out according to the atomic ratios provided in Table 4. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in the PVC chamber, melted using RF induction and then ejected onto a copper die designed for casting 3 inches by 4 inches sheets with thickness of 1.8 mm mimicking the Stage 1 of Thin Strip Casting (FIG. 6). The second sample was cut from Alloy 260 industrial sheet produced by Thin Strip Casting process in as-solidified condition without in-line hot rolling (no hot rolling during Thin Strip Casting) and with an as solidified thickness of 3.2 mm.

Structural analysis was performed by scanning electron microscopy (SEM) using an EVO-MA10 scanning electron microscope manufactured by Carl Zeiss SMT Inc. To make SEM specimens, the cross-section of the as-cast sheet was cut and ground by SiC paper and then polished progressively with diamond media suspension down to 1 μm grit. The final polishing was done with 0.02 μm grit $SiO_2$ solution. SEM images of microstructure in the outer layer region that is close to the surface and in the central layer region of the as-solidified sheet samples are shown in FIG. 9 and FIG. 10. As it can be seen, in the 1.8 mm thick laboratory cast sheet sample, dendrite size of the matrix phase is 2 to 5 μm in thickness and up to 20 μm in length in the outer layer region, while the dendrites are more round in the central layer region with the size from 4 to 20 μm (FIG. 9). Very fine structure can be observed in the interdendritic areas in both regions. The industrial sheet also shows a dendritic structure with matrix phase of 2 to 5 μm in thickness and up to 20 μm in length in the outer layer region and are more round dendrites in the central layer region with the size from 4 to 20 μm (FIG. 10). However, interdendritic borides are well defined in the industrial sheet which are coarser and have needle-type shape in the central layer region as compared to finer and more homogeneous distributed borides in outer layer region. Due to fast cooling rate at laboratory conditions, the microstructure of the 1.8 mm as-cast plate is finer at both the outer layer and the central layer, and the fine boride phase cannot be resolved at the grain boundaries by SEM. In both cases, the large dendrites of the matrix phase with fine boride phase in the interdendritic areas forms the typical Modal Structure in the as-cast state. Coarser microstructure was observed in the central layer region in both laboratory and industrial sheet reflecting slower cooling rate as compared to the outer layers during solidification in both cases.

As demonstrated in this Case Example, Modal Structure (Structure #1) forms in steel alloys herein at solidification during laboratory and industrial casting processes.

Case Example #5

Formation of Nanomodal Structure

When Modal Structure (Structure #1) is subjected to high temperature exposure, it transforms into Nanomodal Structure (Structure #2) through Nanophase Refinement (Mechanism #1). To illustrate this, samples were cut from the Alloy 260 industrial sheet produced by Thin Strip Casting process with in-line hot rolling (32% reduction) that were heat treated at 1150° C. for 2 hours, and then cooled to room temperature in air. Samples for various studies including tensile testing, SEM microscopy, TEM microscopy, and X-ray diffraction were cut after heat treatment using a wire-EDM.

SEM samples were cut out from the heat treated sheet from Alloy 260 and metallographicallyo polished in stages down to 0.02 μm Grit to ensure smooth samples for scanning electron microscopy (SEM) analysis. SEM was done using a Zeiss EVO-MA10 model with the maximum operating voltage of 30 kV. Example SEM backscattered electron micrographs of the microstructure in the Alloy 260 sheet samples after heat treatment are shown in FIG. 11. As shown, the microstructure of the Alloy 260 industrial sheet after heat treatment is distinctly different from Modal Structure (FIG. 10). After heat treatment at 1150° C. for 2 hr, fine boride phases are relatively uniform in size and homogeneously distributed in matrix in the outer layer region (FIG. 11*a*). In the central layer region, although the borides are effectively broken up by hot rolling, the distribution of the boride phase is less homogeneous as compared to that in the outer layer, as one can see that some areas are occupied by boride phase more than other areas (FIG. 11*b*). In addition, the borides become more uniform in size. Before the heat treatment, some boride phase shows a length up to 15 to 18 μm. After the heat treatment, the longest boride phase is ~10 μm and can only be occasionally found. Hot rolling during Thin Strip Casting and additional heat treatment of the industrial sheet led to formation of Nanomodal Structure. Note that the details of the matrix phases cannot be effectively resolved using the SEM due to the nanocrystalline scale of the refined phases which will be shown subsequently using TEM.

To examine the structural details of the Alloy 260 industrial sheet in more detail, high resolution transmission electron microscopy (TEM) was utilized. To prepare TEM specimens, samples were cut from the heat-treated industrial sheets. The samples were then ground and polished to a thickness of 70 to 80 μm. Discs of 3 mm in diameter were punched from these thin samples, and the final thinning was done by twin-jet electropolishing using a mixture of 30% $HNO_3$ in methanol base. The prepared specimens were examined in a JEOL JEM-2100 HR Analytical Transmission Electron Microscope (TEM) operated at 200 kV. TEM micrographs of the microstructure in the Alloy 260 industrial sheet samples after heat treatment at 1150° C. for 2 hr are shown in FIG. 12. After heat treatment, the boride phase with size of 200 nm to 5 μm is revealed in the intergranular regions that separate the matrix grains which is consistent with the SEM observation in FIG. 11. However, the boride phase re-organized into isolated precipitates of less than 500 nm in size and distributed in the region between matrix grains was additionally revealed by TEM. Matrix grains are very much refined due to Nanophase Refinement at high temperature. Unlike in the as-cast state with micron-sized matrix grains, the matrix grains are typically in the range of 200 to 500 nm in size, as shown in FIG. 12.

As demonstrated in this Case Example, Nanomodal Structure (Structure #2, FIG. 3A) forms in steel alloys herein through Nanophase Refinement (Mechanism #1, FIG. 3A).

Case Example #6

Microstructural Evolution During Cold Rolling

Industrial sheet from Alloy 260 produced by Thin Strip Casting and heat treated at 1150° C. for 2 hours was cold rolled using a Fenn Model 061 Rolling Mill mimicking the cold rolling step at industrial post processing of the produced steel sheet. The microstructure of the cold rolled samples was studied by SEM. To make SEM specimens, the cross-sections of the hot rolled samples were cut and ground by SiC paper and then polished progressively with diamond media paste down to 1 μm grit. The final polishing was done with 0.02 μm grit $SiO_2$ solution. Microstructures of cold rolled samples from Alloy 260 sheets were examined by scanning electron microscopy (SEM) using an EVO-MA10 scanning electron microscope manufactured by Carl Zeiss SMT Inc. FIG. 13 shows the microstructure of industrial sheet from Alloy 260 after cold rolling by 50% thickness reduction. Compared to the heat treated samples (FIG. 11), the boride phase is slightly aligned along the rolling direction, but broken up especially in the central layer region where long boride phase commonly forms during solidification. Some of the boride phase may be crushed by the cold rolling down to the size of few microns. At the same time, changes can be found in matrix phase. As shown in FIG. 13, subtle contrast is visible in the matrix after the cold rolling but not fully resolvable by SEM. Additional structural analysis was performed by TEM that revealed additional details described below.

The TEM images of the microstructure in the cold rolled sample are shown in FIG. 14. It can be seen that the cold rolled sheet has a refined microstructure, with nanocrystalline matrix grains typically from 100 to 300 nm in size. Microstructure refinement observed after cold deformation is a typical result of Dynamic Nanophase Strengthening (Mechanism #2, FIG. 3A) with formation of High Strength Nanomodal Structure (Structure #3, FIG. 3A). Small nanocrystalline precipitates can be found scattered in the matrix and grain boundary regions which is typical for High Strength Nanomodal Structure.

Additional details of the Alloy 260 sheet structure including the nature of the small nanocrystalline phases were revealed by using x-ray diffraction. X-ray diffraction was done using a Panalytical X'Pert MPD diffractometer with a Cu Kα x-ray tube and operated at 40 kV with a filament current of 40 mA. The scans was run with a step size of 0.01° and from 25° to 95° two-theta with silicon incorporated to adjust for instrument zero angle shift. The resulting scan was then subsequently analyzed by Rietveld analysis using Siroquant software. In FIG. 15, an x-ray diffraction scan pattern is shown including the measured/experimental pattern and the Rietveld refined pattern for the Alloy 260 sheets in cold rolled condition. As can be seen, good fit of the experimental data was obtained. Analysis of the x-ray patterns including specific phases found, their space groups and lattice parameters are shown in Table 15. Four phases were found; a cubic α-Fe (ferrite), a complex mixed transitional metal boride phase with the $M_2B_1$ stoichiometry and two new hexagonal phases. Note that the lattice parameters of the identified phases are different than that found for pure phases clearly indicating the effect of substitution/saturation by the alloying elements. For example, $Fe_2B_1$ pure phase would exhibit lattice parameters equal to a=5.099 Å and c=4.240 Å. The phase composition and structural features of the microstructure are typical for High Strength Nanomodal structure.

TABLE 15

Rietveld Phase Analysis of Alloy 260 Sheet

| Phased Identified | Phase Details |
|---|---|
| α-Fe | Structure: Cubic<br>Space group #: #229 (Im3m)<br>LP: a = 2.887 Å |

TABLE 15-continued

Rietveld Phase Analysis of Alloy 260 Sheet

| Phased Identified | Phase Details |
|---|---|
| $M_2B$ | Structure: Tetragonal<br>Space group #: 140 (I4/mcm)<br>LP: a = 5.139 Å, c = 4.170 Å |
| Hexagonal Phase 1 (new) | Structure: Hexagonal<br>Space group #: #190 (P6bar2C)<br>LP: a = 5.219 Å, c = 11.398 Å |
| Hexagonal Phase 2 (new) | Structure: Hexagonal<br>Space group #: #186 (P63mc)<br>LP: a = 2.810 Å, c = 6.290 Å |

As demonstrated in this Case Example, the High Strength Nanomodal Structure (Structure #3, FIG. 3A) forms in steel alloys herein through the Dynamic Nanophase Strengthening (Mechanism #2, FIG. 3A).

Case Example #7

Formation of Recrystallized Modal Structure

Following 50% cold rolling, industrial sheet from Alloy 260 was heat treated at 1150° C. for 2 and 5 minutes to mimic in-line induction annealing of steel sheet as well as for 2 hours to mimic the batch annealing of industrial coils. Samples were cut from heat treated sheet and metallographically polished in stages down to 0.02 μm grit to ensure smooth samples for scanning electron microscopy (SEM) analysis. SEM was done using a Zeiss EVO-MA10 model with the maximum operating voltage of 30 kV. Example SEM backscattered electron micrographs of the microstructure in the sheet from Alloy 260 after cold rolling and heat treatment at two conditions are shown in FIGS. 16 and 17.

As shown in FIG. 16*a*, after heat treatment at 1150° C. for 5 minutes, the fine boride phase is relatively uniform in size and homogeneously distributed in the matrix in the outer layer region. In the central layer, although the boride phase is effectively broken up by the previous cold rolling step, the distribution of boride phase is less homogeneous as at the outer layer, as one can see that some areas are occupied by boride phase more than other areas (FIG. 16*b*). After heat treatment at 1150° C. for 2 hr, the boride phase distribution becomes similar at the outer layer region and at the central layer region (FIG. 17). In addition, the boride becomes more uniform in size, with a size less than 5 μm. Additional details of the microstructure were revealed by TEM analysis and will be provided subsequently.

Samples from Alloy 260 sheet that were heat treated at 1150° C. for 5 minutes and 2 hr were studied by TEM. TEM specimen preparation procedure includes cutting, thinning, and electropolishing. First, samples were cut with electric discharge machine, and then thinned by grinding with pads of reduced grit size every time. Further thinning to 60 to 70 μm thickness is done by polishing with 9 μm, 3 μm, and 1 μm diamond suspension solution respectively. Discs of 3 mm in diameter were punched from the foils and the final polishing was fulfilled with electropolishing using a twin-jet polisher. The chemical solution used was a mixture of 30% nitric acid in methanol base. In case of insufficient thin area for TEM observation, the TEM specimens were ion-milled using a Gatan Precision Ion Polishing System (PIPS). The ion-milling usually was done at 4.5 keV, and the inclination angle is reduced from 4° to 2° to open up the thin area. The TEM studies were done using a JEOL 2100 high-resolution microscope operated at 200 kV.

After heat treatment at 1150° C., the cold rolled samples show extensive recrystallization. As shown in FIG. 18, micron size grains are formed after 5 minutes holding at 1150° C. Within the recrystallized grains, there are a number of stacking faults, suggesting formation of austenite phase. At the same time, the boride phases show a certain degree of growth. A similar microstructure is seen in the sample after heat treatment at 1150° C. for 2 hr (FIG. 19). The matrix grains are clean with sharp, large-angle grain boundaries, typical for a recrystallized microstructure. Within the matrix grains, stacking faults are generated and boride phases can be found at grain boundaries, as shown in the 5 minute heat treated sample. Compared to the cold rolled microstructure (FIG. 14), the high temperature heat treatment after cold rolling transforms the microstructure into the Recrystallized Modal Structure (Structure #4, FIG. 3B) with micron-sized matrix grains and boride phase.

Additional details of the Recrystallized Modal Structure in the Alloy 260 sheet were revealed by using x-ray diffraction. X-ray diffraction was done using a Panalytical X'Pert MPD diffractometer with a Cu Kα x-ray tube and operated at 40 kV with a filament current of 40 mA. The scan was run with a step size of 0.01° and from 25° to 95° two-theta with silicon incorporated to adjust for instrument zero angle shift. The resulting scan was then subsequently analyzed using Rietveld analysis using Siroquant software. In FIG. 20, x-ray diffraction scan patterns for Alloy 260 sheet after cold rolling and heat treated at 1150° C. for 2 hr are shown including the measured/experimental pattern and the Rietveld refined pattern. As can be seen, good fit of the experimental data was obtained in all cases. Analysis of the x-ray patterns including specific phases found, their space groups and lattice parameters are shown in Table 16. Four phases were found, a cubic γ-Fe (austenite), a cubic α-Fe (ferrite), a complex mixed transitional metal boride phase with the $M_2B_1$ stoichiometry and one new hexagonal phase. Presence of γ-Fe (austenite) and only one hexagonal phase in the microstructure after cold rolling means that phase transformation occurs in addition to recrystallization.

TABLE 16

Rietveld Phase Analysis of Alloy 260 Sheet

| Phased Identified | Phase Details |
|---|---|
| γ-Fe | Structure: Cubic<br>Space group #: 225 (Fm3m)<br>LP: a = 3.590 Å |
| α-Fe | Structure: Cubic<br>Space group #: #229 (Im3m)<br>LP: a = 2.883 Å |
| $M_2B$ | Structure: Tetragonal<br>Space group #: 140 (I4/mcm)<br>LP: a = 5.187 Å, c = 4.171 Å |
| Hexagonal Phase 1 (new) | Structure: Hexagonal<br>Space group #: #190 (P6bar2C)<br>LP: a = 5.219 Å, c = 11.389 Å |

As demonstrated in this Case Example, Recrystallized Modal Structure (Structure #4, FIG. 3B) forms in steel alloys herein through structural recrystallization of High Strength Nanomodal Structure (Structure #3, FIGS. 3A and 3B).

Case Example #8

Nanophase Refinement and Strengthening

Microstructure of industrial sheet from Alloy 260 with Recrystallized Modal Structure (Structure #4, FIG. 3B) formed during the heat treatment at 1150° C. for 2 hr was studied using SEM, TEM, and X-ray diffraction after taking the sheet and subjecting it to additional tensile deformation. Samples were cut from the gage of tensile specimens after deformation and were metallographically polished in stages down to 0.02 μm grit to ensure smooth samples for scanning electron microscopy (SEM) analysis. SEM was done using a Zeiss EVO-MA10 model with the maximum operating voltage of 30 kV. Example SEM backscattered electron micrographs of the sheet samples from Alloy 260 after deformation are shown in FIG. 21. As shown, the boride phase distribution after tensile deformation is similar to that in the sheet after cold rolling (see FIG. 17). The boride phase shows a size of mostly less than 5 μm and homogeneous distribution in matrix. It suggests that the tensile deformation did not change the boride phase size and distribution. However, the tensile deformation caused substantial structural changes in the matrix phases, which was revealed by TEM studies.

TEM specimen preparation procedure includes cutting, thinning, and electropolishing. First, samples were cut using electric discharge machining from the gage section of tensile specimens, and then thinned by grinding with pads of reduced grit size media every time. Further thinning to 60 to 70 μm thick is done by polishing with 9 μm, 3 μm, and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens were ion-milled using a Gatan Precision Ion Polishing System (PIPS). The ion-milling was done at 4.5 keV, and the inclination angle was reduced from 4° to 2° to open up the thin area. The TEM studies were done using a JEOL 2100 high-resolution microscope operated at 200 kV. FIG. 22 shows the bright-field and dark-field images of the samples made from the gage section of tensile specimen. When the Recrystallized Modal Structure (Structure #4, FIG. 3B) is subjected to cold deformation, extensive microstructure refinement is observed in the sample. In contrast to the recrystallized microstructure after high temperature heat treatment (FIG. 19), substantial structure refinement is seen in the tensile tested sample. The micron size matrix grains were no longer found in the sample, but grains of typically 100 to 300 nm in size were commonly observed instead. Additionally, small nanocrystalline precipitates formed during the tensile deformation. Significant structural refinement occurs through Nanophase Refinement and Strengthening (Mechanism #4, FIG. 3B) with formation of the Refined High Strength Nanomodal Structure (Structure #5, FIG. 3B). Furthermore, the Refined High Strength Nanomodal Structure (Structure #5, FIG. 3B) can undergo recrystallization again if subjected to high temperature exposure forming Recrystallized Modal Structure (Structure #4, FIG. 3B). This ability to go through multiple cycles of recrystallization to the Recrystallized Modal Structure, refinement through NanoPhase Refinement and Strengthening, formation of the Refined High Strength Nanomodal Structure and its recrystallization back to the Recrystallized Modal Structure is applicable in industrial sheet production to produce steel sheet with increasingly finer gauges (i.e. thickness) for specific targeted industrial applications which might be typically found in a range of 0.1 mm to 25 mm.

Additional details of the microstructure in the gage section of tensile specimens from Alloy 260 sheet were revealed by using x-ray diffraction. X-ray diffraction was done using a Panalytical X'Pert MPD diffractometer with a Cu Kα x-ray tube and operated at 40 kV with a filament current of 40 mA.

The scan was run with a step size of 0.01° and from 25° to 95° two-theta with silicon incorporated to adjust for instrument zero angle shift. The resulting scan was then subsequently analyzed using Rietveld analysis using Siroquant software. In FIG. 23 x-ray diffraction scan patterns are shown including the measured/experimental pattern and the Rietveld refined pattern for the Alloy 260 gauge sample. As can be seen, good fit of the experimental data was obtained in all cases. Analysis of the X-ray patterns including specific phases found, their space groups and lattice parameters are shown in Table 17. Four phases were found, a cubic α-Fe (ferrite), a complex mixed transitional metal boride phase with the $M_2B_1$ stoichiometry and two new hexagonal phases.

TABLE 17

Rietveld Phase Analysis of Alloy 260 Sheet

| Phased Identified | Phase Details |
|---|---|
| α-Fe | Structure: Cubic<br>Space group #: #229 (Im3m)<br>LP: a = 2.876 Å |
| $M_2B$ | Structure: Tetragonal<br>Space group #: 140 (I4/mcm)<br>LP: a = 5.169 Å, c = 4.177 Å |
| Hexagonal Phase 1 (new) | Structure: Hexagonal<br>Space group #: #190 (P6bar2C)<br>LP: a = 4.746 Å, c = 11.440 Å |
| Hexagonal Phase 2 (new) | Structure: Hexagonal<br>Space group #: #186 (P63mc)<br>LP: a = 2.817 Å, c = 6.444 Å |

As demonstrated in this Case Example, Recrystallized Modal Structure (Structure #4, FIG. 3B) in steel alloys herein transforms into Refined High Strength Nanomodal Structure (Structure #5, FIG. 3B) through Nanophase Refinement and Strengthening Mechanism (Mechanism #3, FIG. 3B).

Case Example #9

Tensile Property Recovery in Alloy 260 Following Overaging

Industrial sheet from Alloy 260 was produced by the Thin Strip Casting process. As-solidified thickness of the sheet was 3.2 mm (corresponds to Stage 1 of the Thin Strip Casting process, FIG. 6). In-line hot rolling with 19% reduction was applied during production (corresponds to Stage 2 of the Thin Strip Casting process, FIG. 6). Final thickness of produced sheet was 2.6 mm. The industrial sheet from Alloy 260 was heat treated at times and temperatures as shown in Table 6 using a Lucifer 7-R24 Atmosphere Controlled Box Furnace. These temperature/time combinations were selected to simulate extreme thermal exposure that may occur within a produced coil during homogenization heat treatment at either the outside or inside of the coil. That is to hit a minimum heat treatment target at the inner side of a large coil, the outer side of the coil is going to be exposed to much longer exposure times. After heat treatment, the sheet was processed according to Steps 2 and 3 in Table 18 to mimic commercial sheet post-processing methods. The sheet was cold rolled with approximately 15% reduction in one rolling pass. This cold rolling simulates the cold rolling necessary to reduce the material thickness to final gauge levels needed for commercial products. Cold rolling was completed using a Fenn Model 061 rolling mill. Tensile samples were cut using a Brother HS-3100 electrical discharge machine (EDM) of hot rolled, heat treated and cold rolled material. Cold rolled tensile samples were heat treated at 1150° C. for 5 minutes in a Lindberg Blue M Model "BF51731C-1" Box Furnace in air to simulate in-line annealing on a cold rolling production line.

TABLE 18

Sheet Post-Processing Steps

| | |
|---|---|
| Step 1 Overaging Heat Treatment | 1150° C. for 8 hours<br>1150° C. for 16 hours |
| Step 2 - Cold Work | Cold Rolling with 15% reduction |
| Step 3 - Annealing | 1150° C. 5 minute |

Tensile properties were measured of sheet material in the as hot rolled, overaged, cold rolled, and annealed states. The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. Video extensometer was utilized for strain measurements. Tensile properties for industrial sheet from Alloy 260 after overaging heat treatment at 1150° C. for 8 hours and 16 hours and following steps of post-processing are shown in FIG. 24 and FIG. 25, respectively. Note that despite property improvement as compared to as-produced sheet, tensile properties of the 1150° C. for 8 or 16 hours sheet do not regularly exceed 20% total elongation and 1000 MPa ultimate tensile strength. This indicates that the microstructure has overaged due to the extreme temperature exposure. However, after following a 15% cold rolling step and anneal at 1150° C. for 5 minutes, tensile properties are consistently greater than 20% total tensile elongation and 1000 MPa ultimate tensile strength for samples overaged at 1150° C. for both 8 and 16 hours. This clearly illustrates the robustness of the structural pathway and the enabling Nanophase Refinement and Strengthening mechanism (Mechanism #3, FIG. 3B) as the resulting structures and properties of the severely aged (8 and 16 hour exposure) are similar and at high values.

This Case Example demonstrates that overaging of the sheet leads to grain coarsening that results in property reduction. However, this damaged microstructure transforms into Refined High Strength Nanomodal Structure (Structure #5, FIG. 3B) during following cold rolling with further formation of Recrystallized Modal Structure (Structure #4, FIG. 3B) at heat treatment resulting in property restoration in the sheet material.

Case Example #10

Tensile Property Recovery in Alloy 284 Following Overaging

Industrial sheet from Alloy 284 was produced by Thin Strip Casting process with an as-solidified thickness of 3.2 mm (corresponds to Stage 1 of the Thin Strip Casting process, FIG. 6). In-line hot rolling with 19% reduction was applied during production (corresponds to Stage 2 of the Thin Strip Casting process, FIG. 6). Final thickness of produced sheet was 2.6 mm. Samples from the produced sheet were heat treated at times and temperatures as shown in Table 15 using a Lucifer 7-R24 Atmosphere Controlled Box Furnace. These temperature/time combinations were selected to simulate extreme thermal exposure that may occur within a produced coil during homogenization heat treatment at either the outside or inside of the coil. After heat treatment, the sheet was processed according to Steps 2 and 3 in Table 19 to mimic commercial sheet production methods. The sheet was cold rolled approximately 15% in one rolling pass. This cold rolling simulates the cold rolling necessary to reduce the material thickness to reduced levels needed for commercial products. Cold rolling was completed using a Fenn Model 061 rolling mill. Tensile samples were cut using a Brother HS-3100 electrical discharge machine (EDM) of hot rolled, heat treated and cold rolled material. Cold rolled tensile samples were heat treatment at 1150° C. for 5 minutes in a Lindberg Blue M Model "BF51731C-1" Box Furnace in air to simulate in-line annealing on a cold rolling production line. Anneal times were selected to be short so as to be insignificant compared to the time at temperature during the overaging heat treatment.

TABLE 19

| Sheet Post-Processing Steps | |
|---|---|
| Step 1 - Overaging Heat Treatment | 1150° C. for 8 hours |
| Step 2 - Cold Work | Cold Rolling with 15% reduction |
| Step 3 - Annealing | 1150° C. 5 minute |

Tensile properties were measured of Alloy 284 sheet in the as hot rolled, overaged, cold rolled, and annealed states. The tensile properties were tested on an Instron mechanical testing frame (Model 3369) utilizing Instron's Bluehill control and analysis software. All tests were run at room temperature in displacement control with the bottom fixture held rigid and the top fixture moving with the load cell attached to the top fixture. Video extensometer was utilized for strain measurements. Tensile properties for industrial sheet from Alloy 284 after overaging heat treatment at 1150° C. for 8 hours are shown in FIG. 26. Note that despite property improvement as compared to as-hot rolled sheet, tensile properties of over aged (1150° C. for 8 hours) sheet do not regularly exceed 15% total elongation and 1200 MPa ultimate tensile strength. However, after following a 15% cold rolling step and anneal at 1150° C. for 5 minutes, tensile properties are consistently greater than 20% total tensile elongation and 1150 MPa ultimate tensile strength for samples averaged at 1150° C. for 8 hours. This clearly illustrates the robustness of the Nanophase Refinement and Strengthening Mechanism (Mechanism #3) in the specific structural formation pathway forming the intermediate Recrystallized Modal Structure (Structure #4) leading to property restoration in overaged sheet samples.

This Case Example demonstrates that overaging of the sheet leads to grain coarsening that results in property reduction. However, this damaged microstructure transforms into Refined High Strength Nanomodal Structure (Structure #5, FIG. 3B) during following cold rolling with further formation of Recrystallized Modal Structure (Structure #4, FIG. 3B) at heat treatment resulting in property restoration in the sheet material.

Case Example #11

Property Recovery in Alloy 260 Sheet after Multiple Cold Rolling and Annealing Industrial sheet from Alloy 260 was produced by the Thin Strip Casting process. As-solidified thickness of the sheet was 3.45 mm (corresponds to Stage 1 of the Thin Strip Casting process, FIG. 6). In-line hot rolling with 30% reduction was applied during production (corresponds to Stage 2 of the Thin Strip Casting process, FIG. 6). Final thickness of produced sheet was 2.4 mm. Samples from Alloy 260 sheet were heat treated at 1150° C. for 2 hours in a Lucifer 7-R24 Atmosphere Controlled Box Furnace. This temperature/time combination was selected to mimic commercial homogenization heat treatments during coil batch annealing. After heat treatment, the sheet was cold rolled using a Fenn Model 061 rolling mill from 2.4 mm thickness to 1.0 mm thickness with 2 intermittent stress relief annealing steps at 1150° C. for 5 minutes duration in a Lucifer 7-R24 Atmosphere Controlled Box Furnace. Table 20 chronicles the full processing route for this material. Cold rolling percentages are listed as the percentage reduced from the 2.4 mm 1150° C. for 2 hours heat treated thickness. This cold rolling and annealing process simulates the commercial process necessary to reduce the material thickness to final levels needed for commercial products. Tensile samples were cut using a Brother HS-3100 electrical discharge machine (EDM) of hot rolled, heat treated, cold rolled, and annealed material. Following cutting of tensile samples by EDM, the gauge length of each tensile sample was lightly polished with fine grit SiC paper to remove any surface asperities that may cause scatter in the experimental results.

TABLE 20

| Sheet Processing Steps | |
|---|---|
| Step 1 -Heat Treatment | 1150° C. for 2 hours |
| Step 2 - Cold Work | Cold Rolling with 26% reduction |
| Step 3 - Annealing | 1150° C. for 5 minute |
| Step 4 - Cold Work | Cold Rolling with 22% reduction |
| Step 5 - Annealing | 1150° C. for 5 minute |
| Step 6 - Cold Work | Cold Rolling with 12% reduction |
| Step 7 - Annealing | 1150° C. for 5 minute |

Tensile properties were measured of the Alloy 260 sheet in the as hot rolled, heat treated, cold rolled, and annealed states. The tensile properties were tested on an Instron mechanical testing frame (Model 3369), utilizing Instron's Bluehill control and analysis software. All tests were run at room temperature in displacement control with the bottom fixture held rigid and the top fixture moving with the load cell attached to the top fixture. Video extensometer was utilized for strain measurements. Tensile properties for Alloy 260 in the initial (as hot rolled and after step 1) and final (after step 6 and 7) state are shown in FIG. 27. As can be seen, the cold rolled material developed high strength with reduced ductility as a result of strain hardening and the formation of the Refined High Strength Nanomodal Structure (Structure #5, FIG. 3B) at step 6 (Table 16). After final annealing, the ductility is restored due to the Recrystallized Modal Structure (Structure #4, FIG. 3B) formation.

As shown by this Case Example, this process of strain hardening during cold working, followed by recrystallization during annealing, followed by strain hardening by cold rolling again can be applied multiple times as necessary to hit the final gauge thickness target and provide targeted properties in the sheet.

Case Example 12

Cyclic Nature of Enabling Structures and Mechanisms

In order to produce sheet with different thicknesses, cold rolling gauge reduction followed by annealing is used by the steel industry. This process includes the use of cold rolling mills to mechanically reduce the gauge thickness of sheet with intermediate in-line or batch annealing between passes to remove the cold work present in the sheet.

The cold rolling gauge reduction and annealing process was simulated for Alloy 260 material that was commercially produced by the Thin Strip casting process. Alloy 260 was cast at 3.65 mm thickness, and reduced 25% via hot rolling at 1150° C. to 2.8 mm thickness. Following hot rolling, the sheet was coiled and annealed in an industrial batch furnace for a minimum of 2 hours at 1150° C. at the coolest part of the coil. The gauge thickness of the sheet was reduced by 13% in one cold rolling pass by tandem mill, then annealed in-line at 1100° C. for 2 to 5 min. The sheet gauge thickness was further reduced by 25% in 4 cold rolling passes by reversing mill to approximately 1.8 mm in thickness and annealed in an industrial batch furnace at 1100° C. for 30 minutes at the coolest part of the coil (i.e. inner windings). Resultant commercially produced sheet with 1.8 mm thickness was used for further cold rolling in multiple steps using a Fenn Model 061 Rolling Mill with intermediate annealing as described in Table 21. All anneals were completed using a Lucifer 7-R24 box furnace with flowing argon. During anneals, the sheet was loosely wrapped in stainless steel foil to reduce the potential of oxidation from atmospheric oxygen.

TABLE 21

Cold Rolling Gauge Reduction Steps Performed On Alloy 260

| Step 1 | Step 2 | Step 3 | Step 4 | Step 5 | Step 6 | Step 7 | Step 8 | Step 9 |
|---|---|---|---|---|---|---|---|---|
| Cold Roll: To 1.5 mm in 2 passes | Anneal: 950° C. for 6 hrs | Cold Roll: To 1.3 mm in 1 pass | Anneal: 950° C. for 6 hrs | Cold Roll: To 1.0 mm in 2 passes | Anneal: 950° C. for 6 hrs | Cold Roll: To 0.9 mm in 1 pass | Anneal: 950° C. for 6 hrs | Cold Roll: 10% Skin pass roll |

Tensile properties of the Alloy 260 sheet were measured at each step of processing. Tensile samples were cut using a Brother HS-3100 wire EDM. The tensile properties were tested on an Instron mechanical testing frame (Model 3369), utilizing Instron's Bluehill control and analysis software. All tests were run at room temperature in displacement control with the bottom fixture held ridged and the top fixture moving with the load cell attached to the top fixture. Video extensometer was utilized for strain measurements. Tensile properties of commercially produced 1.8 mm thick sheet and after each step of processing specified in Table 17 are shown below in Table 18 and illustrated in FIG. 28. It can be seen that the tensile properties shown in FIG. 28 fall into two distinct groups as indicated by ovals that corresponds to two particular structures (FIG. 3B) formed in Alloy 260 sheet. In the as cold rolled state, the material possess the High Strength Nanomodal Structure (Structure #3, FIG. 3B) at initial rolling (Step 1) or Refined High Strength Nanomodal Structure (Structure #5, FIG. 3B) at the following cold rolling (steps 3, 5, 7 and 9) with the tensile properties reside within this distinct oval. Tensile properties of the Alloy 260 sheet that has been annealed (Steps 2, 4, 6, and 8) correspond to the oval indicated by the Recrystallized Modal Structure (Structure #4, FIG. 3B). This oval also includes the property related to initial Nanomodal Structure (Structure #2, FIG. 3A) after batch annealing (step 0).

The tensile properties shown in FIG. 28 demonstrate that the process of recrystallization during annealing followed by Nanophase Refinement and Strengthening (Mechanism #3, FIG. 3B) is reversible and may be applied in a cyclic manner during processing of Alloy 260 sheet. Comparing tensile properties from Step 1 and Step 2, the properties demonstrate the effect of recrystallization on Alloy 260, increasing the tensile ductility from approximately 10 to 20% to approximately 35%. Ultimate tensile strength decreases from approximately 1300 MPa to 1150 MPa during the recrystallization process. If the tensile properties of Step 2 and 3 are compared, the effect of Nanophase Refinement and Strengthening (Mechanism #3, FIG. 3B) can be seen with tensile ductility changing from approximately 35% to approximately 18%. The ultimate tensile strength of Alloy 260 sheet increases from approximately 1150 MPa to over 1300 MPa due to the Nanophase Refinement and Strengthening (Mechanism #3, FIG. 3B). Note that the decrease in ductility and increase in strength occurring during the Nanophase Refinement and Strengthening (Mechanism #3, FIG. 3B) that is opposite of the effect of recrystallization in Alloy 260 sheet. The strength of the sheet within the oval corresponding to Structure #5 depends on cold rolling reduction and increases when high reduction applied. The properties of the sheet within the oval corresponds to Structure #4 depends on annealing parameters and falls in a tight range when the same annealing was applied at Steps 2, 4, 6, and 8 (Table 22). The replication of this process numerous times results with the two property clusters remaining consistent and not overlapping.

TABLE 22

Tensile Properties of Alloy 260 Sheet at Different Steps of Processing

| Processing Step | Material Description | Tensile Elongation (%) | Ultimate Tensile Strength (MPa) |
|---|---|---|---|
| Step 0 | Commercially produced sheet with 1.8 mm thickness | 26.27 | 1024 |
| | | 30.97 | 1057 |
| | | 27.36 | 1027 |
| Step 1 | Cold Rolled to 1.5 mm (~17% reduction) | 14.16 | 1326 |
| | | 16.15 | 1345 |
| | | 12.06 | 1288 |
| | | 20.82 | 1330 |
| Step 2 | Cold Rolled to 1.5 mm 950° C. 6 hrs annealed | 37.25 | 1083 |
| | | 36.74 | 1084 |
| | | 31.85 | 1083 |
| Step 3 | Cold Rolled to 1.3 mm (~13% reduction) | 18.83 | 1422 |
| | | 18.79 | 1385 |
| | | 20.02 | 1388 |
| | | 21.18 | 1393 |
| Step 4 | Cold Rolled to 1.3 mm 950° C. 6 hrs annealed | 36.62 | 1135 |
| | | 35.90 | 1131 |
| | | 37.76 | 1141 |
| | | 37.43 | 1143 |
| Step 5 | Cold Rolled to 1.0 mm (~23% reduction) | 13.60 | 1464 |
| | | 11.41 | 1465 |
| | | 15.02 | 1462 |
| | | 13.16 | 1465 |
| Step 6 | Cold Rolled to 1.0 mm 950° C. 6 hrs annealed | 38.56 | 1138 |
| | | 33.57 | 1136 |
| | | 33.97 | 1148 |
| | | 37.83 | 1142 |
| Step 7 | Cold Rolled to 0.9 mm (10% reduction) | 24.43 | 1327 |
| | | 23.29 | 1328 |
| | | 23.74 | 1334 |
| | | 24.09 | 1339 |

TABLE 22-continued

Tensile Properties of Alloy 260 Sheet at Different Steps of Processing

| Processing Step | Material Description | Tensile Elongation (%) | Ultimate Tensile Strength (MPa) |
|---|---|---|---|
| Step 8 | Cold Rolled to 0.9 mm | 35.63 | 1165 |
| | 950° C. 6 hrs annealed | 35.19 | 1176 |
| | | 36.50 | 1182 |
| Step 9 | Skin Pass Cold Roll | 24.22 | 1270 |
| | (10% reduction) | 24.48 | 1272 |
| | | 23.96 | 1262 |
| | | 24.20 | 1272 |

This Case Example demonstrates that the cold rolling gage reduction and annealing process can be used cyclically while transitioning between the Refined High Strength Nanomodal Structure (Structure #5, FIG. 3B) and the Recrystallized Modal Structure (Structure #4, FIG. 3B) utilizing recrystallization and the Nanophase Refinement and Strengthening (Mechanism #3, FIG. 3B) processes.

Case Example #13

Sheet Production Routes

The ability of the steel alloys herein to form Recrystallized Modal Structure (Structure #4) that undergoes Nanophase Refinement and Strengthening (Mechanism #3) during deformation leading to advanced property combination enables sheet production by different methods including belt casting, thin strip/twin roll casting, thin slab casting, and thick slab casting with achievement of advanced property combination by subsequent post-processing with realization of new enabling mechanisms herein. While thin strip casting was mentioned previously, a short description of the slab casting processes is provided below. Note that the front end of the process of forming the liquid melt of the alloy in Table 4 is similar in each process. One route is starting with scrap which can then be melted in an electric arc furnace (EAF), followed by argon oxygen decarburization (AOD) furnace, and the final alloying through a ladle metallurgy furnace (LMF) treatment. Additionally, the back end of the process for each production process is similar as well, in-spite of the large variation in as-cast thickness. Typically, the last step of hot rolling results, in the production of hot rolled coils with thickness from 1.5 to 10 mm which is dependent on the specific process flow and goals of each steel producer. For the specific chemistries of the alloys in this application and the specific structural formation and enabling mechanisms as outlined herein, the resulting structure of these as-hot rolled coils would be the Structure #2 (Nanomodal Structure). If thinner gauges are then needed, cold rolling of the hot rolled coils is typically done to produce final gauge thickness which may be in the range of 0.2 to 3.5 mm in thickness). It is during these cold rolling gauge reduction steps, that the new structures and mechanisms as outlined in FIGS. 3A and 3B would be operational (i.e. Structure #3 recrystallized into Structure #4 and refined and strengthened by Mechanism #3 into Structure #5).

As explained previously and shown in the case examples, the process of High Strength Nanomodal Structure formation, recrystallization into the Recrystallized Modal Structure, and refinement and strengthening through NanoPhase Refinement & Strengthening into the Refined High Strength Nanomodal Structure can be applied in a cyclic nature as often as necessary in order to reach end user gauge thickness requirements typically 0.1 to 25 mm thickness for Structures #3, #4 or #5.

Thick Slab Casting Description

Thick slab casting is the process whereby molten metal is solidified into a "semifinished" slab for subsequent rolling in the finishing mills. In the continuous casting process pictured in FIG. 29, molten steel flows from a ladle, through a tundish into the mold. Once in the mold, the molten steel freezes against the water-cooled copper mold walls to form a solid shell. Drive rolls lower in the machine continuously withdraw the shell from the mold at a rate or "casting speed" that matches the flow of incoming metal, so the process ideally runs in steady state. Below mold exit, the solidifying steel shell acts as a container to support the remaining liquid. Rolls support the steel to minimize bulging due to the ferrostatic pressure. Water and air mist sprays cool the surface of the strand between rolls to maintain its surface temperature until the molten core is solid. After the center is completely solid (at the "metallurgical length") the strand can be torch cut into slabs with typical thickness of 150 to 500 mm. In order to produce thin sheet from the slabs, they must be subjected to hot rolling with substantial reduction that is a part of post-processing. After hot rolling, the resulting sheet thickness is typically in the range of 2 to 5 mm. Further gauge reduction would occur normally through subsequent cold rolling which would trigger the identified Dynamic Nanophase Strengthening Mechanism. As the coils are often supplied in the annealed condition, annealing of the cold rolled sheet would then result in the formation of the Recrystallized Modal Structure (Structure #4). This structure would be applicable to be processed into parts by end-users through many different routes including cold stamping, hydroforming, roll forming etc. and during this processing step would then transform into the partial or full Refined High Strength Nanomodal Structure (Structure #5). Note that a variation of this would include cold rolling to a lower extent (perhaps 2 to 10%) to cause partial Nanophase Refinement & Strengthening to tailor sets of properties (i.e. yield strength, tensile strength, and total elongation) for specific applications.

Thin Slab Casting Description

In the case of thin slab casting, the steel is cast directly to slabs with a thickness between 20 and 150 mm. The method involves pouring molten steel into the Tundish at the top of the slab caster, from a ladle. They are sized with a working volume of about 100 t, which will deliver the steel at a rate of one ladle every 40 minutes to the caster. The temperatures of liquid steel in the tundish as well as the steel purity and chemical composition have a significant impact on the quality of the cast product. The liquid steel passes at a controlled rate into the caster, which is made up of a water cooled mould in which the outer surface of the steel solidifies. In general, the slabs leaving the caster are about 70 mm thick, 1000 mm wide and approximately 40 m long. These are then cut by the shearer to length. To enable ease of casting a hydraulic oscillator and electromagnetic brakes are fitted to control the molten liquid whilst in the mould.

A schematic of the Thin Slab Casting process is shown in FIG. 30. The Thin Slab Casting process can be separated into three stages similar to Thin Strip Casting (FIG. 6). In Stage 1, the liquid steel is both cast and rolled in an almost simultaneous fashion. The solidification process begins by forcing the liquid melt through a copper or copper alloy mold to produce initial thickness typically from 20 to 150 mm in thickness based on liquid metal processability and production speed. Almost immediately after leaving the mold and while the inner core of the steel sheet is still liquid, the sheet undergoes reduction using a multistep rolling stand which reduces the thickness significantly down to 10 mm depending on final sheet thickness targets. In Stage 2, the steel sheet is heated by going through one or two induction furnaces and during this stage the temperature profile and the metallurgical structure is homogenized. In Stage 3, the sheet is further rolled to the final gage thickness target is typically in the range of 2 to 5 mm thick. Further gauge reduction would occur normally through subsequent cold rolling which would trigger the identified Dynamic Nanophase Strengthening mechanism. As the coils are often supplied in the annealed condition, annealing of the cold rolled sheet would then result in the formation of the Recrystallized Modal Structure. This structure would be applicable to be processed into parts by many different routes including cold stamping, hydroforming, roll forming etc. and during this processing step would then transform into the partial or full Refined High Strength Nanomodal Structure. The Recrystallized Modal Structure can be partially or fully transformed into the Refined High Strength Nanomodal Structure depending on the specific application and the end-user requirements. Partial transformation occurs with 1 to 25% strain while depending on the specific material, its processing and resulting properties will typically result in complete transformation from 25% to 75% strain. While the three stage process of forming sheet in thin slab casting is part of the process, the response of the alloys herein to these stages is unique based on the mechanisms and structure types described herein and the resulting novel combinations of properties.

What is claimed is:

1. A method comprising:

a. supplying a metal alloy wherein said alloy contains Fe at a level of 55.0 to 88.0 atomic percent, B at a level of 0.5 to 3.8 atomic percent, Si at a level of 0.5 to 12.0 atomic percent and Mn at a level of 1.0 to 19.0 atomic percent;

b. melting said alloy and solidifying to provide a matrix grain size of 200 nm to 200,000 nm wherein said solidified alloy has a thickness of 1 mm to 500 mm;

c. heating said alloy to form a refined matrix grain size of 50 nm to 5000 nm where the alloy has a yield strength of 200 MPa to 1225 MPa and a thickness of 1 mm to 500 mm;

d. stressing said alloy by cold rolling, cold stamping, hydroforming or roll forming that exceeds said yield strength of 200 MPa to 1225 MPa wherein said alloy after stressing results in a thickness reduction to produce a thickness of 0.1 mm to 25 mm and indicates a tensile strength of 400 MPa to 1825 MPa and an elongation of 1.0% to 59.2%;

e. wherein said alloy in step (d) is heated to a temperature in the range 700° C. and below the melting point of said alloy and grain growth occurs and forming an alloy having grains of 100 nm to 50,000 nm, borides of 20 nm to 10000 nm in size, precipitations of 1 nm to 200 nm in size and said alloy has a yield strength of 200 MPa to 1650 MPa; and f. wherein said alloy formed in step (e) is stressed above yield and forms an alloy having grain sizes of 10 nm to 2500 nm, borides of 20 nm to 10000 nm in size, precipitations of 1 nm to 200 nm in size and indicates a yield strength of 200 MPa to 1650 MPa, tensile strength of 400 MPa to 1825 MPa and an elongation of 1.0% to 59.2%.

2. The method of claim 1 wherein said alloy heated in step (c) has a melting point and heating to form said refined grain size comprises heating a temperature of at least 700° C. and below said melting point of said alloy.

3. The method of claim 1 wherein, in step (b), borides are formed having a size of 20 nm to 10000 nm.

4. The method of claim 1, wherein in step (c), precipitations are formed having a size of 1 nm to 200 nm and borides of 20 nm to 10000 nm in size are present.

5. The method of claim 1, wherein in step (d), said alloy has refined grain size of 25 nm to 2500 nm, borides of 20 nm to 10000 nm in size and precipitations at 1 nm to 200 nm in size.

6. The method of claim 1 further including one or more of the following:

Ni at a level of 0.1 to 9.0 atomic percent;

Cr at a level of 0.1 to 19.0 atomic percent;

Cu at a level of 0.1 to 6.00 atomic percent;

Ti at a level of 0.1 to 1.00 atomic percent; and

C at a level of 0.1 to 4.0 atomic percent.

7. The method of claim 1 wherein said alloy has a melting point in the range of 1000° C. to 1450° C.

8. The method of claim 1 wherein said alloy is positioned in a vehicle.

9. The method of claim 1 wherein said alloy formed in step (f) is positioned in a vehicle.

10. The method of claim 1 wherein said alloy is positioned in one of a drill collar, drill pipe, pipe casing, tool joint, wellhead, compressed gas storage tank or liquefied natural gas canister.

11. The method of claim 1 wherein steps (e) and (f) are repeated to further decrease said alloy thickness.

12. The method of claim 11 wherein steps (e) and (f) are repeated 2 to 20 times.

13. A method comprising:

a. supplying a metal alloy comprising Fe at a level of 55.0 to 88.0 atomic percent, B at a level of 0.5 to 3.8 atomic percent, Si at a level of 0.5 to 12.0 atomic percent and Mn at a level of 1.0 to 19.0 atomic percent;

b. melting said alloy and solidifying to provide a matrix grain size of 200 nm to 200,000 nm and borides having a size of 20 nm to 10,000 nm and said alloy has a thickness of 1 mm to 500 mm;

c. heating said alloy to form a refined matrix grain size of 50 nm to 5000 nm where the alloy has a yield strength of 200 MPa to 1225 MPa and a thickness of 1 mm to 500 mm;

d. stressing said alloy by cold rolling, cold stamping, hydroforming or roll forming that exceeds said yield strength of 200 MPa to 1225 MPa wherein said alloy after stressing results in a thickness reduction and indicates a tensile strength of 400 MPa to 1825 MPa and an elongation of 1.0% to 59.2% and a thickness of 0.1 mm to 25 mm;

e. wherein said alloy in step (d) has a melting point and is heated to a temperature in the range of 700° C. and below said melting point of said alloy and grain growth occurs and forming an alloy having grains of 100 nm to 50,000 nm, borides of 20 nm to 10,000 nm in size, precipitations of 1 nm to 200 nm in size and said alloy has a yield strength of 200 MPa to 1650 MPa;

f. wherein said alloy formed in step (e) is stressed above yield and forms an alloy having grain sizes of 10 nm to 2500 nm, borides of 20 nm to 10000 nm in size, precipitations of 1 nm to 200 nm in size and indicates a yield strength of 200 MPa to 1650 MPa, tensile strength of 400 MPa to 1825 MPa and an elongation of 1.0% to 59.2%.

14. The method of claim 13 wherein in step (c) precipitations are formed having a size of 1 nm to 200 nm and borides of 20 nm to 10,000 nm in size are present.

15. The method of claim 13 wherein in step (d) said alloy has refined grain size of 25 nm to 2500 nm, borides of 20 nm to 10,000 nm in size and precipitations at 1 nm to 200 nm in size.

16. The method of claim 13 further including one or more of the following:

Ni at a level of 0.1 to 9.0 atomic percent

Cr at a level of 0.1 to 19.0 atomic percent

Cu at a level of 0.1 to 6.0 atomic percent

Ti at a level of 0.1 to 1.0 atomic percent

C at a level of 0.1 to 4.0 atomic percent.

17. The method of claim 13 wherein said alloy is positioned in a vehicle.

18. The method of claim 13 wherein steps (e) and (f) are repeated to further decrease said alloy thickness.

19. The method of claim 18 wherein steps (e) and (f) are repeated 2 to 20 times.

* * * * *